US010590681B2

(12) United States Patent
Jeong

(10) Patent No.: US 10,590,681 B2
(45) Date of Patent: Mar. 17, 2020

(54) DOOR LATCH SYSTEM

(71) Applicant: WOOBO TECH CO., LTD., Pyeongtaek-si, Gyeonggi-do (KR)

(72) Inventor: Hae Il Jeong, Incheon (KR)

(73) Assignee: Woobo Tech Co., Ltd., Pyeongtaek-si, Gyeonggi-do (KR)

( * ) Notice: Subject to any disclaimer, the term of this patent is extended or adjusted under 35 U.S.C. 154(b) by 364 days.

(21) Appl. No.: 15/531,515

(22) PCT Filed: Sep. 9, 2015

(86) PCT No.: PCT/KR2015/009491

§ 371 (c)(1),
(2) Date: May 30, 2017

(87) PCT Pub. No.: WO2016/108395

PCT Pub. Date: Jul. 7, 2016

(65) Prior Publication Data

US 2017/0321456 A1 Nov. 9, 2017

(30) Foreign Application Priority Data

Dec. 30, 2014 (KR) ..... 10-2014-0193407
May 19, 2015 (KR) ..... 10-2015-0069453

(51) Int. Cl.
*E05B 81/16* (2014.01)
*E05B 77/32* (2014.01)
(Continued)

(52) U.S. Cl.
CPC ..... *E05B 81/16* (2013.01); *E05B 15/04* (2013.01); *E05B 77/26* (2013.01); *E05B 77/32* (2013.01);
(Continued)

(58) Field of Classification Search
CPC ..... E05B 81/16; E05B 15/04; E05B 3/065; E05B 15/101; E05B 15/143; E05B 77/26;
(Continued)

(56) References Cited

U.S. PATENT DOCUMENTS 5,618,069 A * 4/1997 Konchan ..... E05B 17/007 292/216
7,195,090 B2 * 3/2007 Parks ..... B60R 21/38 180/271
(Continued)

FOREIGN PATENT DOCUMENTS

JP 2003-314137 11/2003 ..... E05F 5/02
KR 10-0535053 12/2005 ..... E05B 65/12
(Continued)

*Primary Examiner* — Nathan Cumar
(74) *Attorney, Agent, or Firm* — Sunstein Kann Murphy & Timbers LLP

(57) ABSTRACT

This invention relates to a door latch system. The door latch system includes: a housing; a latch pivotally and rotatably installed in the housing; a main locking member slidingly installed in the housing for locking the latch; a sub-locking member slidingly installed in the housing and disposed in one side of the main locking member; a hook pivotally and movably installed in any one of the main locking member and the sub-locking member; a stopping threshold formed in the other one (wherein the hook is not installed) of the main locking member and the sub-locking member; and a locking plate slidingly installed in the housing for pivotally moving the hook, wherein the main locking member and the sub-locking member are sliding together when the hook is held by the stopping threshold by the sliding of the locking plate, and only the sub-locking member is sliding when the hook is separated from the stopping threshold by the sliding of the locking plate, so that even if the door lever is being pulled when the door is being locked, the unnecessary force is not
(Continued)

transferred to the other components such as a latch, a main locking member, and the like.

28 Claims, 81 Drawing Sheets

(51) Int. Cl.

| | |
|---|---|
| ***E05B 81/20*** | (2014.01) |
| ***E05B 81/34*** | (2014.01) |
| ***E05B 81/64*** | (2014.01) |
| ***E05B 15/04*** | (2006.01) |
| ***E05B 77/26*** | (2014.01) |
| ***E05B 79/20*** | (2014.01) |
| ***E05B 81/38*** | (2014.01) |
| ***E05B 81/54*** | (2014.01) |
| ***E05B 81/74*** | (2014.01) |
| ***E05B 83/36*** | (2014.01) |
| ***E05B 85/24*** | (2014.01) |
| ***E05B 85/26*** | (2014.01) |
| *E05B 81/66* | (2014.01) |
| *E05B 77/44* | (2014.01) |
| *E05B 81/06* | (2014.01) |

(52) U.S. Cl.

CPC ..... *E05B 79/20* (2013.01); *E05B 81/20* (2013.01); *E05B 81/34* (2013.01); *E05B 81/38* (2013.01); *E05B 81/54* (2013.01); *E05B 81/64* (2013.01); *E05B 81/74* (2013.01); *E05B 83/36* (2013.01); *E05B 85/243* (2013.01); *E05B 85/26* (2013.01); *E05B 77/44* (2013.01); *E05B 81/06* (2013.01); *E05B 81/66* (2013.01); *E05Y 2201/72* (2013.01); *E05Y 2400/44* (2013.01); *E05Y 2900/531* (2013.01)

(58) Field of Classification Search

CPC ..... E05B 77/32; E05B 79/20; E05B 81/20; E05B 81/22; E05B 81/34; E05B 81/36; E05B 81/38; E05B 81/54; E05B 81/64; E05B 81/74; E05B 83/36; E05B 85/243; E05B 85/26; E05B 77/44; E05B 81/06; E05B 81/66; E05Y 2201/72; E05Y 240/44; E05Y 2900/531; E05C 19/06

USPC ..... 292/199

See application file for complete search history.

(56) References Cited

U.S. PATENT DOCUMENTS

| | | | | |
|---|---|---|---|---|
| 2002/0105192 | A1* | 8/2002 | Perkins | E05B 81/14 292/216 |
| 2009/0151257 | A1* | 6/2009 | Dominique | E05B 81/20 49/280 |
| 2010/0308624 | A1* | 12/2010 | Juga | E05B 13/004 296/155 |

FOREIGN PATENT DOCUMENTS

| | | | |
|---|---|---|---|
| KR | 20-0418883 | 6/2006 | E05I 65/19 |
| KR | 10-0974549 | 8/2010 | E06B 65/12 |

* cited by examiner

[Fig. 1]
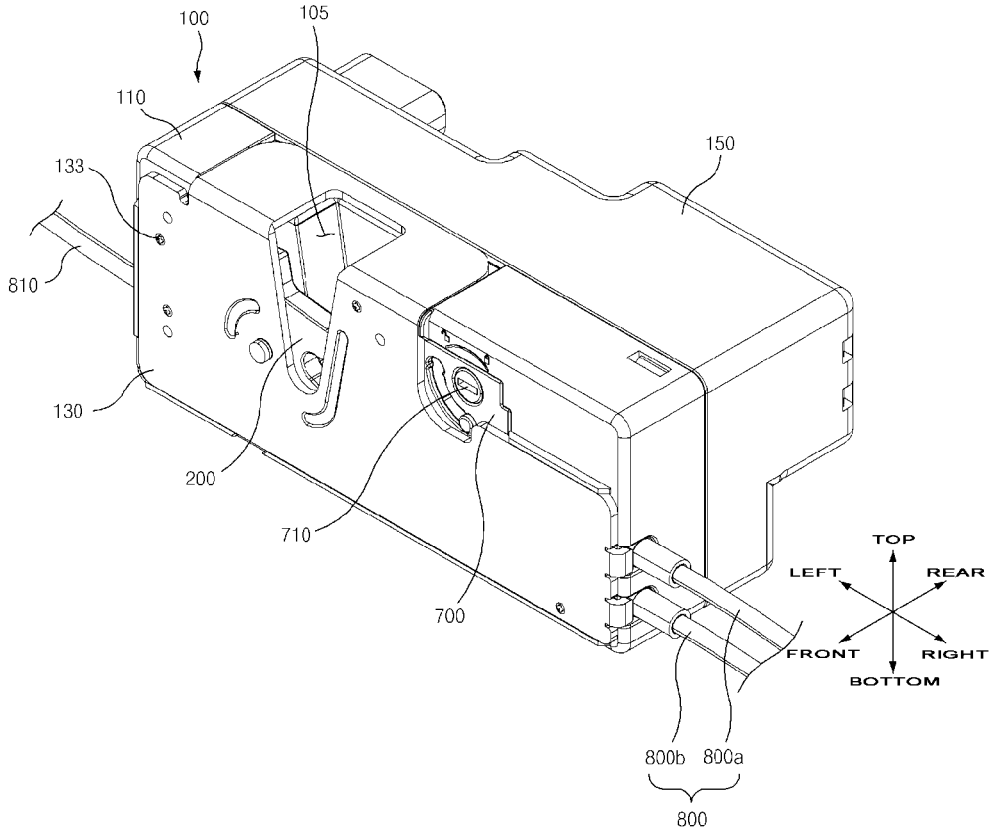

[Fig. 2]
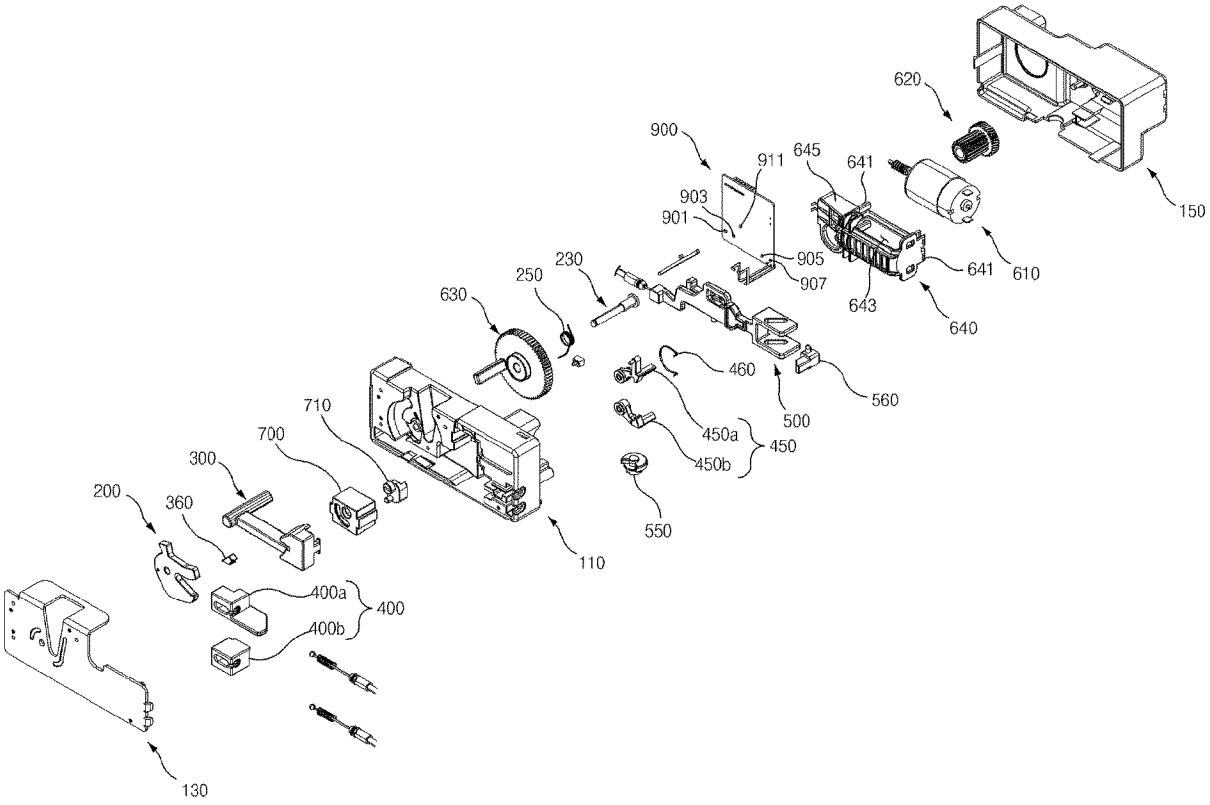
[Fig. 3]
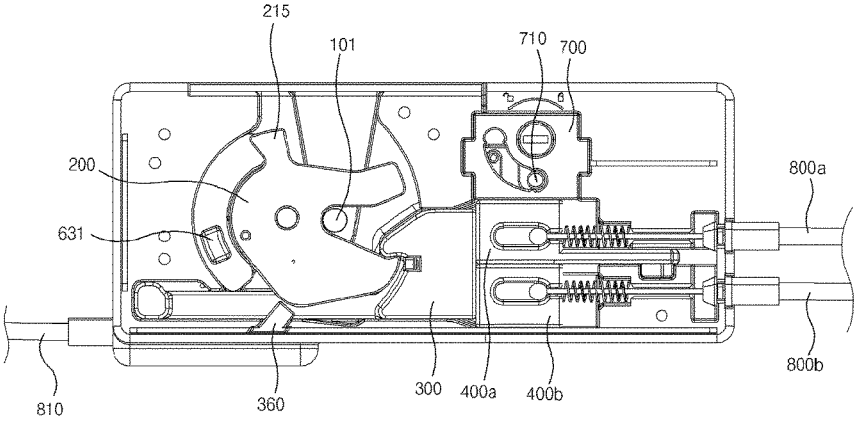

[Fig. 4]
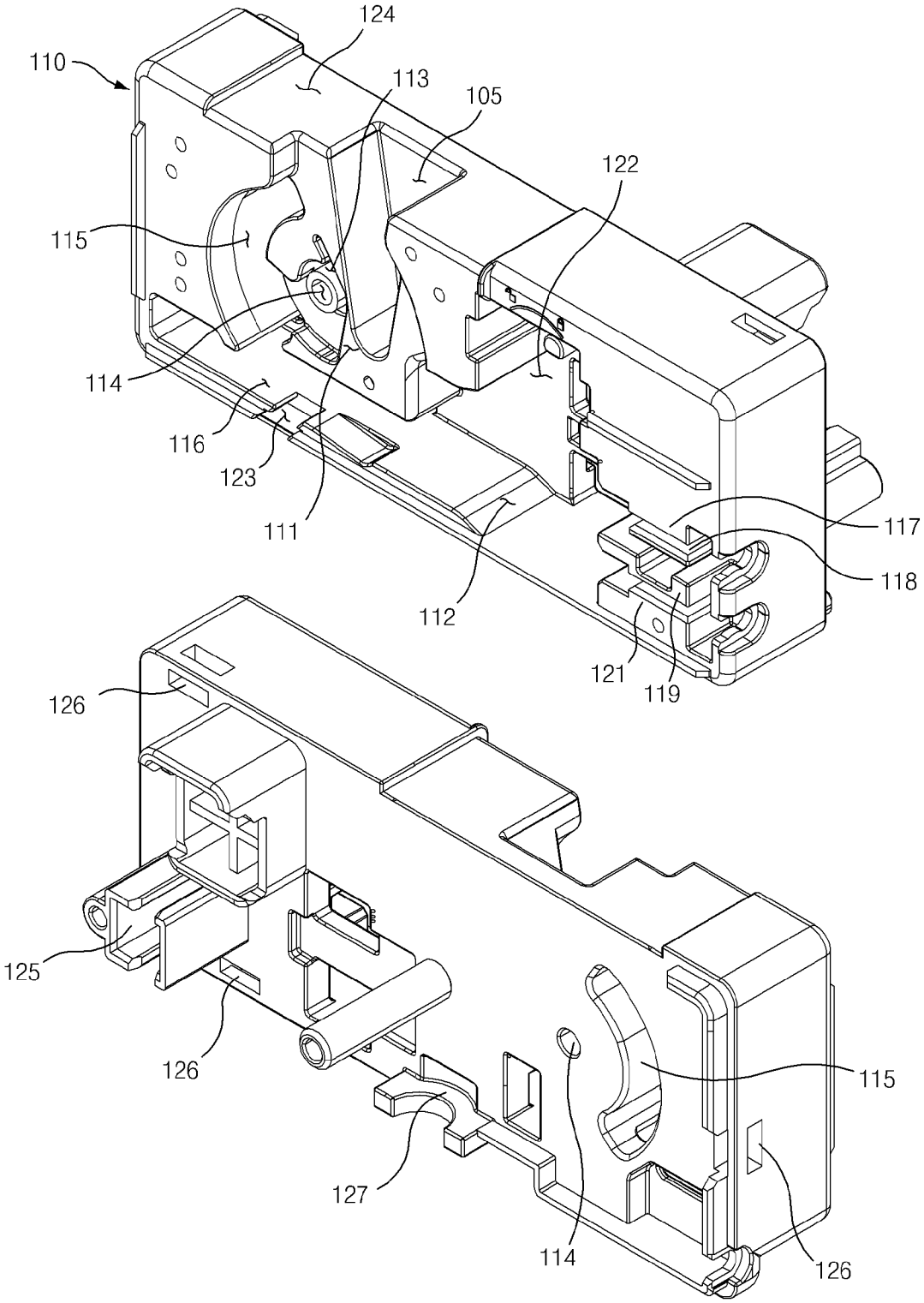

[Fig. 5]
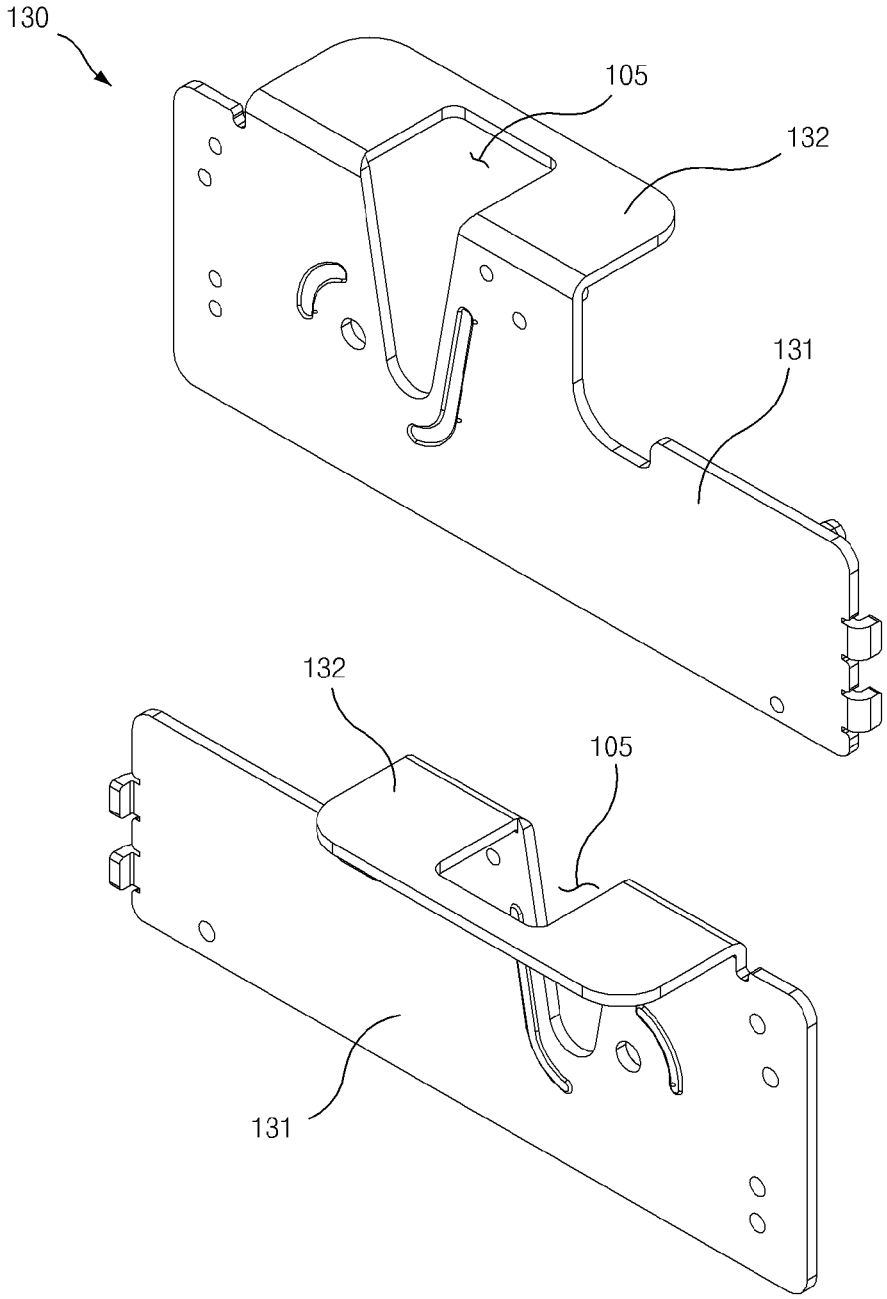

[Fig. 6]
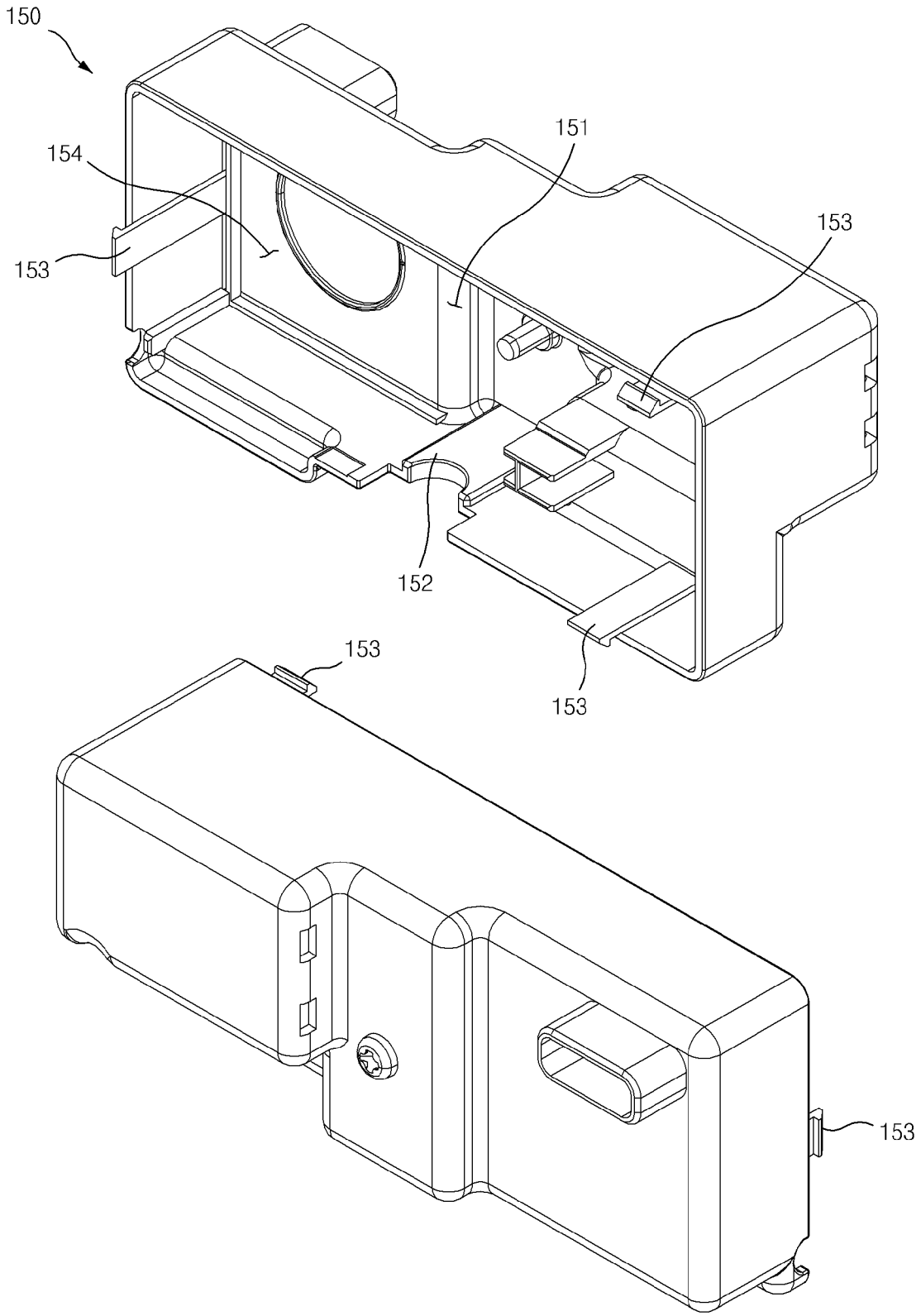

[Fig. 7]
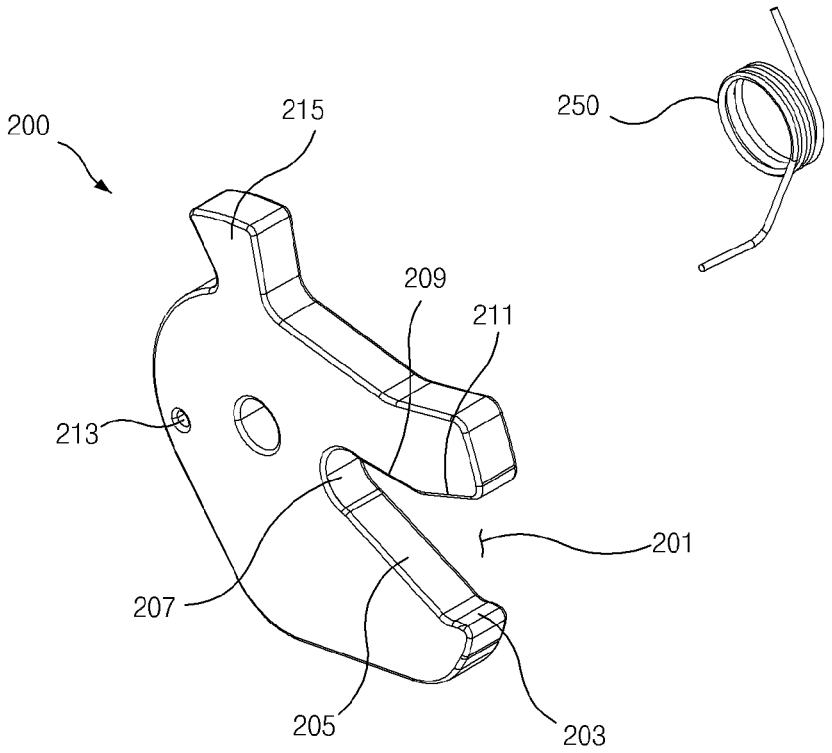

[Fig. 8]
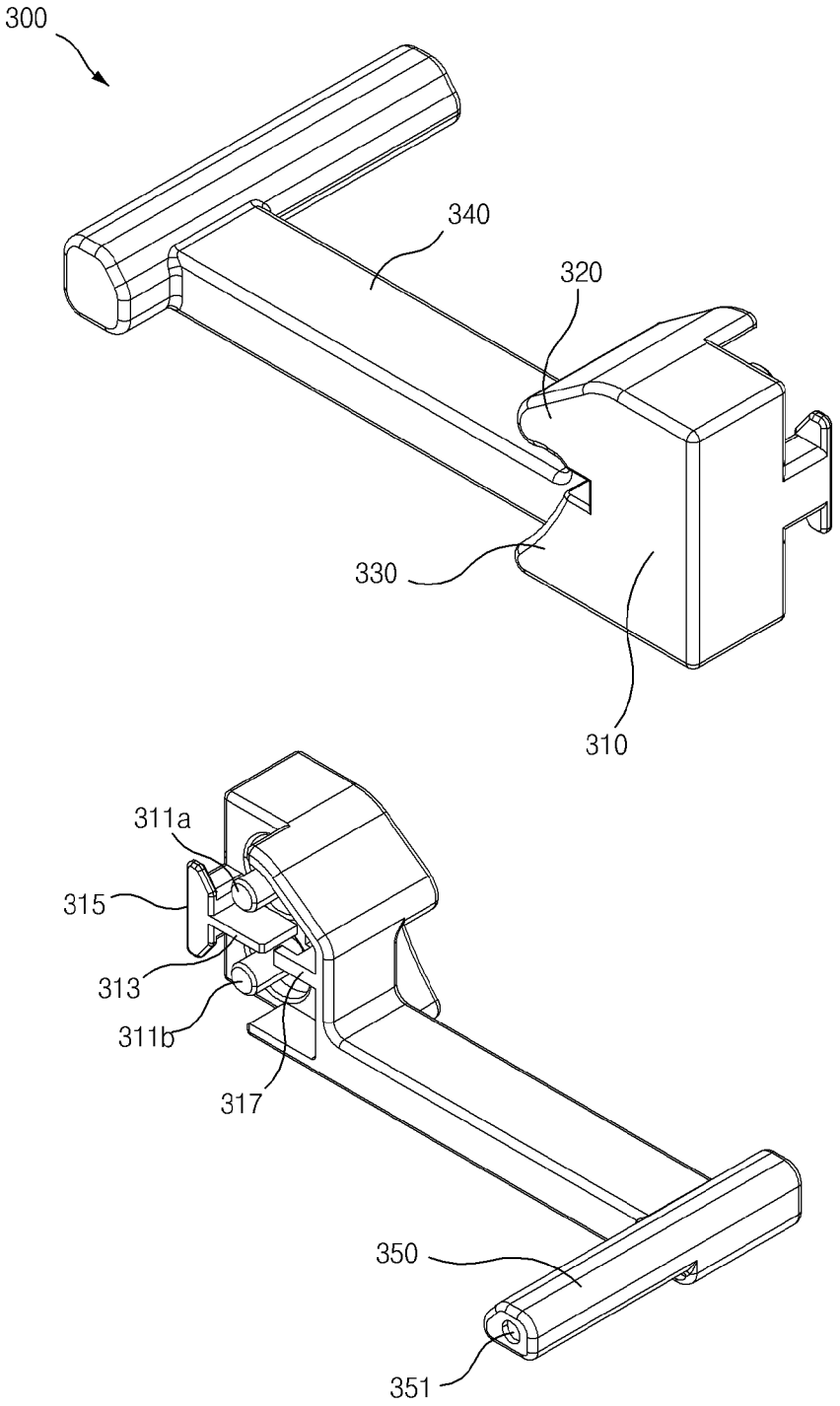

[Fig. 9]
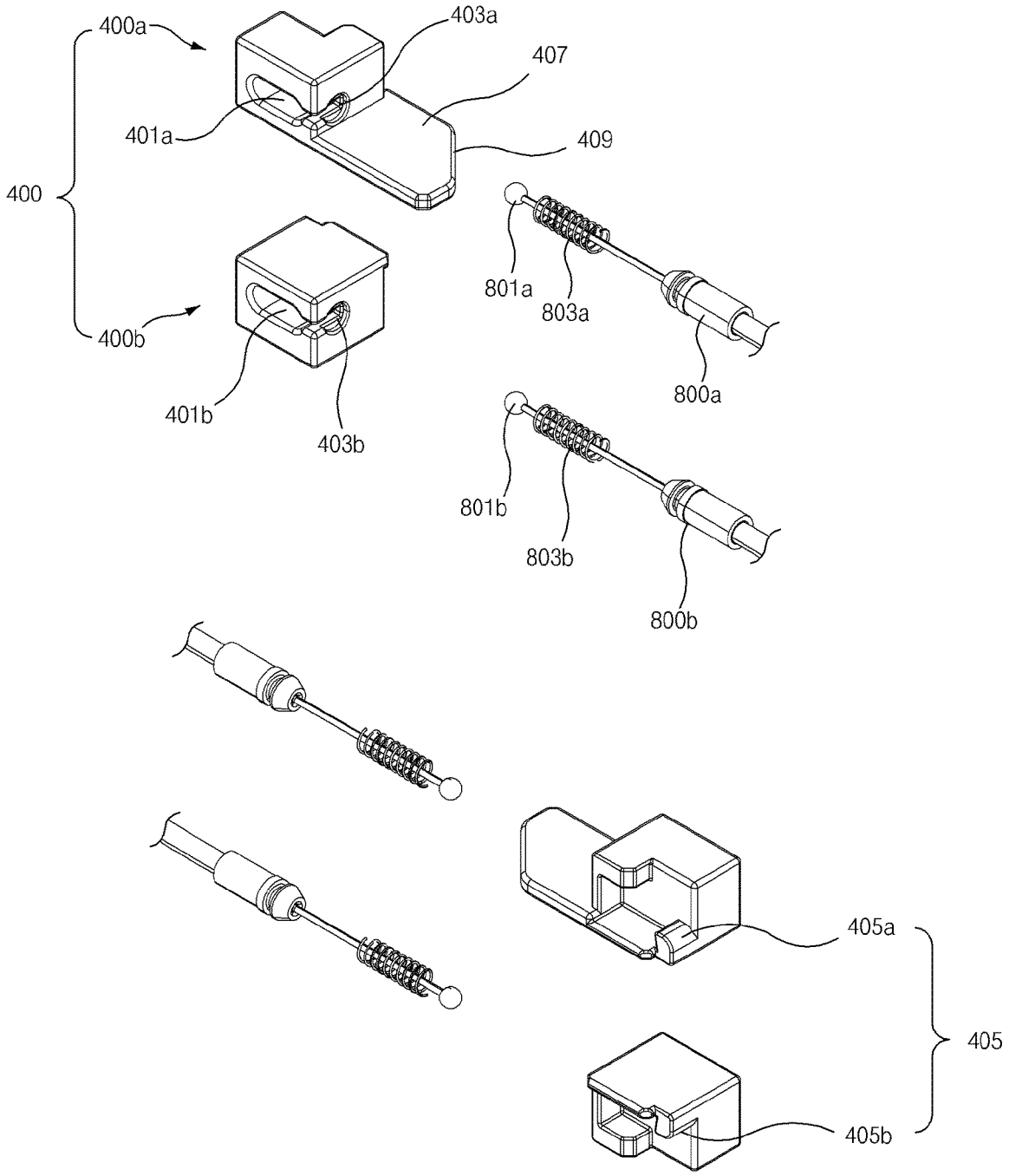

[Fig. 10]
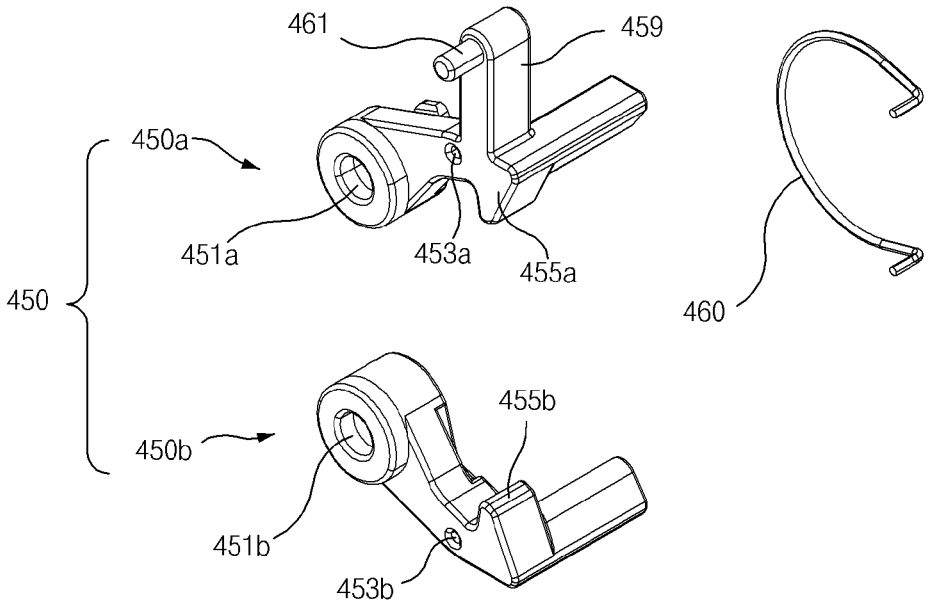
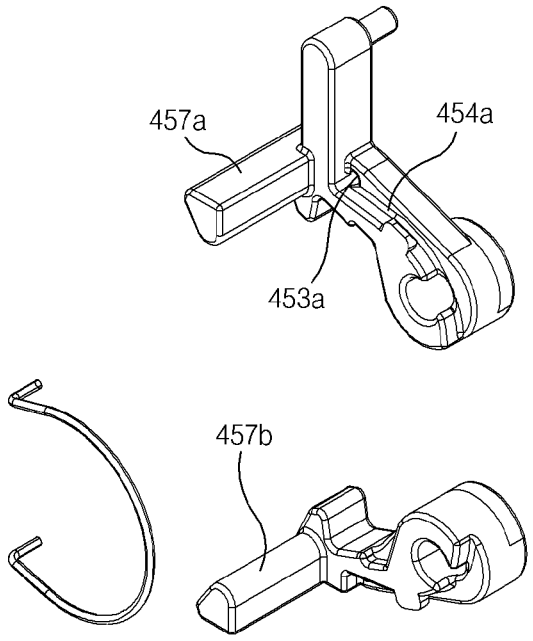

[Fig. 11]
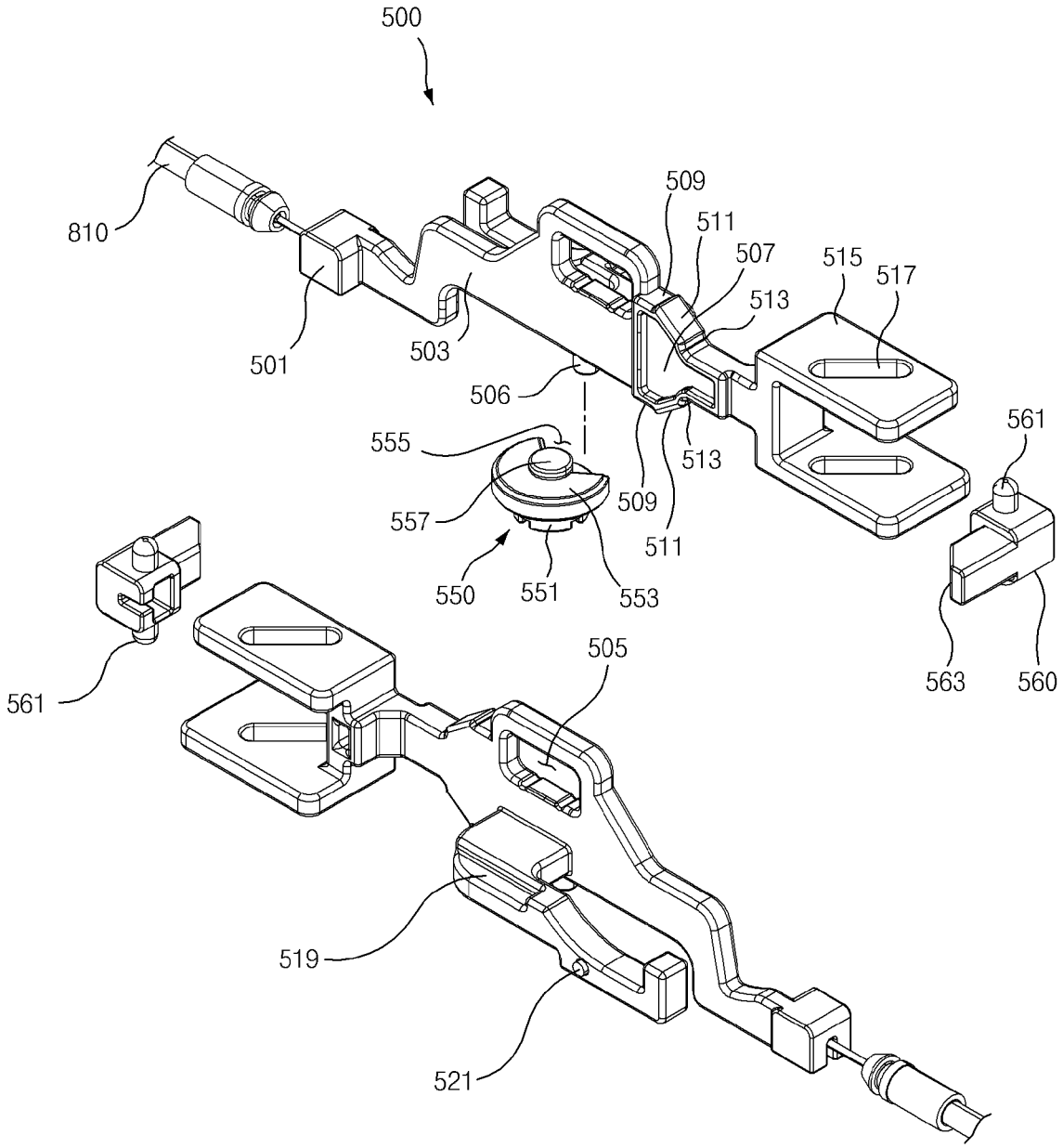

[Fig. 12]
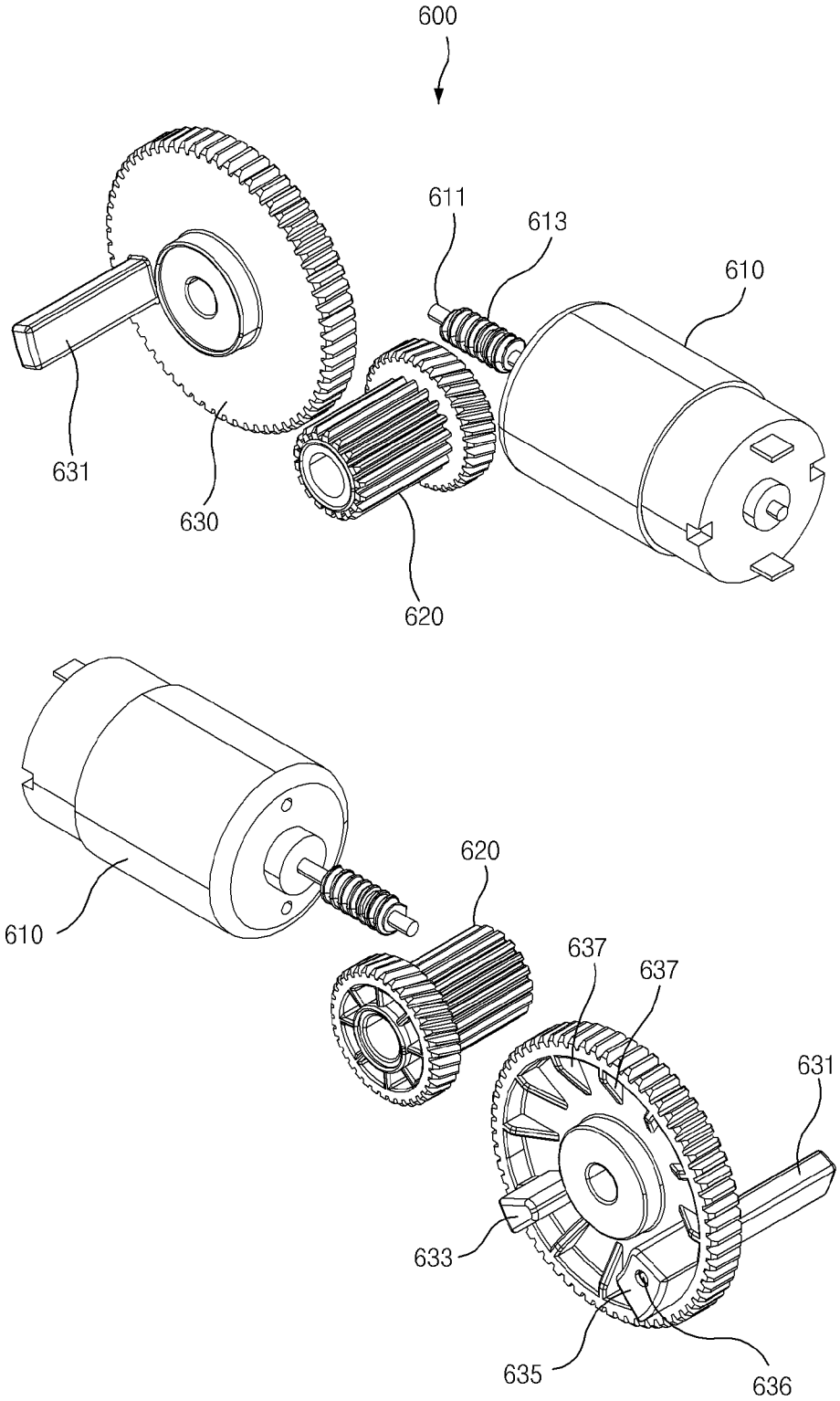

[Fig. 13]
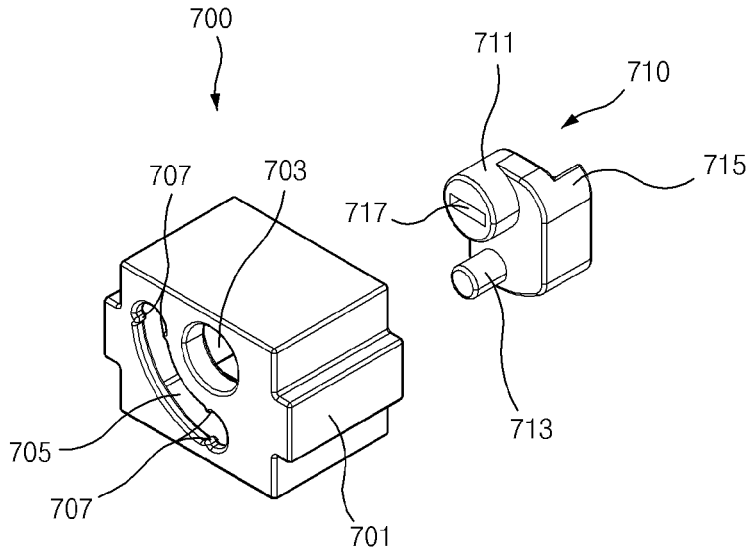
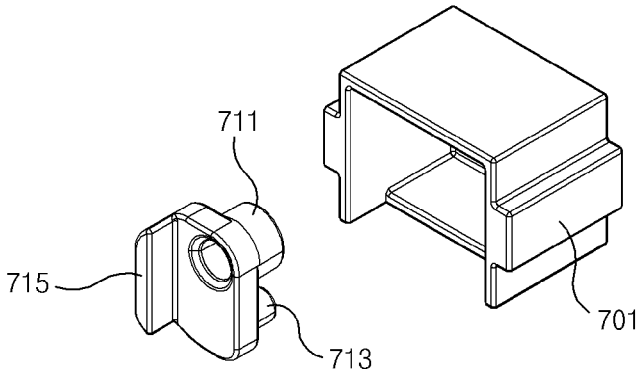

[Fig. 14]
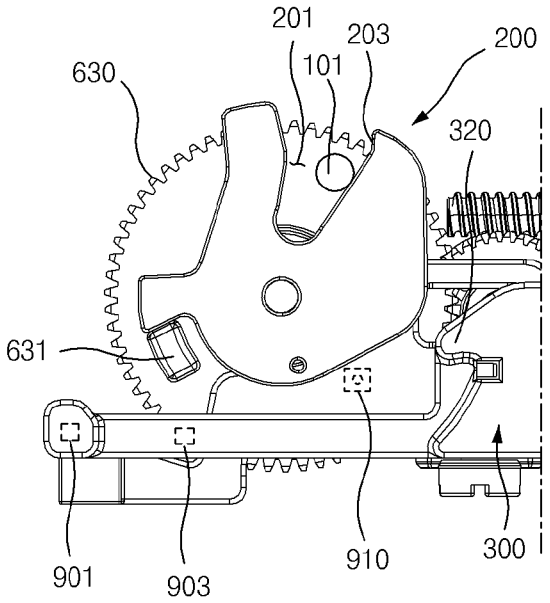
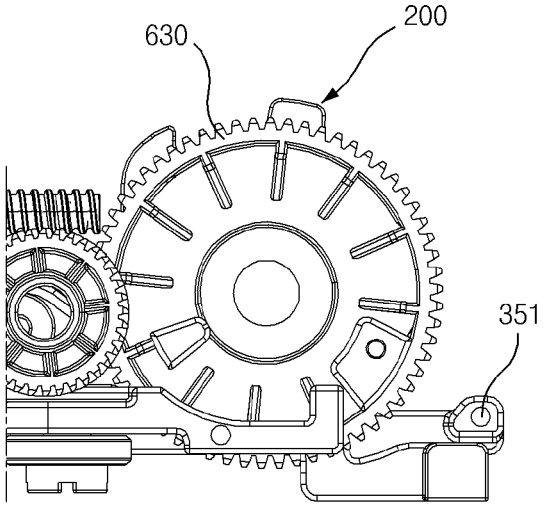

[Fig. 15]
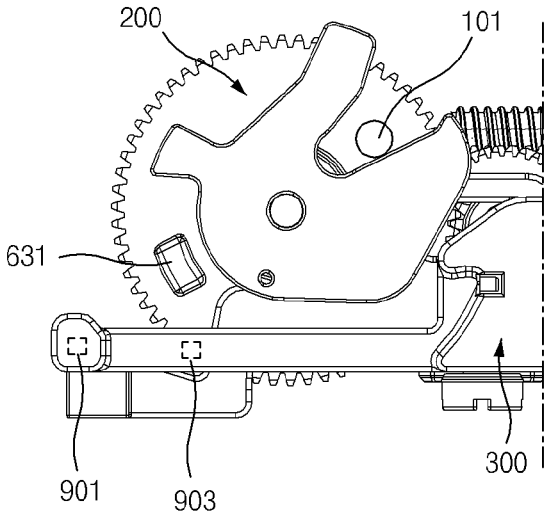
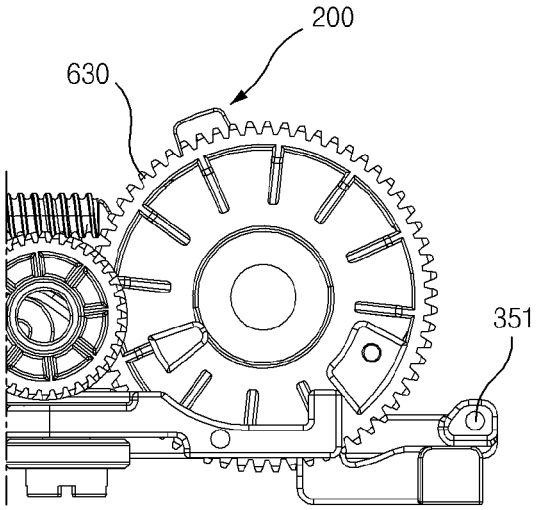

[Fig. 16]
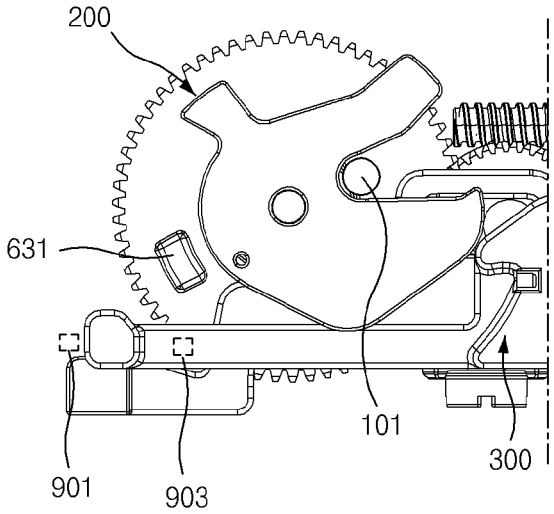
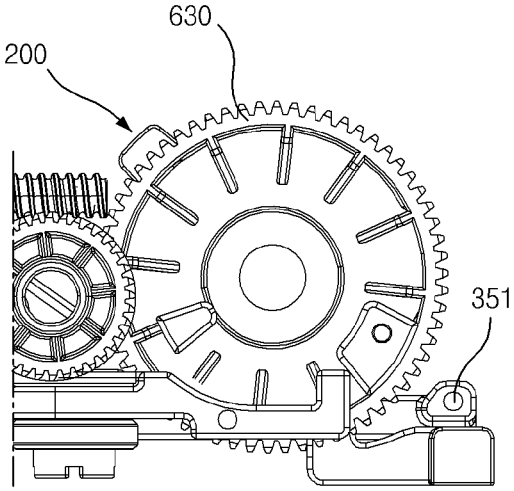

[Fig. 17]
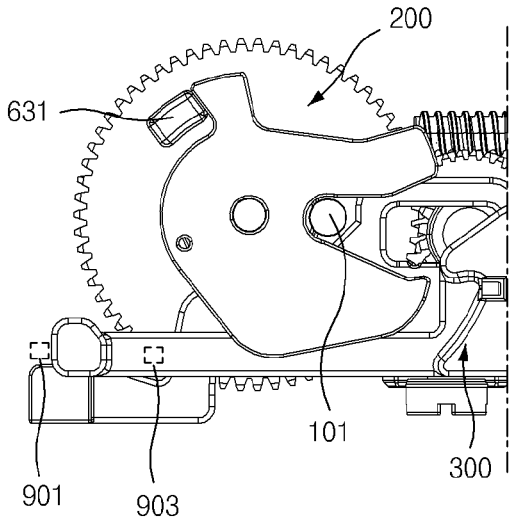
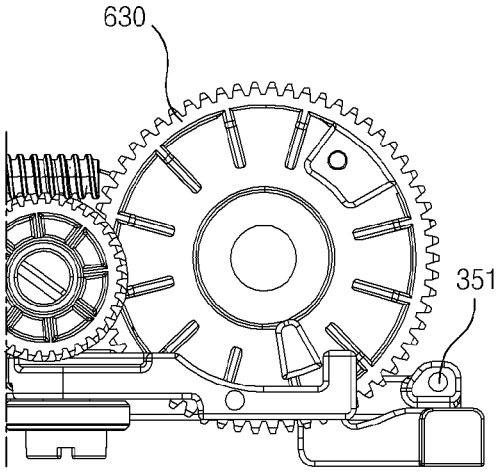

[Fig. 18]
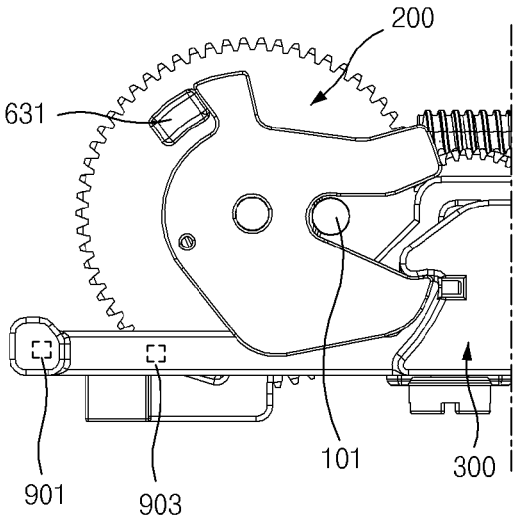
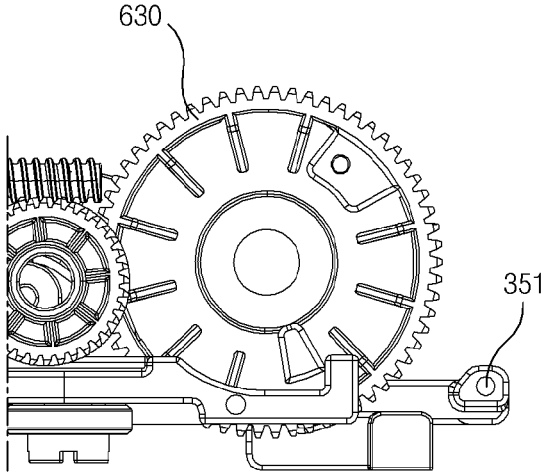

[Fig. 19]
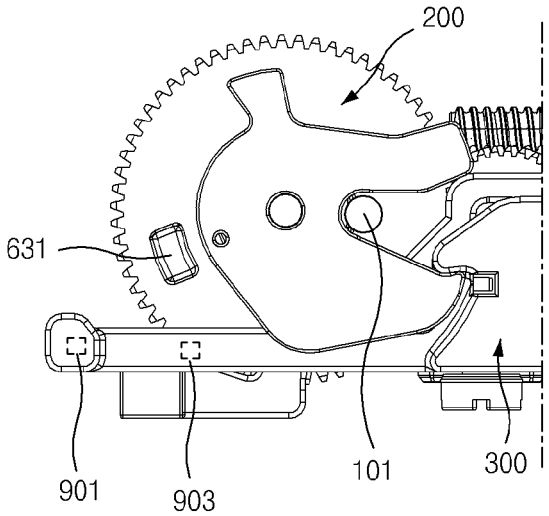
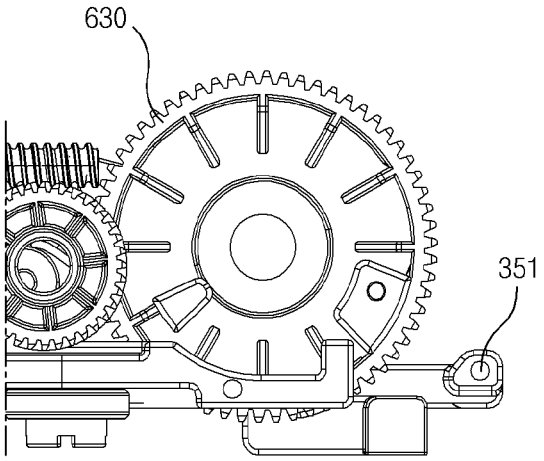

[Fig. 20]
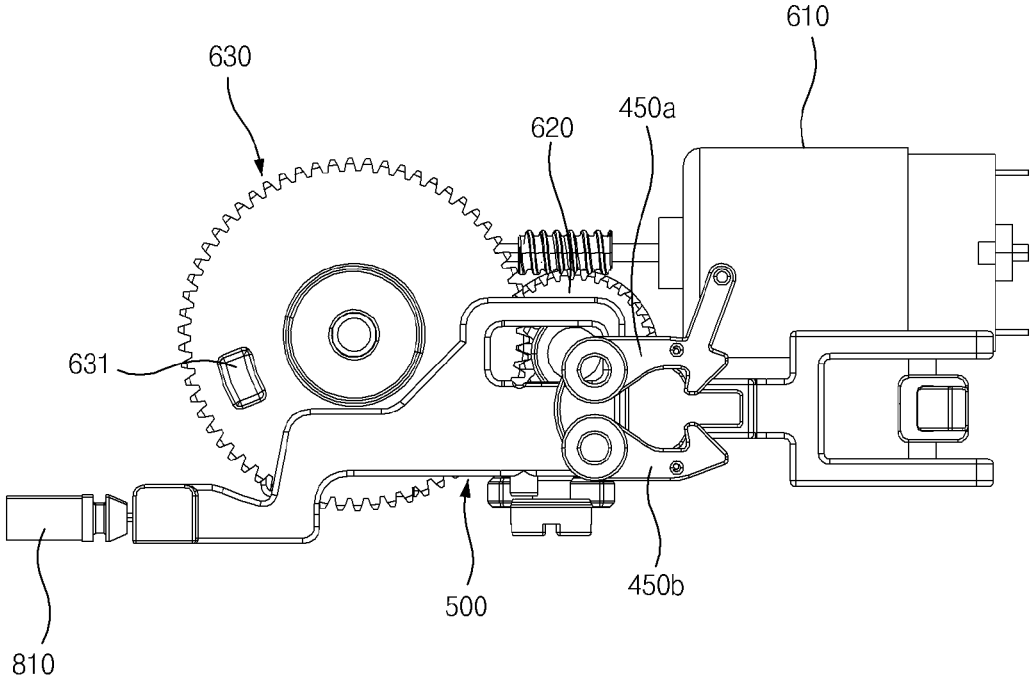
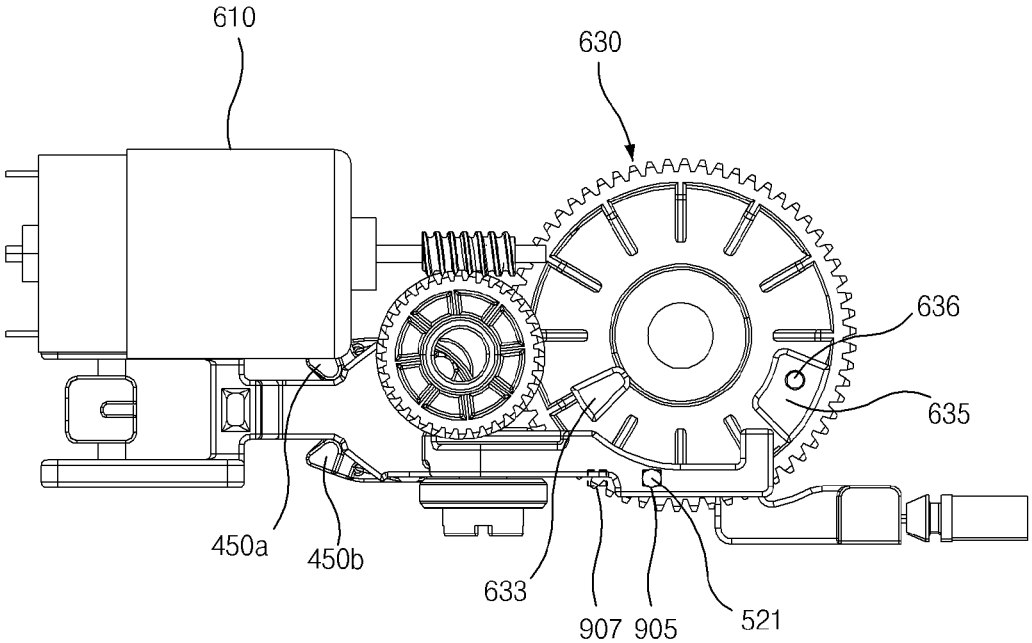

[Fig. 21]
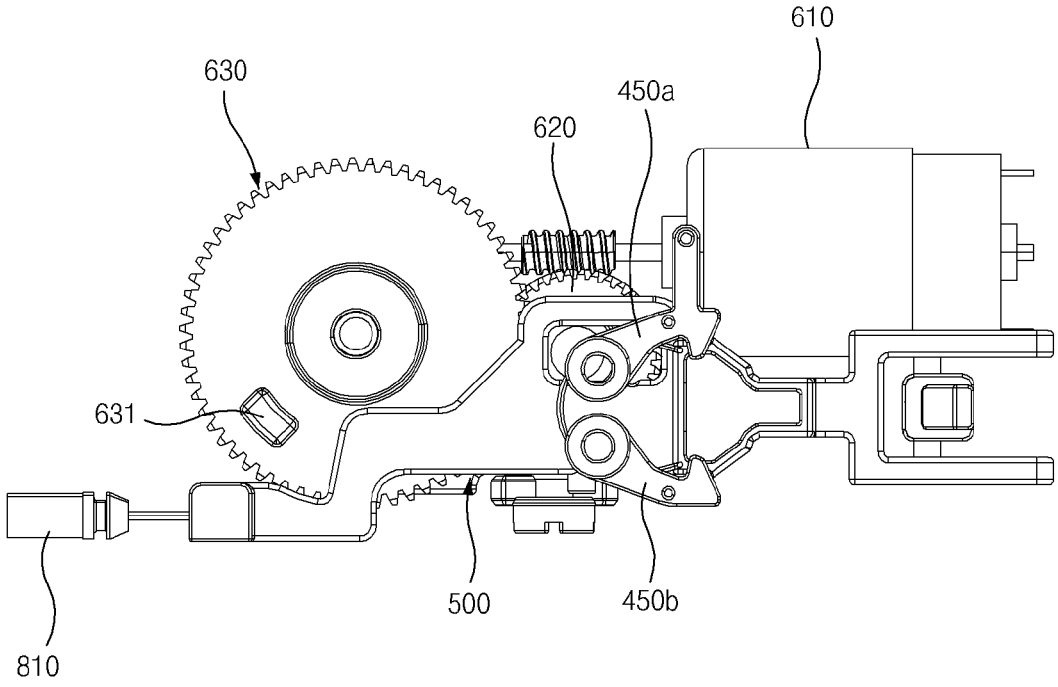
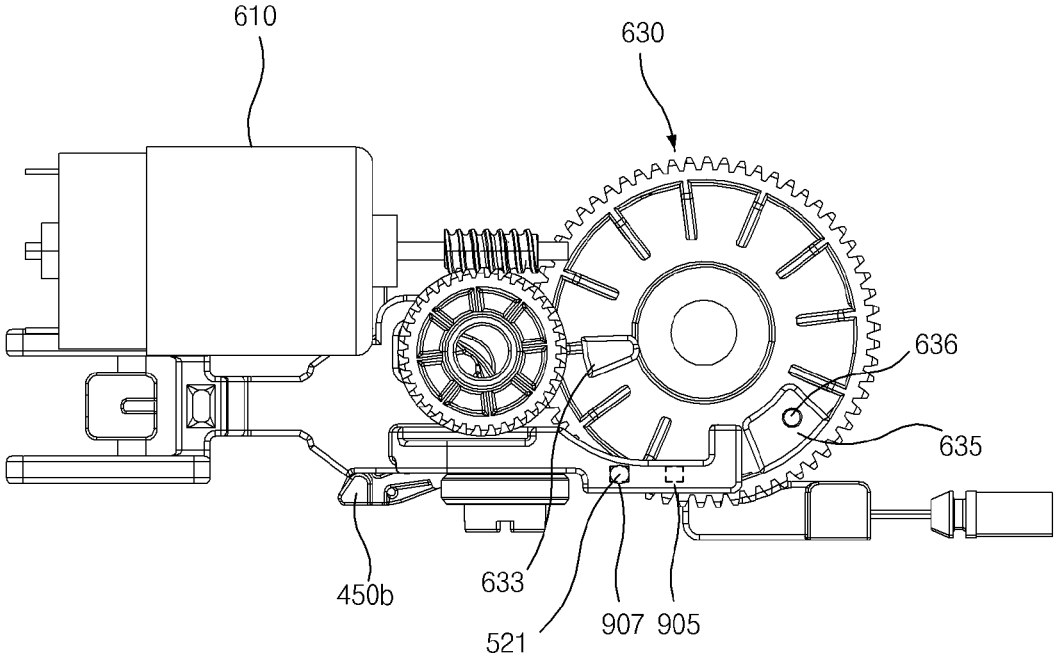

[Fig. 22]
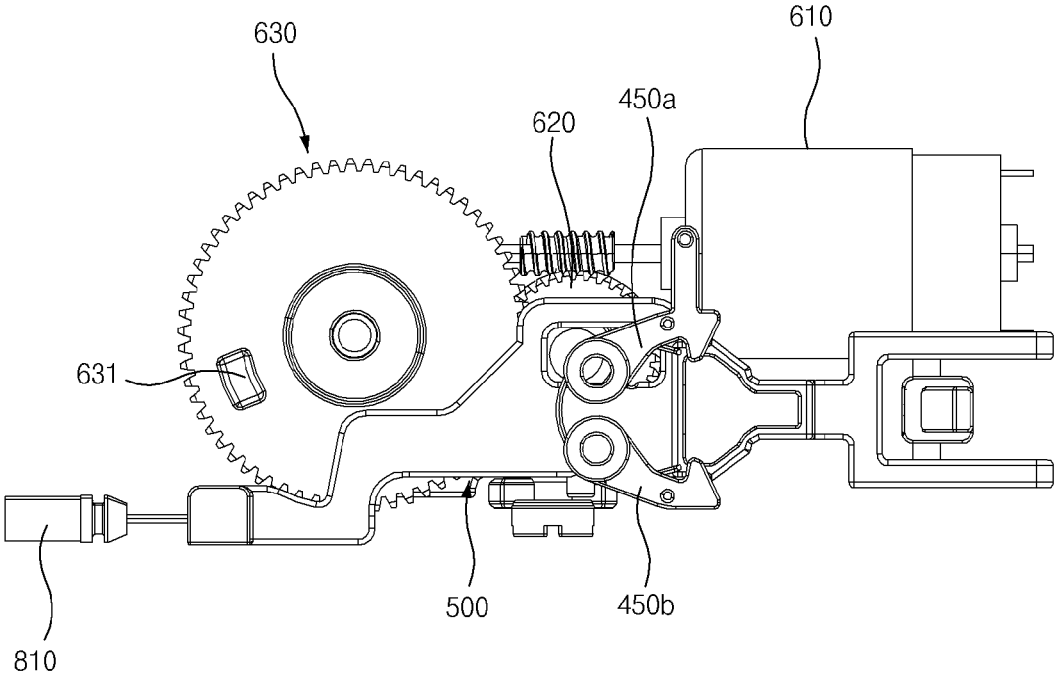
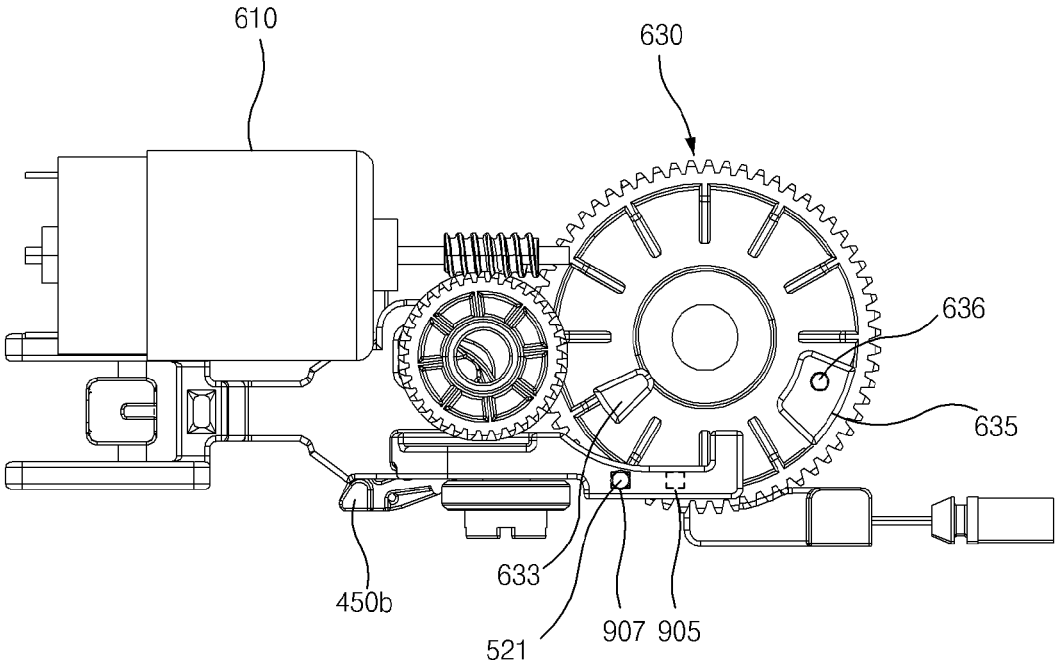

[Fig. 23]
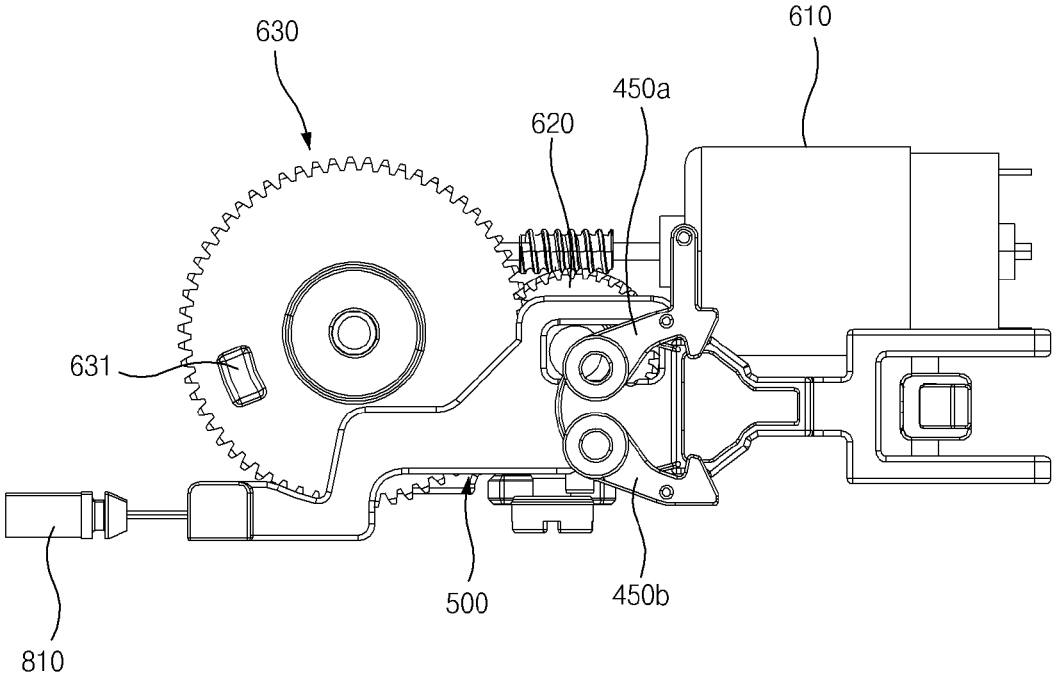
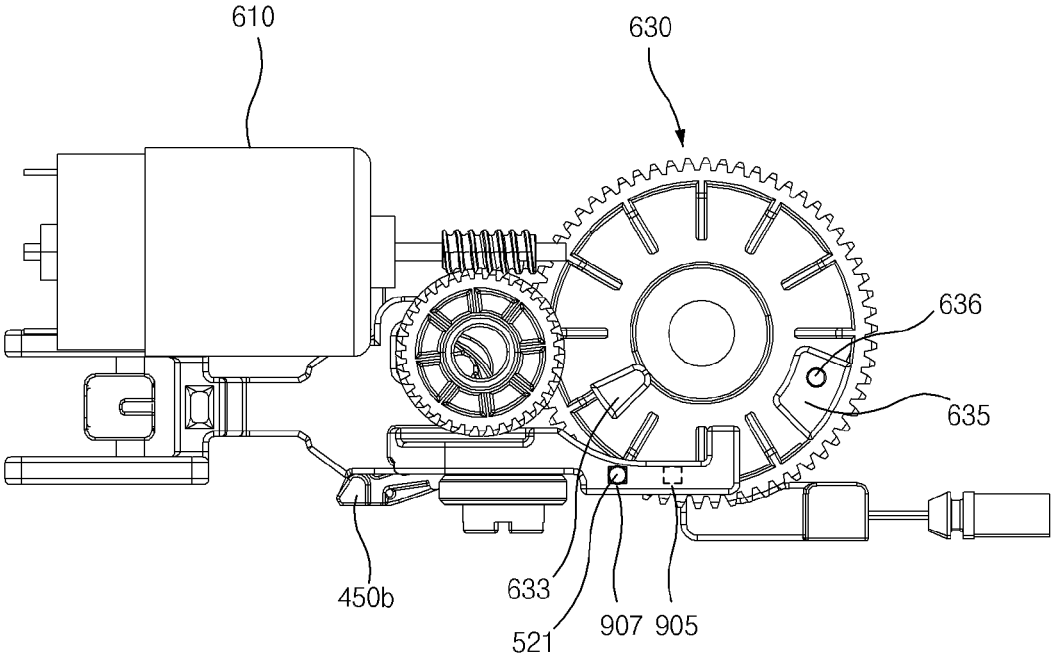

[Fig. 24]
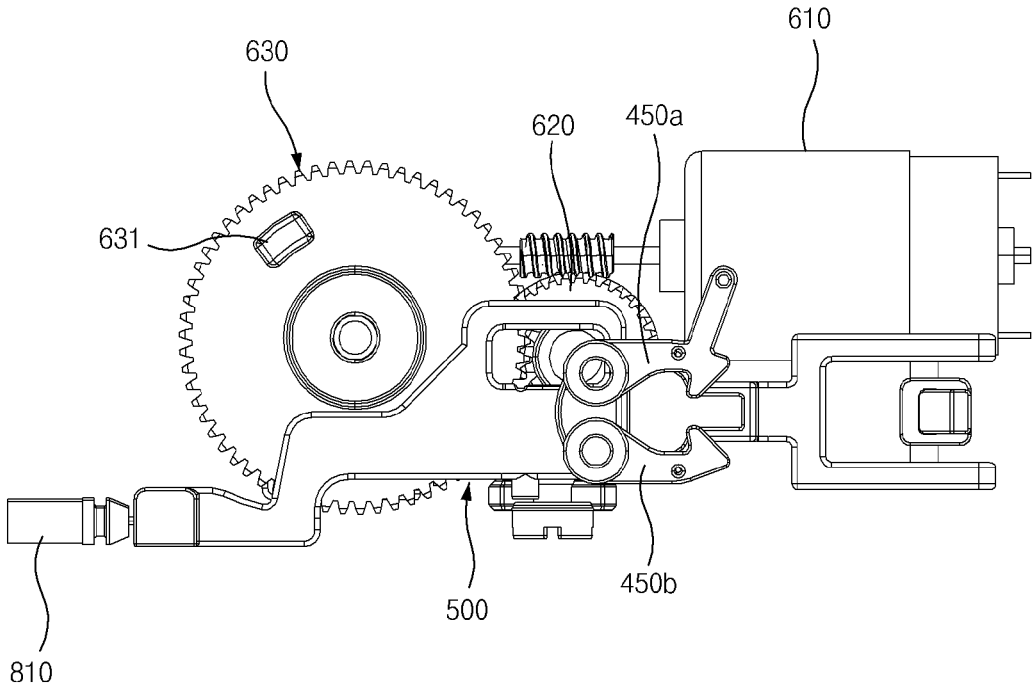
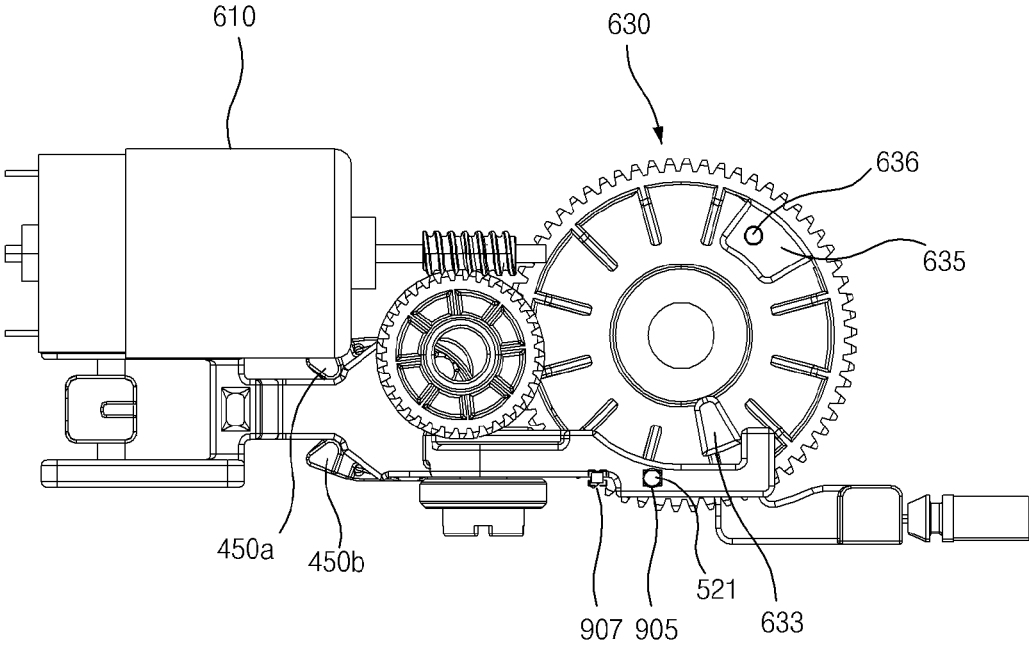

[Fig. 25]
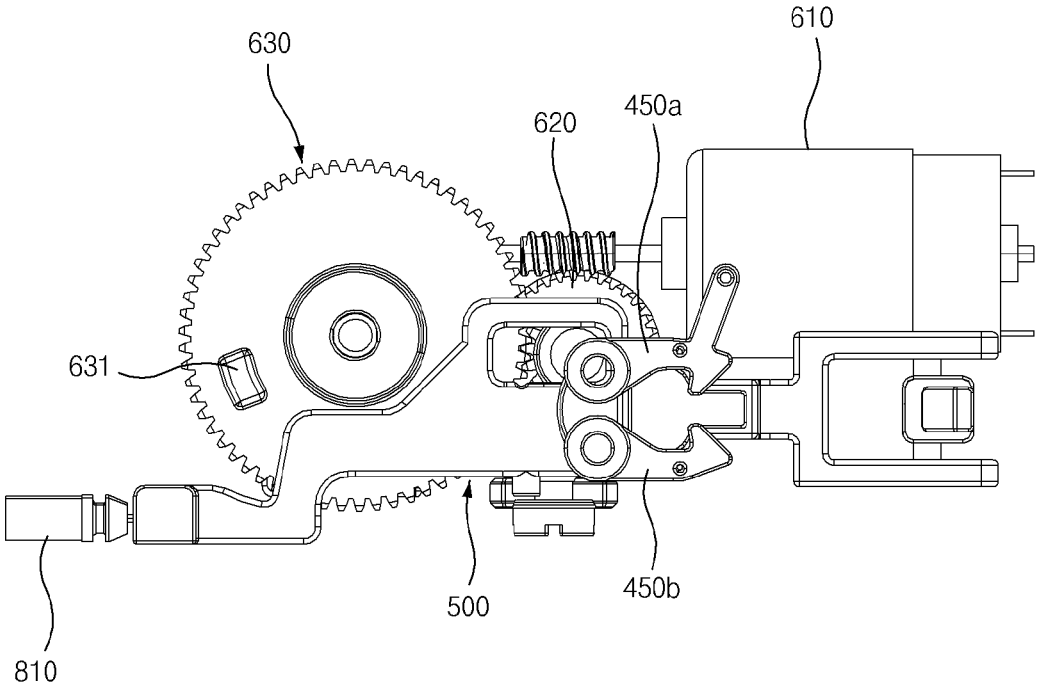
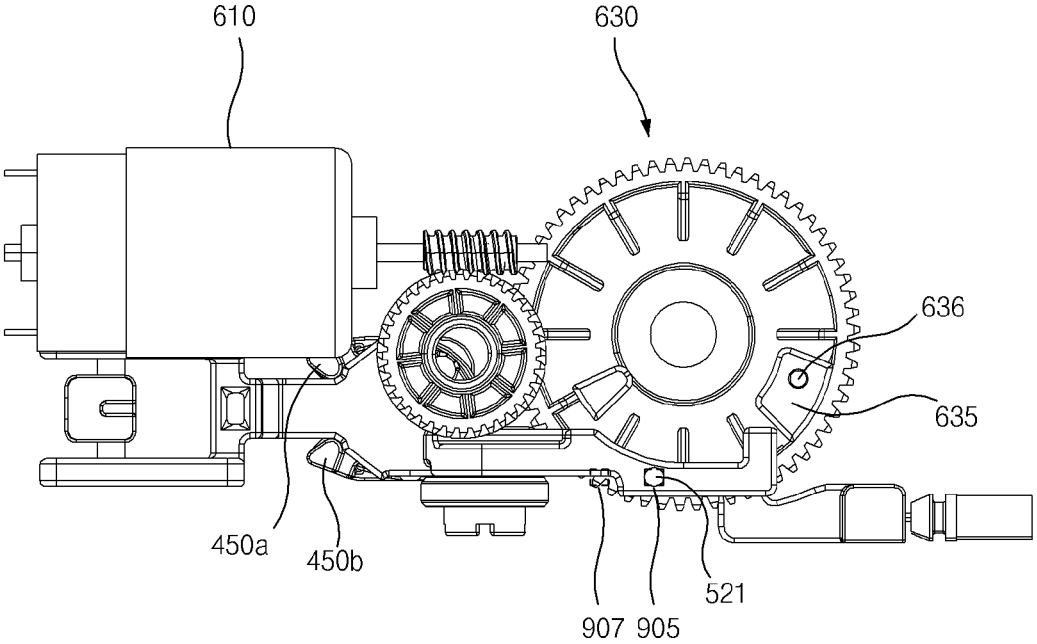

[Fig. 26]
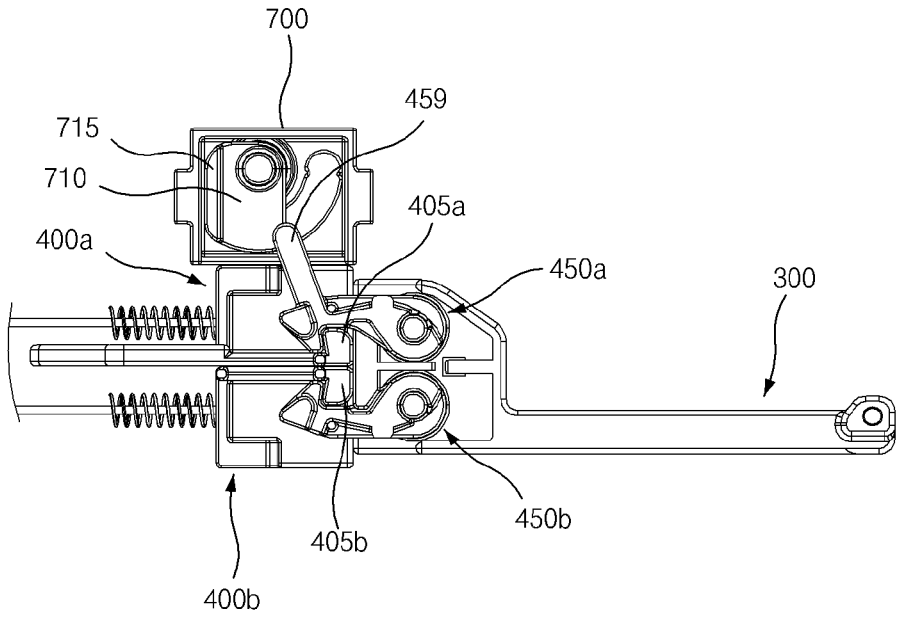
[Fig. 27]
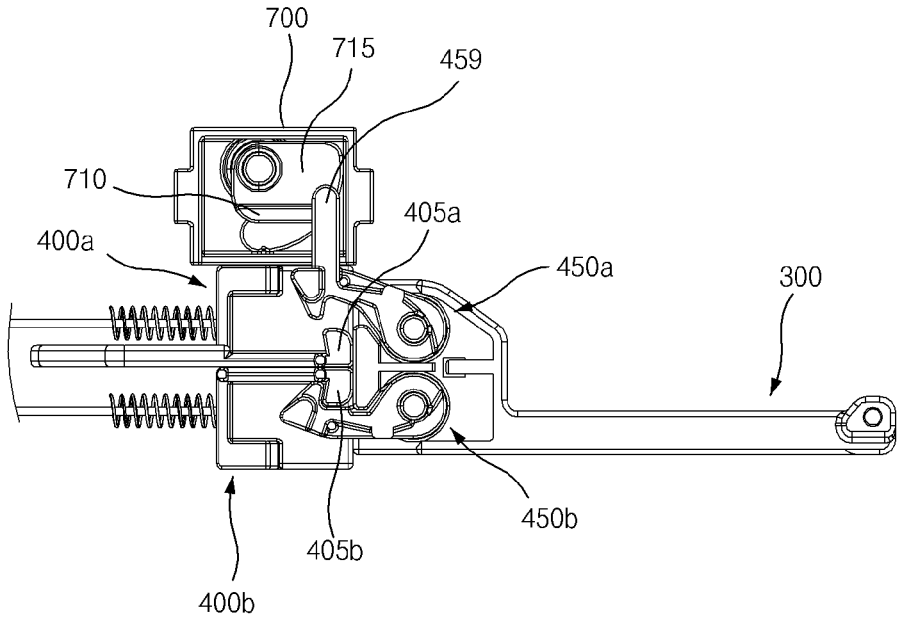

[Fig. 28]
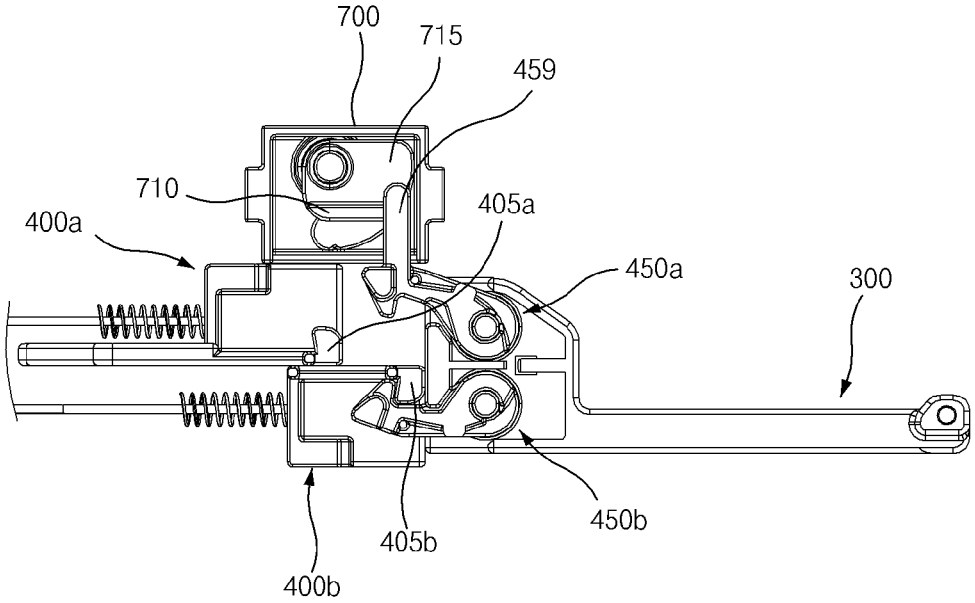

[Fig. 29]
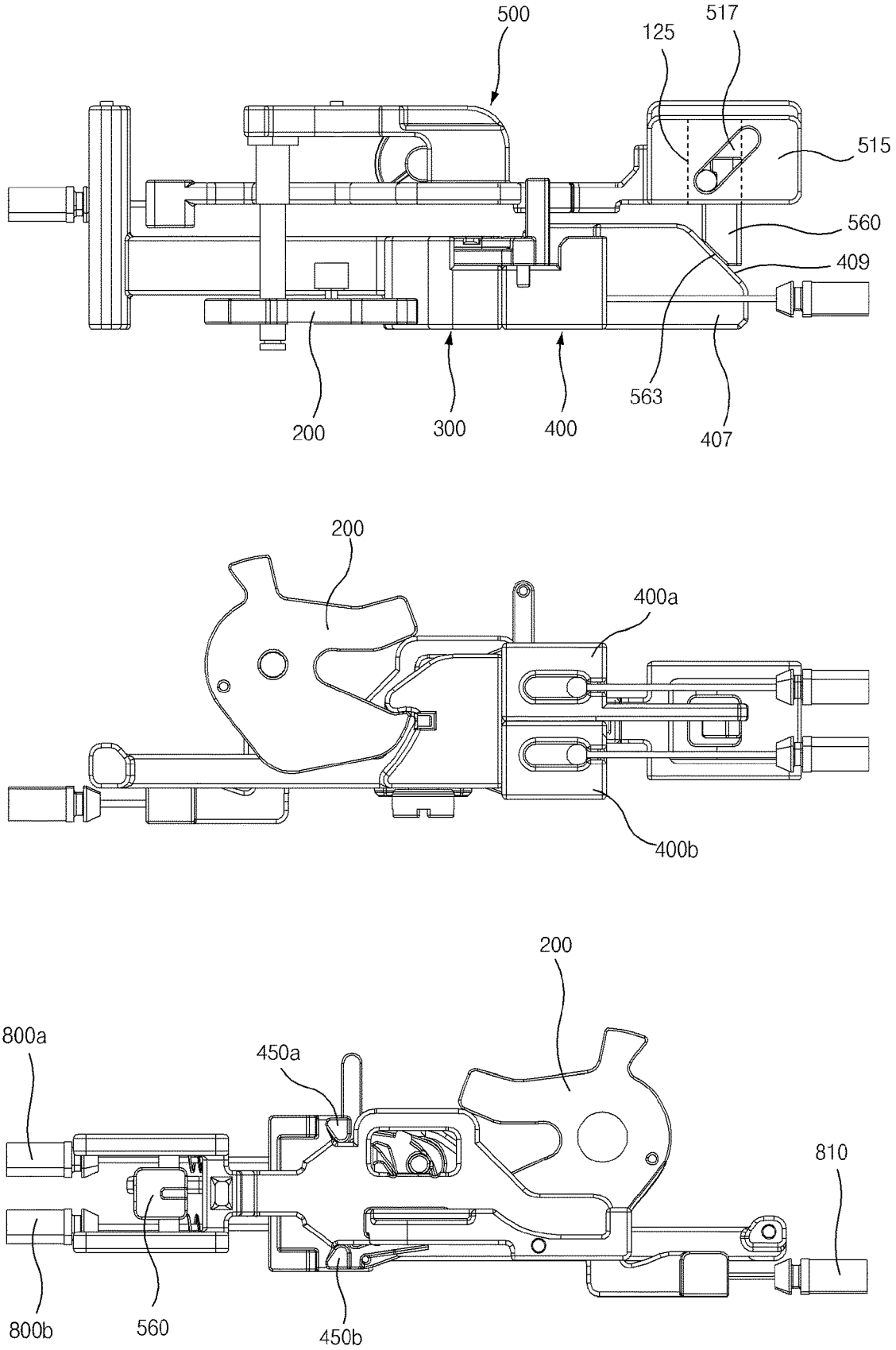

[Fig. 30]
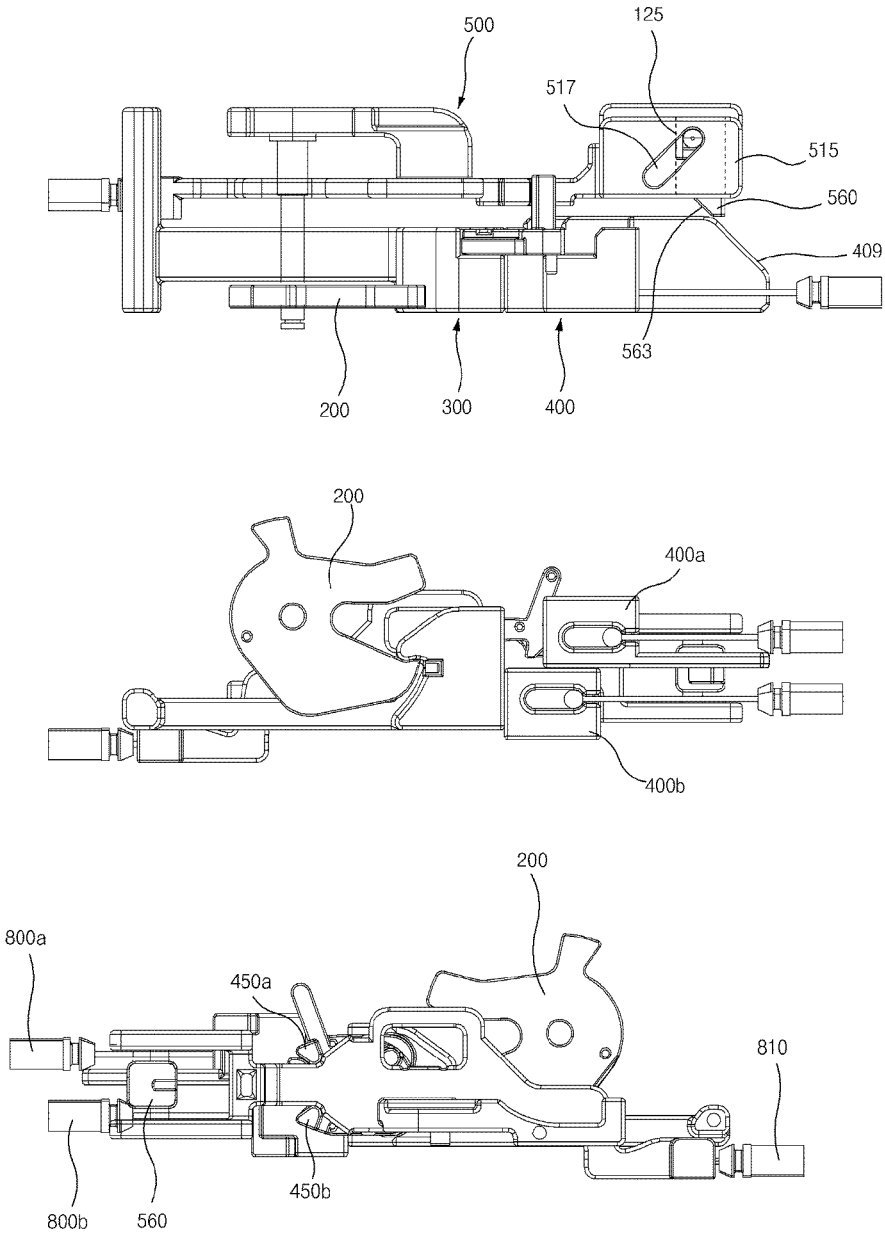

[Fig. 31]
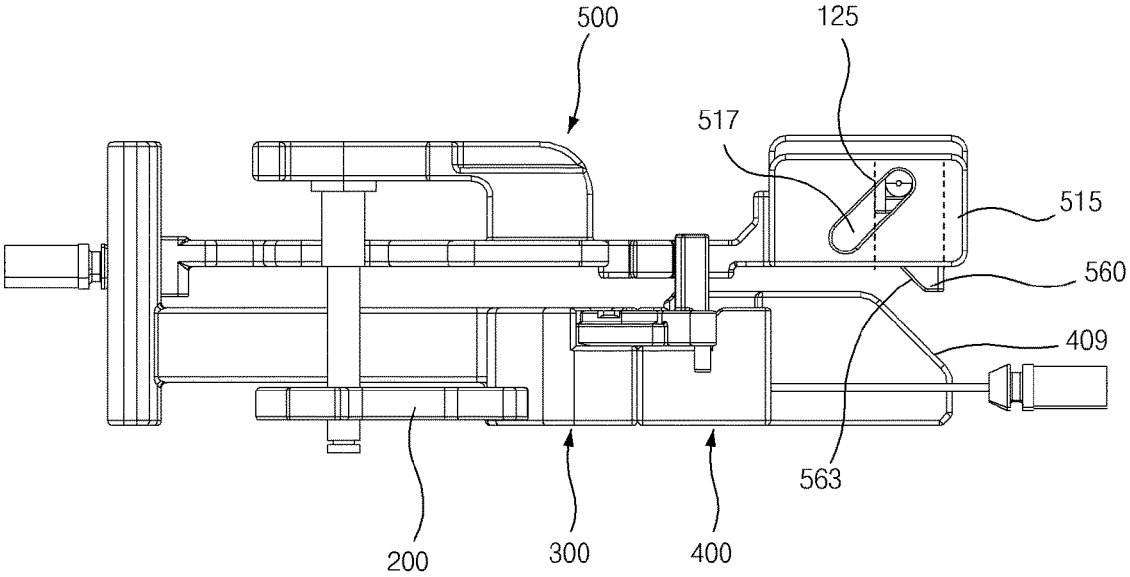
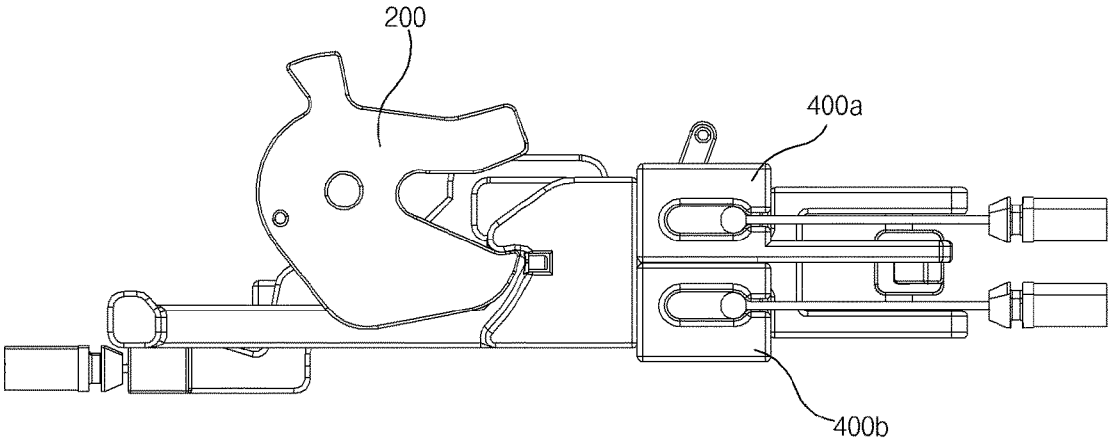
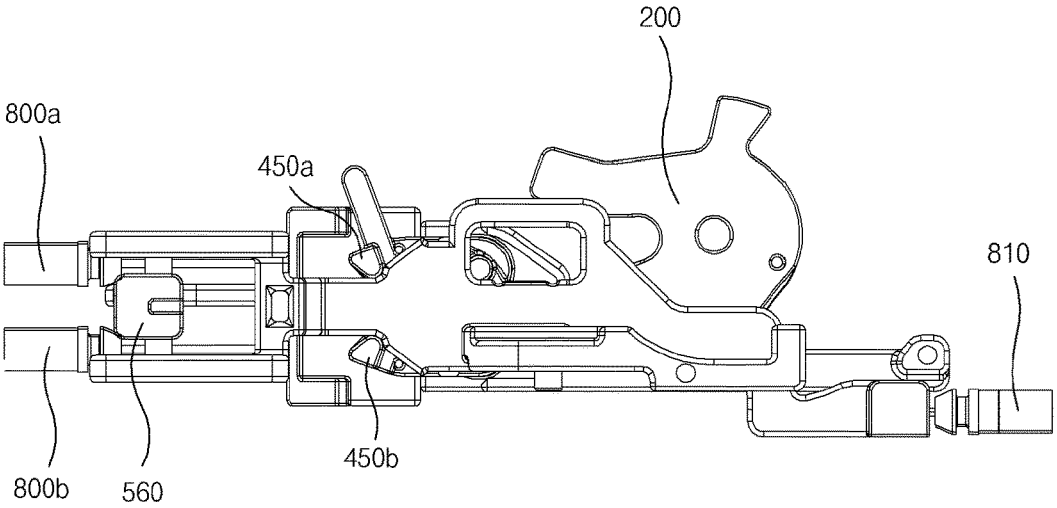

[Fig. 32]
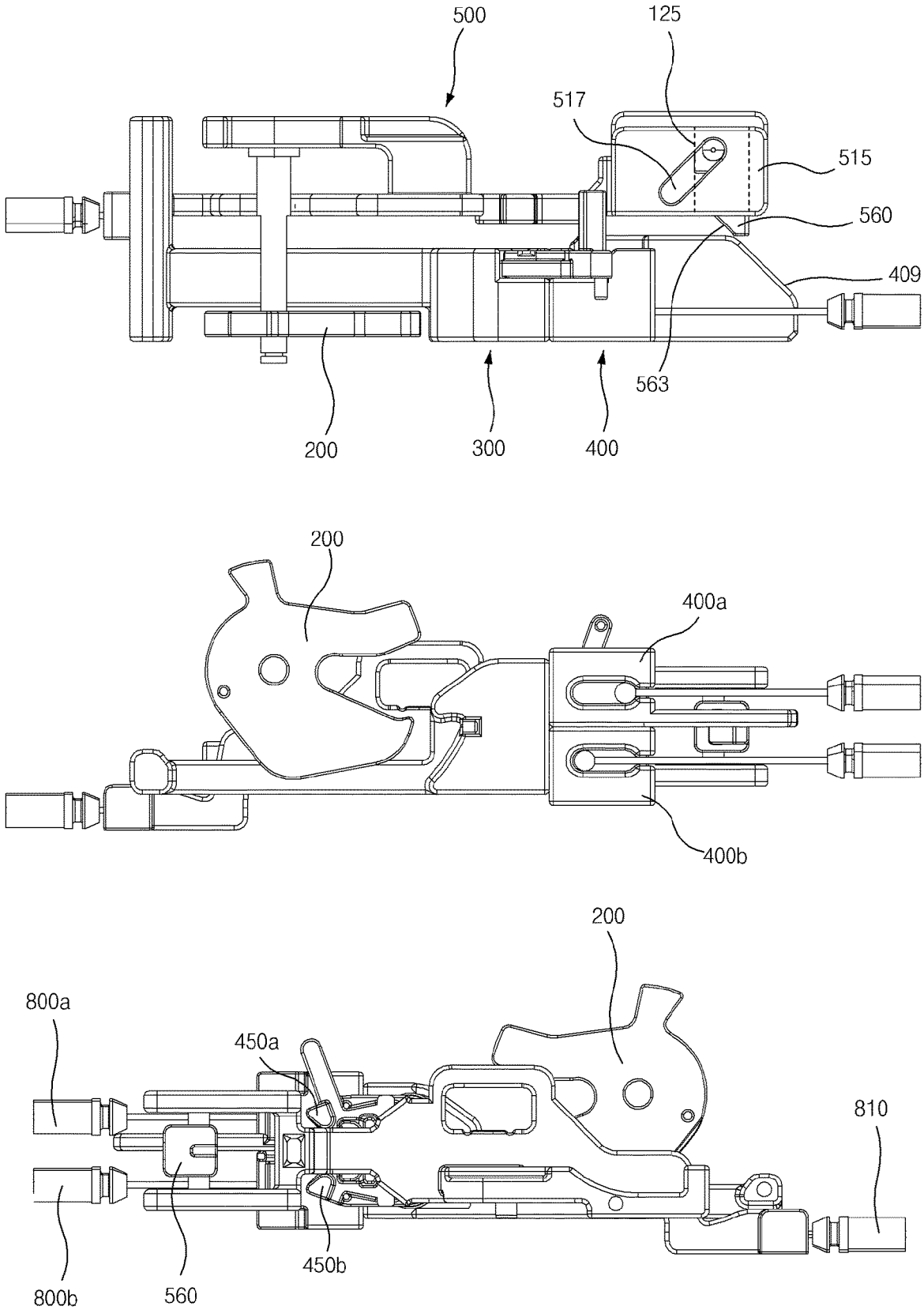

[Fig. 33]
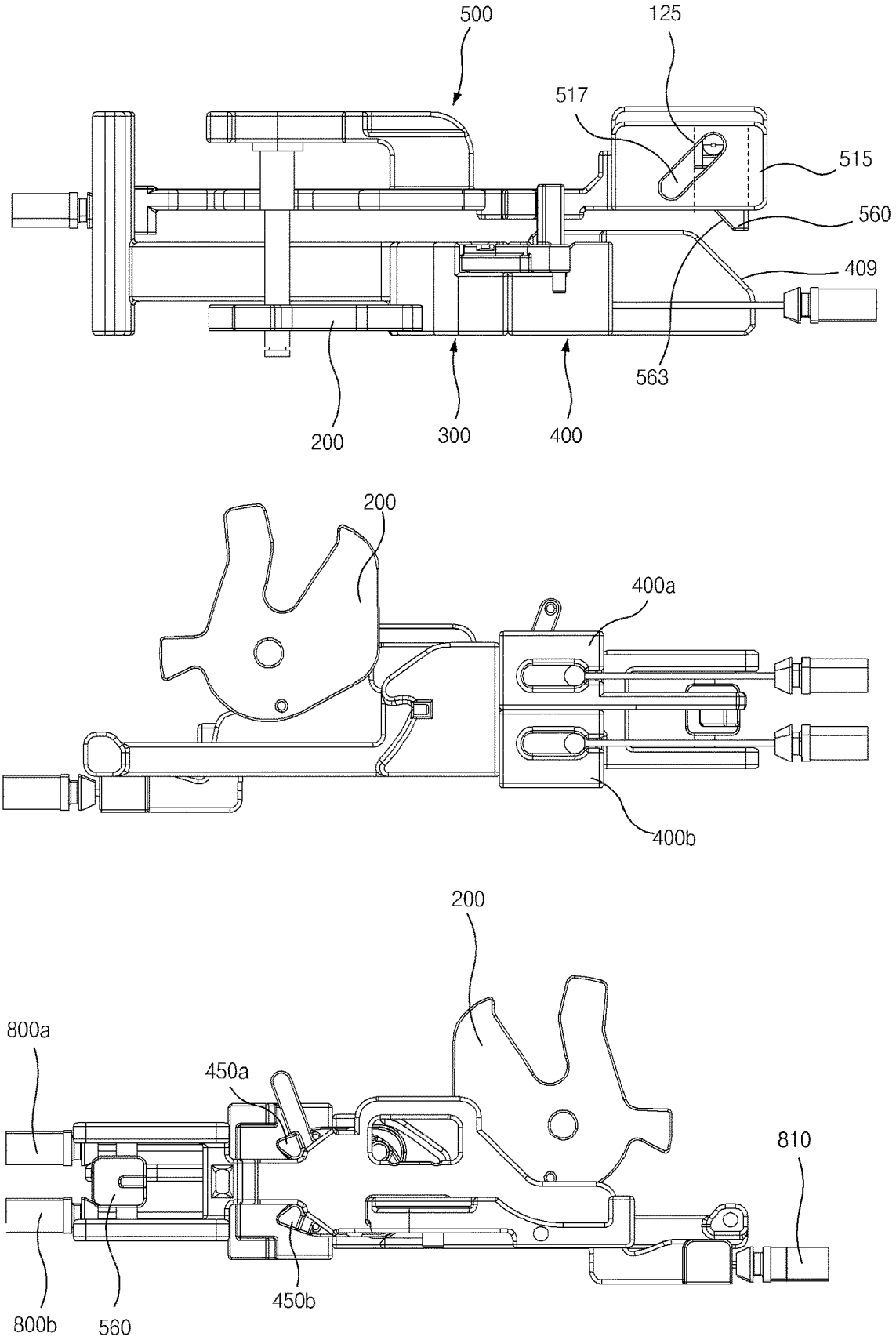

[Fig. 34]
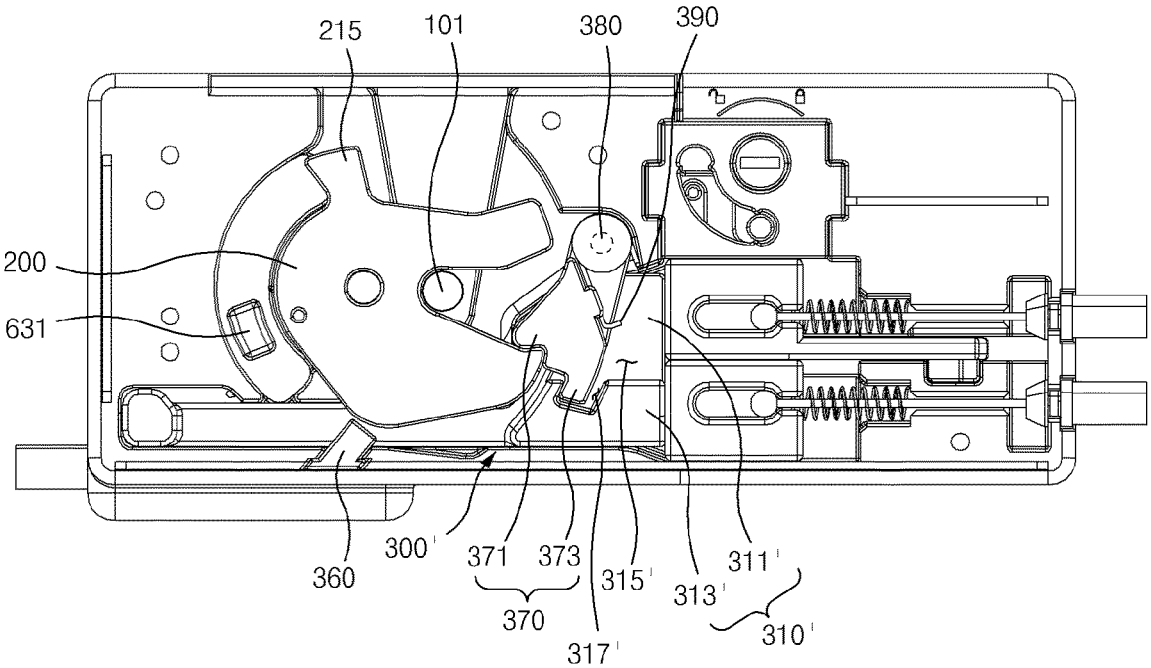

[Fig. 35]
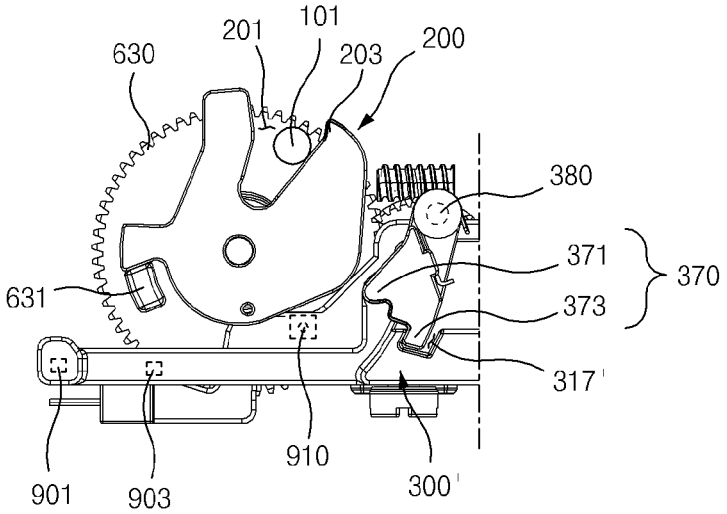
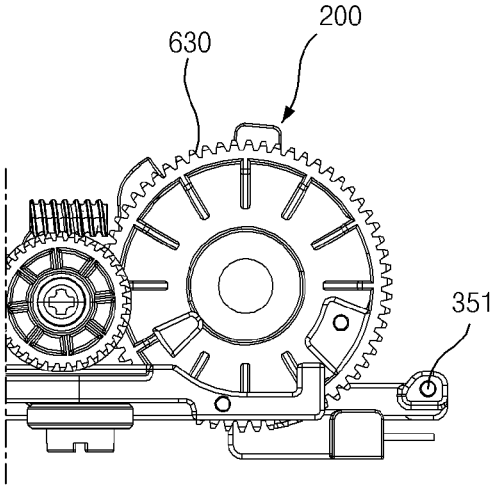

[Fig. 36]
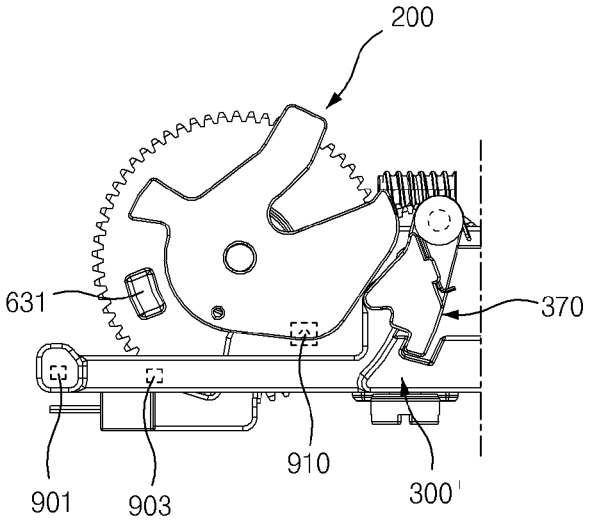
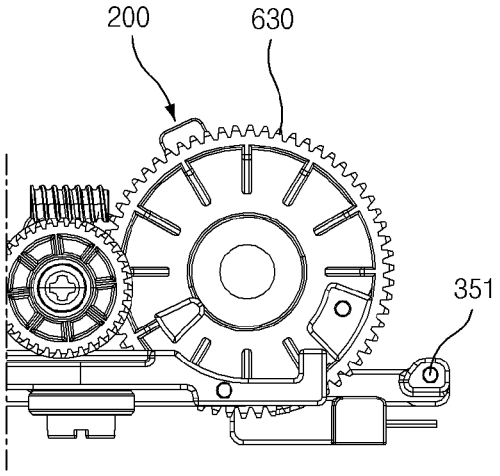

[Fig. 37]
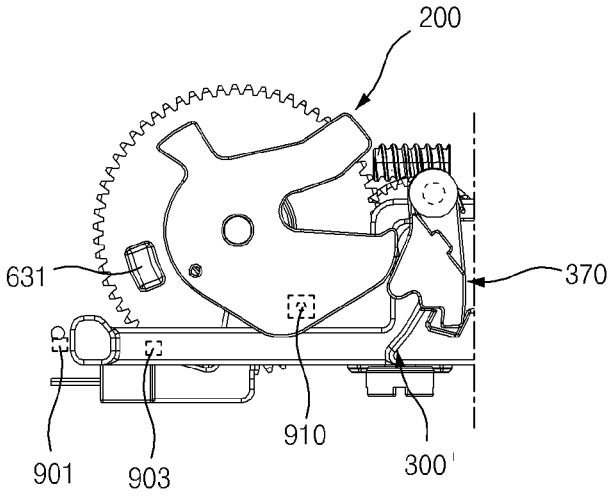
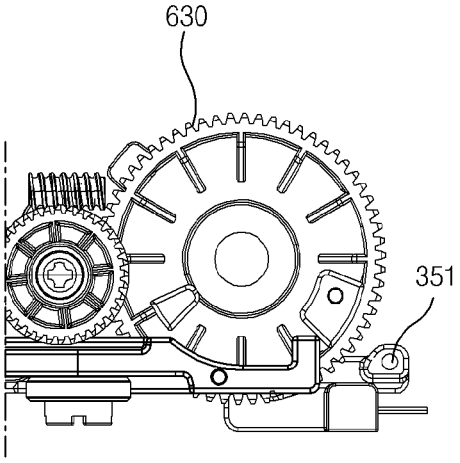

[Fig. 38]
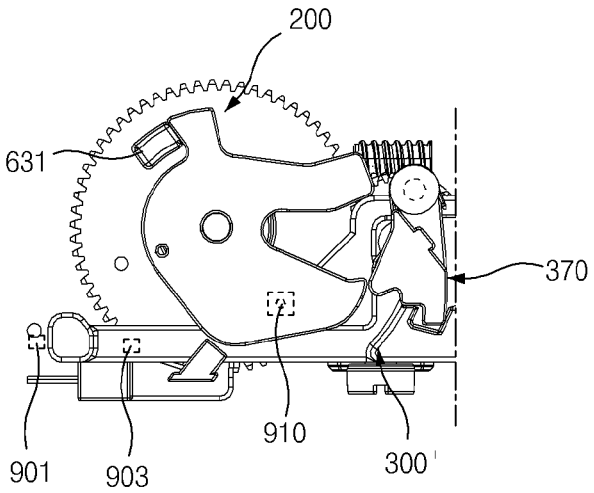
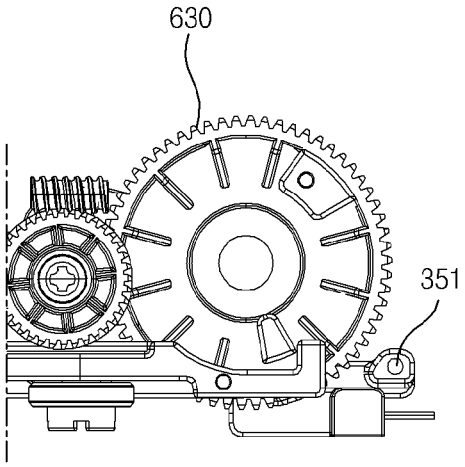

[Fig. 39]
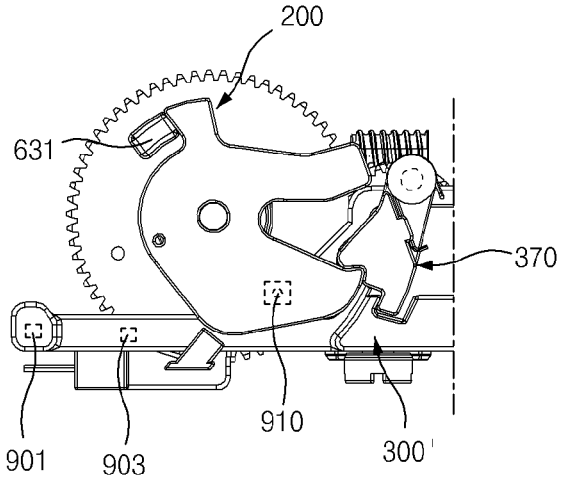
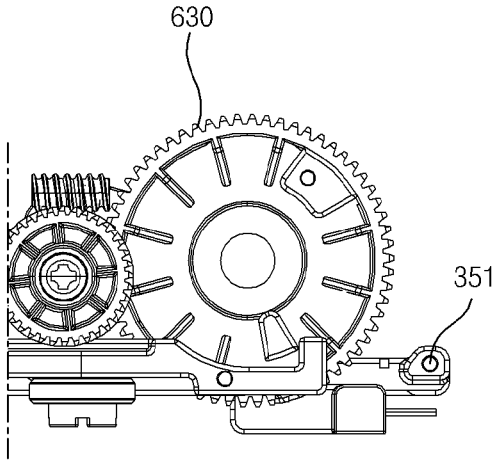

[Fig. 40]
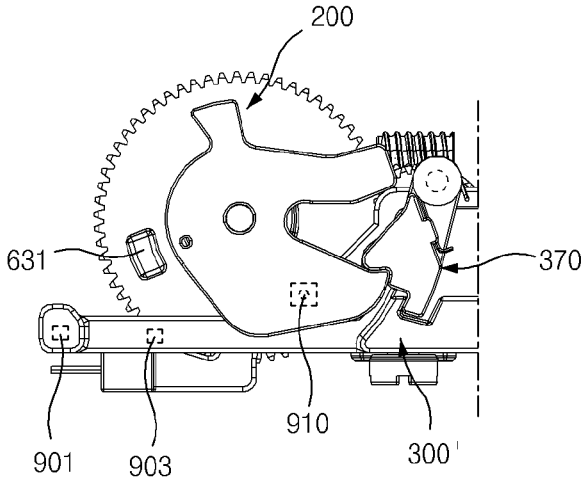
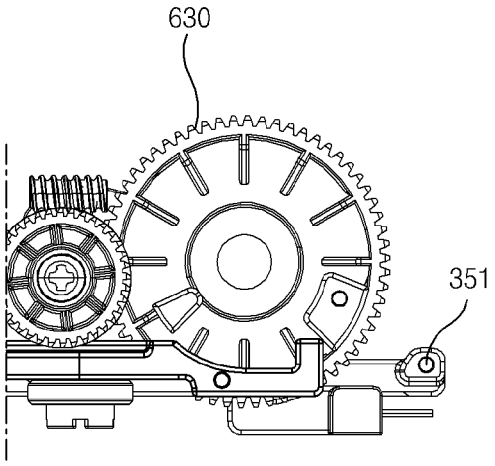

[Fig. 41]
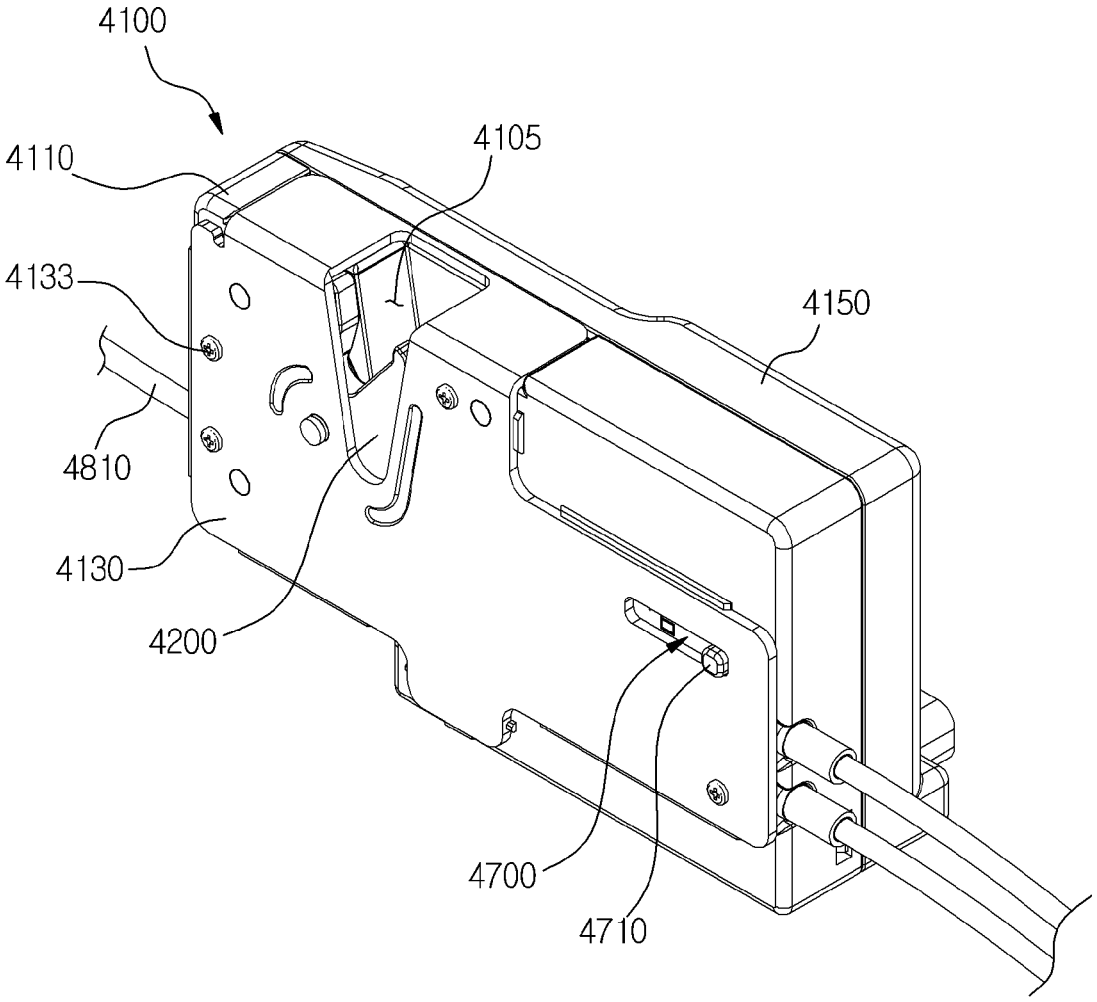

[Fig. 42]
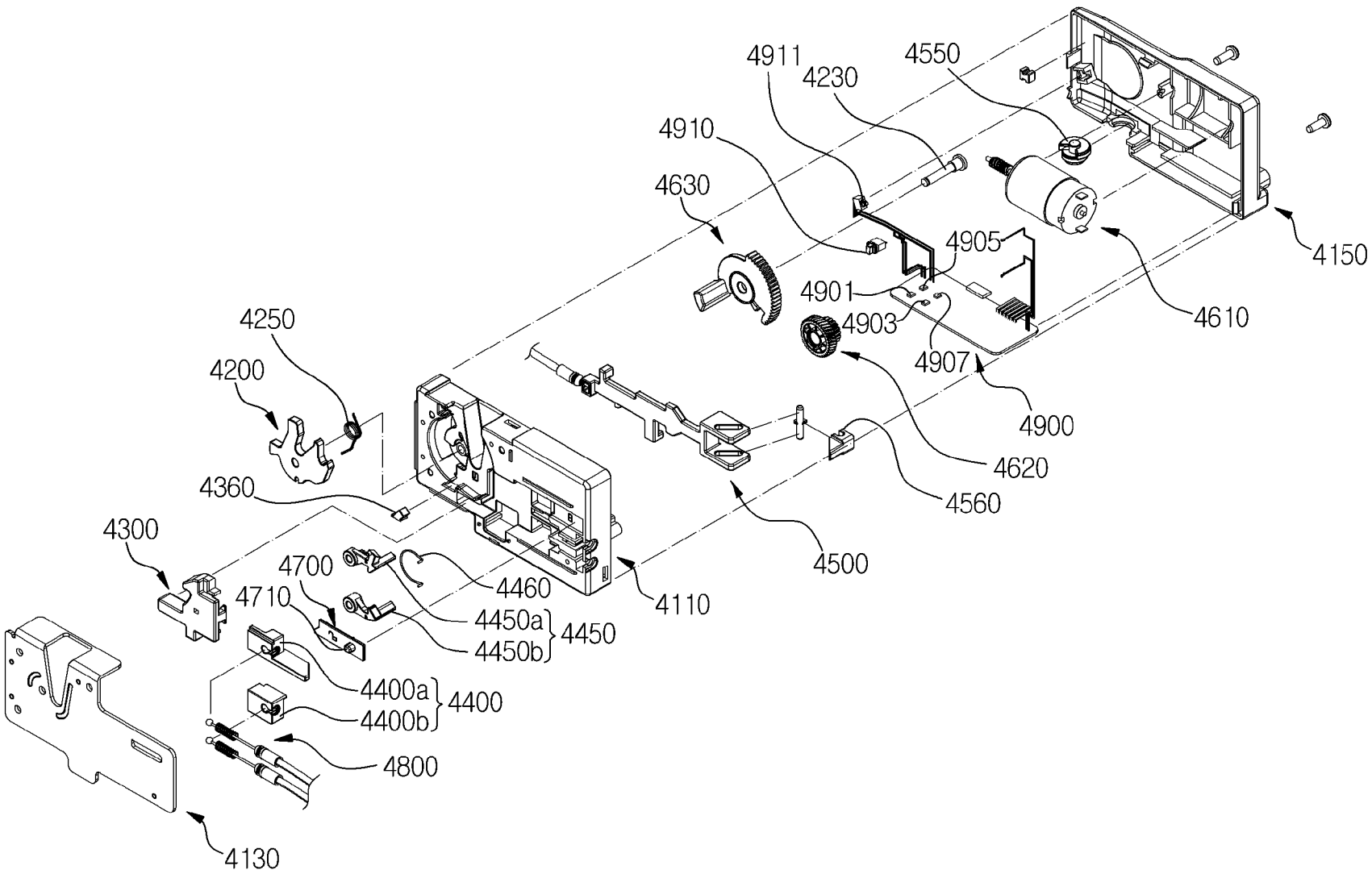

[Fig. 43]
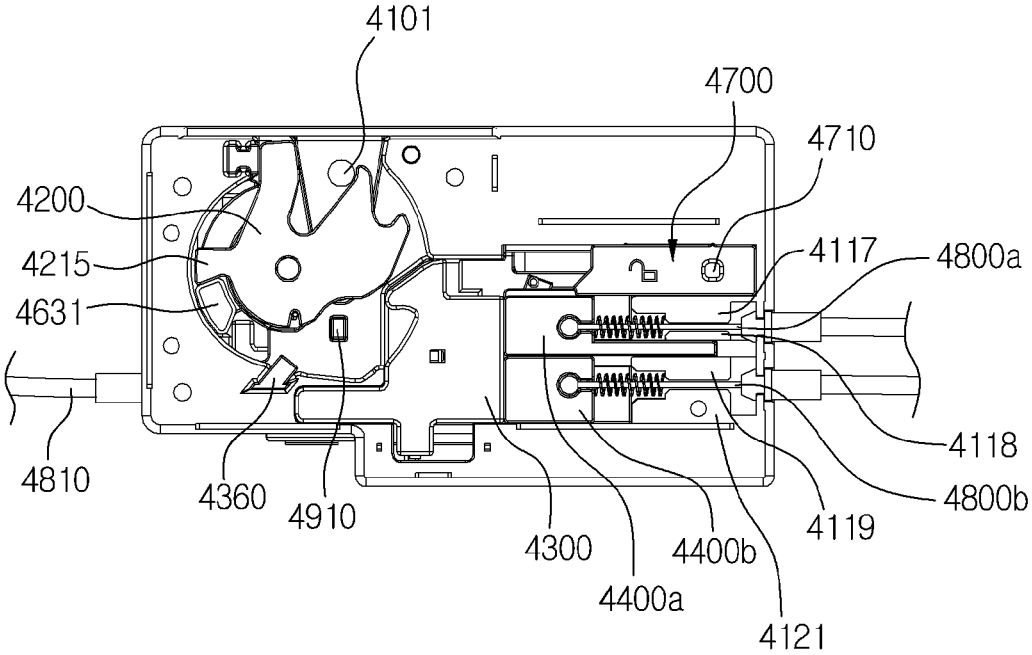
[Fig. 44]
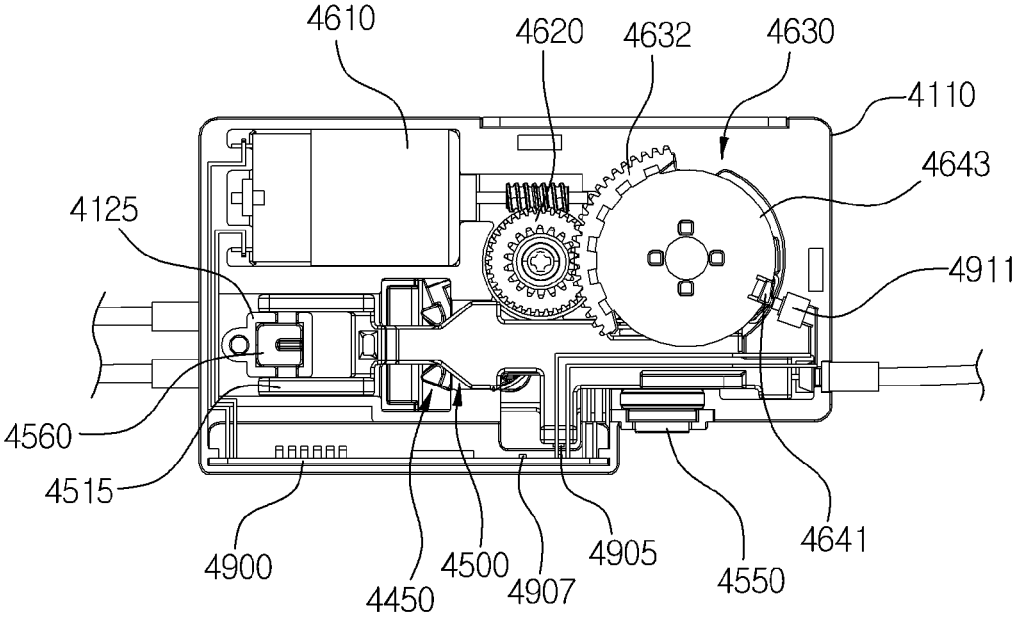

[Fig. 45]
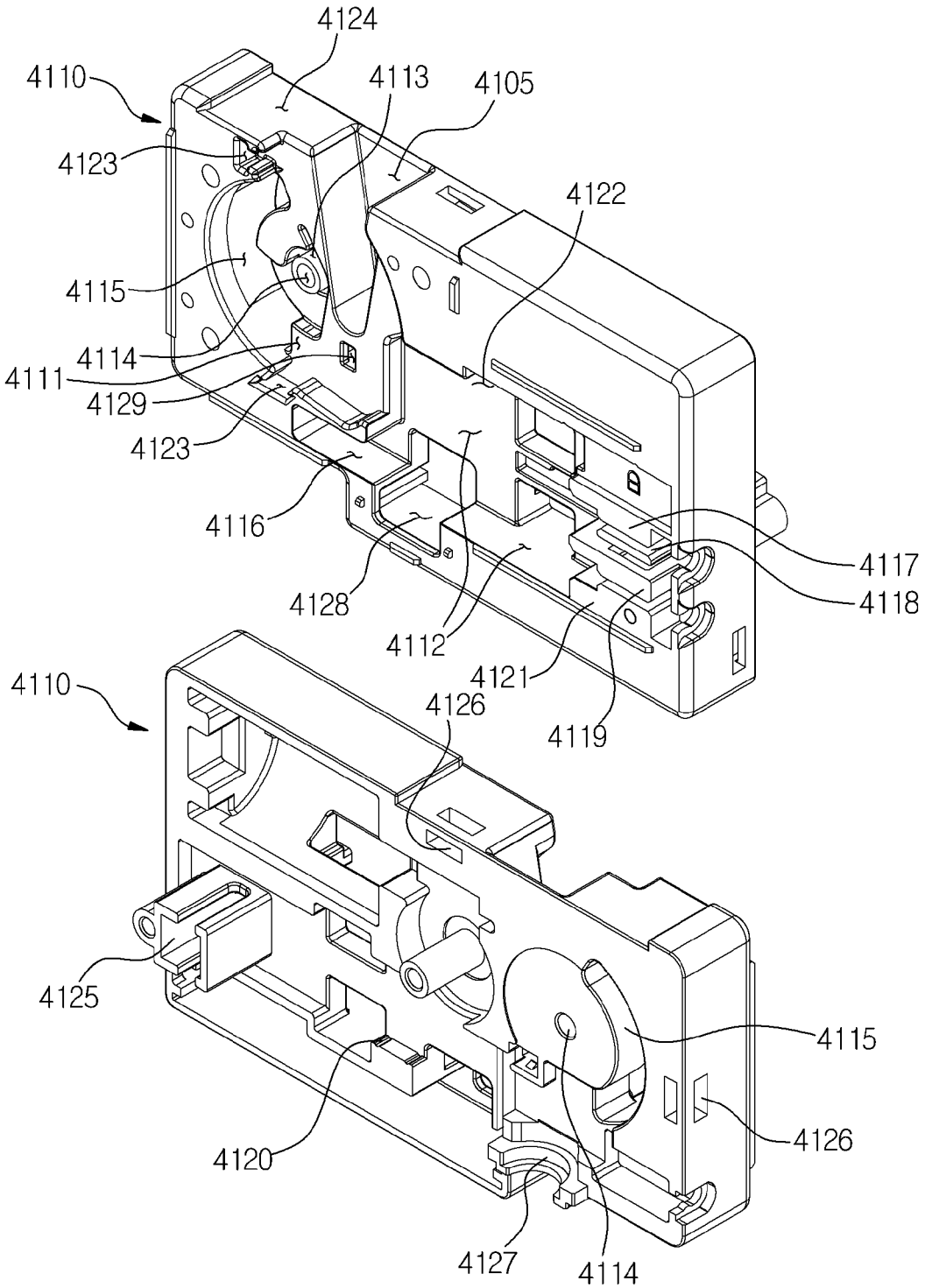

[Fig. 46]
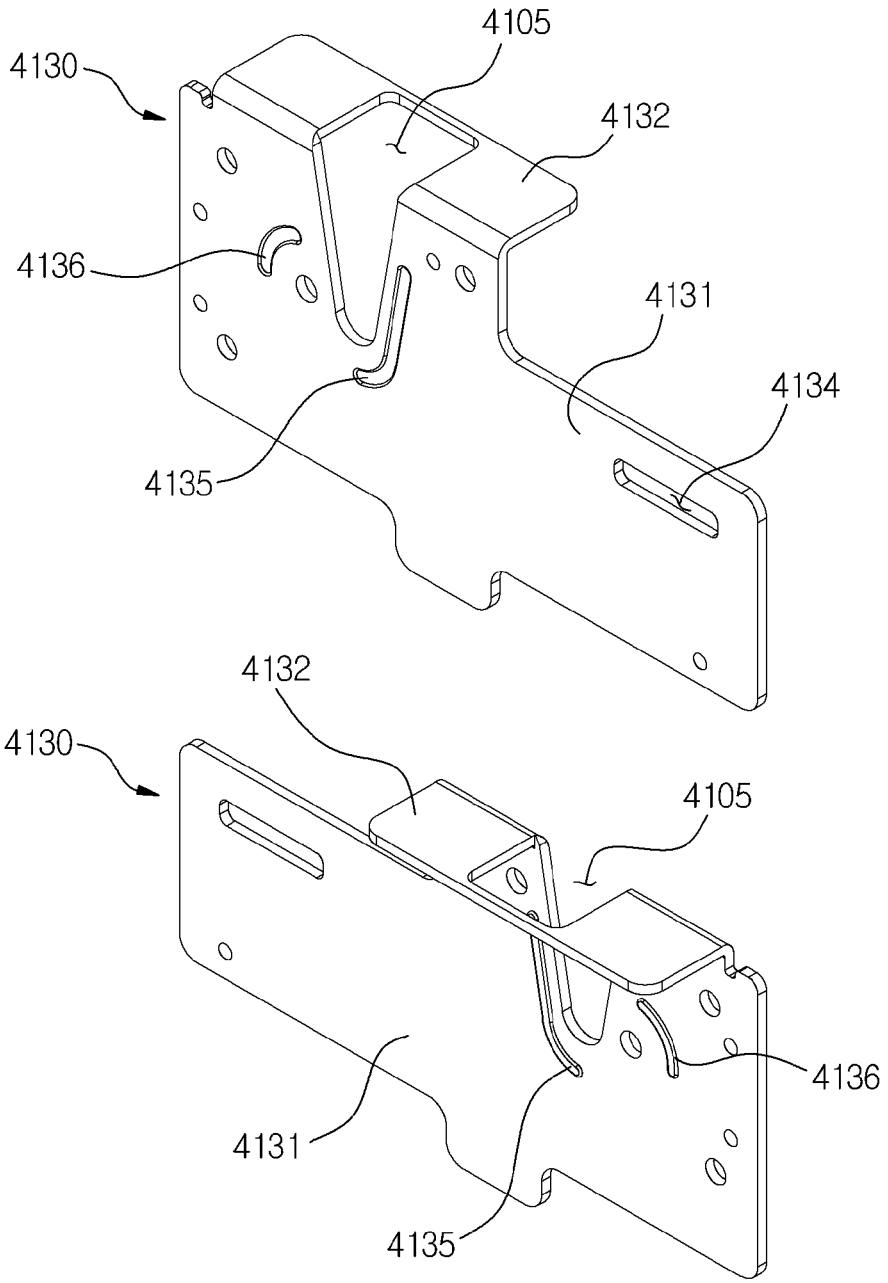

[Fig. 47]
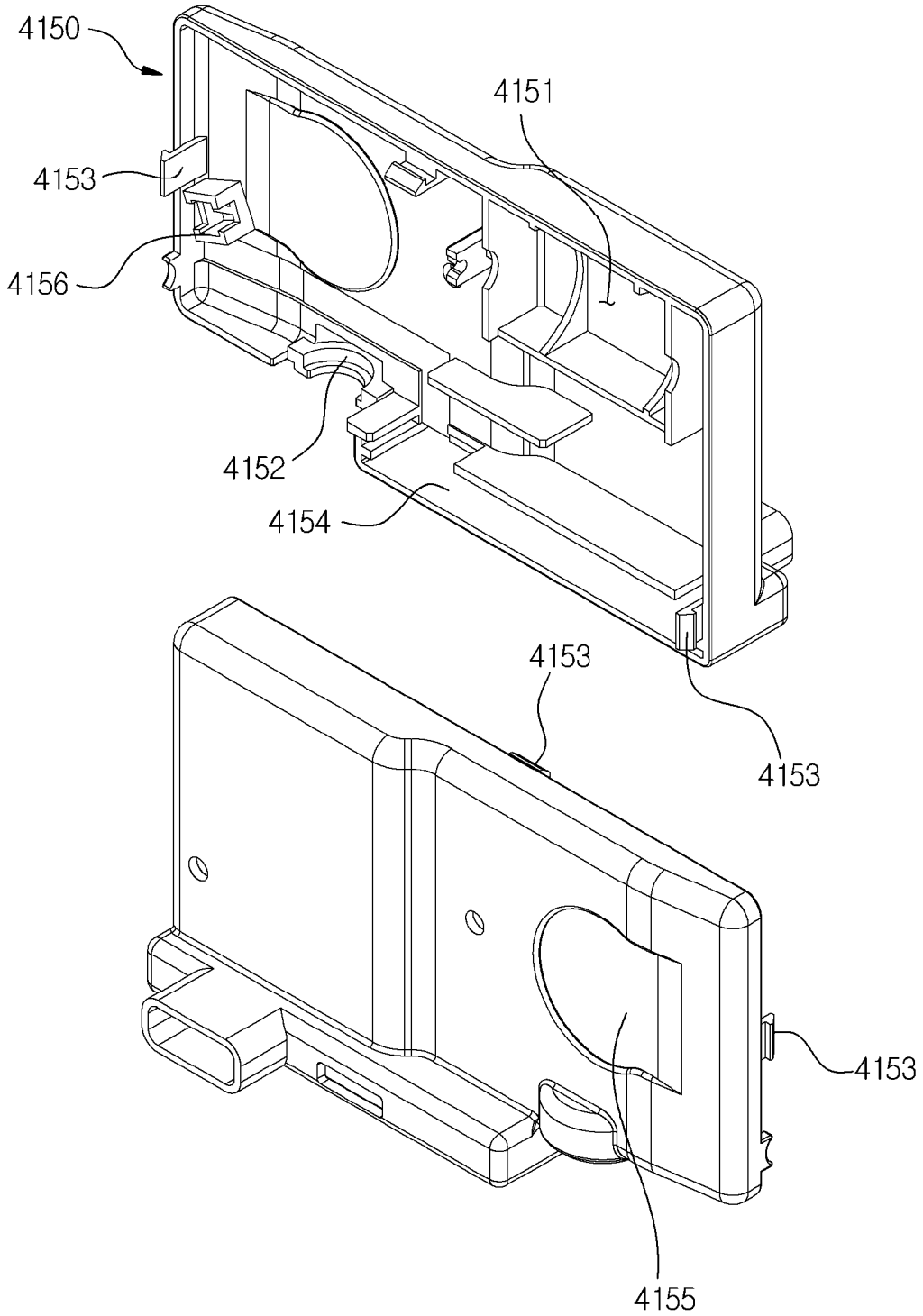

[Fig. 48]
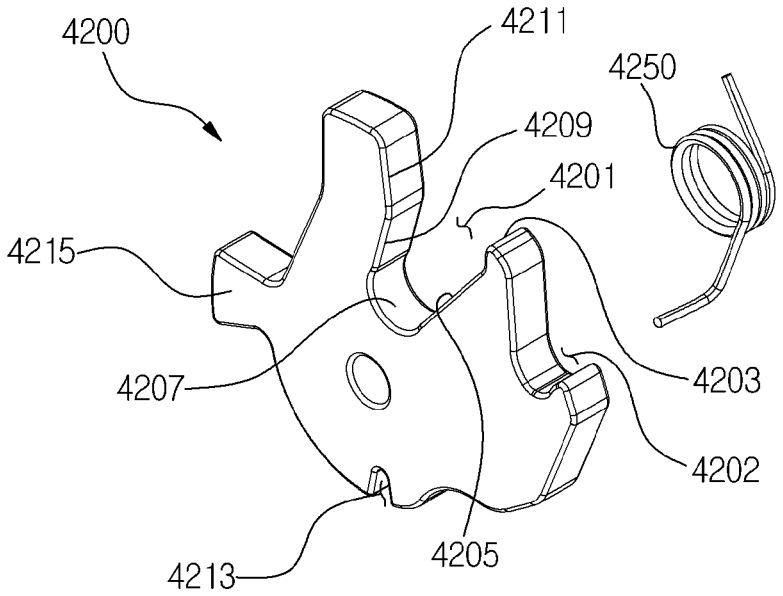
[Fig. 49]
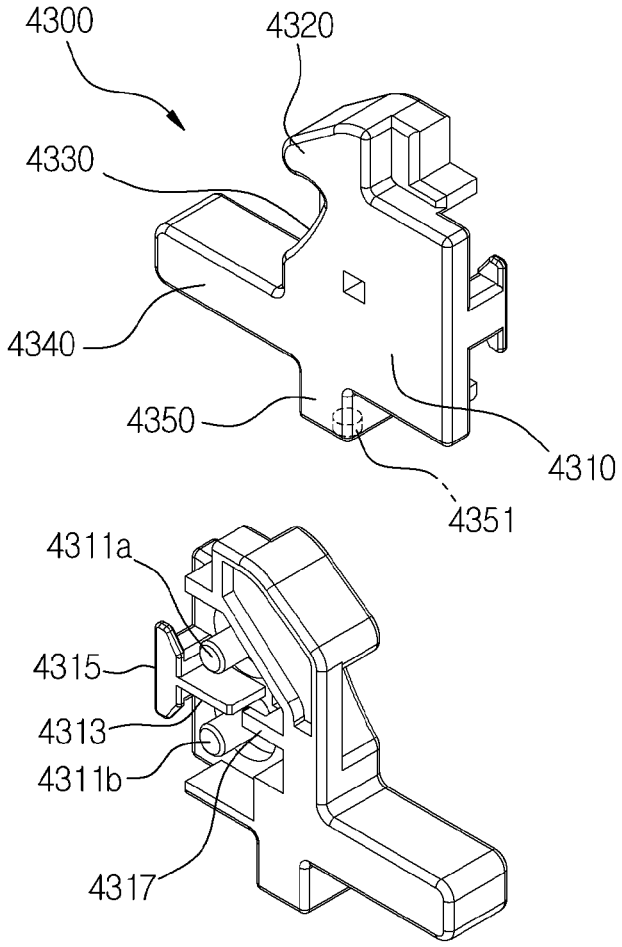

[Fig. 50]
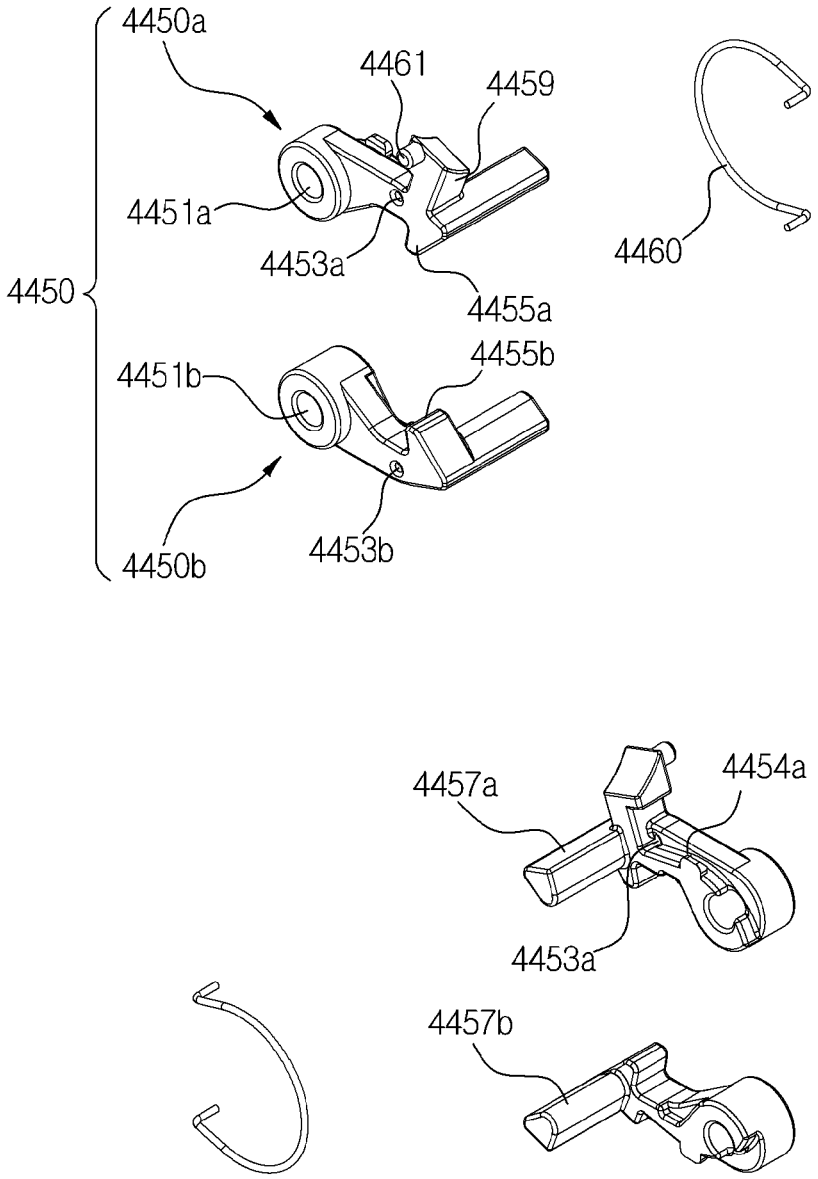

[Fig. 51]
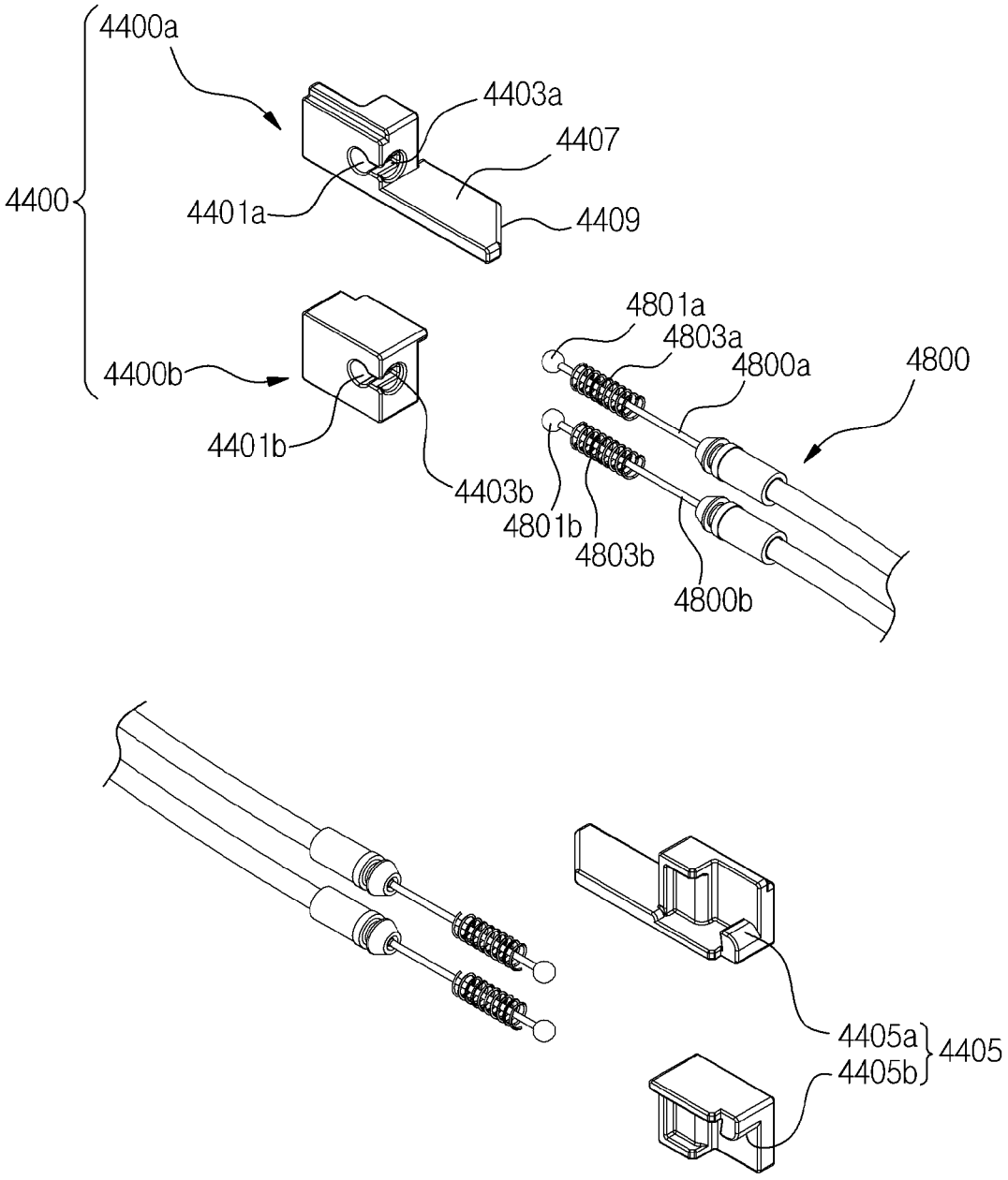

[Fig. 52]
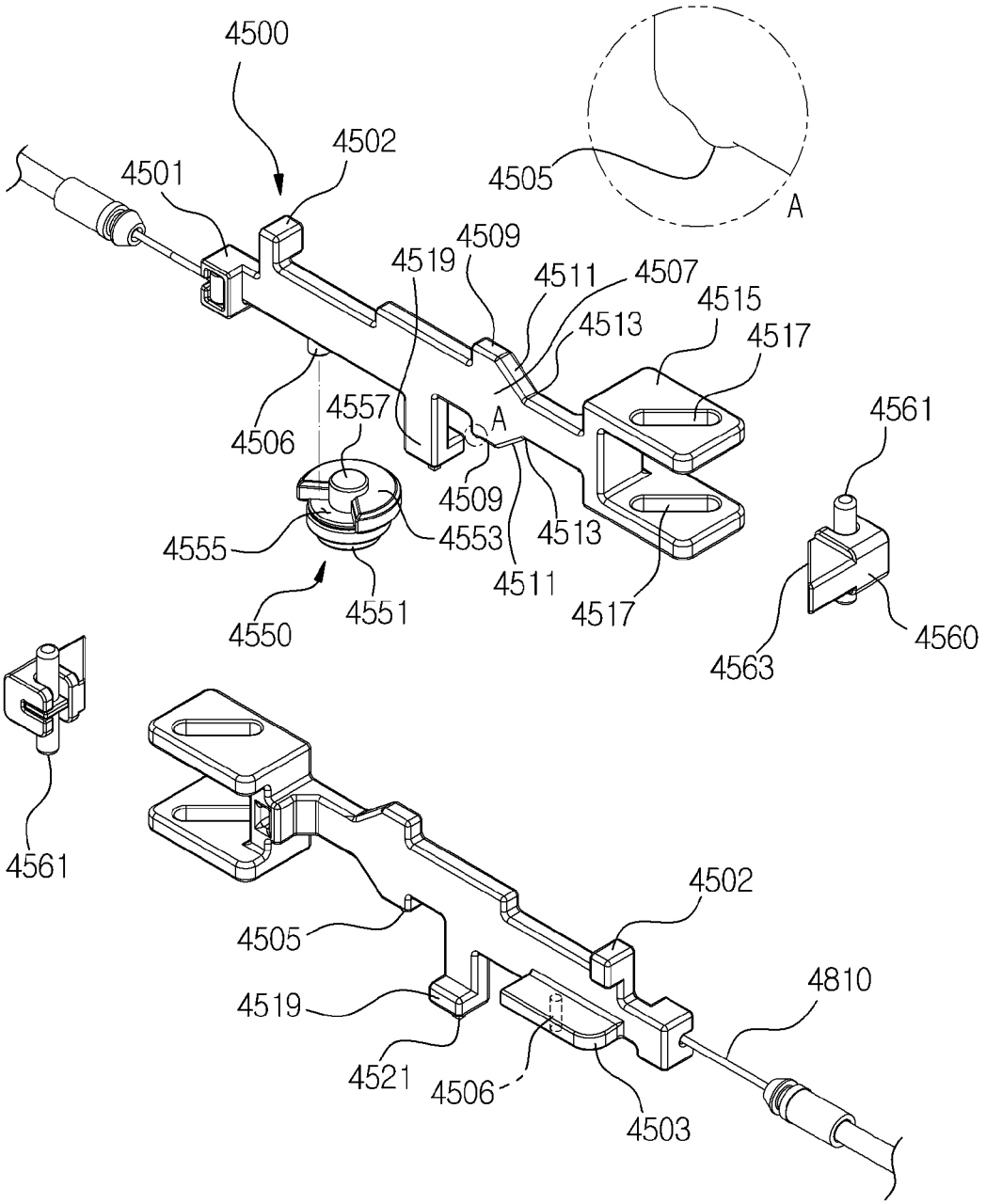

[Fig. 53]
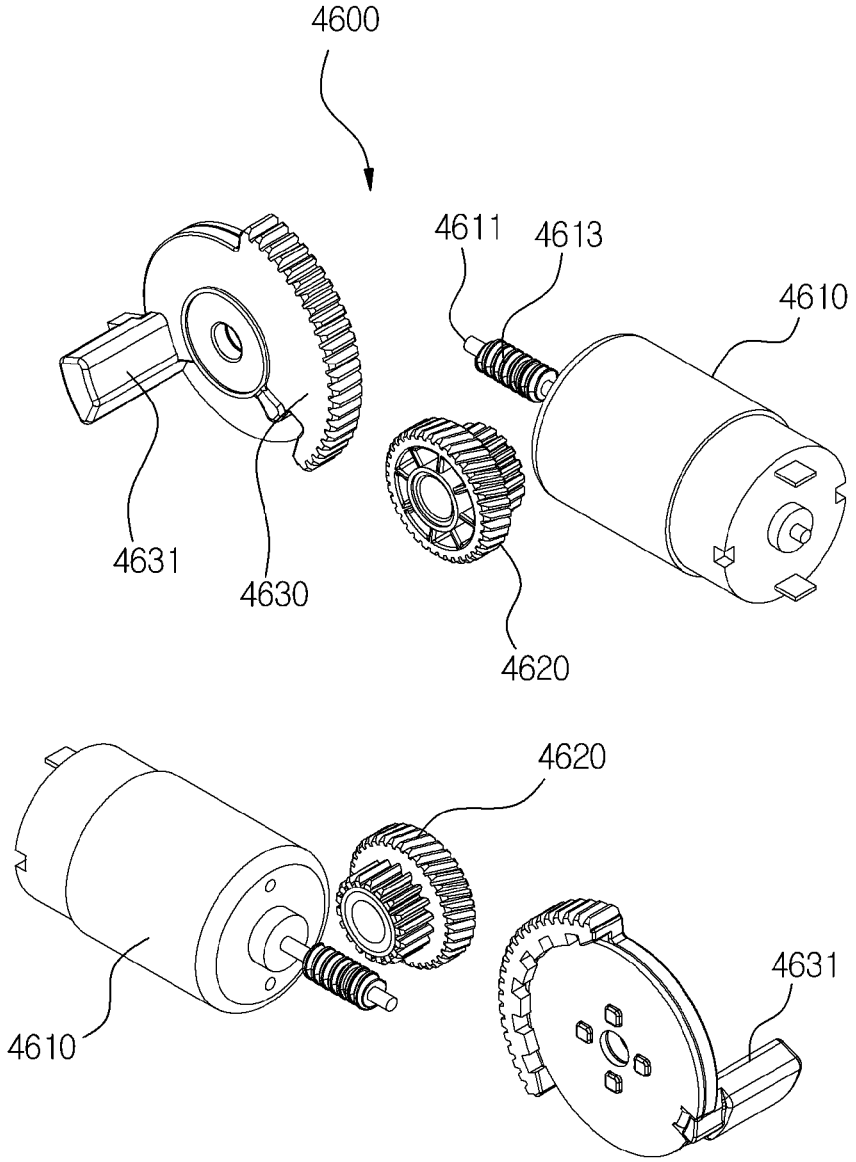

[Fig. 54]
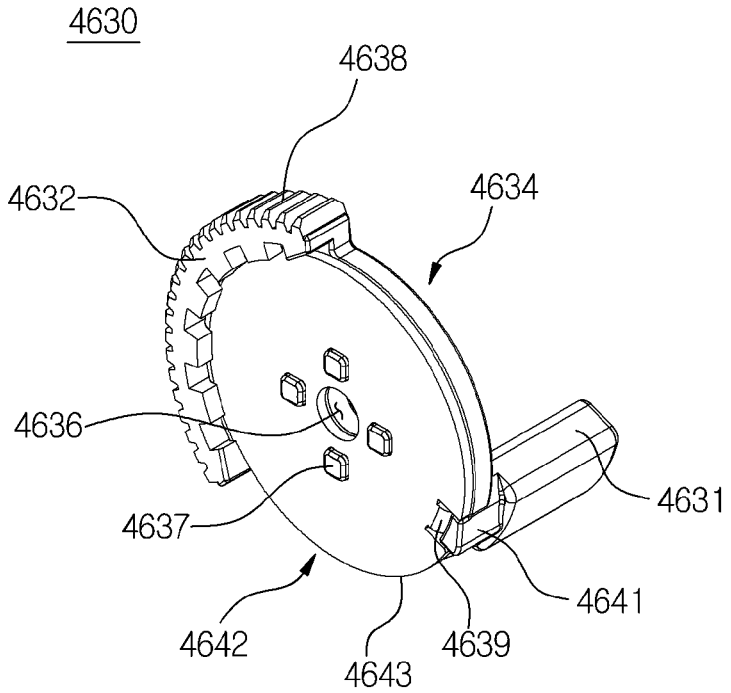
[Fig. 55]
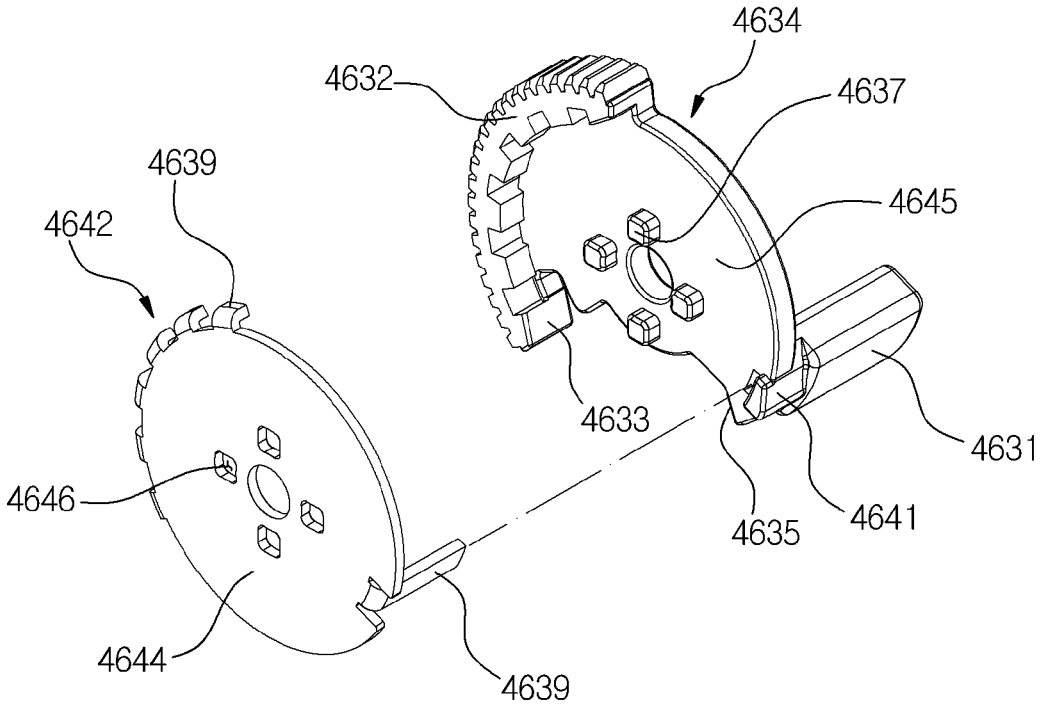

[Fig. 56]
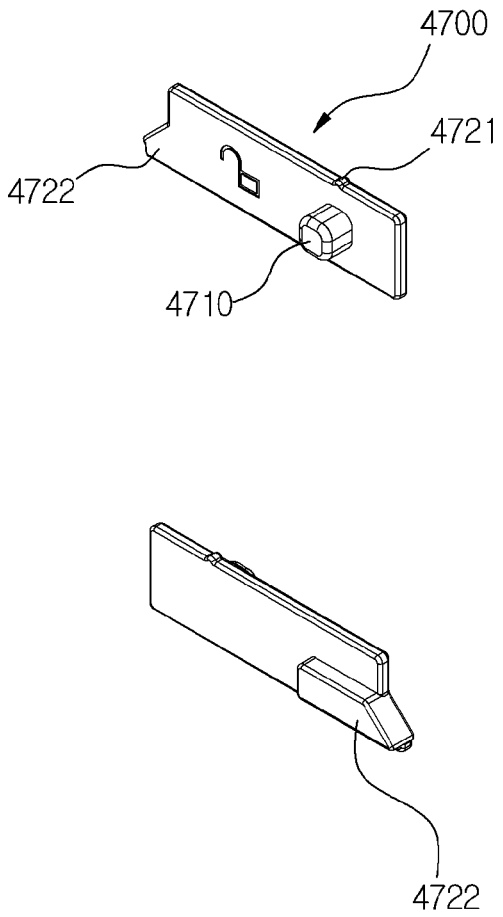
[Fig. 57]
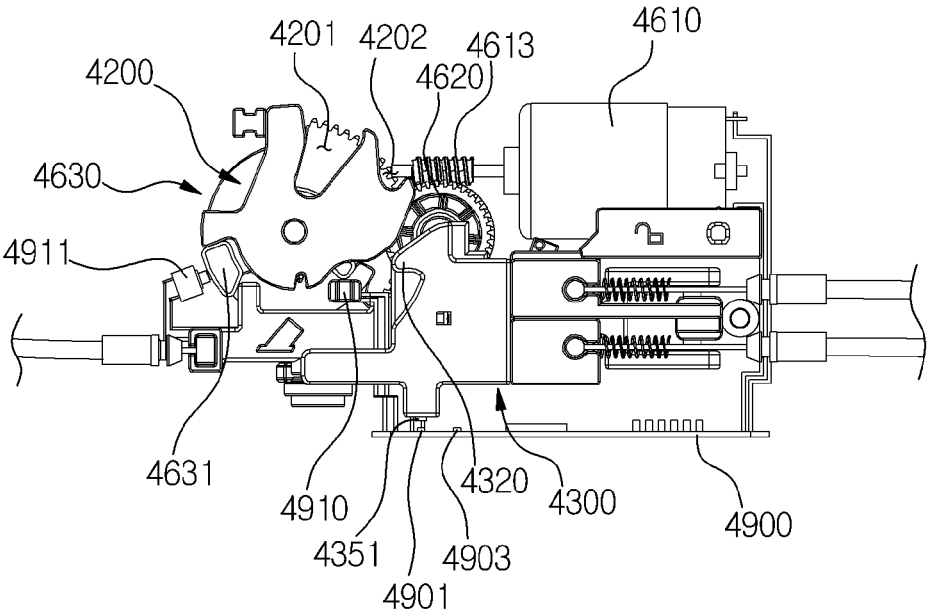

[Fig. 58]
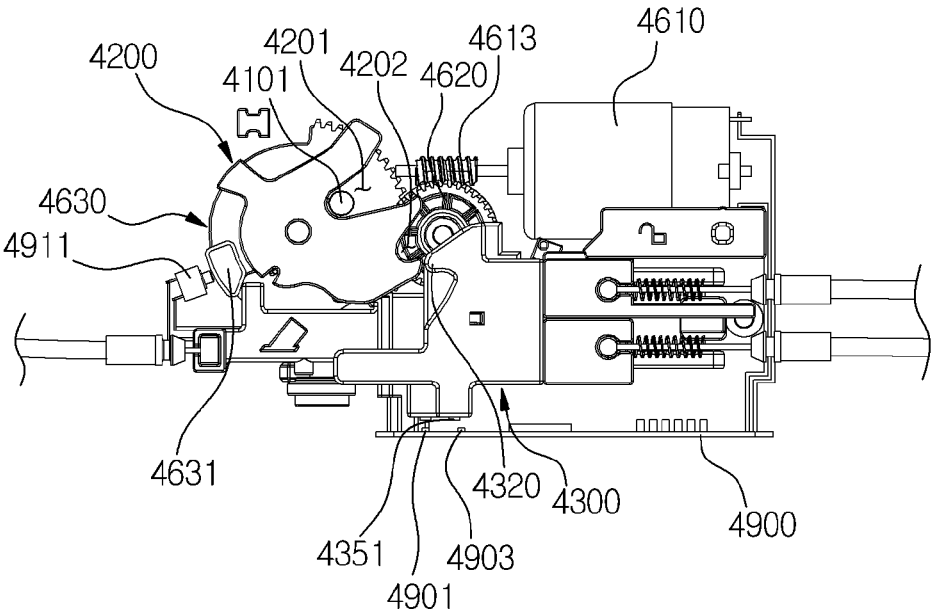
[Fig. 59]
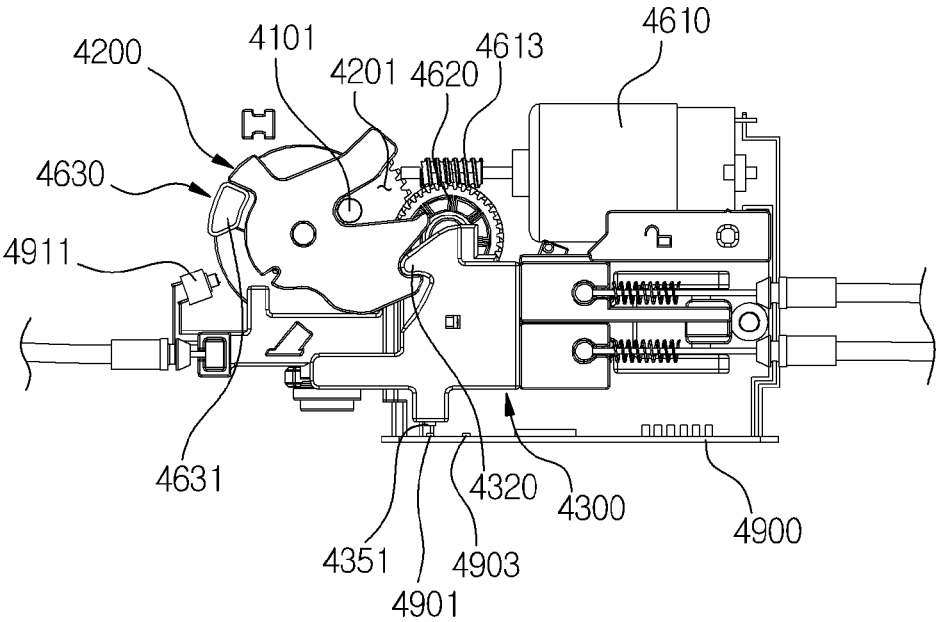

[Fig. 60]
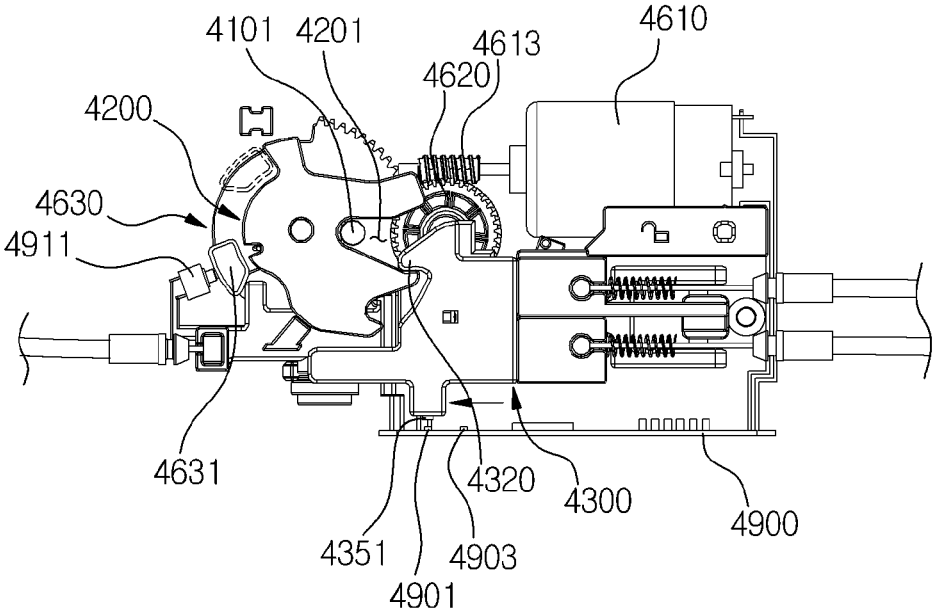

[Fig. 61]
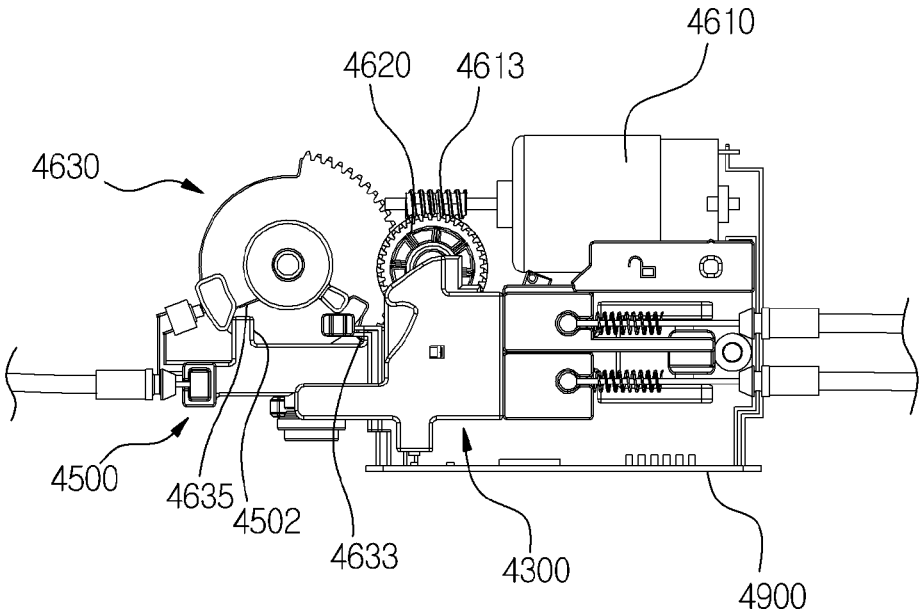
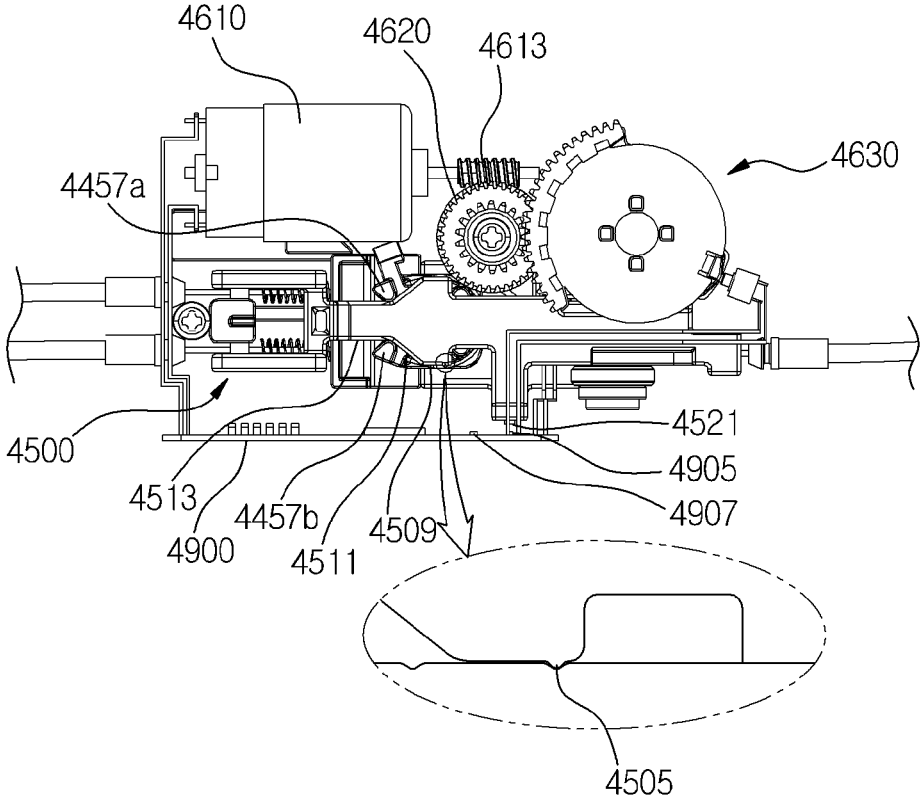

[Fig. 62]
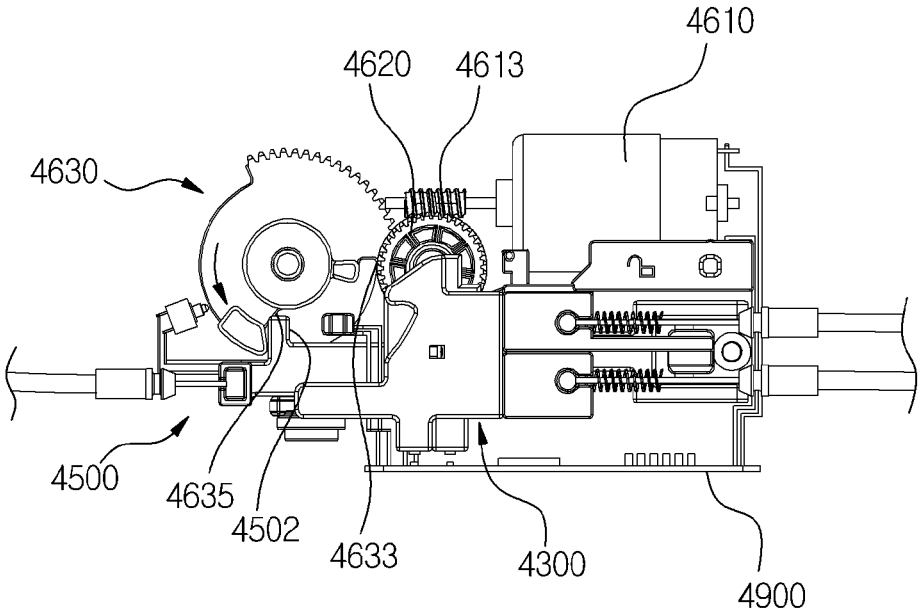
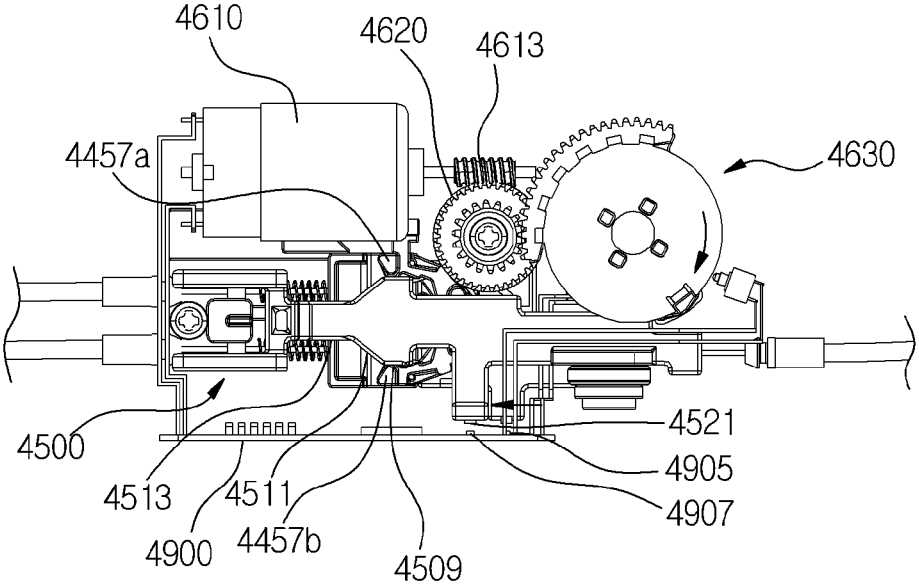

[Fig. 63]
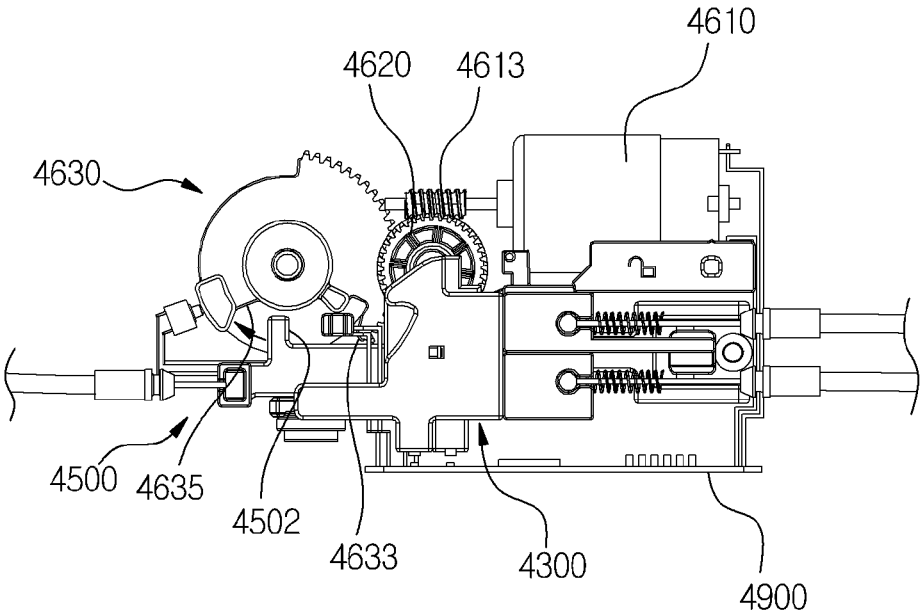
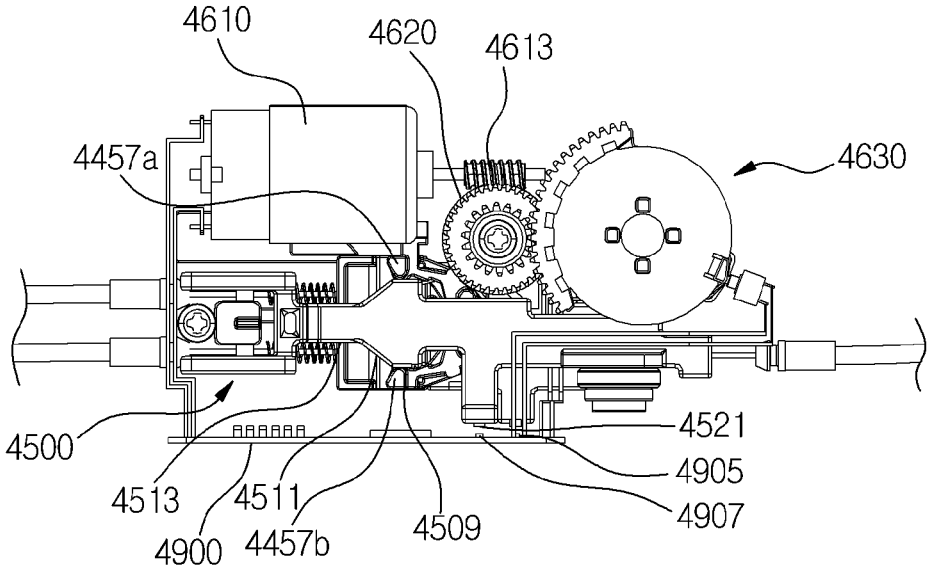

[Fig. 64]
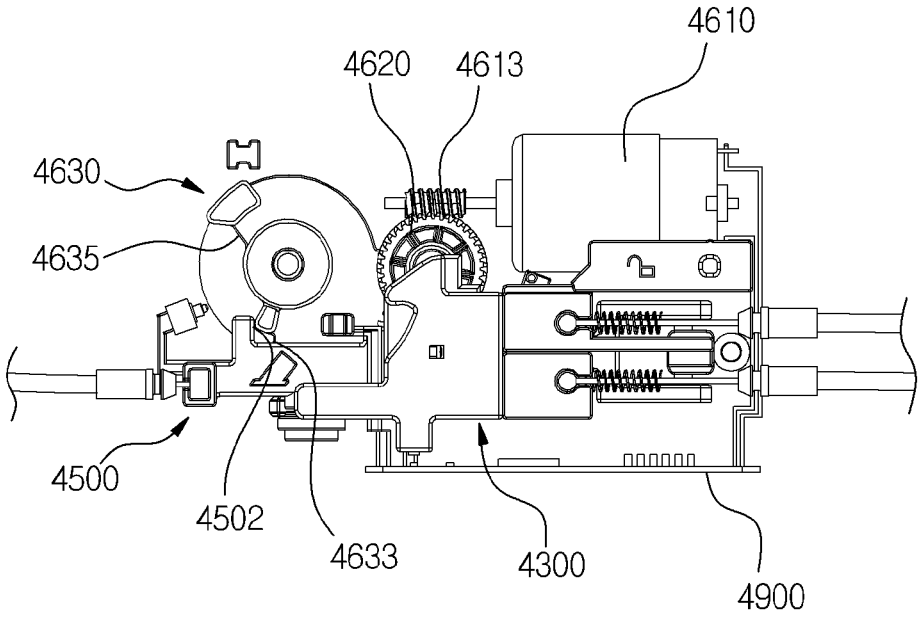
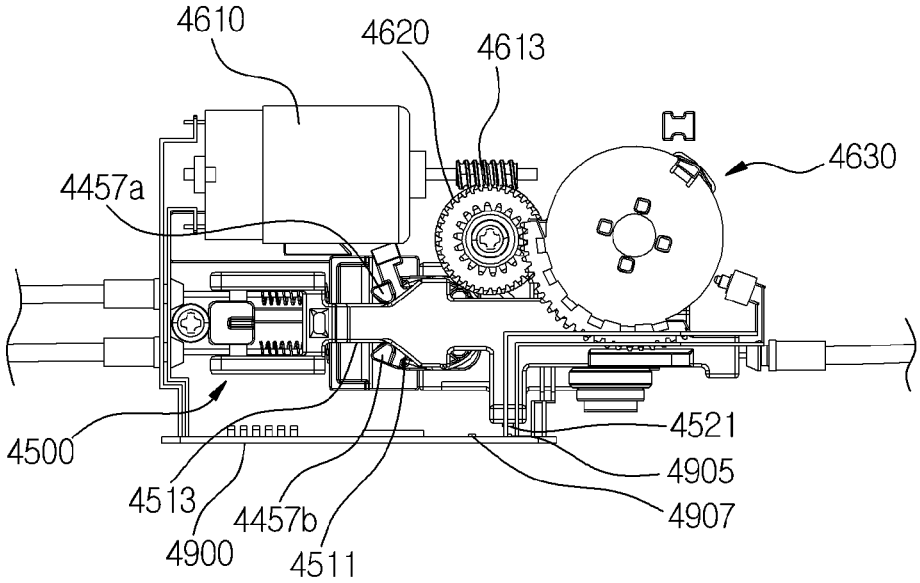

[Fig. 65]
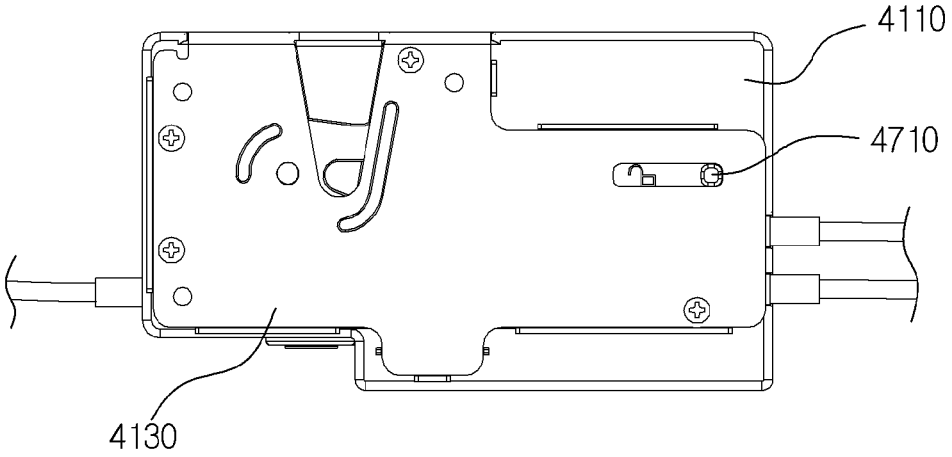
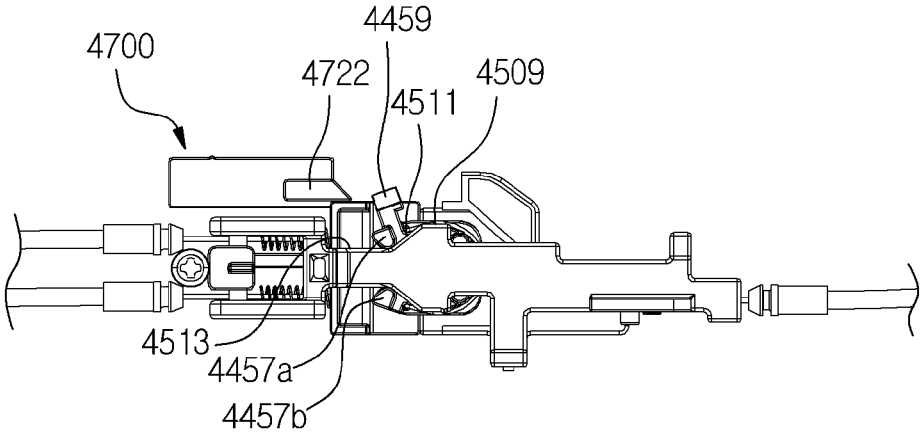

[Fig. 66]
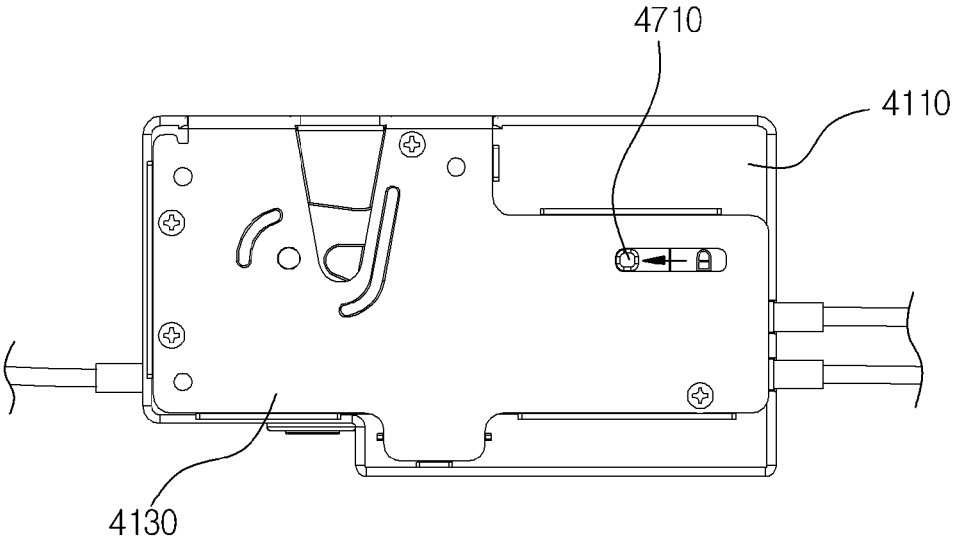
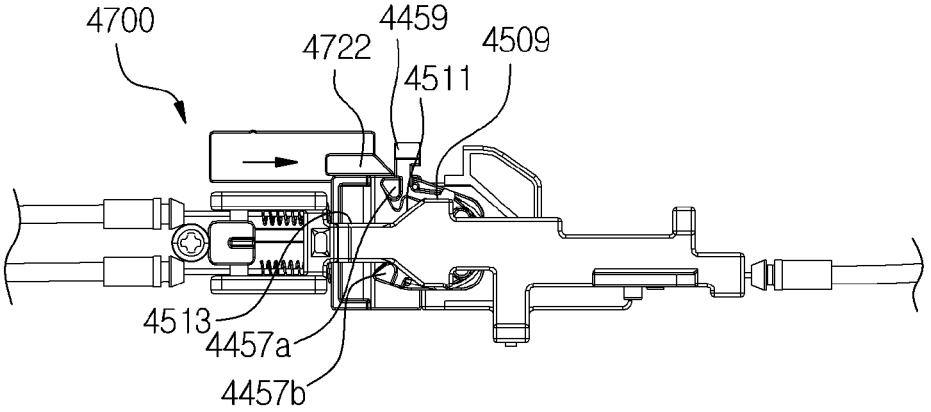

[Fig. 67]
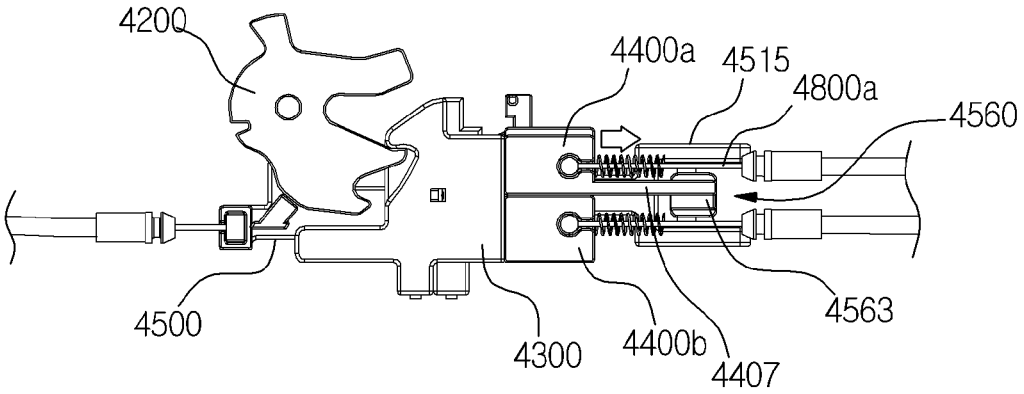
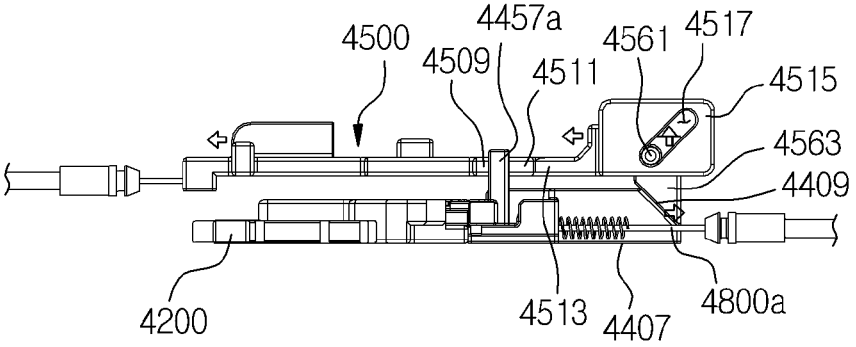

[Fig. 68]
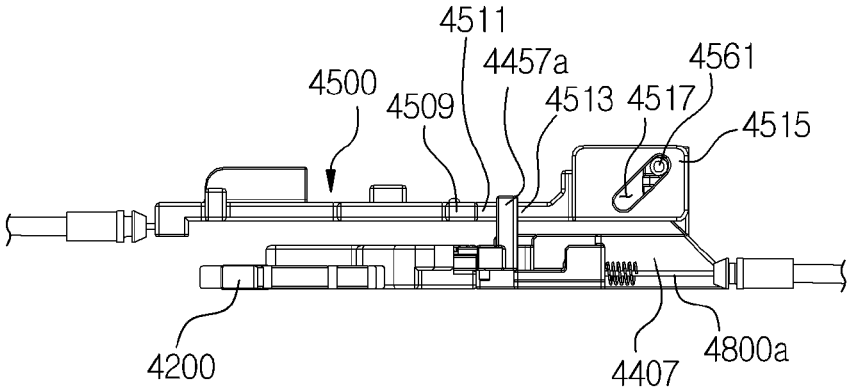
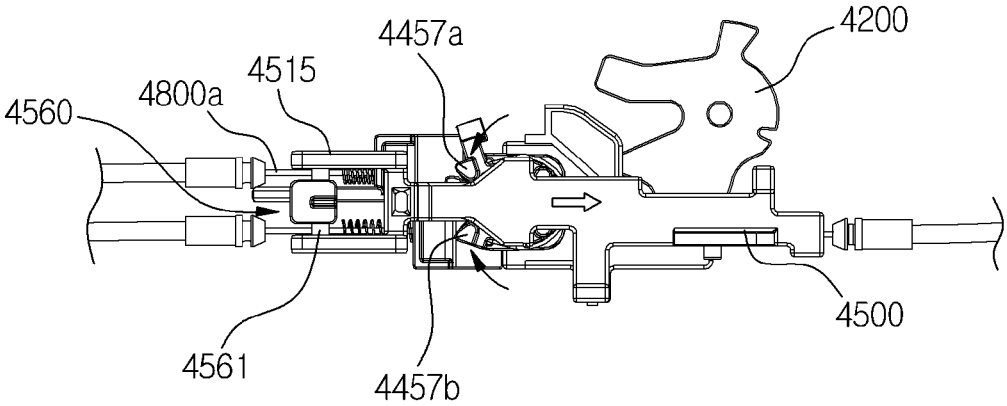

[Fig. 69]
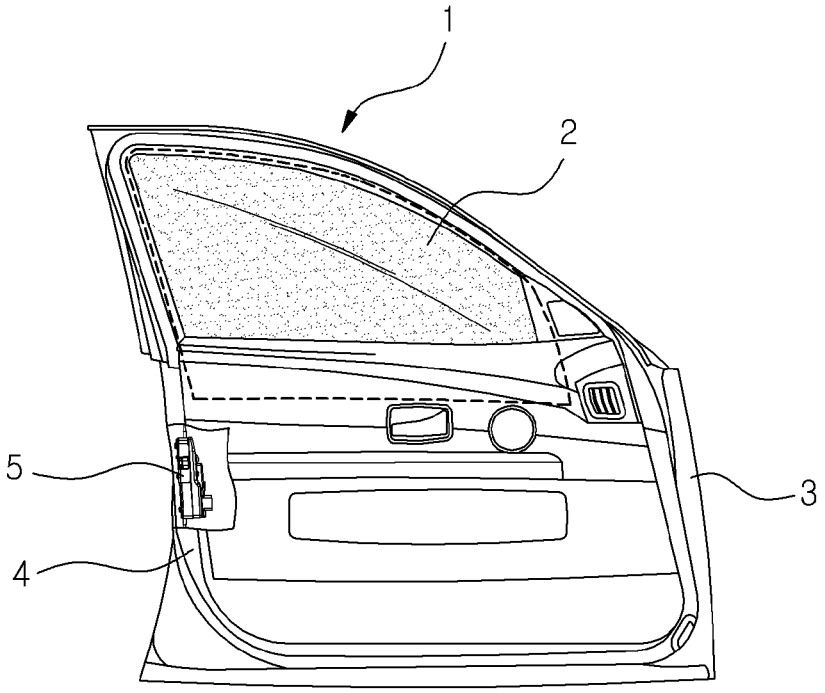
(a)
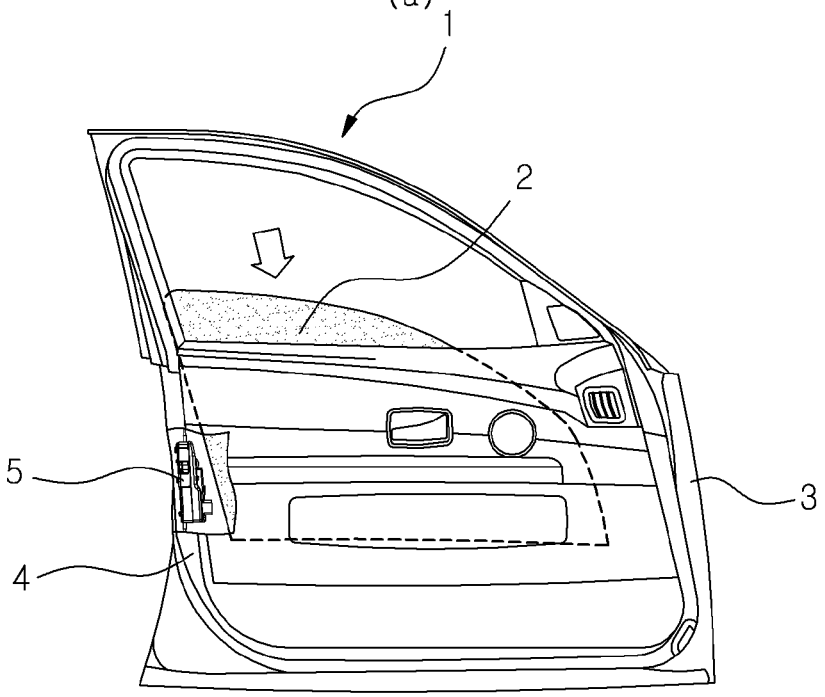
(b)

[Fig. 70]
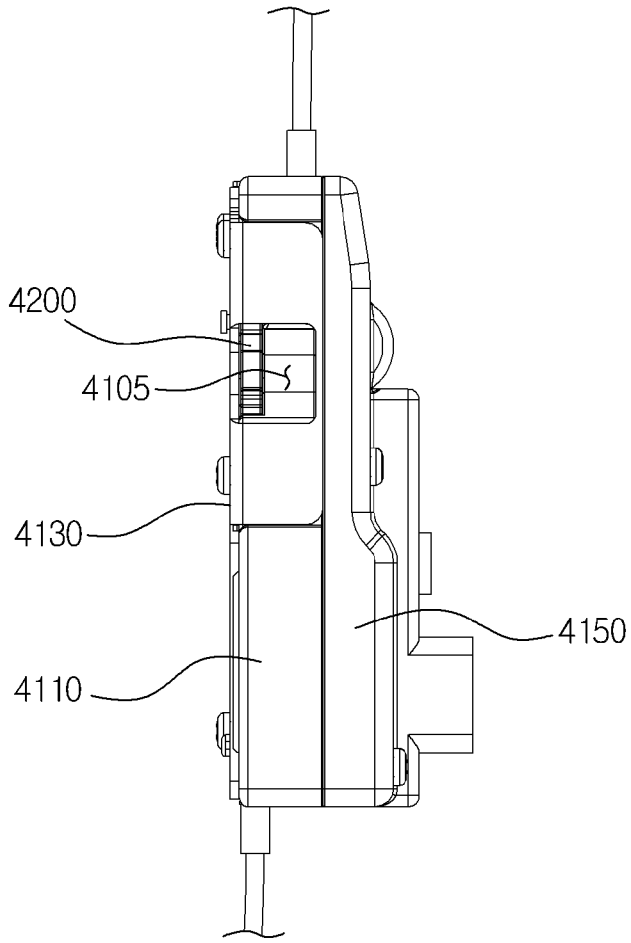

[Fig. 71]
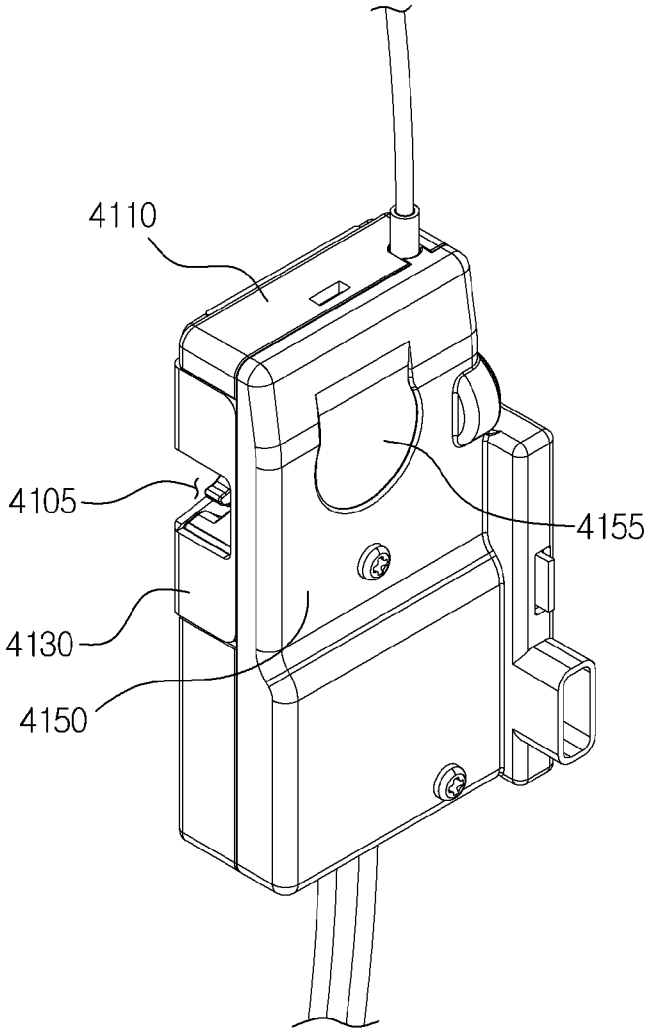

[Fig. 72]
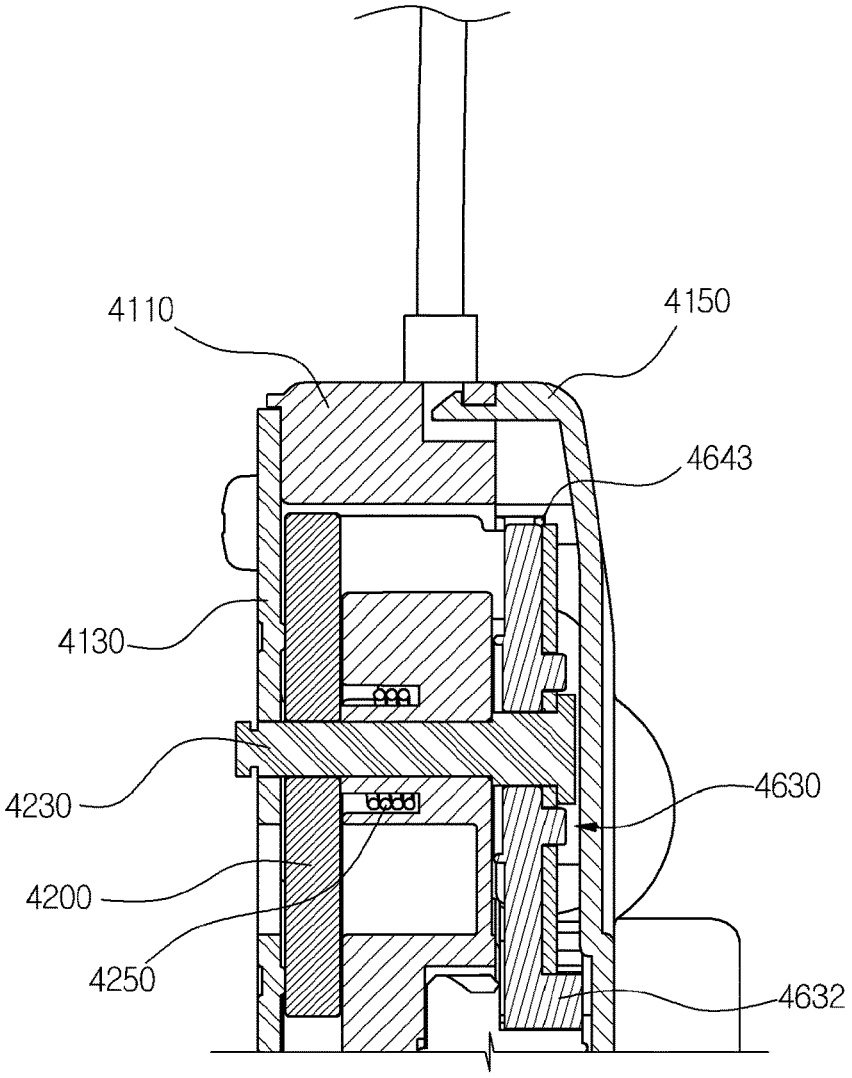
[Fig. 73]
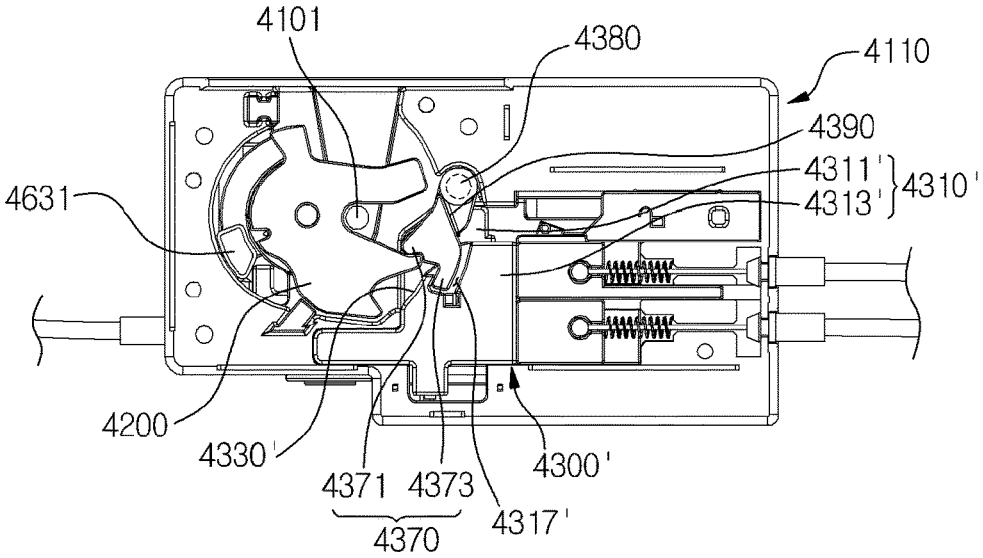

[Fig. 74]
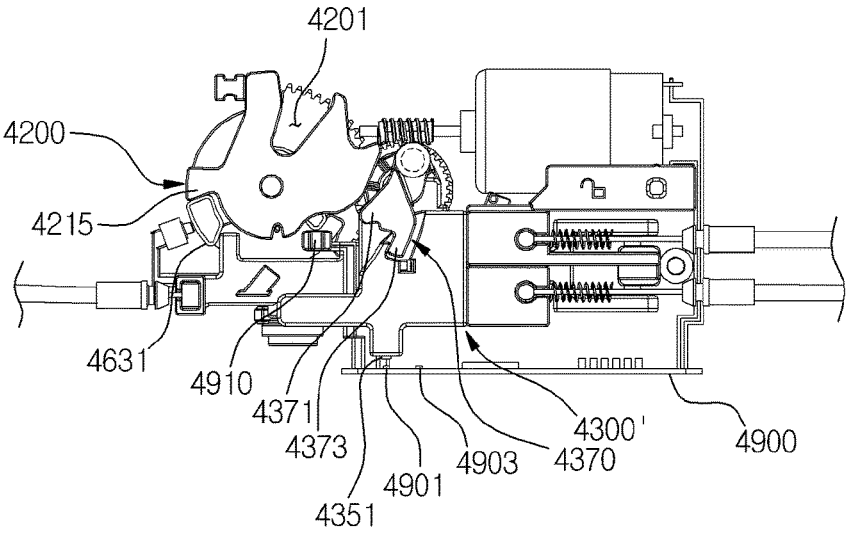
[Fig. 75]
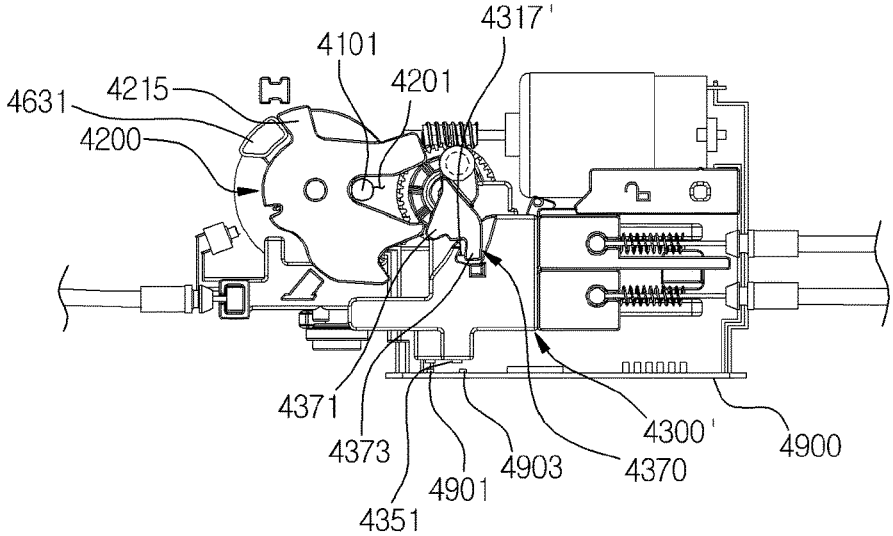
[Fig. 76]
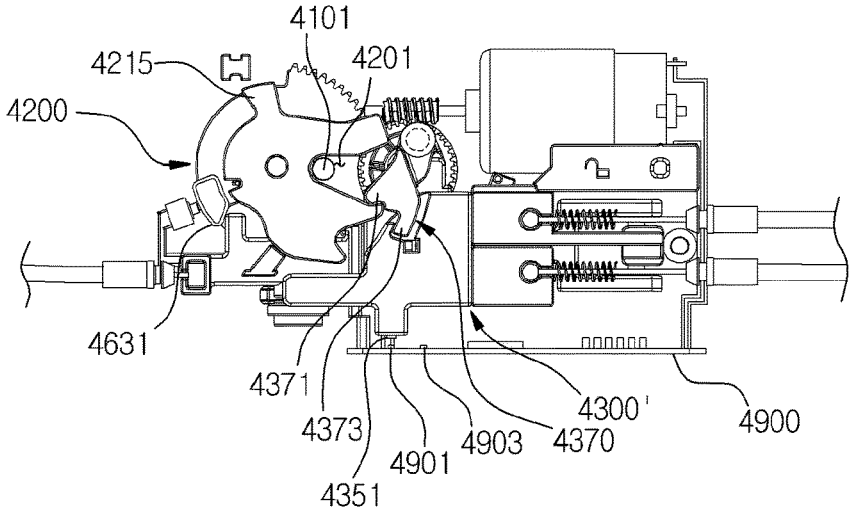

[Fig. 77]
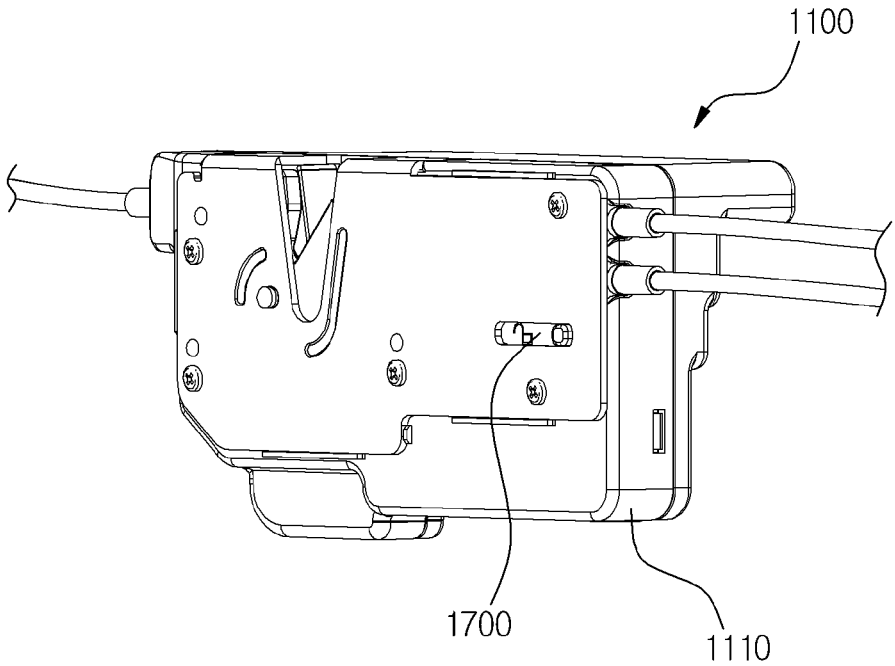
[Fig. 78]
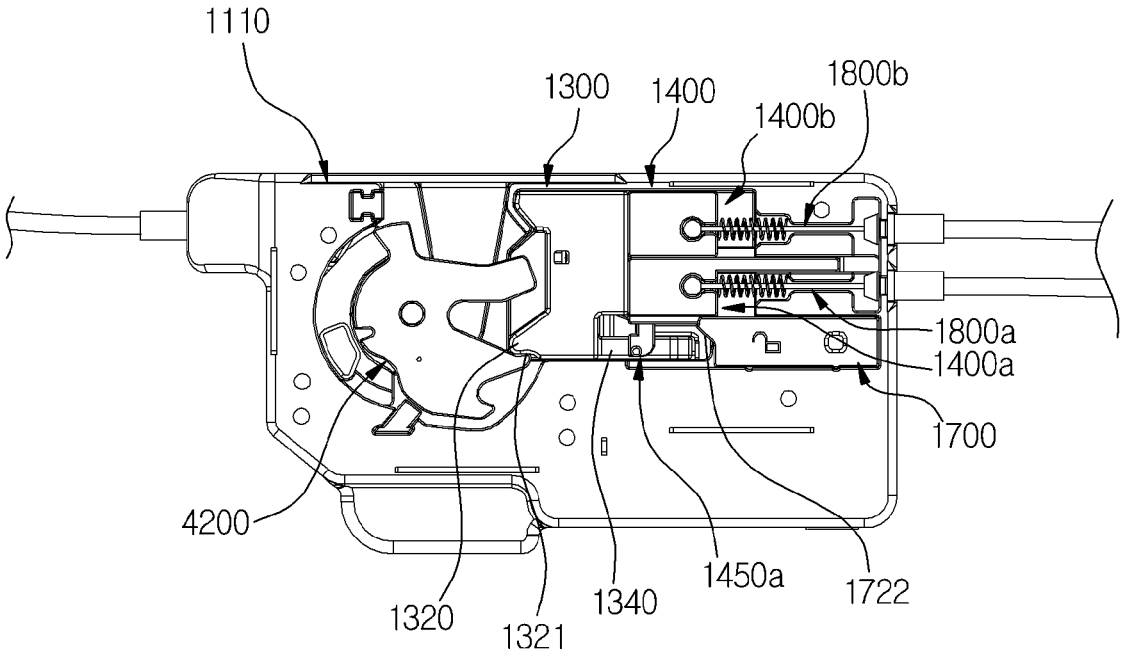

[Fig. 79]
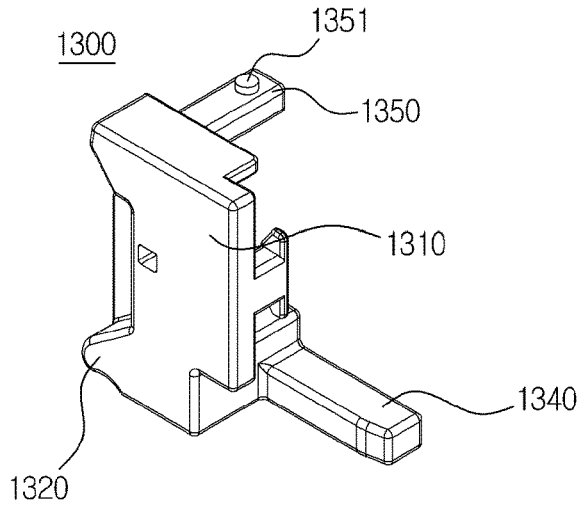
[Fig. 80]
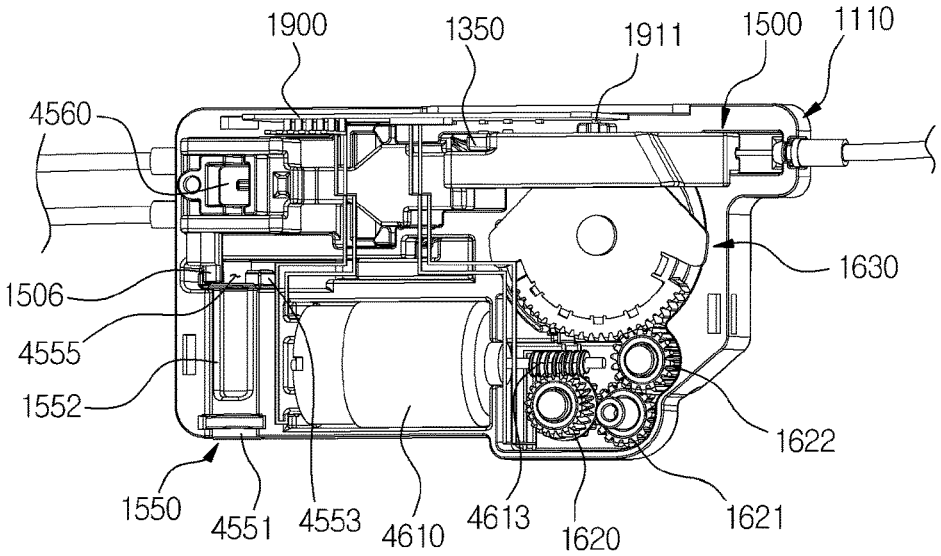
[Fig. 81]
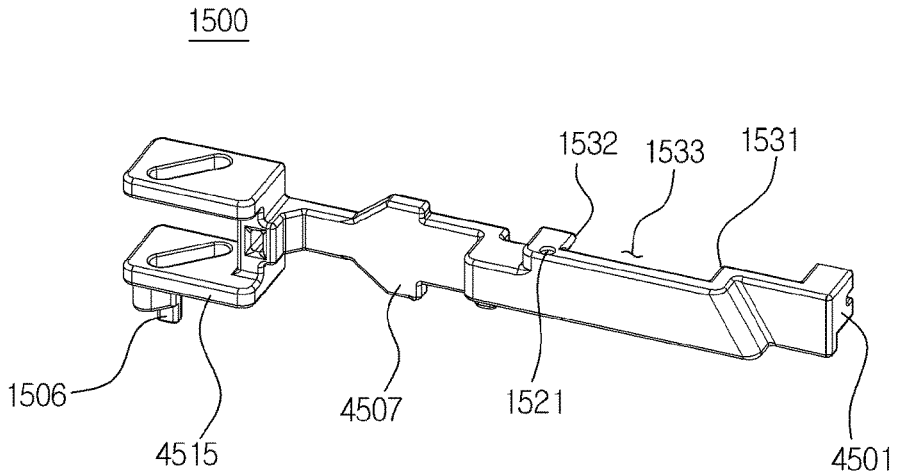

[Fig. 82]
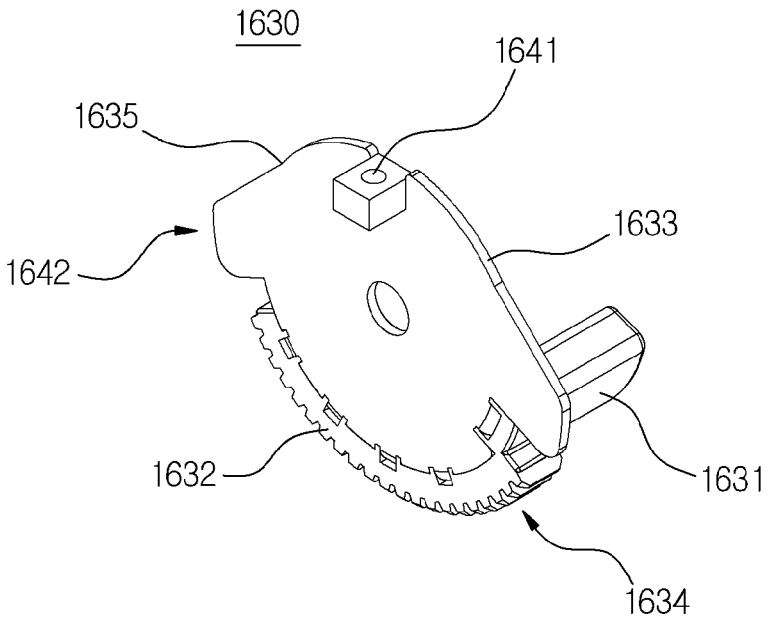
[Fig. 83]
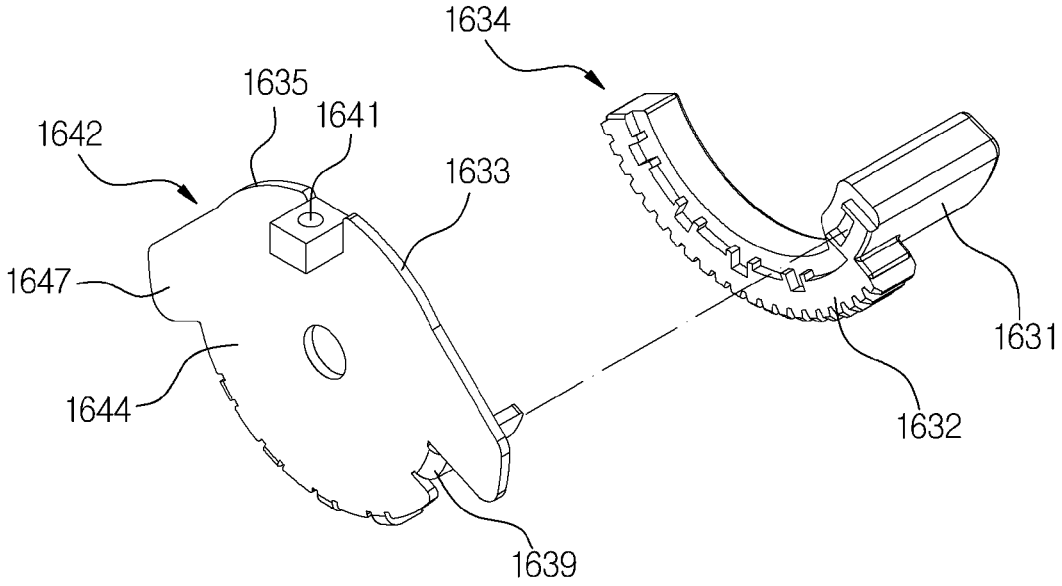

[Fig. 84]
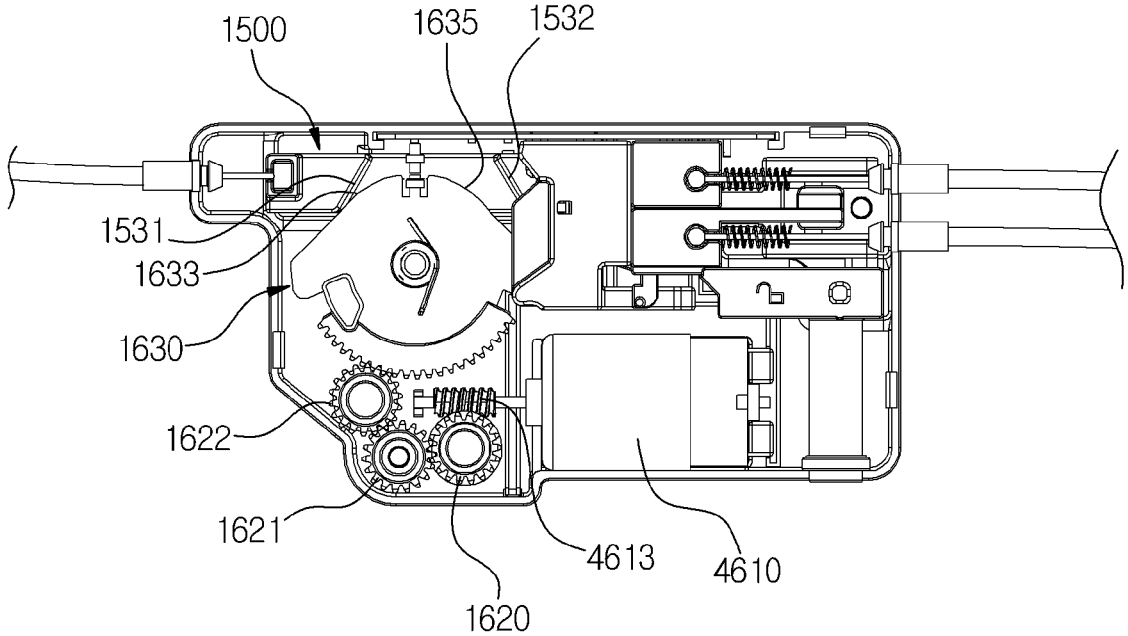
[Fig. 85]
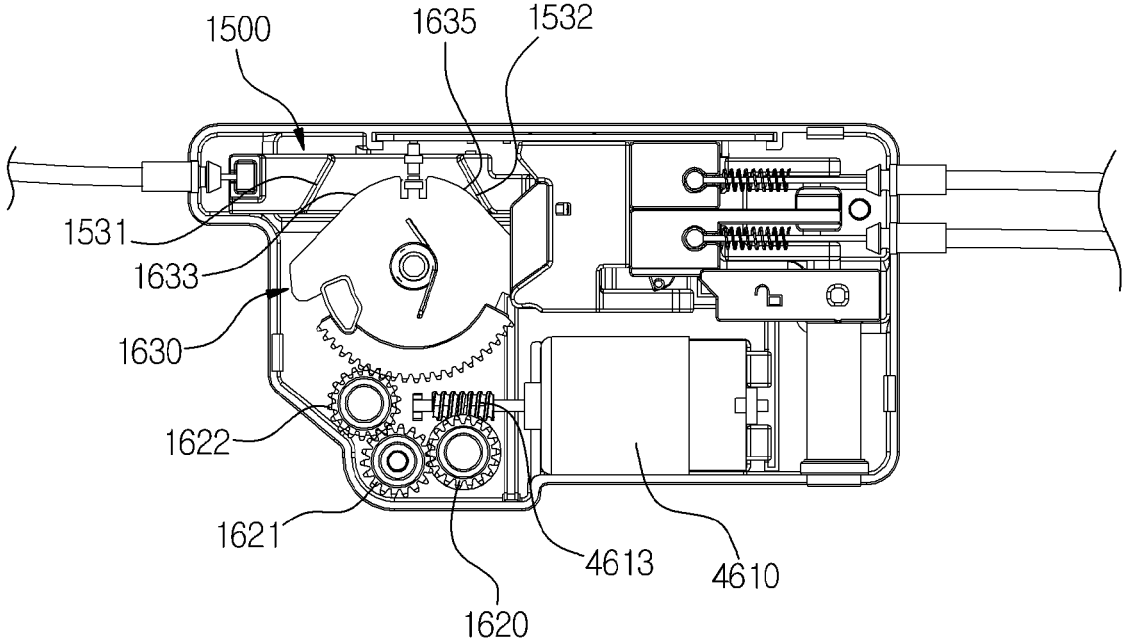

[Fig. 86]
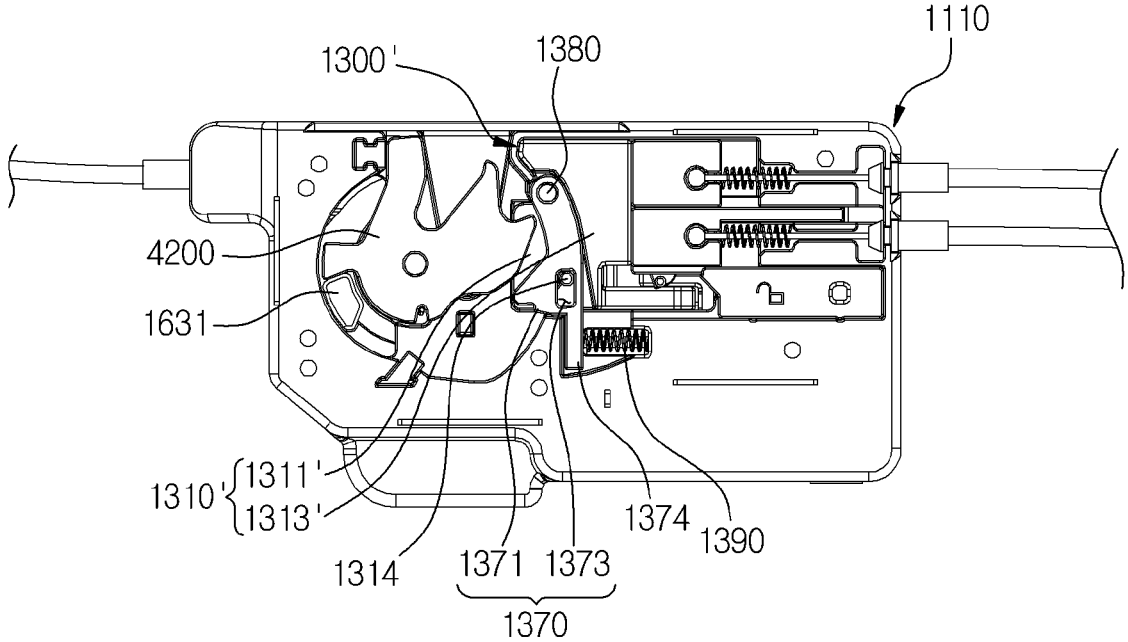
[Fig. 87]
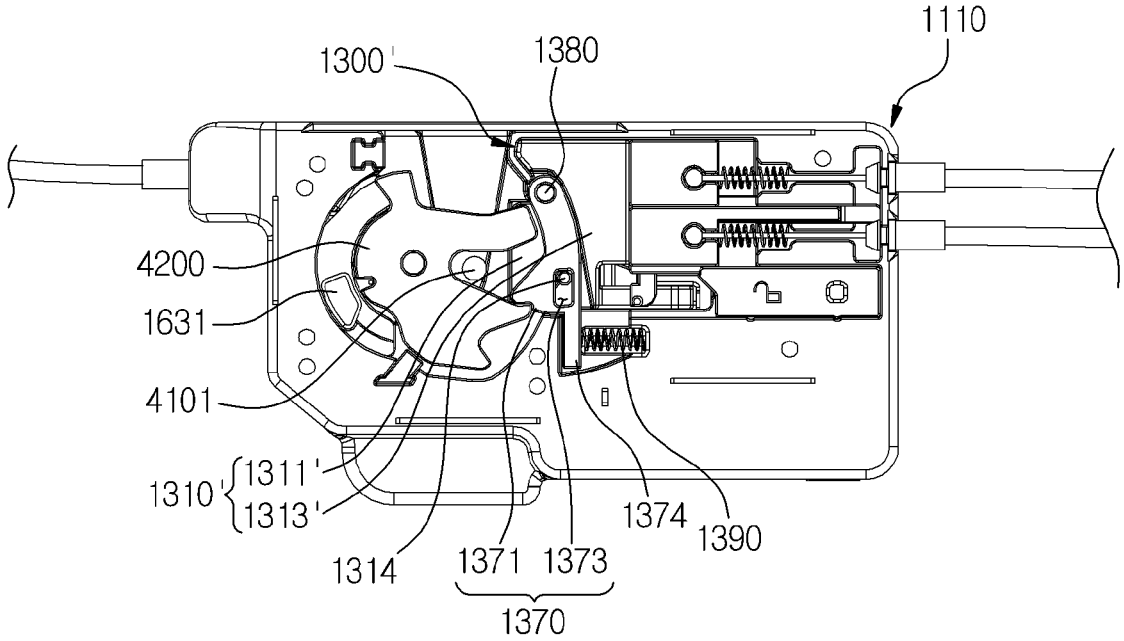

[Fig. 88]
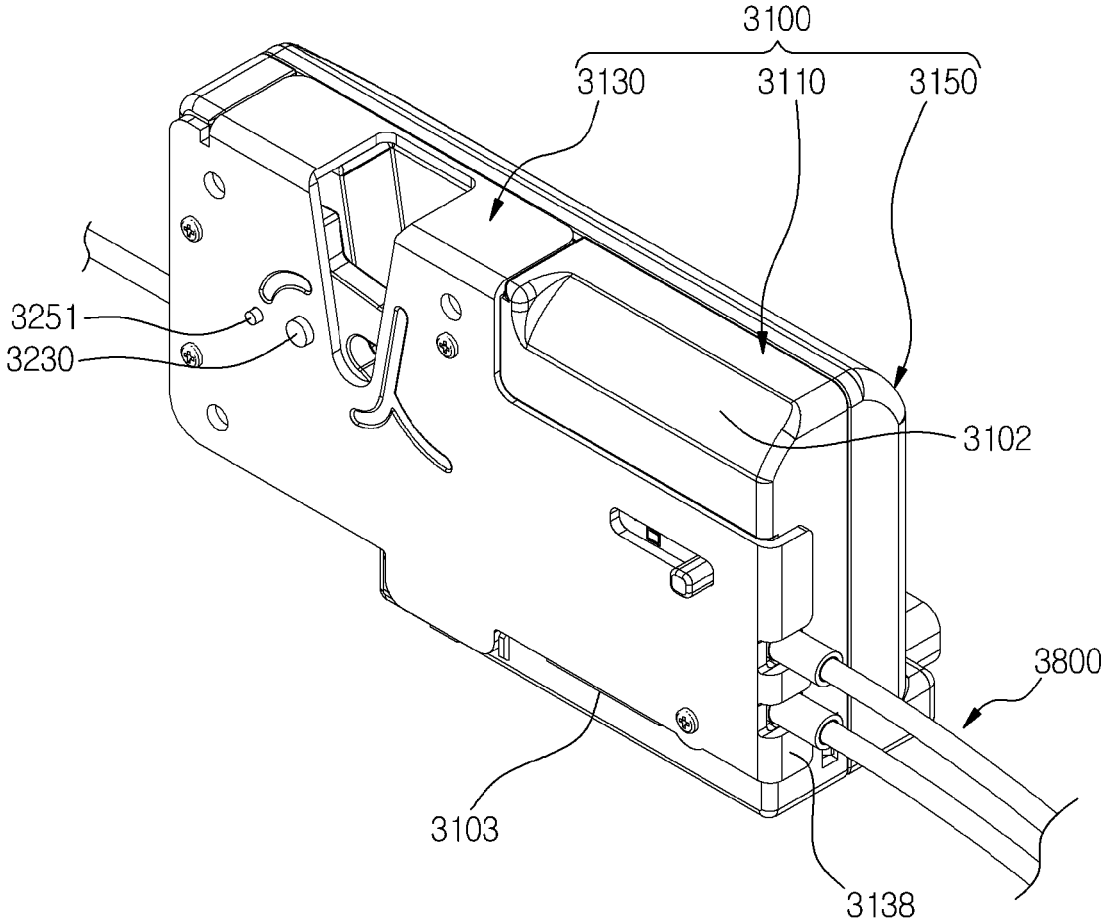
[Fig. 89]
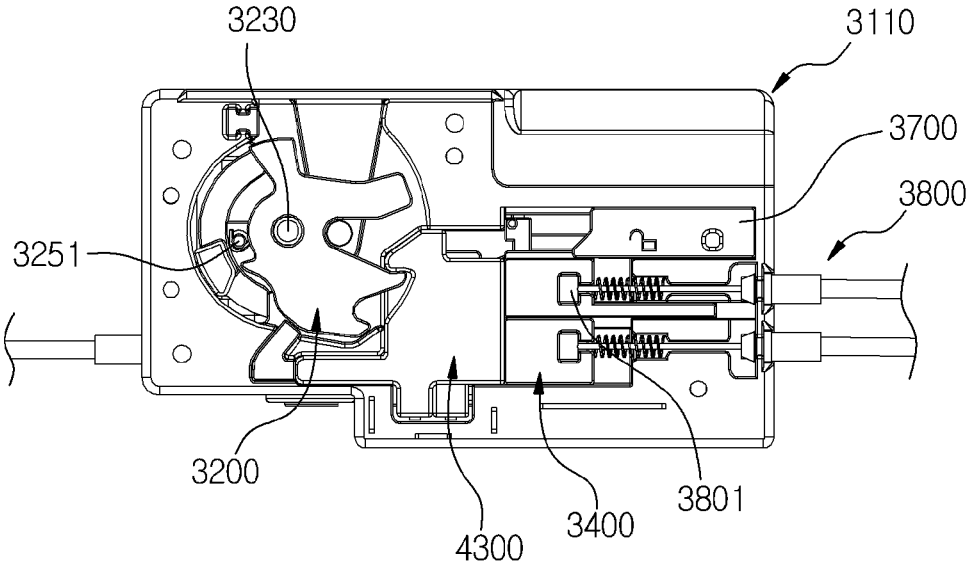

[Fig. 90]
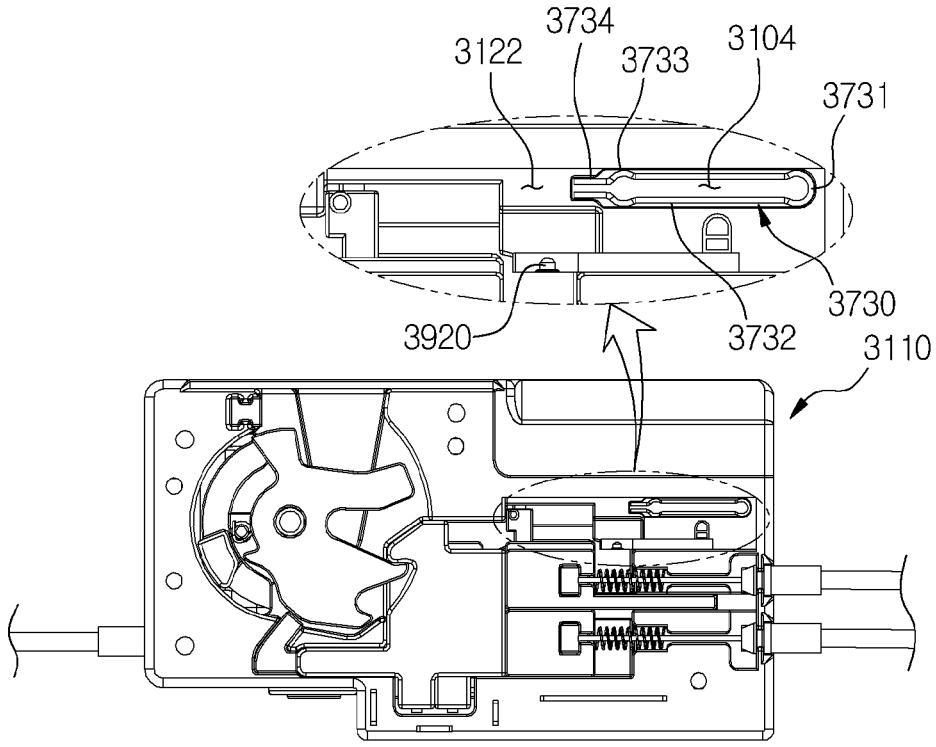
[Fig. 91]
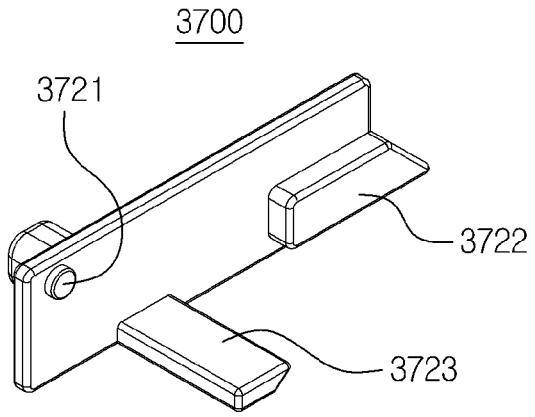

[Fig. 92]
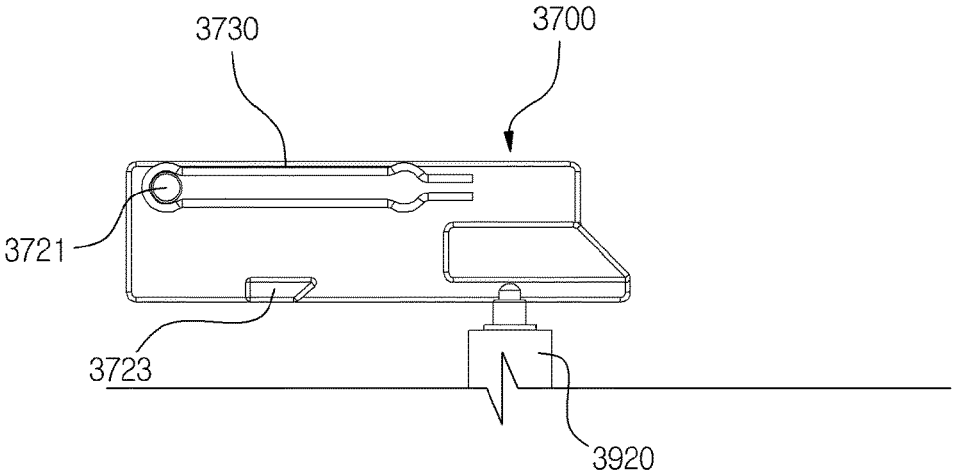
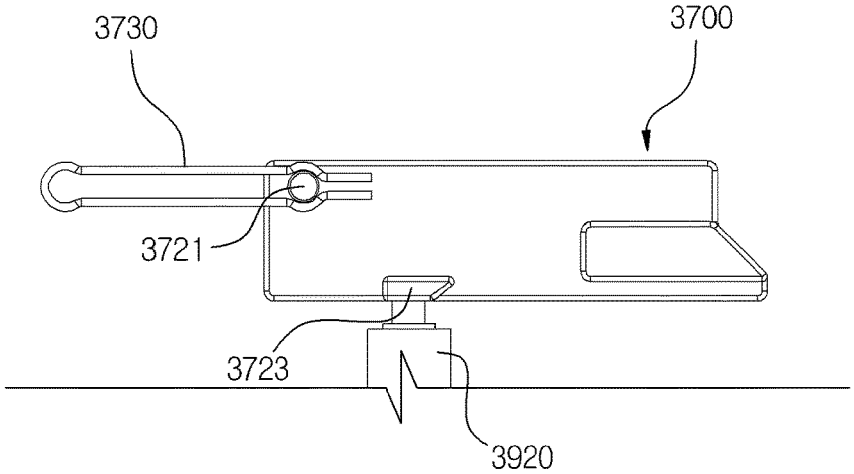
[Fig. 93]
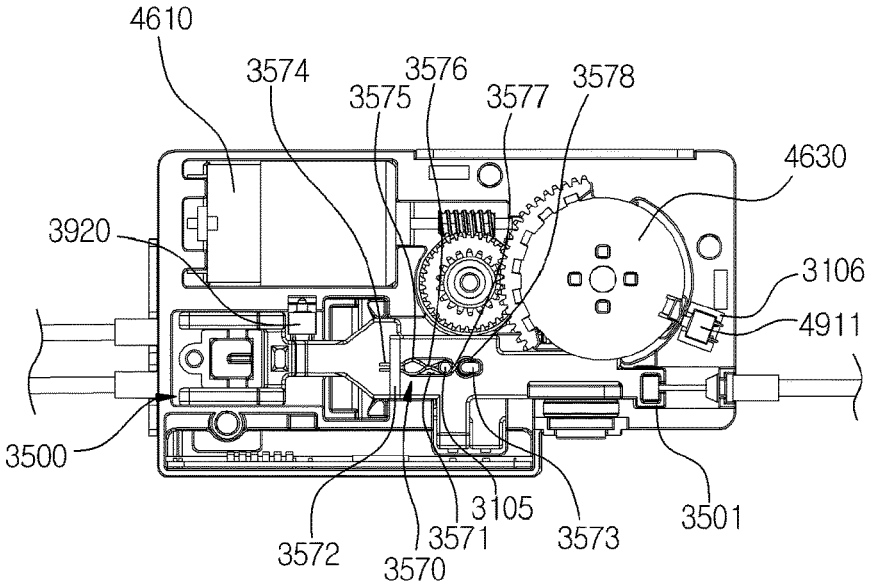

[Fig. 94]
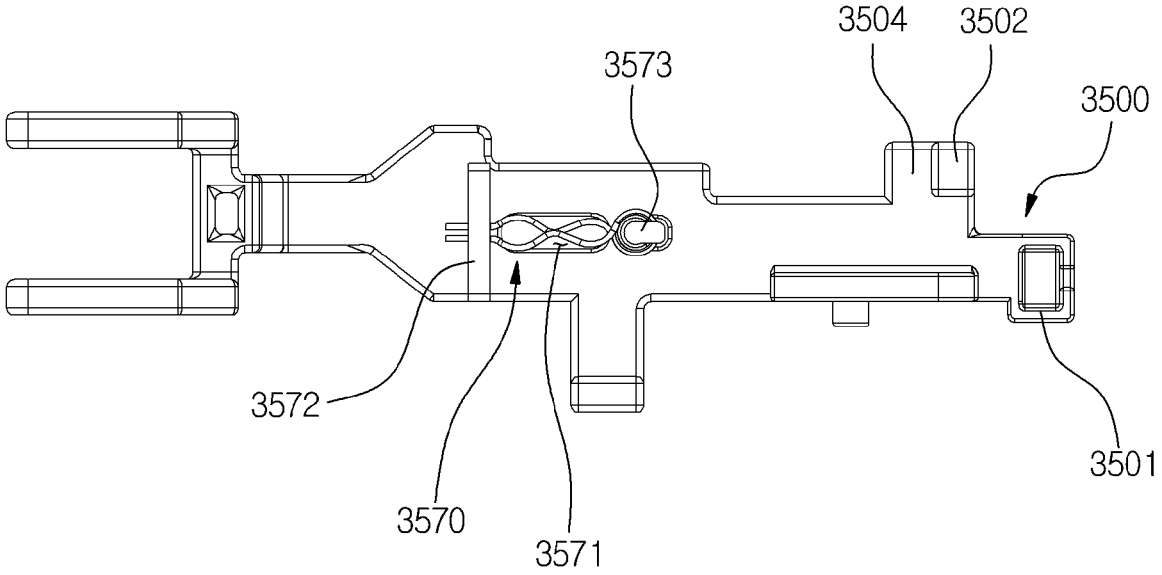
[Fig. 95]
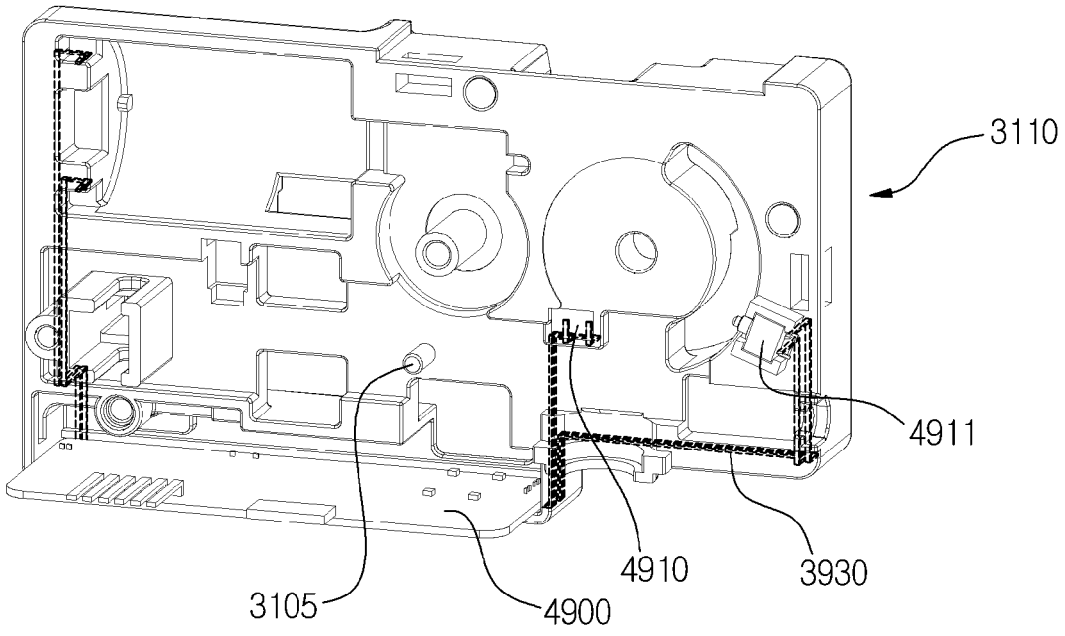

[Fig. 96]
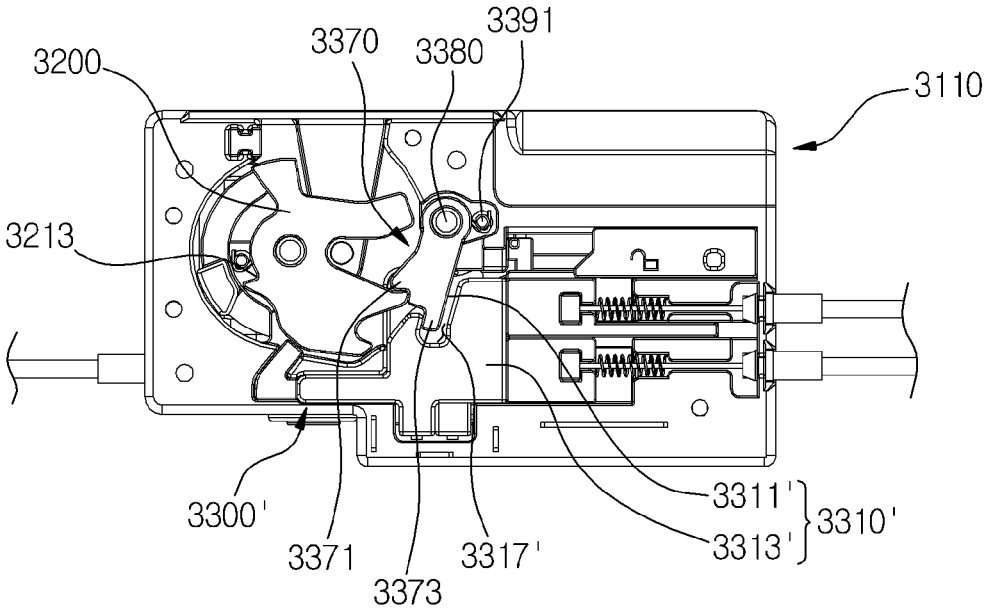
[Fig. 97]
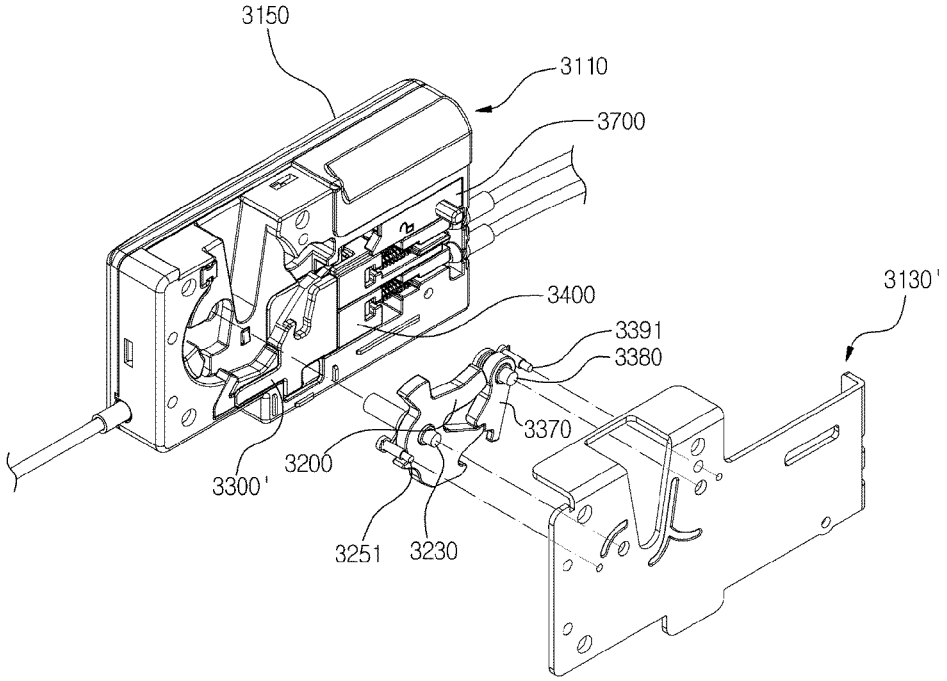

[Fig. 98]
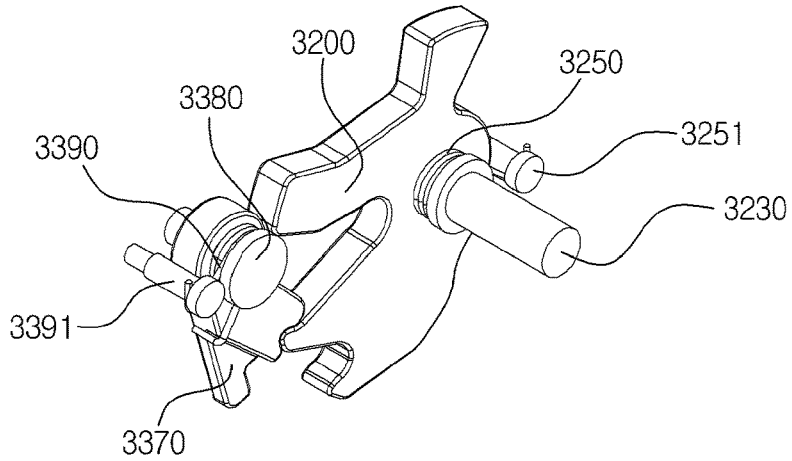
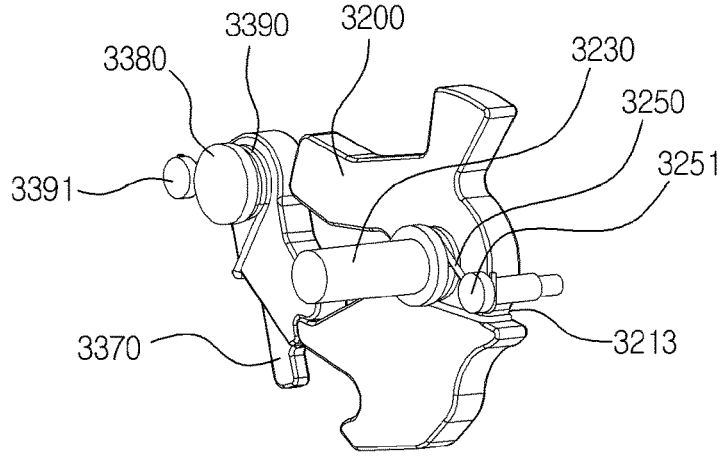
[Fig. 99]
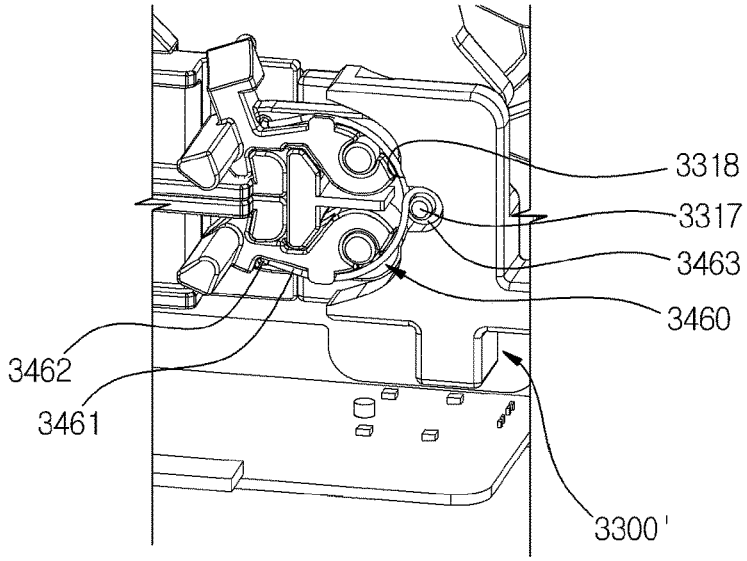

[Fig. 100]
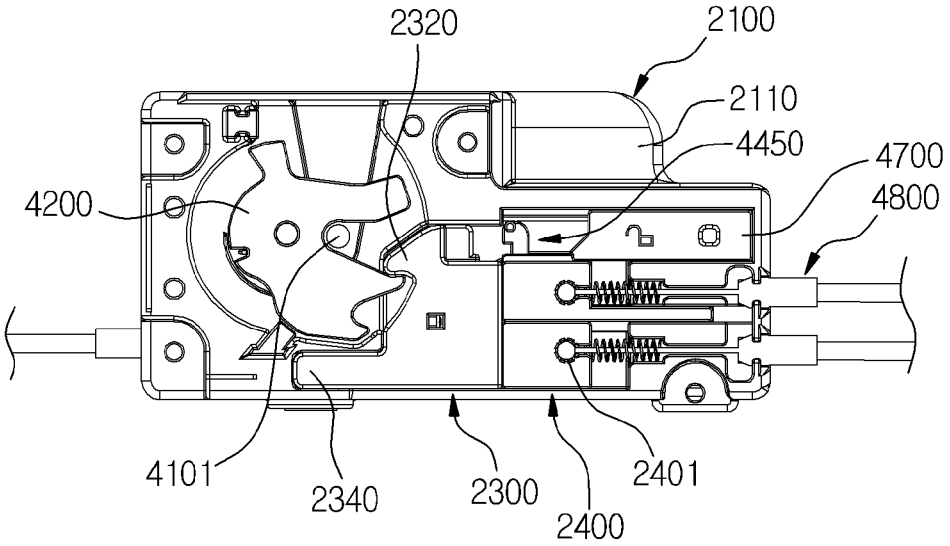
[Fig. 101]
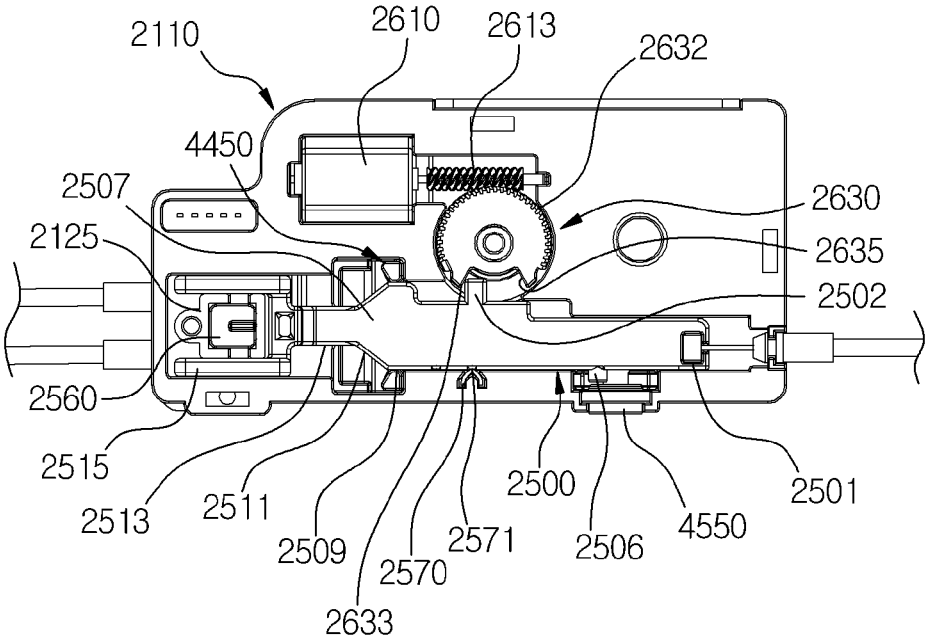

[Fig. 102]
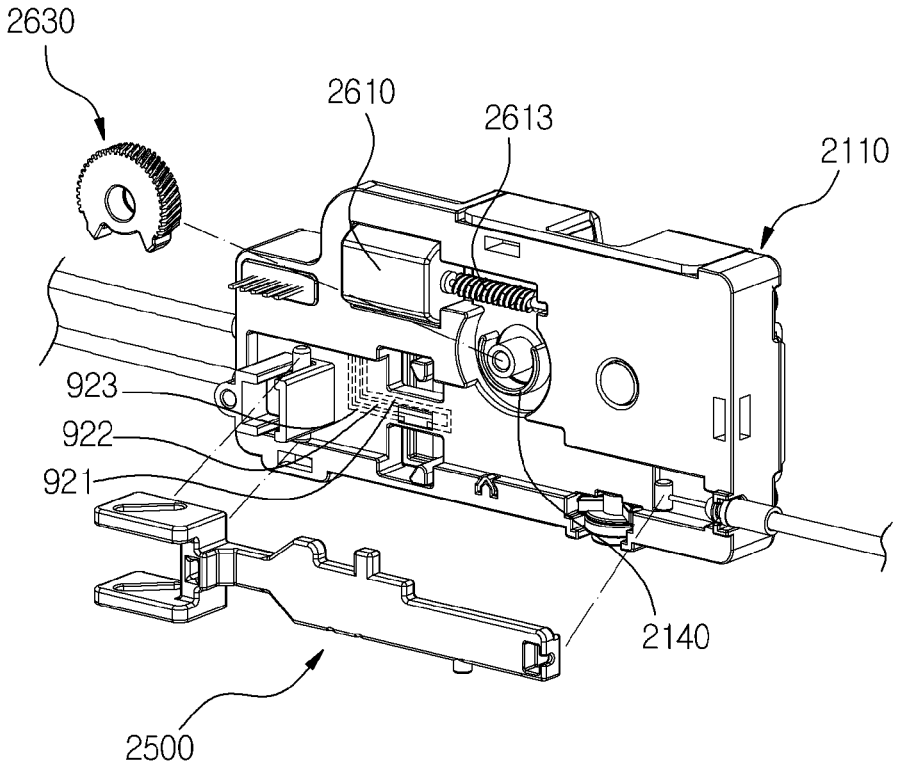
[Fig. 103]
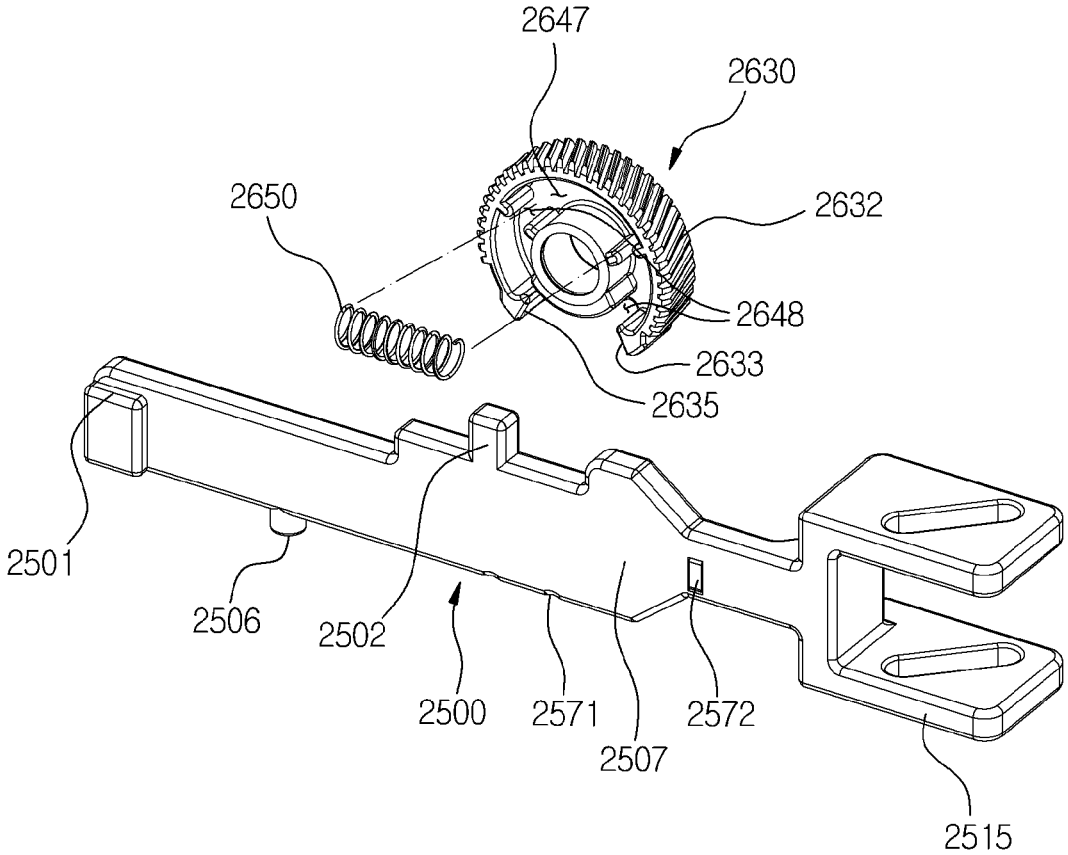

[Fig. 104]
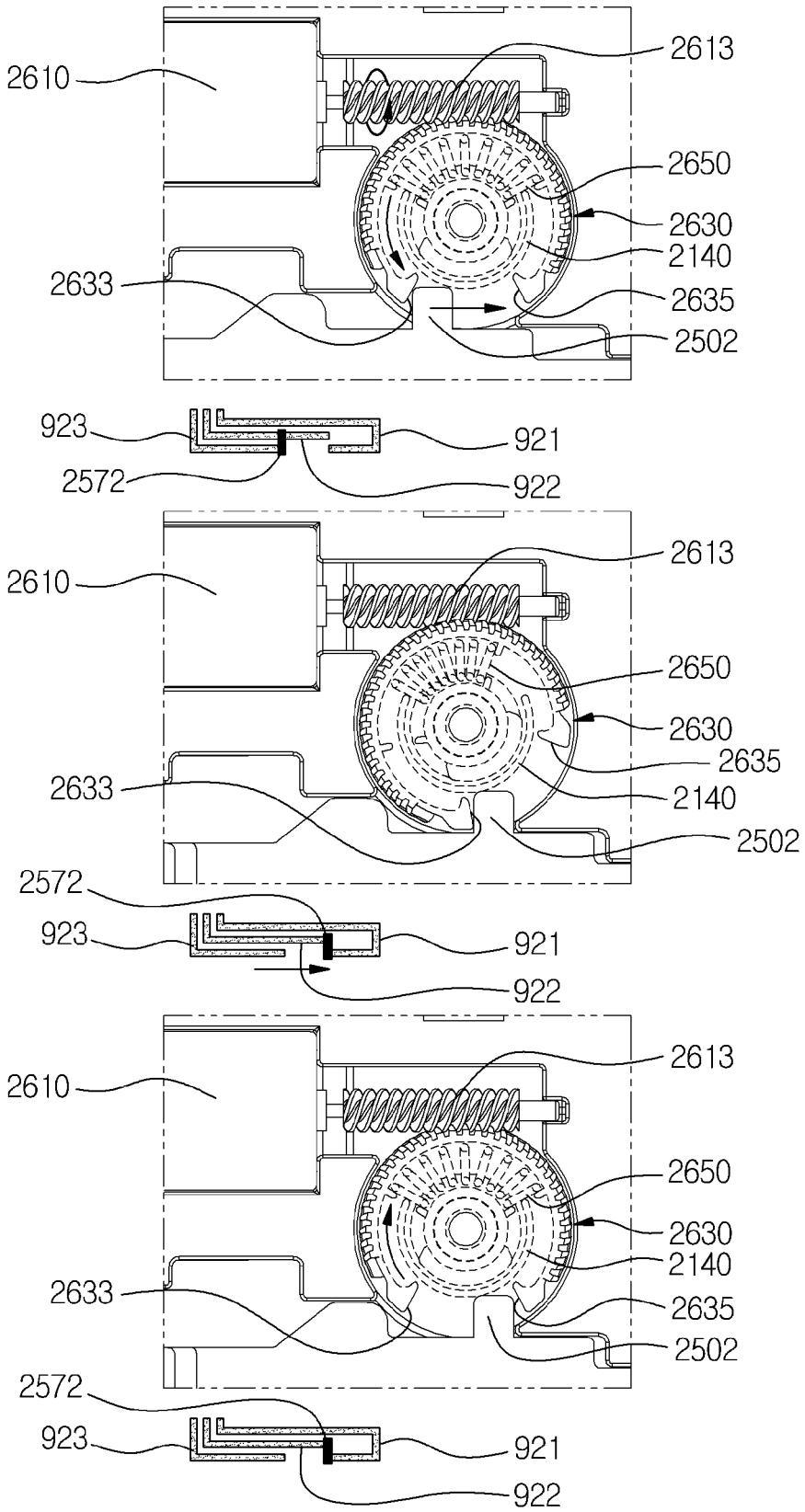

[Fig. 105]
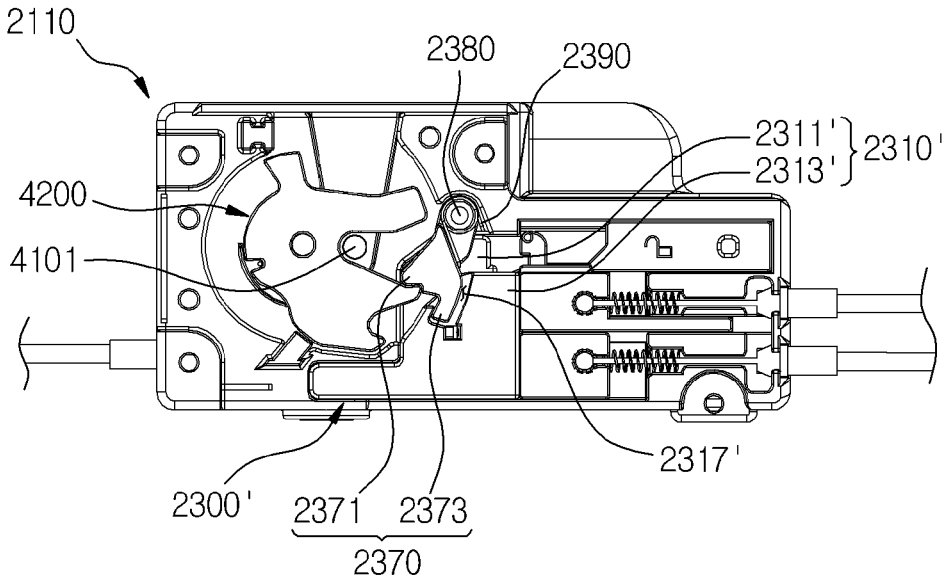

DOOR LATCH SYSTEM

This application is the national phase entry of international patent application no. PCT/KR2015/009491 filed Sep. 9, 2015 and claims the benefit of Korean patent applications No. 10-2014-0193407, filed Dec. 30, 2014 and No. 10-2015-0069453, filed May 19, 2015, the disclosures of which are incorporated herein by reference in their entirety.

TECHNICAL FIELD

The present invention relates to a door latch system, more particularly, relates to a door latch system capable of preventing the latch, the main locking member, and the like from being transferred by a force even when the door lever is being pulled as long as the door is in a locked state, and capable of setting the door to a locked state or a unlocked state with a simple structure.

BACKGROUND ART

Generally, a door latch system is used for opening and closing the automobile's door or locking or unlocking thereof, as suggested in Korea Patent No. 0535053.

However, such door latch system of the prior art has a problem wherein an unnecessary force is applied to the various components such as a latch connected to the door lever and the like when the door lever is pulled while the door is being locked, therefore, damages in the various components of the door latch system may easily occur, consequently, there is a problem of an excessive maintenance cost.

Moreover, the structure of such door latch system of the prior art is complicated.

LEADING TECHNICAL LITERATURE

Patent Literature

[Patent Literature 1] Korea Patent No. 0535053

DISCLOSURE OF INVENTION

Technical Problem

An objective of the present invention devised for solving the above mentioned problems, is to provide a door latch system capable of preventing the latch, the main locking member, and the like from being transferred by a force even when the door lever is being pulled as long as the door is in a locked state, and capable of setting the door to a locked state or a unlocked state with a simple structure.

Solution to Problem

To achieve above described objective, the door latch system of the present invention includes: a housing; a latch pivotally and rotatably installed in the housing; a main locking member slidingly installed in the housing for locking the latch; a sub-locking member slidingly installed in the housing and disposed in one side of the main locking member; a hook pivotally and movably installed in any one of the main locking member and the sub-locking member; a stopping threshold formed in the other one (wherein the hook is not installed) of the main locking member and the sub-locking member; and a locking plate slidingly installed in the housing for pivotally moving the hook, wherein the main locking member and the sub-locking member are sliding together when the hook is held by the stopping threshold by the sliding of the locking plate, and only the sub-locking member is sliding when the hook is separated from the stopping threshold by the sliding of the locking plate.

In addition, it is characterized in that a hook guide portion is formed in the locking plate, and a guide bar is formed in the hook, so that the pivotal rotation of the hook is accomplished as the guide bar is guided by the hook guide portion.

In addition, it is characterized in that a driving unit for pivotally rotating the latch or sliding the locking plate is further included.

In addition, it is characterized in that the driving unit includes a main gear wherein an engagement arm for rotating the latch is formed in the main gear.

In addition, it is characterized in that the driving unit includes a main gear wherein a first engagement arm and a second engagement arm are formed in the main gear for sliding the locking plate.

In addition, it is characterized in that a key connect, which is installed in the lower portion of the locking plate so as to move in conjunction therewith, is further included, wherein the locking plate is being slid as the key connect is being rotated.

In addition, it is characterized in that a child locking cover installed in the upper side of the sub-locking member; and a child locking member pivotally and rotatably installed inside the child locking cover are further included, wherein the hook is held by or separated from the stopping threshold by the pivotal rotation of the child locking member.

In addition, it is characterized in that the sub-locking member comprises a horizontal portion outwardly extended therefrom, and the locking plate comprises a manual locking member mount, and a manual locking member is slidingly installed in the manual locking member mount, wherein the hook is held by the stopping threshold due to the sliding of the locking plate since the manual locking member is pushed by the horizontal portion when the door in lever is pulled once while the hook is separated from the stopping threshold.

In addition, it is characterized in that a rotating member for sliding the main locking member when being pivotally rotated by the latch, is further included.

To achieve above described objective, the door latch system of the present invention includes: a housing; a latch pivotally and rotatably installed in the housing; a main locking member slidingly installed in the housing for locking the latch; a sub-locking member slidingly installed in the housing and disposed in one side of the main locking member; and a connecting means which enables simultaneous sliding of the main locking member and the sub-locking member, or sliding of only the sub-locking member.

In addition, it is characterized in that the connecting means comprises a hook pivotally and rotatably installed in any one of the main locking member and the sub-locking member; and a stopping threshold formed in the other one (wherein the hook is not installed) of the main locking member and the sub-locking member.

In addition, it is characterized in that a locking plate slidingly installed in the housing for pivotally rotating the hook is further included, wherein the main locking member and the sub-locking member are sliding together when the hook is held by the stopping threshold by the sliding of the locking plate, and only the sub-locking member is sliding when the hook is separated from the stopping threshold by the sliding of the locking plate.

A driving unit is further included for pivotally rotating the latch, or releasing the connection of the main locking member and the sub-locking member, or connecting the main locking member and the sub-locking member using the connecting means, wherein the driving unit comprises a main gear, and a geared portion wherein gear teeth are formed in a portion of the peripheral surface of the main gear and a non-geared portion (without gear teeth) may be formed in the remaining portion of the peripheral surface thereof.

The geared portion may be formed to be thicker than the non-geared portion.

The main gear may include a plastic portion and a metal portion which is to be inserted into the plastic portion.

The metal portion may include a plate portion having the shape of a plate and a protruded portion forwardly protruded in the circumference of the plate portion.

The protruded portion may be disposed in the geared portion.

An engagement arm is formed in the main gear for rotating the latch, and the protruded portion may be disposed in the engagement arm.

A locking plate slidingly installed in the housing is further provided, and a first engagement arm and a second engagement arm are formed in the main gear for sliding the locking plate, so that the locking plate disconnects the main locking member and the sub-locking member or connects the main locking member and the sub-locking member, and the first engagement arm and the second engagement arm may be formed in the plastic portion.

A locking plate slidingly installed in the housing is further provided, and a first engagement arm and a second engagement arm for sliding the locking plate is in the main gear, so that the locking plate disconnects the main locking member and the sub-locking member or connects the main locking member and the sub-locking member, and the first engagement arm and the second engagement arm may be formed in the metal portion.

A child locking member movably installed in the housing is further provided, wherein the child locking member is being moved and disconnects the main locking member and the sub-locking member or connects the main locking member and the sub-locking member.

A locking plate slidingly installed in the housing is further provided, and the locking plate is being slid by the main gear, and the locking member disconnects the main locking member and the sub-locking member or connects the main locking member and the sub-locking member, and inside the housing, a first, a second, and a third electrical wires are installed in the surface facing the locking plate, wherein in the locking plate, an electrical connecting member is installed in the surface facing the housing for connecting the first and the second electrical wires or connecting the second and the third electrical wires, and the ends of the first and the third electrical wires may be disposed spaced apart along the sliding direction of the locking plate.

A gear return spring is provided for returning of the main gear, and a coil spring is provided as the gear return spring, and a gear return spring slot is formed in the main gear for receiving the gear return spring, and a pushing rib is formed in the housing, and in the main gear, a rib insertion slot, wherein the pushing rib is inserted, may be formed communicating with the gear return spring slot in each of the both side surfaces constituting the gear return spring slot.

A locking plate slidingly installed in the housing is further provided, and the locking plate is slid by the main gear, and the locking plate disconnects the main locking member and the sub-locking member or connects the main locking member and the sub-locking member, and a first stopper protrusion is protrudedly formed in one of the locking plate and the housing, and a first stop spring elastically deformed by the first stopper protrusion is installed in the remaining one (wherein the first stopper protrusion is not installed), and the first stop spring may be deformed by the first stopper protrusion when the locking plate is located between the connected position and the released position.

A child locking member movably installed in the housing is further provided, wherein the child locking member is being slid and disconnects the main locking member and the sub-locking member or connects the main locking member and the sub-locking member, and a second stopper protrusion is protrudedly formed in one of the locking plate and the housing, and a second stop spring elastically deformed by the second stopper protrusion is installed in the remaining one (wherein the first stopper protrusion is not installed), and the second stop spring may be deformed by the second stopper protrusion when the child locking member is located between the connected position and the released position.

A child locking member movably installed in the housing is further provided, wherein the child locking member is being moved and disconnects the main locking member and the sub-locking member or connects the main locking member and the sub-locking member, and a child locking sensor may further be included for detecting whether the main locking member and the sub-locking member are connected through the child locking member or the connection between thereof is released.

The hook includes a first hook and a second hook, and the first hook and the second hook are pivotally and rotatably installed in the main locking member respectively, and the sub-locking member includes a first sub-locking member connected to the door in lever, and a second sub-locking member connected to the door out lever, and the stopping thresholds are formed in the first and the second sub-locking member respectively, and a second return spring is installed for returning the first and the second hooks, and the one end of the second return spring is connected to the first hook, and the other end is connected to the second hook, and a shaft insert is formed between the both ends thereof, and the shaft insert may be pivotally and rotatably installed in the main locking member.

Advantageous Effects of Invention

As described above, according to a door latch system of the present invention, there are advantageous effects as follows.

Since only the sub-locking member is being slid by the connecting means comprising a hook and a stopping threshold even if the door lever is being pulled when the door is being locked, the unnecessary force is not transferred to the other components such as a latch, a main locking member, and the like, therefore, damages in the above described components can be prevented.

The structure is simple since the hook can be pivotally rotated by the locking plate slidingly installed.

Since the locking plate can be moved towards the left side or the right side through the first engagement arm and the second engagement arm formed in the main gear, the number of the components can be reduced and the structure of the device becomes simple.

Since the latch can be pivotally rotated and the locking plate can be slid with one driving unit, the structure becomes simple, and the device can be maintained in a compact form, and the manufacturing cost can be reduced.

Since the locking plate can be slid by rotating the key connect, locking or unlocking of the door can be performed by holding or separating the hook using the stopping threshold even when the automobile's battery is discharged.

Children and elders can be protected since it can be set in a way that the door cannot be opened using the door in lever by letting the hook be separated from the stopping threshold by pivotally rotating or sliding the simply structured child locking member.

When the door is being locked, the locking of the door can be unlocked by pulling the door in lever once without operating the knob, and opening of the door is possible when the door in lever is being pulled one more time.

When an emergency state such as a safety problem and the like occurs when the door is being closed, the closing of the door can be stopped.

Since the sensors detecting the detecting member and the magnetic member are installed in a PCB, the device becomes compact and the installation of the sensors may become easy.

The jamming phenomenon (JAM) occurring during the simultaneous operation of the door functions can be prevented.

Since the motor is driving only when the limit switch and the first sensor are all detected, and the erroneous operation of the motor can be prevented while the door is being opened, and the possibility of damages in the latch and the components thereof can be prevented in advance.

Since the state of opening and closing of the door can be monitored in conjunction with the room lamps, the instrument panel, and the like, a user can easily monitor the state of the door.

A user can feel the door closing operation more softly by coupling a rotating member between the operation of the latch and the main locking member, and the strength of the door latch system can be increased.

The gear teeth of the main gear, which pivotally rotates the latch, are formed only in a portion of the outer peripheral surface thereof, so that the interference with the door window can be prevented when being installed in the door since the thickness can be reduced while the durability of the main gear is maintained.

The geared portion is formed to be thicker than the non-geared portion, thus the durability of the region around the gear teeth can be enhanced further.

The main gear includes a plastic portion and a metal portion which is to be inserted into the plastic portion, so that the durability of the main gear can be enhanced, and, at the same time, the weight and the thickness can be minimized as well.

The metal portion includes a plate portion formed to have the shape of a plate, and a protruded portion formed forwardly protruded in the circumference of the plate portion, and thus, the coupling strength between the plastic portion and the metal portion can be enhanced.

The protruded portion is disposed in the geared portion, thus, the durability around the region of the gear teeth can be enhanced further.

An engagement arm, which rotates the latch, is formed in the main gear, and the protruded portion is disposed in the engagement arm, thus, the durability of the engagement arm can be enhanced.

Since the latch can be pivotally rotated or the locking plate can be slid by one driving unit, the structure becomes simple, and the compactness of the device can be maintained, and the manufacturing cost can be reduced.

The first engagement arm and the second engagement arm are formed in the plastic portion or the metal portion, thus, the thickness of the main gear can be thinly maintained.

Children and elders can be protected since it can be set in a way that the door cannot be opened using the door in lever by letting the hook be separated from the stopping threshold by sliding the simply structured child locking member.

Since the driving unit is used only for locking and unlocking of the door, the size of the motor and the number of the components can be reduced, thus, the size of the door latch system can be reduced further. Therefore, the door latch system of the present invention can be easily installed in a compact-class car having a small installation space for a door latch system.

At least a portion of the locking plate is inserted into the opening formed in the main gear, thus, the locking plate is being slid held by the main gear when the main gear is rotated, therefore, the door latch system can be more compactly maintained.

Inside the housing, a first, a second, and a third electrical wires are installed in the surface facing the locking plate, wherein in the locking plate, an electrical connecting member is installed in the surface facing the housing for connecting the first and the second electrical wires or connecting the second and the third electrical wires, and the ends of the first and the third electrical wires may be disposed spaced apart along the sliding direction of the locking plate, thus, the door latch system can be compactly maintained, and at the same time, the locking or the unlocking of the door can be detected without providing separate sensors.

By providing a gear return spring which returns the main gear, the main gear can be returned to its original position after locking or unlocking the door due to the elastic force of the spring.

In addition, a coil spring is provided as the gear return spring, and a gear return spring slot is formed in the main gear for receiving the gear return spring, and a pushing rib is formed in the housing, and in the main gear, a rib insertion slot, wherein the pushing rib is inserted, is formed communicating with the gear return spring slot in each of the both side surfaces constituting the gear return spring slot, thus, the door latch system can be compactly maintained.

A locking plate slidingly installed in the housing is further provided, and the locking plate is slid by the main gear, and the locking plate disconnects the main locking member and the sub-locking member or connects the main locking member and the sub-locking member, and a first stopper protrusion is protrudedly formed in one of the locking plate and the housing, and a first stop spring elastically deformed by the first stopper protrusion is installed in the remaining one (wherein the first stopper protrusion is not installed), and the first stop spring may be elastically deformed by the first stopper protrusion when the locking plate is located between the connected position and the disconnected position, so that the separation of the locking plate from the lock position or the unlock position is prevented even when the external impact is applied to the locking plate whether it is in the connected position or in the disconnected position.

A child locking member movably installed in the housing is further provided, wherein the child locking member is being slid and disconnects the main locking member and the sub-locking member or connects the main locking member and the sub-locking member, and a second stopper protrusion is protrudedly formed in one of the locking plate and the housing, and a second stop spring elastically deformed by the second stopper protrusion is installed in the remaining one (wherein the first stopper protrusion is not installed), and the second stop spring may be elastically deformed by the second stopper protrusion when the child locking member is located between the connected position and the released position, so that the separation of the child locking member from the lock position or the unlock position is prevented even when the external impact is applied to the child locking member whether it is in the connected position or in the disconnected position.

A child locking member movably installed in the housing is further provided, wherein the child locking member is being moved and disconnects the main locking member and the sub-locking member or connects the main locking member and the sub-locking member, and a child locking sensor may further be included for detecting whether the main locking member and the sub-locking member are connected or disconnected through the child locking member, so that the driver can easily check the state of the child locking.

The hook includes a first hook and a second hook, and the first hook and the second hook are pivotally and rotatably installed in the main locking member respectively, and the sub-locking member includes a first sub-locking member connected to the door in lever, and a second sub-locking member connected to the door out lever, and the stopping thresholds are formed in the first and the second sub-locking member respectively, and a second return spring is installed for returning the first and the second hooks, and the one end of the second return spring is connected to the first hook, and the other end is connected to the second hook, and a shaft insert is formed between the both ends thereof, and the shaft insert may be pivotally and rotatably installed in the main locking member, so that the structure of the device becomes simple, and the number of the components of the device is reduced further, and, at the same time, the shaking of the second return spring or the twisting in the second return spring can be prevented. Therefore, the return of the hook can be accomplished more easily.

BRIEF DESCRIPTION OF DRAWINGS

FIG. 1 is a perspective view illustrating a door latch system according to a preferred exemplary embodiment of the present invention.

FIG. 2 is an exploded perspective view illustrating a door latch system according to the first exemplary embodiment of the present invention.

FIG. 3 is a front view illustrating the state wherein the second housing is removed from FIG. 2.

FIG. 4 illustrates a front perspective view and a backside perspective view of the first housing of the door latch system according to the first exemplary embodiment of the present invention.

FIG. 5 illustrates a front perspective view and a backside perspective view of the second housing of the door latch system according to the first exemplary embodiment of the present invention.

FIG. 6 illustrates a front perspective view and a backside perspective view of the third housing of the door latch system according to the first exemplary embodiment of the present invention.

FIG. 7 is a front perspective view illustrating the latch of the door latch system according to the first exemplary embodiment of the present invention.

FIG. 8 illustrates a front perspective view and a backside perspective view of the main locking member of the door latch system according to the first exemplary embodiment of the present invention.

FIG. 9 illustrates a front perspective view and a backside perspective view of the sub-locking member and the lever connecting portion of the door latch system according to the first exemplary embodiment of the present invention.

FIG. 10 illustrates a front perspective view and a backside perspective view of the hook of the door latch system according to the first exemplary embodiment of the present invention.

FIG. 11 illustrates a front perspective view and a backside perspective view of the plate, the key connect, and the manual locking member of the door latch system according to the first exemplary embodiment of the present invention.

FIG. 12 illustrates a front perspective view and a backside perspective view of the driving unit of the door latch system according to the first exemplary embodiment of the present invention.

FIG. 13 illustrates a front perspective view and a backside perspective view of the child locking cover and the child locking member of the door latch system according to the first exemplary embodiment of the present invention.

FIG. 14 illustrates a partial front view and a partial backside view illustrating the first step of the door closing operation of the door latch system according to the first exemplary embodiment of the present invention.

FIG. 15 illustrates a partial front view and a partial backside view illustrating the second step of the door closing operation of the door latch system according to the first exemplary embodiment of the present invention.

FIG. 16 illustrates a partial front view and a partial backside view illustrating the third step of the door closing operation of the door latch system according to the first exemplary embodiment of the present invention.

FIG. 17 illustrates a partial front view and a partial backside view illustrating the fourth step of the door closing operation of the door latch system according to the first exemplary embodiment of the present invention.

FIG. 18 illustrates a partial front view and a partial backside view illustrating the fifth step of the door closing operation of the door latch system according to the first exemplary embodiment of the present invention.

FIG. 19 illustrates a partial front view and a partial backside view illustrating the sixth step of the door closing operation of the door latch system according to the first exemplary embodiment of the present invention.

FIG. 20 illustrates a partial front view and a partial backside view illustrating the first step of the door locking operation of the door latch system according to the first exemplary embodiment of the present invention.

FIG. 21 illustrates a partial front view and a partial backside view illustrating the second step of the door locking operation of the door latch system according to the first exemplary embodiment of the present invention.

FIG. 22 illustrates a partial front view and a partial backside view illustrating the third step of the door locking operation of the door latch system according to the first exemplary embodiment of the present invention.

FIG. 23 illustrates a partial front view and a partial backside view illustrating the first step of the door unlocking operation of the door latch system according to the first exemplary embodiment of the present invention.

FIG. 24 illustrates a partial front view and a partial backside view illustrating the second step of the door unlocking operation of the door latch system according to the first exemplary embodiment of the present invention.

FIG. 25 illustrates a partial front view and a partial backside view illustrating the third step of the door unlocking operation of the door latch system according to the first exemplary embodiment of the present invention.

FIG. 26 illustrates a partial backside view illustrating the first step of the door locking operation inside the car using the child locking member of the door latch system according to the first exemplary embodiment of the present invention.

FIG. 27 illustrates a partial backside view illustrating the second step of the door locking operation inside the car using the child locking member of the door latch system according to the first exemplary embodiment of the present invention.

FIG. 28 illustrates a partial backside view illustrating the third step of the door locking operation inside the car using the child locking member of the door latch system according to the first exemplary embodiment of the present invention.

FIG. 29 illustrates a partial plan view, partial front view, and a partial backside view illustrating the first step of the door unlocking operation inside the car using the door in lever of the door latch system according to the first exemplary embodiment of the present invention.

FIG. 30 illustrates a partial plan view, partial front view, and a partial backside view illustrating the second step of the door unlocking operation inside the car using the door in lever of the door latch system according to the first exemplary embodiment of the present invention.

FIG. 31 illustrates a partial plan view, partial front view, and a partial backside view illustrating the third step of the door unlocking operation inside the car using the door in lever of the door latch system according to the first exemplary embodiment of the present invention.

FIG. 32 illustrates a partial plan view, partial front view, and a partial backside view illustrating the fourth step of the door unlocking operation inside the car using the door in lever of the door latch system according to the first exemplary embodiment of the present invention.

FIG. 33 illustrates a partial plan view, partial front view, and a partial backside view illustrating the fifth step of the door unlocking operation inside the car using the door in lever of the door latch system according to the first exemplary embodiment of the present invention.

FIG. 34 is a front view illustrating the state wherein the second housing is removed from the door latch system according to the second exemplary embodiment of the present invention.

FIG. 35 illustrates a partial front view and a partial backside view illustrating the first step of the door closing operation of the door latch system according to the second exemplary embodiment of the present invention.

FIG. 36 illustrates a partial front view and a partial backside view illustrating the second step of the door closing operation of the door latch system according to the second exemplary embodiment of the present invention.

FIG. 37 illustrates a partial front view and a partial backside view illustrating the third step of the door closing operation of the door latch system according to the second exemplary embodiment of the present invention.

FIG. 38 illustrates a partial front view and a partial backside view illustrating the fourth step of the door closing operation of the door latch system according to the second exemplary embodiment of the present invention.

FIG. 39 illustrates a partial front view and a partial backside view illustrating the fifth step of the door closing operation of the door latch system according to the second exemplary embodiment of the present invention.

FIG. 40 illustrates a partial front view and a partial backside view illustrating the sixth step of the door closing operation of the door latch system according to the second exemplary embodiment of the present invention.

FIG. 41 is a front perspective view illustrating a door latch system according to the third exemplary embodiment of the present invention.

FIG. 42 is an exploded perspective view of FIG. 41.

FIG. 43 is a front view illustrating the state wherein the second housing is removed from the door latch system according to the third exemplary embodiment of the present invention.

FIG. 44 is a backside view illustrating the state wherein the third housing is removed from the door latch system according to the third exemplary embodiment of the present invention.

FIG. 45 illustrates a front perspective view (upper drawing) and a backside perspective view (lower drawing) of the first housing of the door latch system according to the third exemplary embodiment of the present invention.

FIG. 46 illustrates a front perspective view (upper drawing) and a backside perspective view (lower drawing) of the second housing of the door latch system according to the third exemplary embodiment of the present invention.

FIG. 47 illustrates a front perspective view (upper drawing) and a backside perspective view (lower drawing) of the third housing of the door latch system according to the third exemplary embodiment of the present invention.

FIG. 48 is a front perspective view illustrating the latch of the door latch system according to the third exemplary embodiment of the present invention.

FIG. 49 illustrates a front perspective view (upper drawing) and a backside perspective view (lower drawing) of the main locking member of the door latch system according to the third exemplary embodiment of the present invention.

FIG. 50 illustrates a front perspective view (upper drawing) and a backside perspective view (lower drawing) of the hook of the door latch system according to the third exemplary embodiment of the present invention.

FIG. 51 illustrates a front perspective view (upper drawing) and a backside perspective view (lower drawing) of the sub-locking member and the door lever connecting unit of the door latch system according to the third exemplary embodiment of the present invention.

FIG. 52 illustrates a front perspective view (upper drawing) and a backside perspective view (lower drawing) of the locking plate of the door latch system according to the third exemplary embodiment of the present invention.

FIG. 53 illustrates a front perspective view (upper drawing) and a backside perspective view (lower drawing) of the driving unit of the door latch system according to the third exemplary embodiment of the present invention.

FIG. 54 is a backside perspective view of the main gear of the door latch system according to the third exemplary embodiment of the present invention.

FIG. 55 is an exploded backside perspective view of the main gear of the door latch system according to the third exemplary embodiment of the present invention.

FIG. 56 illustrates a front perspective view (upper drawing) and a backside perspective view (lower drawing) of the child locking member of the door latch system according to the third exemplary embodiment of the present invention.

FIG. 57 is a front view wherein the housing is removed from the door latch system according to the third exemplary embodiment of the present invention (the state wherein the door is open).

FIG. 58 is a front view wherein the housing is removed from the door latch system according to the third exemplary embodiment of the present invention (the state wherein the main locking member pushed towards the right side by the latch when the door is being closed).

FIG. 59 is a front view wherein the housing is removed from the door latch system according to the third exemplary embodiment of the present invention (the state wherein the locking protrusion of the main locking member is being inserted in the auxiliary locking slot).

FIG. 60 is a front view wherein the housing is removed from the door latch system according to the third exemplary embodiment of the present invention (the state wherein the locking protrusion of the main locking member is being inserted in the auxiliary locking slot, and the main gear had returned back to the basic position thereof).

FIG. 61 illustrates a front view (upper drawing) and a backside view (lower drawing) wherein the housing and the latch are being removed form the door latch system according to the third exemplary embodiment of the present invention (the state wherein the door is unlocked).

FIG. 62 illustrates a front view (upper drawing) and a backside view (lower drawing) wherein the housing and the latch are being removed form the door latch system according to the third exemplary embodiment of the present invention (the state wherein the door is locked after the main gear is rotated counter clockwise).

FIG. 63 illustrates a front view (upper drawing) and a backside view (lower drawing) wherein the housing and the latch are being removed form the door latch system according to the third exemplary embodiment of the present invention (the state wherein the main gear has returned to the basic position after the door is locked).

FIG. 64 illustrates a front view (upper drawing) and a backside view (lower drawing) wherein the housing and the latch are being removed form the door latch system according to the third exemplary embodiment of the present invention (the state wherein the door is unlocked after the main gear is rotated clockwise).

FIG. 65 illustrates a front view of the door latch system according to the third exemplary embodiment of the present invention (upper drawing) and a backside view (lower drawing) wherein the housing and the latch are being removed form the door latch system according to the third exemplary embodiment of the present invention (the state wherein the door inside the car is unlocked using the child locking member).

FIG. 66 illustrates a front view of the door latch system according to the third exemplary embodiment of the present invention (upper drawing) and a backside view (lower drawing) wherein the housing and the latch are being removed form the door latch system according to the third exemplary embodiment of the present invention (the state wherein the door inside the car is locked using the child locking member).

FIG. 67 illustrates a front view (upper drawing) and a plan view (lower drawing) wherein the housing and the child locking member are being removed form the door latch system according to the third exemplary embodiment of the present invention (the state wherein the door is locked).

FIG. 68 illustrates a front view (upper drawing) and a backside view (lower drawing) wherein the housing and the child locking member are being removed form the door latch system according to the third exemplary embodiment of the present invention (the state wherein the door is unlocked).

FIG. 69 is a view illustrating the door latch system according to the third exemplary embodiment of the present invention which is installed inside the car door.

FIG. 70 is a plan view of the door latch system according to the third exemplary embodiment of the present invention (to be installed in a car).

FIG. 71 is a backside perspective view of the door latch system according to the third exemplary embodiment of the present invention.

FIG. 72 is a horizontal cross-sectional view of the right side portion of the door latch system according to the third exemplary embodiment of the present invention.

FIG. 73 is a front view wherein the second housing is removed from the door latch system according to the fourth exemplary embodiment of the present invention.

FIG. 74 is a front view wherein the housing is removed from the door latch system according to the fourth exemplary embodiment of the present invention (the state wherein the door is opened).

FIG. 75 is a front view wherein the housing is removed from the door latch system according to the fourth exemplary embodiment of the present invention (the state wherein the latch is being rotated by the motor).

FIG. 76 is a front view wherein the housing is removed from the door latch system according to the fourth exemplary embodiment of the present invention (the state wherein the locking portion of the rotating member is being inserted in the locking slot, and the main gear had returned back to the basic position thereof).

FIG. 77 is a front perspective view illustrating the door latch system according to the fifth exemplary embodiment of the present invention.

FIG. 78 is a front view wherein the second housing is removed from the door latch system according to the fifth exemplary embodiment of the present invention.

FIG. 79 is a perspective view illustrating the main locking member of the door latch system according to the fifth exemplary embodiment of the present invention.

FIG. 80 is a backside perspective view wherein the third housing is removed from the door latch system according to the fifth exemplary embodiment of the present invention.

FIG. 81 is a backside perspective view of the locking plate of the door latch system according to the fifth exemplary embodiment of the present invention (manual locking member is omitted).

FIG. 82 is a backside perspective view of the main gear of the door latch system according to the fifth exemplary embodiment of the present invention.

FIG. 83 is an exploded backside perspective view of the main gear of the door latch system according to the fifth exemplary embodiment of the present invention.

FIG. 84 is a front view wherein the first and the second housings are removed from the door latch system according to the fifth exemplary embodiment of the present invention (the state wherein the door is locked).

FIG. 85 is a front view wherein the first and the second housings are removed from the door latch system according to the fifth exemplary embodiment of the present invention (the state wherein the door is unlocked).

FIG. 86 is a front view wherein the second housing is removed from the door latch system according to the sixth exemplary embodiment of the present invention (the door is open).

FIG. 87 is a front view wherein the second housing is removed from the door latch system according to the sixth exemplary embodiment of the present invention (the door is closed).

FIG. 88 is a perspective view of the door latch system according to the seventh exemplary embodiment of the present invention.

FIG. 89 is a front view wherein the second housing is removed from the door latch system according to the seventh exemplary embodiment of the present invention (the door is closed).

FIG. 90 is a front view wherein the second housing and the child locking member are removed from the door latch system according to the seventh exemplary embodiment of the present invention (the door is closed).

FIG. 91 is a backside perspective view of the child locking member of the door latch system according to the seventh exemplary embodiment of the present invention.

FIG. 92 is a backside view illustrating the pressed state of the child locking sensor when the child locking member is being slid in the door latch system according to the seventh exemplary embodiment of the present invention (upper drawing: door is unlocked, lower drawing: door is locked).

FIG. 93 is a backside view wherein the third housing is removed from the door latch system according to the seventh exemplary embodiment of the present invention.

FIG. 94 is a backside view of the locking plate of the door latch system according to the seventh exemplary embodiment of the present invention.

FIG. 95 illustrates the state wherein electrical wires are inserted inside the first housing of the door latch system according to the seventh exemplary embodiment of the present invention.

FIG. 96 is a front view illustrating the state wherein the second housing is removed from the door latch system according to the seventh exemplary embodiment of the present invention (the door is closed).

FIG. 97 is an exploded perspective view illustrating the assembling process of the door latch system according to the eighth exemplary embodiment of the present invention.

FIG. 98 illustrates the right side (upper drawing) and the left side (lower drawing) of the backside perspective view of the latch and the rotating member being installed in the second housing when the door latch system according to the eighth exemplary embodiment of the present invention is being assembled.

FIG. 99 is a backside perspective view wherein the hook is installed in the main locking member of the door latch system according to the eighth exemplary embodiment of the present invention.

FIG. 100 is a front view wherein the second housing is removed from the door latch system according to the ninth exemplary embodiment of the present invention (the door is closed).

FIG. 101 is a front view wherein the third housing is removed from the door latch system according to the ninth exemplary embodiment of the present invention (the door is locked).

FIG. 102 is a backside perspective view wherein the third housing is removed from the door latch system according to the ninth exemplary embodiment of the present invention (the main gear and the locking plate are separated).

FIG. 103 is a front perspective view of the main gear and the locking plate of the door latch system according to the ninth exemplary embodiment of the present invention.

FIG. 104 illustrates a backside view illustrating the states of the door being locked (upper drawing), the door being unlocked (middle drawing), and the returned main gear after the door is unlocked (lower drawing); and a schematic diagram of the first, the second, and the third electrical wires of the door latch system according to the ninth exemplary embodiment of the present invention.

FIG. 105 is a front view wherein the second housing is removed from the door latch system according to the tenth exemplary embodiment of the present invention (the door is closed).

MODE FOR THE INVENTION

Hereinafter, a door latch system according to the first exemplary embodiment of the present invention will be described in detail with reference to the accompanying drawings as follows.

For reference, components of the present invention which are the same as those of the prior art as described above will not be described separately while referring to the prior art described above.

Embodiment 1

As illustrated in FIGS. 1 to 33, the door latch system according to the first exemplary embodiment of the present invention includes: a housing 100; a latch 200 pivotally and rotatably installed in the housing 100; a main locking member 300 slidingly installed in the housing 100 for locking the latch 200; a sub-locking member 400 slidingly installed in the housing 100 and disposed in one side of the main locking member 300; and a connecting means which enables simultaneous sliding of the main locking member 300 and the sub-locking member 400, or sliding of only the sub-locking member 400.

As illustrated in FIGS. 1 to 13, the housing 100 includes: a first housing 110, a second housing 130 disposed in front of the first housing 110, and the third housing 150 disposed in the backside of the first housing 110.

As illustrated in FIG. 1, in the housing 100, the front means the direction towards the second housing 130, and the backside means direction towards the third housing 150. In addition, the left side and the right side described hereinafter mean the left side and the right side viewing from the front. The left side and the right side, used when describing the members formed in the backside surface, also mean the left side and the right side viewing from the front of the members.

A striker insertion slot 105 is formed for inserting the striker 101 connected to the door (not shown) in the upper side and the front of the housing 100.

The striker insertion slot 105 is formed across the first housing 110 and the second housing 130.

The first housing 110 is formed in the shape of a block, wherein a latch reception slot 111 for receiving the latch 200, which will be described hereinafter, and a locking member reception slot 112 for receiving the main locking member 300 and the sub-locking member 400, which will be described hereinafter, are formed in the front surface of the first housing.

The upper portion of the latch reception slot 111 is open and communicates with the striker insertion slot 105.

Further, a spring insertion slot 113 is formed in the front side of the first housing 110.

The spring insertion slot 113 is disposed in the backside of the latch reception slot 111 and communicate with the latch reception slot 111.

A shaft through hole 114 is formed in the first housing 110 penetrating along the front and backside direction so as to communicate with the latch reception slot 111 and the spring insertion slot 113.

A engagement arm guide slot 115 is formed in the first housing 110 penetrating along the front and backside direction so as to communicate with the spring insertion slot 113.

The engagement arm guide slot 115 is formed in the shape of an arc.

The locking member reception slot 112 is formed penetrating along the left and right direction so as to communicate with the latch reception slot 111.

The locking member reception slot 112 is formed deeper than the latch reception slot 111.

The locking member reception slot 112 is formed along the left and right direction to have a longer length than the sum of the lengths of the main locking member 300 and the sub-locking member 400 so that the main locking member 300 and the sub-locking member 400 can be slid along the left and right direction.

In the first housing 110, the backside of the locking member receiving slot 112 for receiving the sub-locking member 400 is penetrated so that the guide bars 457*a* and 457*b* of the hooks 450 which will be described hereinafter are inserted therein.

In front of the first housing 110, a load guide slot 116 is formed along the left and right direction so as to communicate with the latch receiving slot 111 and the locking member receiving slot 112.

The load guide slot 116 is disposed in the lower portion of the latch receiving slot 111.

In the front right side of the first housing 110, a first wall 117, a second wall 118, a third wall 119, and a forth wall 121 is sequentially disposed from the upper side towards the lower side.

The first wall 117 whose center portion is downwardly protruded is formed to have steps in the left side and the right side with respect to the center thereof, and the step in the right side is deeper than the step in the left side with respect to the center.

The second wall 118 is formed in the shape of a rectangular plate.

The third wall 119 is formed in a way that the center portion is downwardly protruded, and the upper center portion is concavely formed, and a step is formed in the left side.

The fourth wall 121 whose center portion is upwardly protruded is formed to have steps in the left side and the right side with respect to the center thereof, and the step in the right side is deeper than the step in the left side with respect to the center.

In the center area of the first housing 110, a child locking cover receiving slot 122 for receiving a child locking cover 700 which will be described herein below is formed so as to communicate with the locking member receiving slot 112.

The child locking cover receiving slot 122 is disposed in the upper portion of the locking member receiving slot 112.

In the lower portion of the inner wall of the first housing 110, a bumper member insertion slot 123 for receiving a bumper member 360 is formed so as to be disposed inside the latch receiving slot 111.

The bumper member insertion slot 123 is formed to have a lower height than the height of the bumper member 360.

The bumper member 360 prevents any gap which may occur when the latch 200 is locked by the main locking member 300, and also restricts the rotation of the latch 200.

A concave portion 124 is formed in the upper surface of the first housing 110.

A guide wall body 125 is formed in the lower right side of the first housing 110.

A manual locking member 560, which will be described later, being inserted in the guide wall body 125, guides a manual locking member 560 together with a long guiding hole 517 formed in a manual locking mount 515.

A locking hook holders 126 are formed in the right backside of the upper surface of the first housing 110, in the right backside of the lower surface of the first housing 110, and in the center backside of the left side surface of the first housing 110, for coupling with the third housing 150.

A first key connect mount 127 is formed around the lower center of the backside surface of the first housing 110.

The second housing 130 comprises a vertical member 131, and a horizontal member 132 which is backwardly bended from the upper end of the vertical member 131.

The vertical member 131 is disposed in the front surface of the first housing 110 and being mounted by the bolt 133 and the like.

The horizontal member 132 is disposed on the concave portion 124 formed on the upper surface of the first housing 110.

In addition, a mounting hole is formed in front of the vertical member 131 and the first housing 110 for coupling the mounting bolt so that the door latch system can be installed in the car door.

A striker insertion slot 105 is formed across the vertical member 131 and the horizontal member 132.

The third housing 150 has a box-like shape formed with a space therein.

A PCB 900 is mounted on a PCB mount 154 formed at the inner left side of the third housing 150, and a driving unit 600 is mounted on the driving unit mount 151 formed around the inner right side and the center of the third housing 150.

A first sensor 901, a second sensor 903, a third sensor 905, a fourth sensor 907, and a fifth sensor 911 are installed in the PCB 900.

The first sensor 901 and the second sensor 903 are disposed on a same horizontal line, and the third sensor 905 and the fourth sensor 907 are disposed on a same horizontal line.

The first sensor 901 and the second sensor 903 are associated with the opening and the closing operations of the door (not shown) by detecting the movement of the first sensing unit 351 formed in the main locking member 300.

The third sensor 905 and the fourth sensor 907 are associated with the locking and the unlocking operations of the door (not shown) by detecting the movement of the second sensing unit 521 formed in the locking plate 500.

The fifth sensor 911 detects the movement of the magnetic member 636 formed in the second engagement arm 635 when the first engagement arm 633 and the second engagement arm 635 formed in the main gear 630 are being rotated by the motor 610, and makes it return to the original position (basic position) again.

A locking hooks 153 are installed in the upper right front side of the third housing 150, in the right lower front side of the third housing 150, and in the center left front side of the third housing 150.

Each of the locking hooks 153 is coupled to each of the corresponding three locking hook holders 126 formed in the first housing 110 respectively, so that the first housing 110 and the third housing 150 is coupled thereby.

A second key connect mount 152 is formed in the lower center area of the third housing 150.

A key connect 550, which will be described later, is installed in the first key connect mount 127 and the second key connect mount 152 of the first housing 110.

The latch 200 is installed in the first housing 110 so as to be disposed inside the latch receiving slot 111.

The latch 200 is pivotally and rotatably installed in the first housing 110 through the latch rotating shaft 230 which is inserted in the shaft through hole 114.

The latch 200 is formed in the shape of a plate.

A locking slot 201 in the outer circumferential surface of the latch 200.

The width of the locking slot 201 is getting wider as travelling from the inside towards the outside thereof.

The locking slot 201 is surrounded by a first surface 204 which is formed to be flat, a second surface 205 whose slope is gradually bended and extended from the left end of the first surface 203, a third surface 207 being extended from the left end of the second surface 205, forming an arc, and surrounding the stricker 101, a fourth surface 209 being extended from the upper right end of the third surface 207, and a fifth surface 211 whose slope is rapidly bended and extended from the right end of the fourth surface 209.

The locking slot 201 is formed to be penetrating along the back and forth direction, and the outer end portion thereof is open.

A spring insertion slot 213 is formed in the latch 200. The spring insertion slot 213 is formed in the shape of a hole or a slot.

A protrusion 215 is formed outwardly protruded in the left side outer circumferential surface of the latch 200.

The rotation of the latch 200 is detected by the limit switch 910, and the opening and the closing of the door (not shown) recognized thereby.

The protrusion 215 is disposed in the front of the engagement arm guide slot 115.

The locking slot 201 and the protrusion 215 are sequentially disposed along the rotating direction of the latch 200 when locking thereof.

A first return spring 250 is provided so that the latch 200 can be returned automatically when unlocked.

The first return spring 250 is inserted in the spring insertion slot 113.

The first return spring 250 is installed after being inserted into the latch rotating shaft 230.

One end of the first return spring 250 is fixed to the first housing 110, and the other end thereof is inserted into the spring insert 213.

The other end of the first return spring 250 can be rotated with the latch 200 through the spring insert 213.

The main locking member 300 is slidingly installed inside the locking member receiving slot 112 formed in the first housing 110.

The main locking member 300 is disposed in the first housing 110, and locks the latch 200.

The main locking member 300 comprises a body 310, a locking protrusion 320, a supporting protrusion 330, a horizontal bar 340, and a first sensing member 350.

The body 310 has the shape of a square column in general.

The body 310 forms the right portion of the main locking member 300.

A hook 450 is installed in the backside surface of the body 310.

The hook 450 includes a first hook 450*a* and a second hook 450*b*.

A first hook shaft 311*a* and a second hook shaft 311*b*, which are vertically spaced apart, are backwardly and protrudedly formed in the backside surface of the body 310 respectively.

The first hook shaft 311*a* and the second hook shaft 311*b* are vertically formed with a separating plate 313, which will be described later, disposed therebetween.

A first hole 451*a* of the first hook 450*a* and a second hole 451*b* of the second hook 450*b* are inserted into the first hook shaft 311*a* and the second hook shaft 311*b* respectively, so that the first hook 450*a* and the second hook 450*b* are pivotally and rotatably installed respectively.

The first hook 450*a* and the second hook 450*b* are installed vertically spaced apart, and disposed in a way that they are symmetrical to each other.

A second return spring 460 is installed in the first hook 450*a* and the second hook 450*b*.

One end of the second return spring 460 is installed in the first spring insertion hole 453*a* of the first hook 450*a*, and the other end is installed in the second spring insertion hole 453*b* of the second hook 450*b*.

In addition, the second return spring 460 is inserted into a first spring mounting slot 454*a* formed in the first hook 450*a* and the second spring mounting slot (not shown) formed in the second hook 450*b*.

Thus, after the first hook 450*a* is rotated counter clockwise by applying a force, and the second hook 450*b* is rotated clockwise by applying a force, and then, if the forces applied to the first hook 450*a* and the second hook 450*b* are removed, the first hook 450*a* is rotated clockwise, and the second hook 450*b* is rotated counter clockwise by the elastic restoring force of the second return spring 460.

That is, the elastic restoring force of the second return spring 460 is reacting along the facing direction of the first hook 450*a* and the second hook 450*b*.

The first hook 450*a* and the second hook 450*b* are installed for simultaneously sliding the main locking member 300 and the sub-locking member 400, which will be described later, or sliding only the sub-locking member 400, selectively.

A first link 455*a*, which is downwardly protruded, is formed in the first hook 450*a*, and a second link 455*b*, which is upwardly protruded, is formed in the second hook 450*b*.

The first link 455*a* may be held on or separated from the first stopping threshold 405*a* formed in a first sub-locking member 400*a*, which will be described later, and the second link 455*b* may be held on or separated from the second stopping threshold 405*b* formed in a second sub-locking member 400*b*, which will be described later.

A first guide bar 457*a*, which is backwardly protruded and extended at length, is formed in the backside surface of the first link 455*a*, and a second guide bar 457*b*, which is backwardly protruded and extended at length, is formed in the backside surface of the second link 455*b*.

The first guide bar 457*a* and the second guide bar 457*b* enable the first hook 450*a* and the second hook 450*b* to be rotated respectively, guided by the hook guiding portion 507 formed in a locking plate 500, which will be described later.

An upper member 459, which is upwardly protruded and extended in length, is formed in the right upper surface of the first hook 450*a*, and a circular protrusion 461, which is forwardly protruded, is formed in the end of the front surface of the upper member 459.

The upper member 459 and the circular protrusion 461 are formed for interlocking of a locking member 710, which will be described later, with the first hook 450*a*.

A separating plate 313 is formed between the first hook shaft 311*a* and the second hook shaft 311*b*.

The separating plate 313, which has the shape of a rectangular plate, separates the backside surface of the body 310 into the upper and the lower portions thereof.

A hook receiving wall 315 is formed in the right end of the separating plate 313.

A slope declining as it travels from right to left is formed in the upper portion of the hook receiving wall 315, a slope inclining as it travels from right to left is formed in the lower portion of the hook receiving wall 315, so that the first hook 450*a* and the second hook 450*b* are being received in the upper and the lower portions of the hook receiving wall 315 respectively.

A first rib 317 is formed in the left side of the hook receiving wall 315, and the durability of the main locking member 300 is enhanced thereby. In addition, since the first rib 317 presses the second return spring 460, the second return spring 460 is well received in the main locking member 300 without being bulged.

A locking protrusion 320 is formed in the left upper portion of the body 310, and a supporting protrusion 330 is formed in the left lower portion of the body 310.

The locking protrusion 320 locks the latch 200 by being caught on the first surface 203 of the latch 200.

The lower surface of the locking protrusion 320 is formed to be flat, and the upper surface of the locking protrusion 320 is formed to have a slope inclining as it travels from left to right.

The portion where the lower surface and the upper surface of the locking protrusion 320 are met is roundly formed.

The vertical width of the locking protrusion 320 is getting narrower as it travels from right to left.

Preferably, the end portion of the lower surface of the locking protrusion 320 has the shape corresponding to the first surface 203 of the latch 200.

The supporting protrusion 330 is formed in the lower portion of the locking protrusion 320.

The lower surface of the supporting protrusion 330 is formed to be flat, and the upper surface of the supporting protrusion 330 is formed to have a slope inclining as it travels from left to right.

The upper surface of the supporting protrusion 330 is formed to have a slope steeper than the upper surface of the locking protrusion 320.

The supporting protrusion 330 may support a portion of the outer circumferential surface of the latch 200 when the latch 200 is caught by the locking protrusion 320.

The horizontal bar 340 is formed in length towards the left side in the left lower portion of the body 310.

The horizontal bar 340 is being slid inside the load guiding slot 116 so that the sliding of the main locking member 300 can be performed more stably.

A first sensing member 350 is formed in the left end of the horizontal bar 340.

The first sensing member 350 is formed in length along the forward and backward direction at the left end of the horizontal bar 340.

The first sensing member 350 is more extended towards the backside than the front side with respect to the point where the horizontal bar 340 is met therewith.

A first sensing unit 351 is installed in the backside end of the first sensing member 350.

The first sensing unit 351 may operate or stop the motor 610, which will be described later, since the horizontal movement is detected by the first sensor 901 and the second sensor 903 which are horizontally aligned in a position corresponding to the first sensing unit 351 on the PCB 900.

In here, the first sensing unit 351 may be a magnet and the like.

A sub-locking member 400 is disposed in the right side of the main locking member 300.

The sub-locking member 400 is slidingly installed inside the locking member receiving slot 112 formed in the first housing 110 same as the main locking member.

A door lever connecting unit 800 is connected to the sub-locking member 400.

The sub-locking member 400 includes a first sub-locking member 400*a* and a second sub-locking member 400*b* having the shape of a block.

The door lever connecting unit 800 includes a door in lever connecting unit 800*a* connected to the door in lever (not shown) and a door out lever connecting unit 800*b* connected to the door out lever (not shown).

The first sub-locking member 400*a* is disposed in the upper portion of the second sub-locking member 400*b*.

The door in lever connecting unit 800*a* is connected to the first sub-locking member 400*a*.

The first sub-locking member 400*a* includes a first stopping member receiving slot 401*a*, a first stopping threshold 405*a*, and a horizontal portion 407.

The second sub-locking member 400*b* includes the second stopping member receiving slot 401*b* and a second stopping threshold 405*b*.

The front side and the right side of first stopping member receiving slot 401*a* and the second stopping member receiving slot 401*b* are open.

A first stopping member 801*a* of the door in lever connecting unit 800*a* is being received inside the first stopping member receiving slot 401*a*.

A second stopping member 801*b* of the door out lever connecting unit 800*b* is being received inside the second stopping member receiving slot 401*b*.

The first sub-locking member 400*a* and the first stopping member 801*a* of the door in lever connecting unit 800*a* located inside the first stopping member receiving slot 401*a* will not be separated towards the front side because of the second housing 130 installed across the front surface and the upper surface of the first housing 110.

The second sub-locking member 400*b* and the second stopping member 801*b* of the door out lever connecting unit 800*b* located inside the second stopping member receiving slot 401*b* will not be separated towards the front side because of the second housing 130 installed across the front surface and the upper surface of the first housing 110.

The first stopping member receiving slot 401*a* is formed in length along the left to right direction, so that the first stopping member 801*a* of the door in lever connecting unit 800*a* can be moved left and right when the door in lever (not shown) is being operated.

The second stopping member receiving slot 401*b* is formed in length along the left to right direction, so that the second stopping member 801*b* of the door out lever connecting unit 800*b* can be moved left and right when the door out lever (not shown) is being operated.

A first pulling hole 403*a*, from which the door in lever connecting unit 800*a* is being pulled, is formed with one side open in the right end of first stopping member receiving slot 401*a* in a way that the first pulling hole 403*a* is formed to have a smaller diameter than that of the first stopping member 801*a*, so that the first stopping member 801*a* cannot be pulled out through the first pulling hole 403*a* even when the door in lever connecting unit 800*a* is being pulled out to the right side.

Thus, the first sub-locking member 400*a* is being slid towards the right side when the door in lever connecting unit 800*a* is being pulled towards the right side.

A second pulling hole 403*b*, from which the door out lever connecting unit 800*b* is being pulled, is formed with one side open in the right end of second stopping member receiving slot 401*b* in a way that the second pulling hole 403*b* is formed to have a smaller diameter than that of the second stopping member 801*b*, so that the second stopping member 801*b* cannot be pulled out through the second pulling hole 403*b* even when the door out lever connecting unit 800*b* is being pulled out to the right side.

Thus, the second sub-locking member 400*b* is being slid towards the right side when the door out lever connecting unit 800*b* is being pulled towards the right side.

A first spring 803*a* is inserted into the door in lever connecting unit 800*a*.

The first spring 803*a*, disposed between the right end of the first sub-locking member 400*a* and the second wall 118 of the first housing 110, returns the first sub-locking member 400*a*, which is being slid to the right side by pulling the door in lever connecting unit 800*a* to the right side, to its original position by being slid to the left side because of the elastic restoring force of the first spring 803*a*.

A second spring 803*b* is inserted into the door out lever connecting unit 800*b*.

The second spring 803*b*, disposed between the right end of the second sub-locking member 400*b* and the left side of the protruded portion formed in the center of the third wall 119 and the fourth wall 121 of the first housing 110, returns the second sub-locking member 400*b*, which is being slid to the right side by pulling the door out lever connecting unit 800*b* to the right side, to its original position by being slid to the left side due to the elastic restoring force of the second spring 803*b*.

A first stopping threshold 405*a* is formed in the backside of the first sub-locking member 400*a*, and a second stopping threshold 405*b* is formed in the backside of the second sub-locking member 400*b*.

The right side surface of the first stopping threshold 405*a* is formed to be flat, and the left side surface is roundly formed, and the width left to right is getting narrower as it travels from the lower side towards the upper side.

The right side surface of the second stopping threshold 405*b* is formed to be flat, and the left side surface is roundly formed, and the width left to right is getting wider as it travels from the lower side towards the upper side.

The first stopping threshold 405*a* and the second stopping threshold 405*b* are symmetrical in shape to each other.

The first link 455*a* of the first hook 450*a* can be caught by or separated from the first stopping threshold 405*a*, and the second link 455*b* of the second hook 450*b* can be caught by or separated from the second stopping threshold 405*b*.

The first hook 450*a*, the second hook 450*b*, the first stopping threshold 405*a*, and the second stopping threshold 405*b* are the connecting means for sliding the main locking member 300 and the sub-locking member 400 together, or sliding only the sub-locking member 400.

While the first hook 450*a* is caught by the first stopping threshold 405*a*, and the second hook 450*b* is caught by the second stopping threshold 405*b*, and if the door in lever (not shown) or the door out lever (not shown) is being pulled, then the main locking member 300 and the sub-locking member 400 are being slid together towards the left side.

That is, this is an unlocked state of the door (not shown).

On the contrary, while the first hook 450*a* is separated from the first stopping threshold 405*a*, and the second hook 450*b* is separated from the second stopping threshold 405*b*, and if the door in lever (not shown) or the door out lever (not shown) is being pulled, then only the sub-locking member 400 is being slid towards the left side, however, the main locking member 300 is standing still.

That is, this is a locked state of the door (not shown).

The first sub-locking member 400*a* is provided with a horizontal portion 407 extending from the lower portion of the right side surface towards the right side direction which is an outward direction.

The horizontal portion 407 includes a first inclined portion 409 in the right side surface thereof.

The horizontal portion 407 is disposed between the second wall 118 and the third wall 119 of the first housing 110, and being slid along the left and right direction.

The first inclined portion 409 is in contact with the second inclined portion 563 of the manual locking member 560 which will be described later.

The locking plate 500 is formed in length along the left and right direction.

The locking plate 500 is slidingly installed in the backside surface of the first housing 110.

The locking plate 500 includes a unlocking cable connecting portion 501, a bending member 503, a door locking surface 509, an inclined surface 511, a door unlocking surface 513, a manual locking mount 515, and the second sensing member 519.

The unlocking cable connecting portion 501 is disposed in the left end side of the locking plate 500.

An unlocking cable 810 is connected in the left end of the unlocking cable connecting portion 501, and the unlocking cable 810 is being pulled towards the left side or the right side when the knob (not shown) and the like is operated, thus, the locking plate 500 is moved towards the left side or the right side.

The bending member 503 is formed in the right end of the unlocking cable connecting portion 501.

The bending member 503 is formed to be a plate-like shape having steps therein.

A rectangular hole 505 is formed in the upper right portion of the bending member 503.

An engagement protrusion 506 is formed in the lower right portion of the bending member 503.

The engagement protrusion 506 is a cylindrical protrusion for manually sliding the locking plate 500 using the key connect 550.

The key connect 550 comprises: a head 551 wherein a cross-shaped slot is formed; a wing 553 having a opening 555 wherein a portion of a disk having a larger diameter than that of the head 551 has been cut-off; and an upper protrusion 557 upwardly protruded from the center of the wing 553.

The key connect 550 is installed in the lower portion of the housing 100, and the engagement protrusion 506 is positioned inside the opening 555 of the key connect 550.

At this time, if the head 551 of the key connect 550 is manually rotated using a tool such as a key or a driver or the like, the locking plate 500 can be slid along the left and right direction without driving the driving unit 600.

More specifically, if the head 551 of the key connect 550 is rotated, the engagement protrusion 506 positioned inside the opening 555 is pushed by the both of the side surfaces inside the opening 555, thus, the locking plate 500 is moved along the left to right direction.

In other words, the linear movement of the locking plate 500 is occurring due to the rotational movement of the key connect 550.

Therefore, the door (not shown) can be manually locked or unlocked by using the key connect 550.

A hook guiding portion 507 is formed in the right end of the bending member 503.

The door locking surfaces 509 are located in the upper and the lower sides respectively in the left end of the hook guiding portion 507, and the inclined surfaces 511 are located in the upper and the lower side respectively in the center of the hook guiding portion 507, and the door unlocking surfaces 513 are located in the upper and the lower side respectively in the right end of the hook guiding portion 507.

The door locking surfaces 509, the inclined surfaces 511, and the door unlocking surfaces 513 are connected together.

The width of between the inclined surfaces 511 is getting narrower as it travels from the left side towards the right side.

The upper surface of the hook guiding portion 507 guides the first guide bar 457*a* of the first hook 450*a*, and the lower surface of the hook guiding portion 507 guides the second guide bar 457*b* of the second hook 450*b*.

When the first guide bar 457*a* and the second guide bar 457*b* are positioned in the upper and the lower door locking surfaces 509 respectively, the first hook 450*a* and the second hook 450*b* are being separated from the first stopping threshold 405*a* of the first sub-locking member 400*a* and the second stopping threshold 405*b* of the second sub-locking member 400*b* respectively, thus, the door (not shown) is now in a locked state.

When the first guide bar 457*a* and the second guide bar 457*b* are positioned in the upper and the lower inclined surfaces 511 respectively, the first hook 450*a* and the second hook 450*b* are being rotated towards the first stopping threshold 405*a* of the first sub-locking member 400*a* and the second stopping threshold 405*b* of the second sub-locking member 400*b* respectively.

When the first guide bar 457*a* and the second guide bar 457*b* are positioned in the upper and the lower door unlocking surfaces 513 respectively, the first hook 450*a* and the second hook 450*b* are being caught by the first stopping threshold 405*a* of the first sub-locking member 400*a* and the second stopping threshold 405*b* of the second sub-locking member 400*b* respectively, thus, the door (not shown) is now in an unlocked state.

In this way, the hook guiding portion 507 rotates the first hook 450*a* and the second hook 450*b* according to the sliding of the locking plate 500 along the left and right direction, and the door (not shown) may either be locked or unlocked thereby.

A manual locking member mount 515 is formed in the right side of he hook guiding portion 507.

The manual locking member mount 515 is shaped like a Korean letter 'ㄷ' when viewing from the front thereof, wherein the front, the back, and the right sides are open.

In the upper and the lower surfaces of the manual locking member mount 515, two identical guide long holes 517, having an inclining slope as it travels from the left side towards the right side when viewing from the top, are formed respectively.

The manual locking members 560, provided with the coupling protrusions 561 in the upper and the lower surfaces thereof respectively, are installed in each of the upper and the lower guide long holes 517 respectively, and guided by the guide long holes 517.

The manual locking members 560 has the shape of a parallelepiped having a protruded portion in the front surface thereof.

A second inclined portion 563 having a slope declining as it travels from the left side towards the right side is formed in the front side of the manual locking member 560.

The second inclined portion 563 is in contact with the horizontal portion 407 of the first sub-locking member 400*a*.

When the hook 450 is separated from the stopping threshold 405, if the door in lever (not shown) is pulled once, the horizontal portion 407 formed in the first sub-locking member 400*a* pushes the manual locking member 560 towards the backside direction. Due to this action, the locking plate 500 is being slid towards the right side, and the hook 450 is caught on the stopping threshold 405.

This will be described in detail hereinafter when describing the operational states.

A second sensing member 519 is formed in the backside surface of the bending member 503.

The second sensing member 519 has a shape extended from the backside surface of the bending member 503 towards the backside and bended towards the left side.

The second sensing member 519 is L-shaped when viewing from the top.

A portion of the left end side of the second sensing member 519 is upwardly bended.

The second sensing member 519 enables the locking plate 500 to be moved being pushed by the first engagement arm 633 and the second engagement arm 635 formed in the main gear 630 when the main gear is rotated driven by the motor 610.

The second sensing member 519 is characterized in that the left-to-right width of the portion backwardly extended from the backside surface of the bending member 503 is larger than the front-to-back width of the portion bended towards the left side.

In the second sensing member 519, a second sensing unit 521 is installed around the center of backside surface of the bended portion bended towards the left side.

The second sensing unit 521 enables to detect the locking and unlocking of the door (not shown) accurately by detecting the horizontal movement using the third sensor 905 and the fourth sensor 907 horizontally installed in the position corresponding to the second sensing unit 521 on the PCB 900.

In here, the second sensing unit 521 may be a magnet and the like.

The locking plate 500 rotates the hook 450 by sliding along the left and right direction.

In other words, the first hook 450*a* and the second hook 450*b* are being rotated by the sliding, that is, the linear movement, of the locking plate 500.

The first hook 450*a* and the second hook 450*b*, that have been pivotally rotated, are caught by or separated from the first stopping threshold 405*a* and the second stopping threshold 405*b*, and let the main locking member 300 and the sub-locking member 400 slide together, or only let the sub-locking member 400 slide.

That is, the door (not shown) is locked or unlocked according to the linear movement along the left and right direction of the locking plate 500.

The linear movement along the left and right direction of the locking plate 500 may be performed automatically, but it may also be performed manually.

The driving unit 600 includes a motor 610, a sub-gear 620 being rotated by the motor 610, and a main gear 630 geared with the sub-gear 620 and being rotated.

The driving unit 600 is disposed in the backside surface of the first housing 110.

The driving unit 600 is disposed inside and between the first housing 110 and the third housing 150.

The motor 610 is installed inside the motor case 640 and connected to the PCB 900 so that it may generate the driving force or stop the generation of driving force by receiving the signal from the PCB 900.

A worm gear 613 is installed in the rotating shaft 611 of the motor 610.

The sub-gear 620 is engaged with the worm gear 613 installed in the rotating shaft 611 of the motor 610.

The sub-gear 620 is rotated by the driving force transferred from the motor 610.

The sub-gear 620 is engaged with the main gear 630.

The main gear 630 receives the driving force of the motor 610 via the sub-gear 620.

An engagement arm 631 is formed in the front surface of the main gear 630 for rotating the latch 200, and a first engagement arm 633 and a second engagement arm 635 are formed in the backside surface of the main gear 630 for sliding the locking plate 500.

In addition, a second rib 637 radially shaped along the circumference formed spaced apart with a predetermined distance is formed in the backside surface of the main gear 630.

The second rib 637 enhances the durability of the main gear 630.

The engagement arm 631 restricts the latch 200 to the main locking member 300 by rotating the latch 200 with the driving force of the motor if the door (not shown) is not fully closed when closing the door (not shown).

The first engagement arm 633 and the second engagement arm 635 are backwardly protruded from the backside surface of the main gear 630.

The first engagement arm 633 and the second engagement arm 635 are spaced apart from each other.

The first engagement arm 633 and the second engagement arm 635 slide the locking plate 500 towards the left side or the right side by pushing the partially bended portion towards the upper side of the left end of the second sensing member 519 according to the rotation of the main gear 630.

The size of the first engagement arm 633 is relatively small than the second engagement arm 635.

The first engagement arm 633 and the second engagement arm 635 move the locking plate 500 towards the opposite directions from each other.

A magnetic member 636, which is capable of detecting the position of the second engagement arm 635 using the sensor in the PCB 900, is installed in the second engagement arm 635, so that it can be returned to its original (basic) position again by the operation of the motor 610 after the rotation of the first engagement arm 633 and the second engagement arm 635.

Since the opening and the closing of the door (not shown) using the latch 200, and the locking and the unlocking of the door (not shown) using the locking plate 500 can be performed by one driving unit 600, the structure is simple, and it can be compactly configured, and the manufacturing cost can be reduced.

A motor mounting base 643, a space wherein the motor 610 is accommodated, is formed.

A connecting member connecting the motor 610 and the PCB 900 may be mounted in the motor case 640.

Two pairs (each pair has one hook in the upper side and another hook in the lower side) of the motor case hooks 641 are formed in the center area and the right end of the backside of the motor case 640 respectively.

The motor case 640 can be easily assembled to the third housing 150 with a single touch due to the motor case hooks 641.

In addition, a protection unit 645 is provided in the motor case 640 for protecting the worm gear 613 of the motor 610 and the sub-gear 620 engaged with the worm gear 613, so that the safety of the geared portion between the worm gear 613 and the sub-gear 620 is enhanced, and the operation thereof is protected from being interfered.

The child locking cover 700 is installed in the upper side of the sub-locking member 400.

More specifically, the child locking cover 700 is disposed in the upper portion of the first sub-locking member 400*a*.

The straight line type steps 701 are formed on both side surfaces of the child locking cover 700, and slidingly accommodated inside the child locking cover receiving slot 122 of the first housing 110.

The front outline of the child locking cover 700 and the front outline of the child locking cover receiving slot 122 are identical.

A space is formed inside of the child locking cover 700.

A circular hole 703 and an arc-like long hole 705 roundly formed from the left side towards the lower side of the circular hole 703 are formed in the front surface of the child locking cover 700.

The stopping pieces 707 are formed in the both end portions of the arc-like long hole 705 along the width direction thereof respectively.

A child locking member 710 is inserted into the space inside the child locking cover 700.

A first circular protrusion 711 is formed in the upper front surface of the child locking member 710, and a second circular protrusion 713 is formed in the lower portion of the first circular protrusion 711.

In addition, a supporting step 715 protrudedly extended towards the backside is formed in the right side surface of the child locking member 710.

The supporting step 715 is formed in length along the vertical direction.

The diameter of the first circular protrusion 711 is larger than the second circular protrusion 713.

A straight line type slot 717 is formed in the front surface of the first circular protrusion 711.

The straight line type slot 717 is provided for rotating the first circular protrusion 711 manually.

The first circular protrusion 711 is inserted into the circular hole 703 of the child locking cover 700, and the second circular protrusion 713 is inserted into the arc-like long hole 705.

The child locking member 710 is pivotally rotatable using the first circular protrusion 711 as a shaft, and the second circular protrusion 713 is being rotated within the allowed range of movement inside the arc-like long hole 705.

The second circular protrusion 713 may be fixed at the both ends of the arc-like long hole 705.

The first hook 450*a* may be caught on or separated from the first stopping threshold 405*a* by the pivotal movement of the child locking member 710.

The door latch system of the present invention can perform unlocking operation without any functional jamming even unlocking operation is performed while the door lever (not shown) is being pulled under the locking state of the door (not shown).

This will be described in sequence as follows.

The door lever (not shown) of the door (not shown), which is under locked state, is being pulled.

At this time, since the hook 450 is opened and not holding the sub locking member 400, the sub locking member 400 is being slid towards the opposite side of the main locking member 300 along the door lever (not shown) which is being pulled without affecting the main locking member 300.

If unlocking operation is performed using a key, a remocon, and the like during performing such operation, the opened hooks 450 rotate inwardly in order to be connected to the sub-locking member 400.

However, since the hooks 450 are rotated while the door lever (not shown) is being pulled, the hooks 450 are not connected to the sub-locking member 400 which is spaced apart from the main locking member 300, but instead, the hooks 450 are entered into the space separated between the main locking member 300 and the sub-locking member 400.

At this time, if the door lever (not shown), which is being pulled, is released, the sub-locking member 400 is moved towards the main locking member 300 due to the elastic restoring force of the spring.

The hooks 450 are lifted by the approaching force of the sub-locking member 400, later the sub-locking member 400 enters inside the hooks 450, and the coupling of the hooks 450 to the sub-locking member 400 is completed thereby.

The door latch system of the present invention, can monitor the opening and closing states of the door (not shown) in conjunction with a room lamp (not shown), an instrument panel (not shown), and the like by detecting the rotation of the latch 200 using the sensors installed in the PCB 900.

In this way, the user may easily recognize the opening and closing state of the door (not shown).

Hereinafter, an operational process of the door latch system having the aforementioned configuration and according to the first exemplary embodiment of the present invention will be described.

<Door Closing>

As illustrated in FIGS. 14 to 19, when the user closes the door (not shown), the striker 101 presses the latch 200, and the latch 200 is rotated in a clockwise direction thereby.

The latch 200 masks the limit switch 910 when being rotated in a clockwise direction, and the limit switch 910 detects and recognizes that the door (not shown) is closing, however, the motor 610 is not operating yet.

The latch 200 further rotates in a clockwise direction, and thus, the outer circumferential surface of the latch 200 pushes the locking protrusion 320 of the main locking member 300, and due to this action, the main locking member 300 is pushed towards the right side.

As the main locking member 300 is pushed to the right, the first sensor 901 recognizes that the first sensing unit 351 installed in the left end of the main locking member 300 is off from the detectable position of the first sensor 901, and accordingly the PCB 900 transmits a signal to the motor 610, and then the motor 610 is being operated thereby.

That is, the motor 610 is being driven only when the detection by the limit switch 910 and the first sensor 901 are all satisfied.

Due to this configuration, the erroneous operation of the motor 610 is prevented when the door (not shown) is opened.

The protrusion 215 of the latch 200 is pushed in a clockwise direction by the clockwise rotation of the engagement arm 631 installed in the front surface of the main gear 630 due to the operation of the motor 610, and due to this action, the outer circumferential surface of the latch 200 pushes the upper surface of the locking protrusion 320, and since at the time when the outer circumferential surface of the latch 200 and the upper surface of the locking protrusion 320 are being separated from each other, the first surface 203 of the latch 200 is caught on the lower surface of the locking protrusion 320 of the main locking member 300, thus, the door (not shown) is closed.

The reason why at this time the first surface 203 of the latch 200 is caught on the lower surface of the locking protrusion 320 of the main locking member 300 is that the locking protrusion 320 of the main locking member 300 is being positioned inside the locking slot 201 after being slid from right side towards the left side by the elastic force of the first spring 803*a* and the second spring 803*b*, so that it is caught on the first surface 203 of the latch 200.

Later, the motor 610 determines whether the engagement arm 631 is rotated to the locking position (door closing position) using the sensor installed in the PCB 900, and when it is detected that the engagement arm 631 is rotated to the locking position (door closing position), the engagement arm 631 is rotated in a counter clockwise direction by the motor 610 and returned to the unlocking position, and thereafter the operation of the motor 610 is stopped.

When an emergency such as a safety problem and the like occurs while the door (not shown) is being closed, the door lever (not shown) is pulled, then the first sensing unit 351 which has been moved to the right side is detected by the second sensor 903, and the motor 610 is rotated in a reverse direction so that the engagement arm 631 is sent to the unlocking position, and the door 1 can be opened thereby.

<Door Locking>

The operation that an unlocked state of a door (not shown) becomes a locked state by a key, a locking button, a knob, a door out lever sensor, start, and a preset critical value of a vehicle speed and the like will be described.

As illustrated in FIGS. 20 to 22, when locking operation is performed on the door (not shown) which is in an unlocked state by any one of a key, a locking button, a knob, a door out lever sensor, start, and a preset critical value of a vehicle speed and the like, then the main gear 630 is being rotated in a counter clockwise direction by the motor 610.

When the main gear 630 is being rotated in a counter clockwise direction, the locking plate 500 is being pushed and slid by the second engagement arm 635 which is located in the backside surface of the main gear 630.

At this time, the locking plate 500 is being moved to the right side, the first hook 450*a* and the second hook 450*b* are more separated from each other along the inclined surfaces 511 of the locking plate 500, and the first hook 450*a* and the second hook 450*b* are being separated from the first sub-locking member 400*a* and the second sub-locking member 400*b* respectively, and the state of the door (not shown) becomes a locked state, therefore, the force will not be transferred to the main locking member 300 when the door lever (not shown) is being pulled.

The second engagement arm 635 pushes the locking plate 500 until the second sensing unit 521 formed in the backside of the locking plated 500 is moved from the detecting position of the third sensor 905 to the detecting position of the fourth sensor 907, and returns to its original position.

<Door Unlocking>

The operation that a locked state of a door (not shown) becomes an unlocked state by a key, a locking button, a knob, a door out lever sensor, arrive, and a preset critical value of a vehicle speed and the like will be described.

As illustrated in FIGS. 23 to 25, when unlocking operation is performed on the door (not shown) which is in a locked state by any one of a key, a locking button, a knob, a door out lever sensor, arrive, and a preset critical value of a vehicle speed and the like, then the main gear 630 is being rotated in a clockwise direction by the motor 610.

When the main gear 630 is being rotated in a clockwise direction, the locking plate 500 is being pushed and slid by the first engagement arm 633 which is located in the backside surface of the main gear 630.

At this time, the locking plate 500 is being moved to the left side, the first hook 450*a* and the second hook 450*b* come more closer to each other along the inclined surfaces 511 of the locking plate 500, and the first hook 450*a* and the second hook 450*b* are being caught on the second sub-locking member 400*b* and the second sub-locking member 400*b* respectively, and the state of the door (not shown) becomes an unlocked state, therefore, the force will be transferred to the main locking member 300 when the door lever (not shown) is being pulled.

The first engagement arm 633 pushes the locking plate 500 until the second sensing unit 521 formed in the backside of the locking plated 500 is moved from the detecting position of the fourth sensor 907 to the detecting position of the third sensor 905, and returns to its original position.

<Door Locking from Inside the Car Using Child Locking Member>

As illustrated in FIGS. 26 to 28, the first hook 450*a* is caught on the first stopping threshold 405*a*, and the second hook 450*b* is caught on the second stopping threshold 405*b*, which is an unlocked state of a door (not shown).

At this time, the circular protrusion 461 formed on the upper side of the upper member 459 of the first hook 450*a* is positioned inside the child locking cover 700.

In this case, when the straight line type slot formed in the child locking member 710 is being rotated the child locking member 710 is pivotally rotates along the arc-like long hole 705, and along this action, the supporting step 715 formed in the locking member 710 lifts up the circular protrusion 461 formed in the first hook 450*a*.

At this time, the lower portion of the circular protrusion 461 is placed on the upper portion of the supporting threshold 715 and supported by the supporting threshold 715.

Due to such an operation, the first hook 450*a* is separated from the first stopping threshold 405*a* so that the first sub-locking member 400*a* is not sliding with the main locking member 300.

That is, when the door in lever (not shown) is being pulled, only the first sub-locking member 400*a* can be sliding, therefore, the internal side door (not shown) is in a locked state.

Such a locked state can be released only when the child locking member 710 is pivotally rotated downwards, thus, the children and the elderly can be protected from the accidents caused by the unexpected opening and closing of the door (not shown).

In addition, preferably, the door (not shown) locking function from inside the car using the child locking member is installed only in the backside seats.

<Unlocking of the Door from Inside the Car Using Door in Lever>

As illustrated in FIGS. 29 to 33, if the door in lever (not shown) is being pulled once when the door (not shown) is in a locked state, the first sub-locking member 400*a* is being slid to the right side.

At this time, the first inclined portion 409 formed in the horizontal portion 407 of the first sub-locking member 400*a* is being slid towards the right side, and the at the same time, pushes the second inclined portion 563 of the manual locking member 560.

The manual locking member 560 is trying to incline towards diagonal direction along the guide long hole 517 being pushed by the first inclined portion 409 of the first sub-locking member 400*a*, however, since the manual locking member 560 is inserted into the guide wall body 125 formed in the first housing 110 and guided in a way that only forward and backward movement is allowed, the locking plate 500 is being moved towards the left side when the manual locking member 560 is pushed by the horizontal portion 407 of the first sub-locking member 400*a*.

As the locking plate 500 is moved towards the left side, the first hook 450*a* and the second hook 450*b* move downwards along the inclined surfaces 511 of the locking plate 500, and being positioned on the door unlocking surface 513.

At this state, if the door in lever (not shown), which is being pulled, is released, the first sub-locking member 400*a* is moved towards the left side and caught on the first hook 450*a*, and due to this action, the main locking member 300 and the sub-locking member 400 are being slid together, and the door (not shown) is in an unlocked state thereby.

At this time, when the door in lever (not shown) is being pulled one more time, the latch 200 is separated from the locking protrusion 320 of the main locking member 300, and the door (not shown) is opened.

Embodiment 2

In describing the door latch system according to the second exemplary embodiment of the present invention, same symbols will be used for the same or the similar elements as those of the door latch system according to the first exemplary embodiment of the present invention, and the detailed description and illustration will be omitted.

As illustrated in FIGS. 34 to 40, the door latch system according to the second exemplary embodiment of the present invention further includes a rotating member 370 for sliding the main locking member 300' by the latch 200.

Since only the body 310' of the main locking member 300' is formed in a different form than that of the first exemplary embodiment of the present invention, only the body 310' will be described and the description about the other identical configurations will be omitted.

The body 310' constitutes the right portion of the main locking member 300'.

The body 310' comprises the first step portion 311' and the second step portion 313'.

The first step portion 311' constitutes the upper portion of the body 310', and the second step portion 313' constitutes the lower portion of the body 310'.

A rotating member receiving slot 315' is formed in front of the first step portion 311' wherein the rotating member 370, which will be described later, will is disposed.

The second step portion 313' is formed in the lower portion of the first step portion 311'.

The second step portion 313' is forwardly protruded towards the front side than the first step portion 311'.

A rotating member insertion slot 317' is formed in the upper portion of the second step portion 313' wherein a portion of the rotating member, which will be described later, is inserted.

The rotating member insertion slot 317' is formed to communicate with the rotating member receiving slot 315'.

The front and the upper portion of the rotating member insertion slot 317' are open.

The front of the rotating member insertion slot 317' is closed by installing the second housing 130.

The left side surface and the right side surface forming the rotating member insertion slot 317' have the slopes whose slopes are inclining as they travel from the left side towards the right side.

The length of the inclined slope of the left side surface constituting the rotating member insertion slot 317' is shorter than that of the right side surface.

The lower side surface forming the rotating member insertion slot 317' has a slope whose slope is declining as it travels from the left side towards the right side.

The vertical depth of the slot of the rotating member insertion slot 317' is getting deeper as it travels from the left side towards the right side.

The left side portion of the second step portion 313' comprises a supporting protrusion 330'.

The lower side surface of the supporting protrusion 330' is horizontally formed, and the upper side surface of the supporting protrusion 330' is formed to have a slope inclining as it travels from the left side towards the right side.

The supporting protrusion 330' can support a portion of the outer circumferential surface of the latch 200 when the latch 200 is being caught on the rotating member 370 which will be described later.

The rotating member 370 is disposed in the rotating member receiving slot 315' formed in the front side of the first step portion 311' of the main locking member 300'.

The rotating member 370 is installed in the front side of the first housing 110, and installed so that it can be pivotally rotated by the rotating shaft 380.

The rotating shaft 380 is installed penetrating the upper portion of the rotating member 370.

Preferably, the rotating shaft 380 is a rivet.

The rotating member 370 can pivotally rotated in a clockwise or a counter clockwise direction with respect to the rotating shaft 380.

The rotating member 370 and the rotating shaft 380 is connected by the rotating spring 390.

The rotating spring 390 applies a force to the rotating member 370 and pushes it towards the counter clockwise direction, and when the force is released, an elastic force, which pivotally rotates the rotating member 370 towards the clockwise direction, is generated, and returns (the rotating member) to its original position.

The rotating member 370 comprises a locking portion 371 and an inserting protrusion 373.

The lower portion of the left side of the locking portion 371 is protruded towards the left side, and the right side thereof is formed to be flat.

A latch insertion slot is formed in the lower portion of the locking portion 371 wherein a portion of the end (first surface 203) of the latch 200 is being inserted when closing the door.

The latch insertion slot is formed to have an open lower portion.

The locking portion 371 restricts the position of the latch 200.

An inserting protrusion 373, which is downwardly protruded, is formed in the right side of the lower surface of the locking portion 371.

The inserting protrusion 373 is positioned inside the rotating member insertion slot 317'.

The inserting protrusion 373 slides the main locking member 300' along the left and right direction according to the pivotal rotation of the rotating member 370.

Preferably, the width in the left and right direction of the inserting protrusion 373 is formed to be formed narrower than the width in the left and right direction of the rotating member insertion slot 317'.

Since the rotating member 370 is pivotally rotated by the latch 200 and the main locking member 300' is being slid, a user can feel the door closing operation more softly, and the strength of the door latch system can be increased as well.

<Door Closing>

As shown in FIGS. 35 to 40, when the user closes the door (not shown), the striker 101 installed in the car body presses the latch 200, and the latch 200 is rotated in a clockwise direction thereby.

The latch 200 masks the limit switch 910 when being rotated in a clockwise direction, and the limit switch 910 detects and recognizes that the door (not shown) is closing, however, the motor 610 is not operating yet.

The latch 200 further rotates in a clockwise direction, and thus, the outer circumferential surface of the latch 200 pushes the locking portion 371 of the rotating member 370, and thus the rotating member 370 is being rotated in the counter clockwise, and the inserting protrusion 373 of the rotating member 370 pushes the right side surface forming the rotating member insertion slot 317', thus, the main locking member 300' is being pushed towards the right side thereby.

As the main locking member 300' is pushed to the right, the first sensor 901 recognizes that the first sensing unit 351 installed in the left end of the main locking member 300' is off from the detectable position of the first sensor 901, and accordingly the PCB 900 transmits a signal to the motor 610, and then the motor 610 is being operated thereby.

That is, the motor 610 is being driven only when the detection by the limit switch 910 and the first sensor 901 are all satisfied.

Due to this configuration, the erroneous operation of the motor 610 is prevented when the door (not shown) is opened.

The protrusion 215 of the latch 200 is pushed in a clockwise direction by the clockwise rotation of the engagement arm 631 installed in the front surface of the main gear 630 due to the operation of the motor 610, and due to this action, the outer circumferential surface of the latch 200 pushes the upper surface of the locking protrusion 320, and since at the time when the outer circumferential surface of the latch 200 and the upper surface of the locking portion 371 are being separated from each other, the first surface 203 of the latch 200 is caught on the lower surface of the locking portion 371 of the rotating member 370, thus, the door (not shown) is closed.

The reason why at this time the first surface 203 of the latch 200 is caught on the lower surface of the locking portion 371 of the rotating member 370 is that the locking portion 371 of the rotating member 370 is being positioned inside the locking slot 201 after being rotated in a clockwise direction by the elastic force of the rotating spring 390, so that it is caught on the first surface 203 of the latch 200.

Later, the motor 610 determines whether the engagement arm 631 is rotated to the locking position (door closing position) using the sensor installed in the PCB 900, and when it is detected that the engagement arm 631 is rotated to the locking position (door closing position), the engagement arm 631 is rotated in a counter clockwise direction by the motor 610 and returned to the unlocking position, and thereafter the operation of the motor 610 is stopped.

When an emergency such as a safety problem and the like occurs while the door (not shown) is being closed, the door lever (not shown) is pulled, then the first sensing unit 351 which has been moved to the right side is detected by the second sensor 903, and the motor 610 is rotated in a reverse direction so that the engagement arm 631 is sent to the unlocking position, and the door 1 can be opened thereby.

Embodiment 3

As illustrated in FIGS. 41 to 72, the door latch system according to the first exemplary embodiment of the present invention is characterized in that and includes: a housing 4100; a latch 4200 pivotally and rotatably installed in the housing 4100; a main locking member 4300 slidingly installed in the housing 4100 for locking the latch 4200; and a driving unit 4600 for pivotally rotating the latch 4200, wherein the driving unit 4600 comprises a main gear 4630, and a geared portion 4632 wherein gear teeth are formed in a portion of the peripheral surface of the main gear 4630 and a non-geared portion 4643 (without gear teeth) is formed in the remaining portion of the peripheral surface thereof.

As illustrated in FIGS. 41 to 44, the housing 4100 includes a first housing 4110, a second housing 4130 disposed in front of the first housing 4100, and the third housing 4150 disposed in the backside of the first housing 4100.

A striker insertion slot 4105 is formed in the upper front side of the housing 4100 wherein the striker 4101 is inserted.

Thus, the striker insertion slot 4105 is formed in the first housing 4110 and the second housing 4130.

As illustrated in FIG. 45, the first housing 4110 is formed in the shape of a block, wherein a latch receiving slot 4111 for receiving the latch 4200 which will be described later, a main locking member 4300 which will be described later, and a locking member receiving slot 4112 for receiving the sub-locking member 4400 are formed.

The front and the upper portion of the latch receiving slot 4111 are formed to be open and communicate with the striker insertion slot 4105.

Further, a spring insertion slot 4113 is formed in the front side of the first housing 4110.

The spring insertion slot 4113 is disposed in the backside of the latch receiving slot 4111 and communicates with the latch receiving slot 4111. One end of the first return spring 4250 which will be described later is fixed to the spring insertion slot 4113 of the first housing 4110, and the other end is being inserted into the spring insertion slot 4213 so that it can be rotated together with the latch 4200.

A shaft through hole 4114 is installed in the first housing 4110 penetrating through the forward and backward direction so as to communicate with the latch receiving slot 4111.

A sixth sensor insertion hole 4129 is formed in the first housing 4110 penetrating through the forward and backward direction wherein the sixth sensor 4910, which will be described later, is inserted so as to communicate with the latch receiving slot 4111. The sixth sensor insertion hole 4129 is disposed in the lower portion of the striker insertion slot 4105.

An engagement arm guiding slot 4115 is formed in the left side of the first housing 4110 penetrating through the forward and backward direction so as to communicate with the spring insertion slot 4113 and the latch receiving slot 4111.

The engagement arm guiding slot 4115 is formed in the shape of an arc.

The locking member receiving slot 4112 is formed along the left and right direction so as to communicate with the latch receiving slot 4111.

The locking member receiving slot 4112 is formed deeper towards the backside direction than the latch receiving slot 4111.

The locking member reception slot 4112 is formed along the left and right direction to have a longer length than the sum of the lengths of the main locking member 4300 and the sub-locking member 4400 so that the main locking member 4300 and the sub-locking member 4400 can be slid along the left and right direction.

In the first housing 4110, the backside of the locking member receiving slot 4112 for receiving the sub-locking member 4400 is penetrated so that the guide bars 4457*a* and 4457*b* of the hooks 4450 which will be described hereinafter are inserted therein.

A load guide slot 4116 is formed along the left and right direction in the front side of the first housing 4110 so as to communicate with the locking member receiving slot 4112.

The load guide slot 4116 is disposed in the lower portion of the latch receiving slot 4111.

A first sensing unit insertion slot 4128 is formed along the left and right direction in the front side of the first housing 4110 so as to communicate with the locking member receiving slot 4112 and the load guide slot 4116.

The first sensing unit insertion slot 4128 is disposed in the lower left portion of the locking member receiving slot 4112.

The first sensing unit insertion slot 4128 formed such that the lower portion and the backside thereof are open.

In the front right side of the first housing 4110, a first wall 4117, a second wall 4118, a third wall 4119, and a forth wall 4121 is sequentially disposed from the upper side towards the lower side. The first wall 4117, the second wall 4118, the third wall 4119, and the forth wall 4121 are disposed in the right side of the locking member receiving slot 4112. The first wall 4117, the second wall 4118, the third wall 4119, and the forth wall 4121 are vertically disposed spaced apart from each other.

A door in lever connecting unit 4800*a*, which is connected to the door in lever, is penetrating through the first separating space between the first wall 4117 and the second wall 4118.

A horizontal portion 4407, which will be described later, is inserted through the separating space between the second wall 4118 and the third wall 4119.

A door out lever connecting unit 4800*b*, which is connected to the door out lever, is penetrating through the third separating space between the third wall 4119 and the fourth wall 4121.

In addition, a first spring receiving slot, wherein the first spring 4803*a* is received, is formed in between the first wall 4117 and the second wall 4118 so as to communicate the first separating space.

In addition, a second spring receiving slot, wherein the second spring 4803*b* is received, is formed in between the third wall 4119 and the fourth wall 4121 so as to communicate the first separating space.

A child locking member receiving slot 4122, wherein the child locking member 4700, which will be described later, is received, is formed in the front side of the first housing 4110 so as to communicate with the locking member receiving slot 4112.

The child locking member receiving slot 4122 is disposed in the upper portion of the locking member receiving slot 4112.

The bumper member insertion slots 4123, wherein the bumper members 4360 are inserted respectively, are formed in the lower and the upper portions of the first housing 4110 so as to communicate with the latch receiving slot 4111.

The height of the bumper member insertion slots 4123 is formed to be lower than that of the bumper members 4360.

The bumper member 4360 disposed in the lower portion supports the latch 4200 so as to prevent the occurrence of any gap when the latch 4200 is in a locking state by the main locking member 4300, and the bumper member 4360 disposed in the upper portion supports the latch 4200 so that the latch 4200 is being rotated within a predetermined angle when the latch 4200 is rotating counter clockwise due to the restoring force of the first return spring 4250 after the locking with the main locking member 4300 is released.

A concave portion 4124 is formed in the upper side surface of the first housing 4110.

A guide wall body 4125 is protrudedly formed towards the backside direction in the lower portion of the right side of the backside surface of the first housing 4110. The coupling protrusion forward-backward guide long holes, for guiding the coupling protrusion 4561 along the forward and backward direction, are formed in the upper portion and the lower portion of the guide wall body 4125.

A manual locking member 4560 is inserted into the guide wall body 4125. The guide wall body 4125 guides the manual locking member 4560 together with the guide long hole 4517.

The locking hook holders 4126 for coupling with the third housing 4150 are formed in the upper surface and the side surface of the first housing 4110.

A first key connect mount 4127 is formed in the lower portion of the backside surface of the first housing 4110 in a way that the upper portion and the lower portion thereof are open.

In the backside surface of the first housing 4110, a main gear receiving slot, for receiving the main gear which will be described later, is formed so as to communicate with the engagement arm guiding slot 4115 and the shaft through hole 4114. In the backside surface of the first housing 4110, a locking plate receiving slot, for receiving the locking plate 4500, which will be described later, is formed in length along the left to right direction in the lower portion of the main gear receiving slot. The locking plate receiving slot is formed so as to communicate with the main gear receiving slot. In the backside surface of the first housing 4110, a sub-gear receiving slot, for receiving the sub-gear 4620 which will be described later, is formed, and the sub-gear receiving slot is communicating with the main gear receiving slot. In the backside surface of the first housing 4110, a first motor receiving slot for receiving the front side of the motor 4610 is formed in the right side of the sub-gear receiving slot. The first motor receiving slot is formed so as to communicate with the sub-gear receiving slot. In the backside surface of the first housing 4110, a first PCB insertion slot, wherein the front side of the PCB 4900, which will be described later is inserted, is formed in the lower portion of the locking plate receiving slot. The first PCB insertion slot is formed so as to communicate with the first sensing member insertion slot 4128.

As illustrated in FIG. 46, the second housing 4130 comprises a vertical member 4131 having the shape of a vertical plate, and a horizontal member 4132 backwardly bended from the upper end of the vertical member 4131.

In the vertical member 4131, a shaft insertion hole, wherein the latch rotating shaft 4230 is inserted, is formed penetrating through the forward and backward direction.

In the vertical member 4131, a first protruded portion 4135 and the second protruded portion 4136, being recessed (from the front side) towards the backside direction, are formed in the peripheral area of the shaft insertion hole. The first protruded portion 4135 and the second protruded portion 4136 are more backwardly protruded than the other portions of the backside surface of the vertical member 4131. The first protruded portion 4135 is in contact with the front surface of the latch 4200. Thus, the latch 4200 is not floating along the forward and backward direction and at the same time the friction between the latch 4200 and the second housing 4130 when assembling thereof. That is, since a backwardly protruded portion is formed in the backside surface of the second housing 4130, the friction with the rotating member with respect to the second housing 4130 can be minimized. The first protruded portion 4135 is curvedly formed along the right side of the striker insertion slot 4105. The second protruded portion 4136 is formed in the shape of an arc in the peripheral area of the shaft insertion hole, and guides the other end of the first return spring 4250, which is more forwardly protruded than the latch 4200, when the latch 4200 is being rotated. In addition, a forwardly protruded portion is also formed in the front surface of the third housing 4150, so that the friction with the rotating member (main gear) with respect to the third housing 4150 can be minimized.

In addition, in the vertical member 4131, an operation protrusion long hole 4134 for inserting the child locking operation protrusion 4710, which will be described later, is formed penetrating through the forward and backward direction. The operation protrusion long hole 4134 is formed in length along the left and right direction, so that the length thereof is longer than the width of the child locking operation protrusion 4710 along the left and right direction.

The vertical member 4131 is installed in the front surface of the first housing 4110 through the bolt 4133 and the like, and the horizontal member 4132 is disposed in the concave portion 4124 which is formed in the upper surface of the first housing 4110.

A striker insertion slot 4105 is formed across the vertical member 4131 and the horizontal member 4132.

As illustrated in FIG. 47, the third housing 150 has a box-like shape formed with a space therein.

Inside the third housing 4150, a second PCB insertion slot 4154, wherein the backside of the PCB 4900 is inserted.

A second motor receiving slot 4151 for receiving the backside of the motor 4610 is formed inside the third housing 4150. A fifth sensor receiving slot 4156, for receiving the fifth sensor 4911, which will be described later, is installed inside the third housing 4150.

The locking hooks 4153 are formed in the upper portion and the both sides of the third housing 4150.

Each of the locking hooks 4153 is coupled to each of the corresponding three locking hook holders 4126 formed in the first housing 4110 respectively, so that the first housing 4110 and the third housing 4150 is coupled thereby.

A second key connect mount 4152 is formed in the lower portion of the third housing 4150.

A key connect 4550, which will be described later, is installed in the first key connect mount 4127 and the second key connect mount 4152 of the first housing 4110.

A recessed portion 4155 recessed along the left and right direction is formed at the left side of the backside surface of the third housing 4150.

As illustrated in FIG. 44, the PCB 4900 is inserted between the first PCB insertion slot and the second PCB insertion slot 4154, and installed in the housing 4100. The PCB 4900 is horizontally disposed in the lower portion of the inside of the housing 4100.

As illustrated in FIG. 42, a first sensor 4901, a second sensor 4903, a third sensor 4905, and a fourth sensor 4907 are installed in the PCB 4900. The first sensor 4901, the second sensor 4903, the third sensor 4905, and the fourth sensor 4907 are provided with sensors capable of detecting magnets.

The first sensor 4901 and the second sensor 4903 are disposed on a same horizontal line, and the third sensor 4905 and the fourth sensor 4907 are disposed on a same horizontal line.

When viewing from the front side, the first sensor 4901 is disposed in the left side of the second sensor 4903. When viewing from the front side, the third sensor 4905 is disposed in the left side of the fourth sensor 4907.

The first sensor 4901 and the second sensor 4903 are associated with the opening and the closing operations of the door 1 by detecting the movement of the first sensing unit 4351 formed in the main locking member 4300.

The third sensor 4905 and the fourth sensor 4907 are associated with the locking and the unlocking operations of the door 1 by detecting the movement of the second sensing unit 4521 formed in the locking plate 4500. In addition, the third sensor 4905 is associated with the closing of the door 1.

In addition, as illustrated in FIGS. 43 and 44, a fifth sensor 4911 and the sixth sensor 4910 are connected to the PCB 4900. Limit switches may be provided as the fifth sensor 4911 and the sixth sensor 4910.

The fifth sensor 4911 is disposed between the first housing 4110 and the third housing 4150. More specifically, the fifth sensor 4911 is disposed close to the engagement arm guiding slot 4115.

The fifth sensor 4911 checks whether the main gear 4630 has returned to the original position (basic position) thereof.

The sixth sensor 4910 detects whether the latch 4200 is being rotated while being pressed by the striker 4101.

As illustrated in FIG. 48, the latch 4200 is installed in the first housing 4110 so as to be disposed inside the latch receiving slot 4111.

The latch 4200 is pivotally and movably installed in the first housing 4110 through the latch rotating shaft 4230 which is inserted into the shaft through hole 4114.

The latch is formed in the shape of a plate.

A locking slot 4201 in the outer circumferential surface of the latch 4200.

The width of the locking slot 4201 is getting wider as travelling from the inside towards the outside thereof.

The locking slot 4201 is surrounded by a first surface 4204 which is formed to be flat, a second surface 4205 formed to have a slope and extended from the left end of the first surface 4203, a third surface 4207 being extended from the left end of the second surface 4205, forming an arc, and surrounding the stricker 4101, a fourth surface 4209 being extended from the upper right end of the third surface 4207, and a fifth surface 4211 formed to have a slope and extended from the right end of the fourth surface 4209.

The locking slot 4201 is formed to be penetrating along the back and forth direction, and the outer end portion thereof is open.

In the latch 4200, an auxiliary locking slot 4202 is formed in the right side of the locking slot 4201. The auxiliary locking slot 4202 is formed in the shape similar to the locking slot 4201, but the depth thereof is shallower than the locking slot 4201.

A spring insertion slot 4213 is formed in the outer circumferential surface of the latch 4200.

A protrusion 4215 is formed outwardly protruded in the left side outer circumferential surface of the latch 4200.

The protrusion 4215 is disposed in the front of the engagement arm guide slot 4115.

The locking slot 4201, the auxiliary locking slot 4202, and the protrusion 4215 are sequentially disposed along the rotating (clockwise) direction of the latch 4200 when locking thereof.

A first return spring 4250 is provided so that the latch 4200 can be returned automatically when unlocked.

The first return spring 4250 is inserted in the spring insertion slot 4113.

One end of the first return spring 4250 is fixed by being inserted into the spring insertion slot 4113 of the first housing 4110, and the other end thereof is inserted into the spring insert 4213.

Thus, the other end of the first return spring 4250 can be rotated with the latch 4200 when the latch 4200 is being rotated.

The main locking member 4300 is slidingly installed inside the locking member receiving slot 4112 formed in the first housing 4110.

The main locking member 4300 is disposed in the first housing 4110, and locks the latch 4200.

The main locking member 4300 comprises a body 4310, a locking protrusion 4320, a supporting protrusion 4330, a horizontal bar 4340, and a first sensing member 4350. The main locking member 4300 is integrally formed of a body 4310, a locking protrusion 4320, a horizontal bar 4340, and a first sensing member 4350.

In the backside surface of the body 4310, a first hook shaft 4311*a* and a second hook shaft 4311*b* are backwardly and protrudedly formed respectively. The first hook shaft 4311*a* is disposed spaced above the second hook shaft 4311*b*.

A separating plate 4313 is horizontally formed between the first hook shaft 4311*a* and the second hook shaft 4311*b*.

The separating plate 4313 shaped like a rectangular plate divides the backside surface of the body 4310 into a upper portion and a lower portion.

A hook receiving wall 4315 is formed in the right end of the separating plate 4313.

In the upper portion and the lower portion of the hook receiving wall 4315, slopes are formed in a way that the width between thereof is getting narrower as it travels from the right side towards the left side. The first hook 4450*a* and the second hook 4450*b* are being received in the upper and the lower portions of the hook receiving wall 4315 respectively.

A first rib 4317 is formed in the left side of the hook receiving wall 4315, and the durability of the main locking member 4300 is enhanced thereby. In addition, since the first rib 4317 presses the second return spring 4460, the second return spring 4460 is well received in the main locking member 4300 without being bulged.

As illustrated in FIG. 50, the hook 4450 includes a first hook 4450*a* and a second hook 4450*b*.

The first hook 4450*a* and the second hook 4450*b* are connecting means being installed for simultaneously sliding the main locking member 4300 and the sub-locking member 4400, which will be described later, or sliding only the sub-locking member 4400, selectively.

In the left side of the first hook 4450*a* and the second hook 4450*b*, a first hole 4451*a* and a second hole 4451*b* are formed penetrating along the front and backside direction.

Inside the first hook shaft 4311*a* and the second hook shaft 4311*b*, the first hole 4451*a* of the first hook 4450*a* and the second hole 4451*b* of the second hook 4450*b* are inserted respectively. Thus, the first hook 4450*a* and second hook 4450*b* can be pivotally and movably installed in the backside surface of the body 4310 of the main locking member 4300 respectively.

The first hook 4450*a* and second hook 4450*b* are vertically installed spaced apart, and disposed in a way that they are symmetrical to each other with reference to a horizontal line.

A first link 4455*a*, which is downwardly protruded, is formed in the first hook 4450*a*, and a second link 4455*b*, which is upwardly protruded, is formed in the second hook 4450*b*.

The first link 4455*a* may be held on or separated from the first stopping threshold 4405*a* formed in a first sub-locking member 4400*a*, which will be described later, and the second link 4455*b* may be held on or separated from the second stopping threshold 4405*b* formed in a second sub-locking member 4400*b*, which will be described later.

In the first hook 4450*a*, a first spring insertion hole 4453*a* is formed between the first hole 4451*a* and the first link 4455*a* penetrating along the front and backside direction. In the second hook 4450*b*, a second spring insertion hole 4453*b* is formed between the second hole 4451*b* and the second link 4455*b* penetrating along the front and backside direction.

A second return spring 4460 for returning the first hook 4450*a* and the second hook 4450*b* to the original positions thereof is installed in the first hook 4450*a* and the second hook 4450*b*. The portion between the both ends of the second return spring 4460 is curvedly formed in the shape of an arc, more specifically, the center portion thereof is formed in the shape of a letter "C." The both ends of the second return spring 4460 is forwardly bended and protrudedly formed.

One end of the second return spring 4460 is installed in the first spring insertion hole 4453*a* of the first hook 4450*a*, and the other end is installed in the second spring insertion hole 4453*b* of the second hook 4450*b*. The portion between the both ends of the second return spring 4460 is held by the first rib 4317 of the main locking member 4300.

In addition, the one end of the second return spring 4460 is inserted into the first spring mounting slot 4454*a* formed in the backside surface of the first hook 4450*a*, the other end is inserted into the second spring mounting slot (not shown) formed in the backside surface of the second hook 4450*b*. Due to this configuration, the second return spring 4460, the first hook 4450*a*, and the second hook 4450*b* can be smoothly interlocked for a movement, and the second return spring 4460 will not be easily separated from the first hook 4450*a* and the second hook 4450*b*.

Accordingly, after applying a force to the first hook 4450*a* and the second hook 4450*b* so that the distance between the first hook 4450*a* and the second hook 4450*b* is more increased due to the pivotal rotation thereof, and then, if the force being applied to the first hook 4450*a* and the second hook 4450*b* is removed, the first hook 4450*a* and the second hook 4450*b* are pivotally rotated towards the opposite direction by the elastic restoring force of the second return spring 4460, so they are returned to the original states.

That is, the restoring force of the second return spring 4460 is reacting towards the direction in which the separation distance between the first hook 4450*a* and the second hook 4450*b* becomes narrower.

A first guide bar 4457*a*, which is backwardly protruded and extended at length, is formed in the backside surface of the first link 4455*a*, and a second guide bar 4457*b*, which is backwardly protruded and extended at length, is formed in the backside surface of the second link 4455*b*.

The first guide bar 4457*a* and the second guide bar 4457*b* enable the first hook 4450*a* and the second hook 4450*b* to be rotated respectively, guided by the inclined surface 4511 formed in a locking plate 4500, which will be described later.

An upper member 4459, which is upwardly protruded and extended in length, is formed in the right upper surface of the first hook 4450*a*, and a circular protrusion 4461, which is forwardly protruded, is formed in the end of the front surface of the upper member 4459.

The upper member 4459 and the circular protrusion 4461 are formed for interlocking of a locking member 4700, which will be described later, with the first hook 4450*a*.

A locking protrusion 4320 is formed in the left upper portion of the body 4310 of the main locking member 4300.

The locking protrusion 4320 locks the latch 4200 by being caught on the first surface 4203 of the latch 4200.

The lower surface of the locking protrusion 4320 is formed to be flat, and the upper surface of the locking protrusion 4320 is formed to have a slope inclining as it travels from left to right.

The portion where the lower surface and the upper surface of the locking protrusion 4320 are met is roundly formed.

Preferably, the end portion of the lower surface of the locking protrusion 4320 has the shape corresponding to the first surface 4203 of the latch 4200.

In the left side of the body 4310, an inclined surface 4330 is formed in the lower portion of the locking protrusion 4320. The inclined surface 4330 is formed to have a slope inclining as it travels from left to right.

The inclined surface 4330 is formed to have a slope steeper than the upper surface of the locking protrusion 4320.

The interference is prevented due to the inclined surface 4330 when the latch 4330 is rotated with reference to the main locking member 4300.

The horizontal bar 4340 is formed in length towards the left side in the left lower portion of the body 4310.

The horizontal bar 4340 is being slid inside the load guiding slot 4116 so that the sliding of the main locking member 4300 can be performed more stably.

In the lower portion of the right end of the horizontal bar 4340, a first sensing member 4350 is downwardly and protrudedly formed.

A first sensing unit 4351 like a magnet is installed in the lower side surface of the first sensing member 4350.

The first sensing unit 4351 is detected by the first sensor 4901 or the second sensor 4903 which are disposed in a position corresponding to the first sensing unit 4351 on the PCB 4900. The control unit (not shown) receives such detected signal and controls the motor 4610, which will be described later.

A sub-locking member 4400 is disposed in the right side of the main locking member 4300.

As illustrated in FIG. 51, the sub-locking member 4400 is slidingly installed inside the locking member receiving slot 4112 formed in the first housing 4110 same as the main locking member 4300.

A door lever connecting unit 4800 is connected to the sub-locking member 4400.

The sub-locking member 4400 includes a first sub-locking member 4400*a* and a second sub-locking member 4400*b* having the shape of a block.

The door lever connecting unit 4800 includes a door in lever connecting unit 4800*a* connected to the door in lever (not shown) and a door out lever connecting unit 4800*b* connected to the door out lever (not shown). Wires are provided as the door in lever connecting unit 4800*a* and the door out lever connecting unit 4800*b*.

The first sub-locking member 4400*a* is disposed in the upper portion of the second sub-locking member 4400*b*.

The door in lever connecting unit 4800*a* is connected to the first sub-locking member 4400*a*.

The first sub-locking member 4400*a* includes a first stopping member receiving slot 4401*a*, a first stopping threshold 4405*a*, and a horizontal portion 4407.

The second sub-locking member 4400*b* includes the second stopping member receiving slot 4401*b* and a second stopping threshold 4405*b*.

The front side and the right side of first stopping member receiving slot 4401*a* and the second stopping member receiving slot 4401*b* are open.

A first stopping member 4801*a* formed in the end of the door in lever connecting unit 4800*a* is being received inside the first stopping member receiving slot 4401*a*.

The first stopping member 4801*a* of the door in lever connecting unit 4800*a* located inside the first stopping member receiving slot 4401*a* will not be separated towards the front side because of the second housing 4130.

A second stopping member 4801*b* formed in the end of the door out lever connecting unit 4800*b* is being received inside the second stopping member receiving slot 4401*b*.

The second stopping member 4801*b* of the door in lever connecting unit 4800*b* located inside the second stopping member receiving slot 4401*b* will not be separated towards the front side because of the second housing 4130.

A first pulling hole 4403*a*, from which the door in lever connecting unit 4800*a* is being pulled, is formed with one side open in the right end of first stopping member receiving slot 4401*a* in a way that the first pulling hole 4403*a* is formed to have a smaller diameter than that of the first stopping member 4801*a*, so that the first stopping member 4801*a* cannot be pulled out through the first pulling hole 4403*a* even when the door in lever connecting unit 4800*a* is being pulled out to the right side.

Thus, the first sub-locking member 4400*a* is being slid towards the right side when the door in lever connecting unit 4800*a* is being pulled towards the right side.

A second pulling hole 4403*b*, from which the door out lever connecting unit 4800*b* is being pulled, is formed with one side open in the right end of second stopping member receiving slot 4401*b* in a way that the second pulling hole 4403*b* is formed to have a smaller diameter than that of the second stopping member 4801*b*, so that the second stopping member 4801*b* cannot be pulled out through the second pulling hole 4403*b* even when the door out lever connecting unit 4800*b* is being pulled out to the right side.

Thus, the second sub-locking member 4400*b* is being slid towards the right side when the door out lever connecting unit 4800*b* is being pulled towards the right side.

A first spring 4803*a* is inserted into the door in lever connecting unit 4800*a* close to the first stopping member 4801*a*.

The first spring 4803*a* is disposed between the right end of the first sub-locking member 4400*a* and the first and the second walls 4117 and 4118 of the first housing 4110. The first spring 4803*a* returns the first sub-locking member 4400*a*, which is being slid to the right side by an external force, to its original position by being slid to the left side due to the elastic restoring force of the first spring 4803*a*.

A second spring 4803*b* is inserted into the door out lever connecting unit 4800*b*.

The second spring 4803*b* is disposed between the right end of the second sub-locking member 4400*b* and the third and the fourth walls 4119 and 4121 of the first housing 4110. The second spring 4803*b* returns the second sub-locking member 4400*b*, which is being slid to the right side by an external force, to its original position by being slid to the left side due to the elastic restoring force of the first spring 4803*b*.

A first stopping threshold 4405*a* is formed in the backside of the first sub-locking member 4400*a*, and a second stopping threshold 4405*b* is formed in the backside of the second sub-locking member 4400*b*.

The right side surface of the first stopping threshold 4405*a* is formed to be flat, and the left side surface is roundly formed, and the width left to right is getting narrower as it travels from the lower side towards the upper side.

The right side surface of the second stopping threshold 4405*b* is formed to be flat, and the left side surface is roundly formed, and the width left to right is getting wider as it travels from the lower side towards the upper side.

The first stopping threshold 4405*a* and the second stopping threshold 4405*b* are symmetrical in shape to each other with respect to the horizontal surface.

The first link 4455*a* of the first hook 4450*a* can be caught by or separated from the first stopping threshold 4405*a*, and the second link 4455*b* of the second hook 4450*b* can be caught by or separated from the second stopping threshold 4405*b*.

The first hook 4450*a*, the second hook 4450*b*, the first stopping threshold 4405*a*, and the second stopping threshold 4405*b* are the connecting means for sliding the main locking member 4300 and the sub-locking member 4400 together, or sliding only the sub-locking member 4400.

While the first hook 4450*a* is caught by the first stopping threshold 4405*a*, and the second hook 4450*b* is caught by the second stopping threshold 4405*b*, and if the door in lever (not shown) or the door out lever (not shown) is being pulled, then the main locking member 4300 and the sub-locking member 4400 are being slid together towards the left side.

That is, this is an unlocked state of the door 1.

On the contrary, while the first hook 4450*a* is separated from the first stopping threshold 4405*a*, and the second hook 4450*b* is separated from the second stopping threshold 4405*b*, and if the door in lever (not shown) or the door out lever (not shown) is being pulled, then only the sub-locking member 4400 is being slid towards the left side, however, the main locking member 4300 is standing still.

That is, this is a locked state of the door 1.

The first sub-locking member 4400*a* is provided with a horizontal portion 4407 extending from the lower portion of the right side surface towards the right side direction which is an outward direction.

The horizontal portion 4407 includes a first inclined portion 4409 in the right side surface thereof.

The horizontal portion 4407 is disposed between the second wall 4118 and the third wall 4119 of the first housing 4110, and being slid along the left and right direction.

The first inclined portion 4409 is in contact with the second inclined portion 4563 of the manual locking member 4560 which will be described later.

As illustrated in FIG. 52, the locking plate 4500 is formed in length along the left and right direction.

The locking plate 4500 is slidingly installed in the backside surface of the first housing 4110.

The locking plate 4500 includes a unlocking cable connecting portion 4501, a bending member 4503, a door locking surface 4509, an inclined surface 4511, a door unlocking surface 4513, a manual locking mount 4515, and the second sensing member 4519.

The unlocking cable connecting portion 4501 is disposed in the left end side of the locking plate 4500.

An unlocking cable 4810 is connected in the left end of the unlocking cable connecting portion 4501, and the unlocking cable 4810 is being pulled towards the left side or the right side when the knob (not shown) and the like is operated, thus, the locking plate 4500 is moved towards the left side or the right side.

The bending member 4503 is formed in the lower portion of the right side of the unlocking cable connecting portion 4501.

The bending member 4503 has a flat plate-like shape.

An engagement protrusion 4506 is downwardly and protrudedly formed in the lower portion of the bending member 4503.

The engagement protrusion 4506 is a cylindrical protrusion for manually sliding the locking plate 4500 using the key connect 4550.

The key connect 4550 comprises: a head 4551 wherein a cross-shaped slot is formed;

a wing 4553 having a key connect opening 4555 wherein a portion of a disk having a larger diameter than that of the head 4551 has been cut-off; and an upper protrusion 4557 upwardly protruded from the center of the wing 4553.

The key connect 4550 is pivotally and movably installed in the lower portion of the housing 4100, and the engagement protrusion 4506 is positioned inside the key connect opening 4555 of the key connect 4550.

At this time, if the head 4551 of the key connect 4550 is manually rotated using a tool such as a key or a driver or the like, the locking plate 4500 can be slid along the left and right direction without driving the driving unit 4600.

More specifically, if the head 4551 of the key connect 4550 is rotated, the engagement protrusion 4506 positioned inside the key connect opening 4555 is pushed by the both of the side surfaces inside the key connect opening 4555, thus, the locking plate 4500 is moved along the left to right direction.

In other words, the locking plate 4500 is linearly moving due to the rotational movement of the key connect 4550.

Therefore, the door 1 can be manually locked or unlocked by using the key connect 4550.

In the locking plate 4500, a hook guiding portion 4507 is formed in the right side of the bending member 4503.

The door locking surfaces 4509 are located in the upper and the lower sides respectively in the left end of the hook guiding portion 4507, and the inclined surfaces 4511 are located in the upper and the lower side respectively in the center of the hook guiding portion 4507, and the door unlocking surfaces 4513 are located in the upper and the lower side respectively in the right end of the hook guiding portion 4507. The door locking surfaces 4509 and the door unlocking surfaces 4513 are formed to be horizontally flat. A first stopper protrusion 4505 is downwardly and protrudedly formed in the left side of the door locking surface 4509 which is disposed in the lower portion. The first stopper protrusion 4505 is inserted into the first stopper slot 4120 when the locking plate 4500 is in the door locking position and the door unlocking position, so that the locking plate 4500 stably maintains the stop state while in the door locking position and the door unlocking position.

The door locking surfaces 4509, the inclined surfaces 4511, and the door unlocking surfaces 4513 are connected together.

The width of between the inclined surfaces 4511 is getting narrower as it travels from the left side towards the right side.

The upper surface of the hook guiding portion 4507 guides the first guide bar 4457*a* of the first hook 4450*a*, and the lower surface of the hook guiding portion 4507 guides the second guide bar 4457*b* of the second hook 4450*b*.

When the first guide bar 4457*a* and the second guide bar 4457*b* are positioned in the upper and the lower door locking surfaces 4509 respectively, the first hook 4450*a* and the second hook 4450*b* are being separated from the first stopping threshold 4405*a* of the first sub-locking member 4400*a* and the second stopping threshold 4405*b* of the second sub-locking member 4400*b* respectively, thus, the door 1 is now in a locked state.

When the first guide bar 4457*a* and the second guide bar 4457*b* are positioned in the upper and the lower inclined surfaces 4511 respectively, the first hook 4450*a* and the second hook 4450*b* are being rotated towards the first stopping threshold 4405*a* of the first sub-locking member 4400*a* and the second stopping threshold 4405*b* of the second sub-locking member 4400*b*, or being rotated towards the opposite direction.

When the first guide bar 4457*a* and the second guide bar 4457*b* are positioned in the upper and the lower door unlocking surfaces 4513 respectively, the first hook 4450*a* and the second hook 4450*b* are being caught by the first stopping threshold 4405*a* of the first sub-locking member 4400*a* and the second stopping threshold 4405*b* of the second sub-locking member 4400*b* respectively, thus, the door 1 is now in an unlocked state.

In this way, the hook guiding portion 4507 rotates the first hook 4450*a* and the second hook 4450*b* according to the sliding of the locking plate 4500 along the left and right direction, and the door 1 may either be locked or unlocked thereby.

In the locking plate 4500, a manual locking member mount 4515 is formed in the right side of the hook guiding portion 4507.

The locking member mount 4515 is movable along the left and right direction between the backside surface of the first housing 4110 and the front surface of the third housing 4150, however, disposed in a way that movement along the forward and backward direction is not possible.

The manual locking member mount 4515 is shaped like a Korean letter 'ㄷ' (i.e., a rectangle without one side) when viewing from the front thereof, wherein the front, the back, and the right sides are open.

A guide wall body 4125 is disposed inside the locking member mount 4515.

In the upper and the lower surfaces of the manual locking member mount 4515, two identical guide long holes 4517, having an inclining slope as it travels from the left side towards the right side when viewing from the top, are formed respectively. That is, the guide long holes 4517 are diagonally formed.

In each of the upper and the lower guide long holes 4517, the coupling protrusions 4561 of the manual locking members 4560 are inserted respectively. The coupling protrusions 4561 are guided by the guide long holes 4517.

The manual locking members 4560 has the shape of a parallelepiped having a protruded portion in the front surface thereof. The manual locking members 4560 are disposed inside the guide wall body 4125.

In the upper and the lower portions of the manual locking members 4560, the coupling protrusions 4561 are formed upwardly protruded and downwardly protruded respectively.

A second inclined portion 4563 is formed in the front side of the manual locking member 4560 in a way that the width along the forward and backward direction is getting wider as it travels from the left side towards the right side.

The second inclined portion 4563 is in contact with the horizontal portion 4407 of the first sub-locking member 4400*a*.

When the hook 4450 is separated from the stopping threshold 4405, if the door in lever (not shown) is pulled once, the horizontal portion 4407 formed in the first sub-locking member 4400*a* pushes the manual locking member 4560 towards the backside direction. Due to this action, the locking plate 4500 is being slid towards the right side, and the hook 4450 is caught on the stopping threshold 4405.

This will be described in detail when describing operational states hereinafter.

In the locking plate 4500, a second sensing member 4519 is downwardly and protrudedly formed in the lower portion between the engagement protrusion 4506 and the hook guiding portion 4507. More specifically, the second sensing member 4519 is formed in a way that the lower portion thereof is backwardly bended.

In the second sensing member 4519, a second sensing member 4519 such as a magnet is installed in the lower surface of the backwardly bended portion.

The second sensing unit 4521 is detected by the third sensor 4905 and the fourth sensor 4907 which are installed in a position corresponding to the second sensing unit 4521 on the PCB 4900. Such signal detected by the third sensor 4905 and the fourth sensor 4907 is transferred to the information device of the car, thus the driver recognize the locking and unlocking states of the door 1.

In addition, in the upper portion of the locking plate 4500, a main gear stopper 4502 is backwardly and protrudedly formed between the unlocking cable connecting portion 4501 and the engagement protrusion 4506.

When the main gear 4630 is rotated driven by the motor 4610, the main gear stopper 4502 is being pushed by the first stopping portion 4633 and the second stopping portion 4635 formed in the main gear 4630. Therefore, the locking plate 4500 is moved towards the left side or the right side.

The main gear 4630 is disposed in the upper portion of the main gear stopper 4502 so that only the main gear stopper 4502 is being caught while the other portions of the locking plate are not being caught when the main gear 4630 is rotated. In other words, in the locking plate 4500, other portions in proximity of the main gear 4630 are forwardly disposed with respect to the main gear 4630 so that there is no interference with the other portions of the locking plate 4500 when the main gear 4630 is rotating.

The locking plate 4500 slides along the left and right direction and pivotally rotates the hook 4450 thereby.

Due to the sliding of the locking plate 4500, that is, the linear motion along the left and right direction, the first hook 4450*a* and the second hook 4450*b* are being pivotally moved.

The first hook 4450*a* and the second hook 4450*b*, that have been pivotally rotated, are caught by or separated from the first stopping threshold 4405*a* and the second stopping threshold 4405*b*, and let the main locking member 4300 and the sub-locking member 4400 slide together, or only let the sub-locking member 4400 slide.

That is, the door 1 is locked or unlocked according to the linear movement along the left and right direction of the locking plate 4500.

The linear movement along the left and right direction of the locking plate 4500 may be performed automatically, but it may also be performed manually.

As illustrated in FIG. 53, the driving unit 4600 includes a motor 4610, a sub-gear 4620 being rotated by the motor 4610, and a main gear 4630 geared with the sub-gear 4620 and being rotated.

The driving unit 4600 is installed in the backside surface of the first housing 4110 and in the front side surface of the third housing 4150.

The driving unit 4600 is disposed between the backside surface of the first housing 4110 and in the front side surface of the third housing 4150.

The motor 4610 is connected to the PCB 4900 so that it may generate the driving force or stop the generation of driving force by receiving the signal from the PCB 4900.

A worm gear 4613 is installed in the rotating shaft 4611 of the motor 4610.

In the sub-gear 4620, a small diameter gear and a large diameter gear are connected through the same shaft.

The large diameter gear of the sub-gear 4620 is engaged with the worm gear 4613.

The small diameter gear of the sub-gear 4620 is engaged with the main gear 4630.

The main gear 4630 receives the driving force of the motor 4610 via the sub-gear 4620.

As illustrated in FIGS. 54 and 55, in the main gear 4630, a geared portion 4632, wherein gear teeth 4638 are formed, is formed in a portion of the peripheral surface of the main gear 4630; and a non-geared portion 4643, wherein no gear teeth 4638 are formed, is formed in the remaining portion of the peripheral surface thereof.

The geared portion 4632 is formed only in a portion of the right side of the main gear 4630.

The non-geared portion 4643 is formed in the remaining portion of the main gear 4630 not in the geared portion 4632. The non-geared portion 4643 is formed to be flat or curved.

That is, the gear teeth 4638 are not formed around the entire circumference of the main gear 4630 but only in a portion thereof. Therefore, the thickness, along the forward and backward direction, of the main gear 4630 can be reduced while the durability of the main gear 4630 is maintained.

The thickness, along the forward and backward direction, of the geared portion 4632 is formed to be thicker than that of the non-geared portion 4643. Therefore, the durability of the geared portion 4632 can be enhanced.

The main gear 4630 includes a plastic portion 4634 and a metal portion 4642 which is inserted into the plastic portion 4634. The main gear 4630 is formed by inserting the metal portion 4642 into the plastic portion 4634.

The plastic portion 4634 includes a plastic plate portion 4645 formed in the shape of a plate, and a geared portion 4632 backwardly and protrudedly formed in a portion of the outer circumferential surface of the plastic plate portion 4645.

The plastic plate portion 4645 is formed in the shape of a circular disk, and the insert protrusions 4637 are backwardly and protrudedly formed in the backside surface thereof. Four of the insert protrusions 4637 are formed around the insert hole 4636 wherein the latch rotating shaft 4230 is inserted.

An engagement arm 4631 is formed in the lower left portion of the front surface of the plastic plate portion 4645 for rotating the latch 4200. The engagement arm 4631 is formed in the shape of a bar, and protrudedly formed towards the front direction.

When a user closes the door 1, if the door 1 is closed a certain degree even the door 1 is completely closed, the engagement arm 4631 automatically rotates the latch 4200 by the driving force of the motor 4610, and restricts the latch 4200 to the main locking member 4300.

In addition, a fifth sensor detecting portion 4641 is formed in the outer circumferential surface of the plastic plate portion 4645 so as to be disposed in the backside of the engagement arm 4631. The fifth sensor detecting portion 4641 is formed in a way that it presses the fifth sensor 4911, which is a limit switch, when the main gear 4630 returns to the basic position. Thus, the main gear 4630 can return to the original position (basic position) again after moving the locking plate 4500, or being rotated for moving the latch 4200.

A portion of the plastic portion 4634 is cutoff. A main gear stopping portion 4502 is inserted into the cutoff space of the plastic portion 4634. Due to this, a first stopping portion 4633 and a second stopping portion 4635 are formed in the lower portion of the plastic portion 4634 for sliding the locking plate 4500. The first stopping portion 4633 is continuously formed in the lower end of the geared portion 4632.

The first stopping portion 4633 and the second stopping portion 4635 are spaced apart from each other.

The first stopping portion 4633 and the second stopping portion 4635 push the main gear stopping portion 4502 according to the rotation of the main gear 4630, and slide the locking plate 4500 towards the left side or the right side.

In addition, the main gear stopping portion 4502 is disposed in the front side of the metal portion 4642.

The metal portion 4642 includes a plate portion 4644 formed in the shape of a plate, and a plurality of the protrusions 4639 forwardly and protrudedly formed along the circumference of the plate portion 4644.

The plate portion 4644 is formed in the shape of a disk. In the center area of the plate portion 4644, the insert protrusion slots 4646 are formed around insert hole 4636 wherein the latch rotating shaft 4230 is inserted. The insert protrusions 4637 are inserted into the insert protrusion slots 4646.

The protrusions 4639 are inserted into the geared portion 4632 and the inside of the engagement arm 4631 of the plastic portion 4634. Thus, the durability of the geared portion 4632 and the engagement arm 4631 can be enhanced further.

The protrusions 4639 which are inserted in the geared portion 4632 are formed divided in multiple numbers, and the protrusion 4639 which is disposed inside the engagement arm 4631 is formed to have a longer length than those of the protrusions 4639 inside the geared portion 4632.

Since the opening and the closing of the door 1 using the latch 4200, and the locking and the unlocking of the door 1 using the locking plate 4500 can be performed by one driving unit 4600, the structure is simple, and it can be compactly configured, and the manufacturing cost can be reduced.

As illustrated in FIG. 56, the child locking member 4700 is slidingly installed in the housing 4100 so as to be disposed in the upper portion of the sub-locking member 4400.

More specifically, the child locking member 4700 is disposed in the upper portion of the first sub-locking member 4400*a*.

The child locking member 4700 is formed in the shape of a plate, and received in the child locking member receiving slot 4122 of the first housing 4110. Thus, the child locking member 4700 can be slid along the left and right direction with respect to the housing 4100.

In the upper surface of the child locking member 4700, a second stopper protrusion 4721 is upwardly and protrudedly formed. The second stopper protrusion 4721 is inserted into the second stopper slot (not shown) when the child locking member 4700 is in the door locking position and the door unlocking position, so that the child locking member 4700 stably maintains the stop state while in the door locking position and the door unlocking position.

In the left lower portion of the child locking member 4700, a locking protrusion 4722 is formed protruded towards the left and backward direction. The upper surface of the locking protrusion 4722 is formed to have a slope. The height of the locking protrusion 4722 is formed to be lower than the maximum height of the child locking member 4700.

In the front surface of the child locking member 4700, a phrase or a symbol is displayed which informs the unlocking state of the door. In the first housing 4110, a phrase or a symbol is displayed which informs the locking state of the door so as to be disposed in the backside of the child locking member 4700.

In the right side of the front surface of the child locking member 4700, a child locking operation protrusion 4710 is forwardly and protrudedly formed. The child locking operation protrusion 4710 is inserted into the operation protrusion long hole 4134 formed in the second housing 4130.

When the child locking member 4700 is moved towards the left side, the door locking symbol can be seen through the operation protrusion long hole 4134 from the outside of the housing 4100, and at this state, if the child locking member 4700 is moved towards the right side, the door unlocking symbol can be seen through the operation protrusion long hole 4134 from the outside of the housing 4100. Thus, a user can easily recognize whether the door is locked or not.

When the child locking member 4700 is moved towards the left side, the circular protrusion 4461 of the first hook 4450*a* is lifted up along the inclining slope of the locking protrusion 4722. In this way, if the first hook 4450*a* is lifted up, the first hook 4450*a* is separated from the first stopping threshold 4405*a*. In addition, when the child locking member 4700 is moved towards the right side, the first hook 4450*a* is returned to the original state. Thus, the first hook 4450*a* is caught on the first stopping threshold 4405*a*.

In this way, the first hook 4450*a* can be caught on or separated from the first stopping threshold 4405*a* by the movement of the child locking member 4700.

The door latch system 5 of the present invention can perform unlocking operation without any functional jamming even unlocking operation is performed while the door lever (not shown) is being pulled under the locking state of the door 1.

This will be described in sequence as follows.

The door lever (not shown) of the door 1, which is under locked state, is being pulled.

At this time, since the hook 4450 is opened and not holding the sub locking member 4400, the sub locking member 4400 is being slid towards the opposite side of the main locking member 4300 along the door lever (not shown) which is being pulled without affecting the main locking member 4300.

If unlocking operation is performed using a key, a remocon, and the like during performing such operation, the opened hooks 4450 rotate inwardly in order to be connected to the sub-locking member 4400.

However, since the hooks 4450 are rotated while the door lever (not shown) is being pulled, the hooks 4450 are not connected to the sub-locking member 4400 which is spaced apart from the main locking member 4300, but instead, the hooks 4450 are entered into the space separated between the main locking member 4300 and the sub-locking member 4400.

At this time, if the door lever (not shown), which is being pulled, is released, the sub-locking member 4400 is moved towards the main locking member 4300 due to the elastic restoring force of the spring.

The hooks 4450 are lifted by the approaching force of the sub-locking member 4400, later the sub-locking member 4400 enters inside the hooks 4450, and the coupling of the hooks 4450 to the sub-locking member 4400 is completed thereby.

The sensors installed in the PCB 4900 of the door latch system 5 of the present invention are connected to a room lamp (not shown), an instrument panel (not shown), and the like, a user can easily recognize the opening and closing state of the door 1.

Hereinafter, an operational process of the door latch system 5 having the aforementioned configuration and according to the third exemplary embodiment of the present invention will be described.

<Door Closing>

As illustrated in FIG. 57, when the user closes the door 1, the striker 4101 presses the latch 4200, and the latch 4200 is rotated in a clockwise direction thereby.

As illustrated in FIG. 58, since the latch 4200 masks the sixth sensor 4910 while being rotated in a clockwise direction, the latch 4200 presses the sixth sensor 4910, and the control unit recognizes that the door 1 is closing, however, the motor 4610 is not operating yet. At this time, the outer circumferential surface of the latch 4200 pushes the locking protrusion 4320 of the main locking member 4300, and due to this action, the main locking member 4300 is pushed towards the right side. Therefore, the first sensing unit 4351 is not detected by the first sensor 4901.

Next, the latch 4200 further rotates clockwise by the force of the user closing the door 1, as illustrated in FIG. 59, and the first sensing unit 4351 is detected by the first sensor 4901 as the locking protrusion 4320 is being inserted into the auxiliary locking slot 4201.

In this way, when the sixth sensor 4910 and the first sensor 4901 are all detected, the control unit operates the motor 4610.

That is, after the latch 4200 is rotated along the clockwise direction for a certain degree while the latch 4200 is being pressed by the stricker 4101, the motor 4610 begins to operate.

Due to this configuration, the erroneous operation of the motor 4610 is prevented when the door 1 is opened.

As illustrated in FIG. 59, the protrusion 4215 of the latch 4200 is pushed in a clockwise direction by the clockwise rotation of the engagement arm 4631 installed in the front surface of the main gear 4630 due to the operation of the motor 4610. Consequently, the locking protrusion 4320 is inserted into the locking slot 4201, and the door 1 is closed thereby.

The reason why at this time the first surface 4203 of the latch 4200 is caught on the lower surface of the locking protrusion 4320 of the main locking member 4300 is as follows. The locking protrusion 4320 of the main locking member 4300 is being positioned inside the locking slot 4201 after being slid from right side towards the left side by the elastic force of the first spring 4803*a* and the second spring 4803*b*, so that it is caught on the first surface 4203 of the latch 4200.

As the engagement arm 4631 is being rotated by the motor 4610, and arrived at the door closing position, and then the locking protrusion 4320 is inserted into the locking slot 4201, and the first sensing unit 4351 is detected by the first sensor 4901 thereby. In this way, when the first sensing unit 4351 is detected by the first sensor 4901 while the motor is being operated for closing the door, the control unit determines that the engagement arm 4631 is being rotated up to the door closing position and rotates the engagement arm 4631 in a counter clockwise direction using the motor 4610. As illustrated in FIG. 60, the control unit operates the motor 4610 until the fifth sensing unit 4641 presses the fifth sensor 4911. Thus, the main gear 4630 is returned to the basic position. In such a way, since the main gear 4630 is returned to the basic position after the operations of door closing or door locking, the driver can manually lock or unlock the door.

When an emergency state occurs such that fingers or clothes of a child are trapped between the door and the car body while the door 1 is being closed by operating the motor 4610, the door lever (not shown) is being pulled, and then, the second sensor 4903 detects the first sensing unit 4351 which has been moved towards the right side, and the motor 4610 is being rotated in the reversed direction, and the engagement arm 4631 is being moved to the unlocking position (basic position), and thus, the door can be opened thereby.

<Door Locking>

As illustrated in the FIG. 61, the operation that an unlocked state of a door 1 becomes a locked state by a key, a locking button, a knob, a door out lever sensor, start, and a preset critical value of a vehicle speed and the like will be described.

When a door locking (signal) is entered through the motor 4610, the motor 4610 is operated and rotates the main gear 4630 in a counter clockwise direction.

As illustrated in FIG. 62, when the main gear 4630 is rotated in a counter clockwise direction, the second stopping portion 4635 located in the backside surface of the main gear 4630 pushes the main gear stopping portion 4502 of the locking plate 4500 and slides the locking plate 4500.

At this time, the locking plate 4500 is being moved to the right side, and the first hook 4450*a* and the second hook 4450*b* are more separated from each other along the inclined surfaces 4511 of the locking plate 4500, and the first hook 4450*a* and the second hook 4450*b* are being separated from the first sub-locking member 4400*a* and the second sub-locking member 4400*b* respectively. Due to this action, the state of the door 1 becomes a locked state, therefore, the force will not be transferred to the main locking member 4300 when the door lever (not shown) is being pulled.

The second stopping portion 4635 pushes the locking plate 4500 until the second sensing unit 4521 of the locking plated 4500 is detected by the fourth sensor 4907, as illustrated in FIG. 63, and returns to its original position.

<Door Unlocking>

The operation that a locked state of a door 1 becomes an unlocked state by a key, a locking button, a knob, a door out lever sensor, arrive, and a preset critical value of a vehicle speed and the like will be described.

As illustrated in FIG. 64, when a door unlocking (signal) is entered through the motor 4610, the motor 4610 is operated and rotates the main gear 4630 in a clockwise direction.

When the main gear 4630 is rotated in a clockwise direction, the first stopping portion 4633 located in the backside surface of the main gear 4630 pushes the main gear stopping portion 4502 and slides the locking plate 4500.

At this time, the locking plate 4500 is being moved to the left side, and the first hook 4450*a* and the second hook 4450*b* are getting closer to each other along the inclined surfaces 4511 of the locking plate 4500, and the first hook 4450*a* and the second hook 4450*b* are being caught on the first sub-locking member 4400*a* and the second sub-locking member 4400*b* respectively. Due to this action, the state of the door 1 becomes an unlocked state, therefore, the force will be transferred to the main locking member 4300 when the door lever (not shown) is being pulled.

The first stopping portion 4633 pushes the locking plate 4500 until the second sensing unit 4521 of the locking plated 4500 is detected by the third sensor 4905, and returns to its original position.

<Door Locking from Inside the Car Using Child Locking Member>

As illustrated in FIG. 65, the first hook 4450*a* is caught on the first stopping threshold 4405*a*, and the second hook 4450*b* is caught on the second stopping threshold 4405*b*, which is an unlocked state of a door 1, the upper member 4459 and the circular protrusion 4461 of the first hook 4450*a* are disposed spaced apart in the left side of the child locking member 4700.

In this state, as illustrated in FIG. 66, when the child locking operation protrusion 4710 formed in the child locking member 4700 is pushed towards the left side, the circular protrusion 4461 is lifted up by the locking protrusion 4722.

Due to such an operation, the first hook 4450*a* is separated from the first stopping threshold 4405*a* so that the first sub-locking member 4400*a* is not sliding with the main locking member 4300.

That is, when the door in lever (not shown) is being pulled, only the first sub-locking member 4400*a* can be sliding, therefore, the door (not shown) is in a locked state from the inside.

Such a locked state can be released only when the child locking member 4700 is being slid towards the right side, the door 1 cannot be opened from the inside of the car when it is in a child locking state, but the door 1 can be opened only from the outside of the car. Thus, the children and the elderly can be protected from the accidents caused by the unexpected opening and closing of the door 1.

In addition, preferably, the door 1 locking function from inside the car using the child locking member is installed only in the backside seats.

<Unlocking of the Door from Inside the Car Using Door in Lever>

As illustrated in FIG. 67, when the door 1 is in a locked state, as illustrated in FIG. 68, if the door in lever (not shown) is being pulled once, the first sub-locking member 4400*a* is being slid to the right side.

At this time, the first inclined portion 4409 formed in the horizontal portion 4407 of the first sub-locking member 4400*a* is being slid towards to the right side, and the at the same time, pushes the second inclined portion 4563 of the manual locking member 4560.

The manual locking member 4560 is moved by the first inclined portion 4409 of the first sub-locking member 4400*a*. During the movement, the manual locking member 4560 is guided towards the backside direction by the guide wall body 4125. The coupling protrusion 4561 of the manual locking member 4560 which is moving towards the backside direction is inserted into the diagonally formed guide long hole 4517, thus the coupling protrusion 4561 pushes the locking plate 4500. At this time, the locking plate 4500 can be moved only along the left and right direction, and since movement along the forward and backward direction is not allowed, it is moved only towards the left side.

As the locking plate 4500 is moved towards the left side, the first hook 4450*a* and the second hook 4450*b* move downwards along the inclined surfaces 4511 of the locking plate 4500, and being positioned on the door unlocking surface 4513.

At this state, if the door in lever (not shown), which is being pulled, is released, the first sub-locking member 4400*a* is moved towards the left side and caught on the first hook 4450*a*, and due to this action, the main locking member 4300 and the sub-locking member 4400 are being slid together, and the door 1 is in an unlocked state thereby.

At this time, when the door in lever (not shown) is being pulled one more time, the latch 4200 is separated from the locking protrusion 4320 of the main locking member 4300, and the door 1 is opened.

<Installation State of the Door Latch System>

As illustrated in FIGS. 69 and 70, in the door 1, the door latch system 5 is installed in the center area of the opposite side of the portion 3 wherein the door is pivotally and rotatably connected to the body of the car. The door latch system 5 is disposed in a way that the upper surface is facing the inside of the car, and the front surface is facing the body of the car, and the backside surface is facing the door 1. That is, the center portion of the backside surface of the door latch system 5 is disposed so as to face the door window 2 when the door window 2 is coming down. When coming down, the door window 2 is not coming down straightly but coming down slantly. Due to this feature, when the door window 2 is coming down, the center portion of the left side of the backside surface of the door latch system 5 is coming closer to the door window 2. Thus, if the center portion of the left side of the backside surface of the door latch system 5 is backwardly protruded, it will encounter the coming door window 2. However, as illustrated in FIGS. 71 and 72, in the main gear 4630 disposed in the left backside of the door latch system 5 according to the third exemplary embodiment of the present invention, the gear teeth 4638 are formed only in a portion of the right side of the outer circumferential surface, so that the gear teeth 4638 can be formed to be thick and the thickness of the left center portion of the main gear 4630 can be reduced while maintaining the durability thereof.

Thus, the interference between the door window 2 and the door latch system 5 is prevented when the door latch system 5 is being installed in the door 1.

Embodiment 4

In describing the door latch system according to the fourth exemplary embodiment of the present invention, same symbols will be used for the same or the similar elements as those of the door latch system 5 according to the third exemplary embodiment of the present invention, and the detailed description and illustration will be omitted.

As illustrated in FIGS. 73 to 76, the door latch system according to the fourth exemplary embodiment of the present invention further includes a rotating member 4370 for sliding the main locking member 4300' which is being pivotally rotated by the latch 4200.

Since only the body 4310' of the main locking member 4300' is formed in a different form than that of the third exemplary embodiment of the present invention, only the body 4310' will be described and the description about the other identical configurations will be omitted.

As illustrated in FIG. 73, the body 4310' comprises a first portion 4311', and a second portion 4313' formed to have a step in a way that the front surface thereof is to be disposed in front of the front surface of the first portion 4311'.

The first portion 4311' constitutes the upper portion of the body 4310', and the second portion 4313' constitutes the lower portion of the body 4310'.

A rotating member insertion slot 4317' is formed in the upper portion of the second portion 4313' wherein a portion of the rotating member 4370, which will be described later, is inserted.

The front and the upper portion of the rotating member insertion slot 4317' are open.

The front of the rotating member insertion slot 4317' is closed by installing the second housing 4130.

The left side surface and the right side surface forming the rotating member insertion slot 4317' have the slopes whose slopes are inclining as they travel from the left side towards the right side.

The length of the inclined slope of the left side surface constituting the rotating member insertion slot 4317' is shorter than that of the right side surface constituting the rotating member insertion slot 4317'.

The lower side surface forming the rotating member insertion slot 4317' has a slope whose slope is declining as it travels from the left side towards the right side.

In the left side portion of the second portion 4313', an inclined surface 4330' is formed.

The rotating member 4370 is disposed in front of the first portion 4311' of the main locking member 4300'.

The rotating member 4370 is installed in the front side of the first housing 4110, and installed in a way that it can be pivotally rotated by the rotating shaft 4380 disposed along the forward and backward direction.

The rotating shaft 4380 is installed penetrating the upper portion of the rotating member 4370.

Preferably, the rotating shaft 4380 is a rivet.

The rotating member 4370 can pivotally rotated in a clockwise or a counter clockwise direction with respect to the rotating shaft 4380.

In addition, a rotating spring 4390 which returns the rotating member 4370 may be provided.

One end of the rotating spring 4390 is supported and fixed by the first housing 4110, and the other end is connected to the rotating member 4370.

The rotating spring 4390 applies a force to the rotating member 4370 and pushes it towards the counter clockwise direction, and when the force is released, an elastic force, which pivotally rotates the rotating member 4370 towards the clockwise direction, is generated, and returns (the rotating member) to its original position.

The rotating member 4370 comprises a locking portion 4371 and an inserting protrusion 4373.

The lower portion of the left side of the locking portion 4371 is protruded towards the left side, and the right side thereof is formed to be flat.

A latch insertion slot is formed in the lower portion of the locking portion 4371 wherein a portion of the end (first surface) of the latch 4200 is being inserted when closing the door. The latch insertion slot is formed to have an open lower portion.

The locking portion 4371 restricts the position of the latch 4200.

An inserting protrusion 4373, which is downwardly protruded, is formed in the right side of the lower surface of the locking portion 4371.

The inserting protrusion 4373 is positioned inside the rotating member insertion slot 4317'.

The reason for this is to prevent the separation of the inserting protrusion 4373 of the rotating member 4370 from the inside of the rotating member insertion slot 4317' when the main locking member 4300' is being slid by the rotating member 4370 due to the pivotal rotation of the latch 4200.

The inserting protrusion 4373 slides the main locking member 4300' along the left and right direction according to the pivotal rotation of the rotating member 4370.

Preferably, the width along the left and right direction of the inserting protrusion 4373 is formed to be formed narrower than the width along the left and right direction of the rotating member insertion slot 4317'.

Since the rotating member 4370 is pivotally rotated by the latch 4200 and the main locking member 4300' is being slid, a user can feel the door closing operation more softly, and the strength of the door latch system can be increased as well.

That is, when closing the door, by adding a rotational movement of the rotating member 4370 prior to the linear movement of the main locking member 4300' along the left and right direction, the user may feel the door closing operation more softly.

<Door Closing>

As illustrated in FIG. 74, when the user closes the door which is opened, as illustrated in FIG. 75, the striker 4101 installed in the car body presses the latch 4200, and the latch 4200 is rotated in a clockwise direction thereby.

The latch 4200 presses the sixth sensor 4910 while being rotated in a clockwise direction, and the control unit recognizes that the door 1 is closing, however, the motor 4610 is not operating yet. At this time, the outer circumferential surface of the latch 4200 pushes the locking portion 4371 of the main locking member 4300', and due to this action, the main locking member 4300' is pushed towards the right side. Therefore, the first sensing unit 4351 is not detected by the first sensor 4901.

Next, the latch 4200 further rotates clockwise by the force of the user closing the door 1, and the first sensing unit 4351 is detected by the first sensor 4901 as the locking portion 4371 is being inserted into the auxiliary locking slot 4201.

In this way, when the sixth sensor 4910 and the first sensor 4901 are all detected, the control unit operates the motor 4610.

As illustrated in FIG. 75, the protrusion 4215 of the latch 4200 is pushed in a clockwise direction by the clockwise rotation of the engagement arm 4631 installed in the front surface of the main gear 4630 due to the operation of the motor 4610. Consequently, the locking portion 4371 of the rotating member 4370 is inserted into the locking slot 4201 of the latch 4200, and the door 1 is closed thereby.

At this time, the locking portion 4371 of the rotating member 4370 is being rotated in the clockwise direction due to the elastic force of the return spring 4390, and positioned inside the locking slot 4201, and thus, the first surface of the latch 4200 is inserted into the latch insertion slot of the locking portion 4371.

Hereinafter, since the control process of the motor 4610 is same as the door closing process of the above described third exemplary embodiment, the detailed description on this matter will be omitted.

Embodiment 5

In describing the door latch system according to the fifth exemplary embodiment of the present invention, same symbols will be used for the same or the similar elements as those of the door latch system according to the first and the second exemplary embodiments of the present invention, and the detailed description and illustration will be omitted.

As illustrated in FIGS. 77 to 85, in the door latch system according to the fifth exemplary embodiment of the present invention, a main locking member 1300 and a sub-locking member 1400 are disposed in the right upper portion of the housing 1100.

As illustrated in FIGS. 78 to 79, the main locking member 1300 is formed in a way that a locking protrusion 1320 is protrudedly formed towards the left side in the left lower portion of the body 1310. The locking protrusion 1320 is formed similar to that of the third exemplary embodiment, wherein a latch insertion slot 1321 having an open lower portion is additionally formed in the lower surface.

The first sensing member 1350 of the main locking member 1300 is formed in the shape of a bar backwardly protruded in the upper side of the backside surface of the body 1310. A first sensing unit 1351 is formed in the upper surface of the first sensing member 1350. The first sensing member 1350 disposed penetrating the first housing 1110 so that the first sensing unit 1351 is facing the PCB 1900.

A horizontal bar 1310 of the main locking member 1300 is formed in the shape of a bar protruded towards the right side in the right side surface of the body 131.

The first hook 1450*a* of the hook is disposed in the lower side of the second hook (not shown), and the upper side member is formed in the lower portion.

The child locking member 1700 is formed to have a slope in the lower surface of the locking protrusion 1722. Thus, the width of the locking protrusion 1722 along the vertical direction is getting wider as it travels towards the right side.

The first sub-locking member 1400*a* of the sub-locking member 1400 is disposed lower side of the second locking member 1400*b*. The horizontal portion of the first sub-locking member 1400*a* is formed extended from the upper side of the right side surface of the sub-locking member 1400*a* towards the right side.

The door in lever connecting unit 1800*a* is disposed in the lower side of the door out lever connecting unit 1800*b*.

As illustrated in FIG. 80, the PCB 1900 is horizontally disposed in the upper portion of the first housing 1110.

The locking plate 1500 is horizontally disposed in the upper portion of the backside surface of the first housing 1110.

The locking plate 1500 is disposed in the lower portion of the PCB 1900.

As illustrated in FIG. 81, the locking plate 1500 includes, a unlocking cable connecting portion 4501 formed in the left end, a hook guiding portion 4507 disposed in the right side of the unlocking cable connecting portion 4501, a manual locking member mount 4515 disposed in the right side of the hook guiding portion 4507, and a second sensing unit 1521.

A stopping protrusion 1506 is formed downwardly protruded in the lower surface of the manual locking member mount 4515.

The stopping protrusion 1506 is disposed inside the key connect opening 4555 of the key connect 1550.

The key connect 1550 is disposed in the right side of the backside surface of the first housing 1110.

The key connect 1550 is disposed in the lower side of the manual locking member mount 4515.

In the key connect 1550, a connecting path 1552 is formed between the head 4551 and the wing 4553. The connecting path 1552 is formed in the shape of a hollowed cylinder whose one side is open.

The second sensing unit 1521 made of magnet and the like is disposed in the left upper side of the hook guiding portion 4507.

In the locking plate 1500, a first and a second main gear stopping portions 1531 and 1532 are formed between the unlocking cable connecting portion 4501 and the hook guiding portion 4507. The first main gear stopping portion 1531 is disposed in the left side of the second main gear stopping portion 1532. The first and the second main gear stopping portions 1531 and 1532 are formed to have a slope in a way that the gap therebetween is getting narrower as it travels towards the upper direction. A main gear moving slot 1533 is formed between the first and the second main gear stopping portions 1531 and 1532 wherein the main gear 1630 is inserted and being moved. The main gear moving slot 1533 is formed in a way that the front side, the upper side, and the lower side thereof are open.

The motor 4610 is disposed in the lower portion of the right backside surface of the first housing 1110.

In the first sub-gear 1620, two gears disposed in the front side and the backside thereof are connected through the same shaft.

A worm gear 4613 is engaged with the gear disposed in the backside of the first sub-gear 1620.

A second sub-gear 1621 is engaged with the gear disposed in the front side of the first sub-gear 1620.

In the third sub-gear 1622, two gears disposed in the front side and the backside thereof are connected through the same shaft.

The second sub-gear 1621 is engaged with the gear disposed in the front side of the third sub-gear 1622.

The main gear 1630 is engaged with the gear disposed in the backside of the third sub-gear 1622.

As illustrated in FIGS. 82 and 83, in the main gear 1630, a geared portion 1632, wherein gear teeth are formed, is formed in a portion of the peripheral surface thereof, and a non-geared portion, wherein no gear teeth are formed, is formed in the remaining portion of the peripheral surface.

The geared portion 1632 is formed only in a portion of the lower side of the main gear 1630.

The non-geared portion is formed in the remaining portion of the main gear 1630 not the geared portion 1632.

The main gear 1630 includes a plastic portion 1634 and a metal portion 1642 which is inserted into the plastic portion 1634. The main gear 1630 is formed by inserting the metal portion 1642 into the plastic portion 1634.

The plastic portion 1634 includes a geared portion 1632 formed in the shape of an arc whose central angle is less than 180 degrees.

An engagement arm 1631 which rotates the latch 4200 is formed in the left upper side of the geared portion 1632. The engagement arm 1631 is formed forwardly protruded in the shape of a bar.

When a user closes the door (not shown), if the door (not shown) is closed a certain degree even the door (not shown) is completely closed, the engagement arm 1631 automatically rotates the latch 4200 by the driving force of the motor 4610, and restricts the latch 4200 to the main locking member 1300.

The metal portion 1642 includes a plate portion 1644 formed in the shape of a plate, and a plurality of the protrusions 1639 forwardly and protrudedly formed along the circumference of the plate portion 1644.

The plate portion 1644 is formed in the shape of a disk. In the center area of the plate portion 1644, an insert hole, wherein the latch rotating shaft is inserted, is formed penetrating along the forward and backward direction.

The protruded portions 1647 are formed in each of the both sides of the plate portion 1644 respectively.

The upper surface and the lower surface of the protruded portion 1647 are formed to have slopes in a way that the heights thereof are decreasing as they travel towards the outside direction.

A first stopping portion 1633 is formed in the upper left side of the plate portion 1644, and a second stopping portion 1635 is formed in the upper right side thereof. The first stopping portion 1633 and the second stopping portion 1635 are curvedly formed in the form of an arc in a way that the distance therebetween is getting narrower as they travel towards the upper direction. The first stopping portion 1633 and the second stopping portion 1635 are disposed in the upper side of the protruded portions 1647.

The upper portion of the plate portion 1644 is disposed inside the main gear moving slot 1533. That is, the first stopping portion 1633 and the second stopping portion 1635 are disposed inside the main gear moving slot 1533.

The first stopping portion 1633 and the second stopping portion 1635 slide the locking plate 1500 towards the left side or the right side by pushing the first and the second main gear stopping portions 1531 and 1532.

As illustrated in FIG. 84, when the door is in a locked state, if the main gear 1630 is rotated in a counter clockwise direction by the motor 4610 for unlocking the door, the first stopping portion 1633 pushes the first main gear stopping portion 1531, and the locking plate 1500 is moved towards the left side thereby. Thus, the door is unlocked.

As illustrated in FIG. 85, when the door is in an unlocked state, if the main gear 1630 is rotated in a clockwise direction by the motor 4610 for locking the door, the second stopping portion 1635 pushes the second main gear stopping portion 1532, and the locking plate 1500 is moved towards the right side thereby. Thus, the door is locked.

The protrusions 1639 are inserted into the geared portion 1632 and the engagement arm 1631 of the plastic portion 1634. Thus, the durability of the geared portion 1632 and the engagement arm 1631 can be further enhanced.

In the upper portion of the plate portion 1644, a fifth sensing unit 1641 made of magnet and the like is formed.

The fifth sensing unit 1641 is disposed between the first stopping portion 1633 and the second stopping portion 1635.

The fifth sensing unit 1641 is detected by the fifth sensor 1911 installed in the PCB 1900 when the main gear 1630 is returned to the basic position. Therefore, after the main gear 1630 is rotated for moving the locking plate 1500 or the latch 4200, it can be returned to the original position (basic position).

Hereinafter, since the operations of the door closing, door opening, door locking, door unlocking, and the like according to the fifth exemplary embodiment are same as the operations of the above described third exemplary embodiment, the detailed description on this matter will be omitted.

Embodiment 6

In describing the door latch system according to the sixth exemplary embodiment of the present invention, same symbols will be used for the same or the similar elements as those of the door latch system according to the first, the second, and the third exemplary embodiments of the present invention, and the detailed description and illustration will be omitted.

As illustrated in FIGS. 86 and 87, the door latch system according to the sixth exemplary embodiment of the present invention further includes a rotating member 1370 for sliding the main locking member 1300' which is being pivotally rotated by the latch 4200.

Since only the body 1310' of the main locking member 1300' is formed in a different form than that of the fifth exemplary embodiment of the present invention, only the body 1310' will be described and the description about the other identical configurations will be omitted.

The body 1310' comprises a first portion 1311', and a second portion 1313' formed to have a step in a way that the front surface thereof is to be disposed in front of the front surface of the first portion 1311'.

The first portion 1311' constitutes the lower portion of the body 1310', and the second portion 1313' constitutes the upper portion of the body 1310'.

In the lower side of the first portion 1311', a rotating member inserting protrusion 1314, which is being inserted in the moving hole 1373 of the rotating member 1370 which will be described later, is formed forwardly protruded.

The rotating member inserting protrusion 1314 is formed in the shape of a cylinder.

The rotating member 1370 is disposed in the front direction of the first portion 1311' of the locking member 1300'.

The rotating member 1370 is installed so as to be pivotally rotated by the rotating shaft 1380 disposed along the forward and backward direction in the front side of the first housing 1110.

The rotating shaft 1380 is installed in the first housing penetrating the upper portion of the rotating member 1370.

The rotating member 1370 can be pivotally rotated around the rotating shaft 1380 in a clockwise or a counter clockwise direction.

The rotating member 1370 comprises a locking portion 1371.

The locking portion 1371 is protrudedly formed towards the left direction in the left lower portion of the rotating member 1370.

A latch insertion slot is formed in the lower portion of the locking portion 1371 wherein a portion of the end (first surface) of the latch 4200 is being inserted when closing the door. The latch insertion slot is formed to have an open lower portion.

The right side of the rotating member 1370 is formed to be flat.

The locking portion 1371 restricts the position of the latch 4200.

In the rotating member 1370, a moving hole 1373 is formed penetrating along the forward and backward direction so as to be disposed in the right side of the locking portion 1371. The moving hole 1373 is formed in length along the vertical direction having a length longer than the diameter of the rotating member inserting protrusion 1314. Thus, the rotating member inserting protrusion 1314 becomes movable inside the moving hole 1373. In this way, the rotating member 1370 being rotated and the main locking member 1300' being slid may be moved smoothly.

The rotating member inserting protrusion 1314 slides the main locking member 1300' along the left and right direction in accordance with the pivotal rotation of the rotating member 1370.

Since the rotating member 1370 is pivotally rotated by the latch 4200 and the main locking member 1300' is being slid, a user can feel the door closing operation more softly, and the strength of the door latch system can be increased as well.

In addition, a rotating spring 1390 may be provided for returning of the rotating member 1370.

A spring support 1374 is formed downwardly protruded in the lower right side of the rotating member 1370.

The rotating spring 1390 is received in the rotating spring receiving slot formed in the front surface of the first housing 1110. The rotating spring receiving slot is formed along the left and right direction. In addition, the spring support 1374 is disposed inside the spring support moving slot formed in the front surface of the first housing 1110. The spring support moving slot communicates with the rotating spring receiving slot. The spring support moving slot is formed in the shape of an arc. The spring support moving slot is disposed in the backside of the spring support moving slot.

One end of the rotating spring 1390 is supported and fixed by the first housing 1110, and the other end supports the right side of the spring support 1374.

Thus, the rotating spring 1390 applies a force to the rotating member 1370 and pushes it towards the counter clockwise direction, and when the force is released, an elastic force, which pivotally rotates the rotating member 1370 towards the clockwise direction, is generated, and returns (the rotating member) to its original position.

<Door Closing>

As illustrated in FIG. 86, when the user closes the door which is opened, the striker 4101 installed in the car body presses the latch 4200, and the latch 4200 is rotated in a clockwise direction thereby.

The outer circumferential surface of the latch 4200 pushes the locking portion 1371 of the rotating member 1370, and thus the rotating member 1370 is being rotated in the counter clockwise, and the rotating member 1370 pushes the rotating member inserting protrusion 1314 of the main locking member 1300', and the main locking member 1300' is being slid towards the right side thereby, and the locking portion 1371 is inserted into the auxiliary locking slot. Later, when the latch 4200 is further rotated in a clockwise direction by the motor 4610, the door is closed when the locking portion 1371 of the rotating member 1370 is inserted into the locking slot 4201 of the latch 4200, as illustrated in FIG. 87. In this way, when the locking portion 1371 is inserted into the locking slot 4201, the rotating member 1370 is rotated in a clockwise direction by the elastic force of the rotating spring 1390, and the rotating member inserting protrusion 1314 is being pulled by the rotating member 1370, and the locking member 1300' is moved towards the left direction thereby.

Hereinafter, since the detailed descriptions such as an operation of the motor 4610 and the like are described in the above described exemplary embodiments, the detailed description on this matter will be omitted.

Embodiment 7

In describing the door latch system according to the seventh exemplary embodiment of the present invention, same symbols will be used for the same or the similar elements as those of the door latch system according to the first, the second, the third, the fourth, the fifth, and the sixth exemplary embodiments of the present invention, and the detailed description and illustration will be omitted.

As illustrated in FIGS. 88 and 95, the door latch system according to the seventh exemplary embodiment of the present invention is characterized in that and includes: a housing 3100; a latch 3200 pivotally and rotatably installed in the housing 3100; a main locking member 3300 slidingly installed in the housing 3100 for locking the latch 3200; a sub-locking member 3400 slidingly installed in the housing 3100 and disposed in one side of the main locking member 3300; a connecting means which enables simultaneous sliding of the main locking member 3300 and the sub-locking member 3400, or sliding of only the sub-locking member 3400; and a driving unit which unlocks the connection between the main locking member 4300 and the sub-locking member 3400, or connects the main locking member 4300 and the sub-locking member 3400 using the connecting means, wherein the driving unit includes a main gear 4630, and a locking plate 3500 being slidingly installed in the housing 3100 is further provided, and the locking plate 3500 is being slid by the main gear 4630, and the locking plate 3500 unlocks the connection between the main locking member 4300 and the sub-locking member 3400, or connects the main locking member 4300 and the sub-locking member 3400, and a first stopper protrusion 3105 is protrudedly formed in any one of the locking plate 3500 and the housing 3100, and a first stop spring 3570 elastically deformed by the first stopper protrusion 3105 is installed in the remaining one, and the first stop spring 3570 is elastically deformed by the first stopper protrusion 3105 when the locking plate 3500 is positioned between the connection position and disconnecting position.

As illustrated in FIG. 88, the housing 3100 includes: a first housing 3110, a second housing 3130 disposed in front of the first housing 3110, and the third housing 3150 disposed in the backside of the first housing 3110.

The first housing 3110 is made of plastic material and can be formed by injection molding. The second housing 3130 may be made of a high strength material such as a steel plate.

A plurality of mounting holes are formed in the first housing 3110 and the second housing 3130 for bolt tightening with the door of the car. The mounting holes are disposed in the upper side and the lower side of the left side of the first housing 3110 and the second housing 3130, and in the right side of the striker insertion slot. The door latch system of the exemplary embodiment of the present invention can be easily and durably installed in the door of the car due to such mounting holes.

In addition, the first housing 3110 and the second housing 3130 are connected with a plurality of the bolts. The plurality of the bolts are disposed in the both sides of the striker insertion slot and in the both sides of the lower portion of the first housing 3110 and the second housing 3130.

Further, in the second housing 3130, the second rivet insertion holes are formed wherein the latch rotating shaft 3230 and the first return spring holding shaft 3251, which are provided in the form of rivets, are inserted.

In the right side of the second housing 3130, a vertical member 3138, which surrounds and supports the right side of the first housing 3110 from where the door lever connecting unit 3800 is being pulled out (drawn), is protrudedly formed towards the backside direction. Due to such vertical member 3138, the strength of the portion supporting the door lever connecting unit 3800 is reinforced. In the vertical member 3138, the outlet holes from which the door lever connecting unit 3800 is pulled out (drawn) are formed respectively. Due to such vertical member 3138, the damage of the first housing 3110 is prevented when an impact is applied thereto.

In the front surface of the first housing 3110, a plurality of supporting protrusions 3103 which supports the horizontal portion or the vertical portion of the lower portion of the second housing 3130 is formed in length. Due to these supporting protrusions 3103, the pre-assembly of the first housing 3110 and the second housing 3130 is facilitated. Therefore, the assembly process becomes simple.

A mounting surface 3102 is formed in the upper right portion of the first housing 3110 which is the portion not covered by the second housing 3130.

As illustrated in FIG. 89, an opening is formed between the spring insert portion 3213 and the protrusion so that the latch 3200 is not stopped by the first return spring stopping shaft 3251 when rotating.

The stopping members 3801 are formed at the end of the door lever connecting unit 3800 which connects the sub-locking member 3400 and the door lever.

The stopping members 3801 are formed in the shape of a long cylinder along the vertical direction. Therefore, the separation of the stopping members 3801 from the sub-locking member 3400 is prevented even when the door lever is being pulled.

In the sub-locking member 3400, a stopping member receiving slot, wherein the stopping members 3801 are received, are formed corresponding to the shape of the stopping members 3801. In addition, the outlet holes, from which the door lever connecting unit 3800 is being pulled out and communicating with the stopping member receiving slot, are formed in the end of the right side of the sub-locking member 3400.

The connecting means includes a hook pivotally installed in any one of the main locking member 4300 and the sub-locking member 3400, and a stopping threshold, formed in the other one of the main locking member 4300 and the sub-locking member 3400, wherein the hook is being held. In this exemplary embodiment of the present invention, the hook is rotatably formed in the backside of the main locking member 4300, and the stopping threshold is formed in the backside of the sub-locking member 3400.

The driving unit includes a motor 4610 and a main gear 4630 being rotated by the motor 4610. The driving unit is connected to the PCB 4900 and controlled by the control unit.

The door latch system according to the exemplary embodiments of the present invention further includes a child locking member 3700 slidingly (movably) installed in the first housing 3110 of the housing 3100.

The child locking member 3700 is being slid (moved) along the left or the right side direction with respect to the housing 3100 and disconnects the main locking member 4300 and the sub-locking member 3400 or connects the main locking member 4300 and the sub-locking member 3400. Due to this action, the door in lever is being locked or unlocked. Locking and unlocking operation of the door through the child locking member 3700 will be referred to the above described third exemplary embodiment, and detailed description on this matter will be omitted.

A second stopper protrusion 3721 is protrudedly formed in one of the child locking member 3700 and the first housing 3100, and a second stop spring protrusion 3730, which applies an elastic force to the second stop spring protrusion 3721, is installed in the remaining one thereof.

In the exemplary embodiment of the present invention, as illustrated in FIGS. 90 and 91, the second stopper protrusion 3721 is protrudedly formed towards the backside direction in the upper right side of the back surface of the child locking member 3700, and the second stop spring 3730 is installed in the front surface of the first housing 3110. The second stop spring 3730 is disposed in the backside of the child locking member 3700.

In the front surface of the first housing 3110, a stop spring receiving slot 3104 is formed in length along the left and right direction so that it is communicating with the child locking member receiving slot 3122 and disposed in the backside of the child locking member receiving slot 3122. The stop spring receiving slot 3104 is correspondingly formed to the shape of the second stop spring 3730, and the portion where the elastic deforming portion 3732, which will be described later, is being received, is formed in a way that the vertical width thereof is longer than that of the elastic deforming portion 3732, thereby enabling the elastic deformation of the elastic deforming portion 3732.

The second stop spring 3730 is formed by bending the center portion of a metal based material. Thus, the second stop spring 3730 is formed in the shape of a pin (⊃) on the whole. In this way, a wire form spring is provided as the second stop spring 3730.

In the second stop spring 3730, a first stop portion 3731, being formed in the shape of an arc corresponding to the shape of the second stopper protrusion 3721, is formed in the far right end thereof. The second stopper protrusion 3721 is being received in the first stop portion 3731 when the child locking member 3700 is in the connected position.

In the second stop spring 3730, a second stop portion 3733, whose upper portion and lower portion are being formed in the shape of an arc respectively, is formed in the left side thereof. The second stopper protrusion 3721 is being received in the second stop portion 3733 when the child locking member 3700 is in the disconnected position.

In the second stop spring 3730, an elastic deforming portion 3732, whose vertical width is smaller than those of the first stop portion 3731 and the second stop portion 3733, is formed between the first stop portion 3731 and the second stop portion 3733. That is, the vertical width of the elastic deforming portion 3732 is formed to be smaller than the vertical width of the second stopper protrusion 3721. The elastic deforming portion 3732 is horizontally disposed along the left and right direction in the shape of a line.

The shape of the cross-section of the second stopper protrusion 3721 is formed in the shape of a cylinder.

Thus, the second stop spring 3730 is elastically deformed by the second stopper protrusion 3721 when the child locking member 3700 is in at least in a portion between the connected position and disconnected position. That is, in order to move the child locking member 3700 from the connected position to the disconnected position, or in order to move the child locking member 3700 from the disconnected position to the connected position, the child locking member 3700 must be slid by a force which is strong enough to elastically deform the second stop spring 3730.

Moreover, when sliding the child locking member 3700, a friction force is generated due to the contact between the elastic deforming portion 3732 of the second stop spring 3730 and the second stopper protrusion 3721.

Thus, the separation of the child locking member 3700 from the connected position or the disconnected position is prevented even when the external impact is applied thereto when the child locking member 3700 is in the connected position or in the disconnected position. That is, the erroneous operation of the child locking member 3700 due to the external impact is prevented.

A spring end portion 3734 is formed at the left end of the second stop spring 3730. The vertical width of the spring end portion 3734 is formed to be narrower than that of the elastic deforming portion 3732. The spring end portion 3734 is horizontally disposed along the left and right direction in the shape of a line.

Further, the door latch system of the exemplary embodiment further includes a child locking sensor 3920 detecting whether the main locking member 4300 and the sub-locking member 3400 is connected or disconnected through the child locking member 3700.

The child locking sensor 3920 is provided as a limit switch, and disposed in the backside surface of the first housing 3110. The child locking sensor 3920 is connected to the PCB 4900.

A child locking sensor unit 3723 is protrudedly formed towards the backside direction in the backside surface of the child locking member 3700. The child locking sensor unit 3723 is disposed between the second stopper protrusion 3721 and the locking protrusion 3722, and disposed under the locking protrusion 3722.

The child locking sensor unit 3723 is disposed above the child locking sensor 3920.

In the front surface of the first housing 3110, a guide slot is formed along the left and right direction for guiding the locking protrusion 4722. The guide slot is disposed in the backside of the lower portion of the child locking member receiving slot 4122, and formed to be communicating with the child locking member receiving slot 4122. In the guide slot, the left side, which is the portion being disposed with the child locking sensor 3920, is penetratingly formed along the forward and backward direction.

As illustrated in FIG. 92, when the child locking member 3700 is being slid towards the left side in order to lock the door through the child locking member 3700, the child locking sensing unit 3723 pushes the child locking sensor 3920. That is, the child locking sensor 3920 detects the door locking through the child locking member 3700. The control unit can inform the driver whether the child locking state is established or not by using the signal detected by the child locking sensor 3920. Thus, the driver can easily check the state of the child locking.

In addition, the door latch system of the exemplary embodiment of the present invention further includes a locking plate 3500 slidingly installed in the first housing 3110 of the housing 3100 as illustrated in FIG. 93.

The locking plate 3500 is being slid by the main gear 4630, and the locking plate 3500 disconnects the main locking member 4300 and the sub-locking member 3400, or connects the main locking member 4300 and the sub-locking member 3400. Since the connecting or disconnecting process through the locking plate 3500 is same as the above described third exemplary embodiment, the detailed description on this matter will be omitted.

A second stopper protrusion 3721 is protrudedly formed in one of the child locking member 3700 and the first housing 3100, and a first stop spring 3570, elastically deformed by the first stopper protrusion 3105, is installed in the remaining one thereof.

In the exemplary embodiment of the present invention, the first stopper protrusion 3105 is protrudedly formed towards the backside direction in the backside surface of the first housing 3110, and the first stop spring 3570 is installed in the backside surface of the center portion of the locking plate 3500.

In the locking plate 3500, a stopper long hole 3571, wherein the first stopper protrusion 3105 is penetrating through, is formed along the left and right direction.

In the backside surface of the locking plate 3500, a first link 3573, wherein the one end of the first stop spring 3570 is inserted, is formed backwardly protruded in the left side of the stopper long hole 3571.

In the backside surface of the locking plate 3500, a second link 3572, wherein the other end of the first stop spring 3570 is inserted, is formed backwardly protruded in the left side of the stopper long hole 3571.

The first stop spring 3570 is formed by bending the center portion of a metal based material. Thus, the first stop spring 3570 is formed in the shape of a pin (⊃) on the whole. In this way, a wire form spring is provided as the first stop spring 3570.

In one end of the first stop spring 3570, a first insert portion 3578 which is being inserted into the first link 3573. The first insert portion 3578 is formed in the shape of a circle.

In the first stop spring 3570, a first stop portion 3577, whose upper and lower portions are being formed in the shape of an arc corresponding to the shape of the first stopper protrusion 3105, is formed in the right of the first insert portion 3578. The first stopper protrusion 3105 is being received in the first stop portion 3577 when the locking plate 3500 is in the disconnected position.

In the first stop spring 3570, a second stop portion 3575, whose upper and lower portions are being formed in the shape of an arc corresponding to the shape of the first stopper protrusion 3105, is formed in the right of the first stop portion 3577. The first stopper protrusion 3105 is being received in the second stop portion 3575 when the locking plate 3500 is in the connected position.

In the first stop spring 3570, an elastic deforming portion 3576, whose vertical width is smaller than those of the first stop portion 3577 and the second stop portion 3575, is formed between the first stop portion 3577 and the second stop portion 3575. That is, the vertical width of the elastic deforming portion 3576 is formed smaller that the vertical width of the first stopper protrusion 3105. The upper portion of the elastic deforming portion 3576 is curvedly formed to be downwardly concave, and the lower portion thereof is curvedly formed to be upwardly convex.

In the first stop spring 3570, the portions disposed in the upper side may be more forwardly disposed than the portions disposed in the lower side thereof.

In the right end of the first stop spring 3570, a spring end portion 3574 is formed. The vertical width of the spring end portion 3574 is formed to be smaller than that of the second stop portion 3575. The spring end portion 3734 is horizontally disposed along the left and right direction in the shape of a line.

The shape of the cross-section of the first stopper protrusion 3105 is formed in the shape of a cylinder.

Thus, in order to move the locking plate 3500 from the connected position to the disconnected position (or move towards the opposite direction), the vertical gap of the elastic deforming portion 3576 must be widened through the elastic deformation thereof. That is, in order to move the locking plate 3500 from the connected position to the disconnected position, or in order to move the locking plate 3500 from the disconnected position to the connected position, the locking plate 3500 must be slid by a force which is strong enough to elastically deform the elastic deforming portion 3576 of the first stop spring 3570.

Moreover, when sliding the locking plate 3500, a friction force is generated due to the contact between the elastic deforming portion 3576 of the first stop spring 3570 and the first stopper protrusion 3105.

Thus, the separation of the locking plate 3500 from the connected position or the disconnected position is prevented even when the external impact is applied thereto when the locking plate 3500 is in the connected position or in the disconnected position. That is, the erroneous operation of the locking plate 3500 due to the external impact is prevented.

In the locking plate 3500, a stopping member receiving slot wherein the end of the unlocking cable which is formed in the unlocking cable connecting portion 3501, is formed in the backside surface thereof. Thus, assembling of the unlocking cable with the locking plate 3500 becomes more easy.

The stopping member of the unlocking cable is formed in the shape of a cylinder which is vertically long.

As illustrated in FIG. 94, in the locking plate 3500, a reinforcement rib 3504 is formed in the right side of the main gear stopping portion 3502, which is being caught by the main gear 4630, and thus, damages in the locking plate 3500 during the operation can be prevented.

Meanwhile, a fifth sensor receiving slot 3106, wherein the fifth sensor 4911 is being received, is formed in the backside surface of the first housing 3110. Thus, damages in the fifth sensor 4911 can be prevented during assembly.

As illustrated in FIG. 95, in the first housing 3110, wires 3930 for connecting the PCB 4900 and the sensors (fifth sensor 4911 and sixth sensor 4910) or the driving unit (motor 4610), are insertingly installed. In this way, the lengths of the wires 3930 can be reduced.

The wires 3930 are installed in a way that the portions being connected to the driving unit and the PCB 4900 are formed protruded outside of the first housing 3110. Thus, the sensors, the driving unit, or the PCB can be connected to the wires 3930 only if the sensor or the driving unit is inserted into the corresponding receiving slot formed in the first housing 3110. Thus, assembling becomes more simple.

Embodiment 8

In describing the door latch system according to the eighth exemplary embodiment of the present invention, same symbols will be used for the same or the similar elements as those of the door latch system according to the first, the second, the third, the fourth, the fifth, the sixth, and the seventh exemplary embodiments of the present invention, and the detailed description and illustration will be omitted.

As illustrated in FIGS. 96 and 97, the door latch system according to the eighth exemplary embodiment of the present invention further includes a rotating member 3370 for sliding the main locking member 3300' which is being pivotally rotated by the latch 3200.

The latch 3200 is disposed between the first housing 3110 and the second housing 3130'.

The latch 3200 is installed in the second housing 3130' so that it is pivotally rotated by the latch rotating shaft 3230 which is installed in the backside surface of the second housing 3130'.

In the latch 3200, an opening is formed between the spring insert portion and the protrusion in order not to be caught on the first return spring stopping shaft 3251 disposed in the left side thereof, when rotating.

Since only the body 3310' of the main locking member 3300' is formed in a different form than that of the seventh exemplary embodiment of the present invention, only the body 3310' will be described and the description about the other identical configurations will be omitted.

As illustrated in FIG. 96, the body 3310' comprises a first portion 3311', and a second portion 3313' formed to have a step in the first portion 3311' in a way that the front surface thereof is to be disposed in front of the front surface of the first portion 3311'.

The first portion 3311' is disposed in the upper portion of the second portion 3313'.

A rotating member insertion slot 3317' is formed in the upper portion of the second portion 3313', wherein a portion of the rotating member 3370, which will be described later, is inserted.

The rotating member 3370 is disposed in front of the first portion 3311' of the main locking member 3300'.

The rotating member 3370 is disposed in front of the first housing 3110, and installed in the second housing 3130' so that it is pivotally rotated by the rotating shaft 3380 disposed along the forward and backward direction.

The rotating shaft 3380 is installed penetrating the upper portion of the rotating member 3370.

The rotating shaft 3380 is provided as a rivet, and riveted in the second housing 3130'.

In addition, a rotating spring 3390 which returns the rotating member 3370 may be provided.

One end of the rotating spring 3390 is supported and fixed by the rotating spring stopping shaft 3391 which is riveted in the second housing 3130', and the other end is caught on and being connected to the right side of the rotating member 3370. The center portion of the rotating spring 3390 is inserted into the rotating shaft 3380.

The rotating member 3370 comprises a locking portion 3371 and an inserting protrusion 3373.

The left lower portion of the locking portion 3371 is protruded towards the left side, and the right side thereof is formed to be flat.

A latch insertion slot, wherein a portion of the end of the latch 3200 is inserted when the door is being closed, is formed in the lower portion of the locking portion 3371. The latch insertion slot is formed in a way that the lower portion thereof is open.

The locking portion 3371 restricts the position of the latch 3200.

A latch insertion slot, wherein a portion (first surface) of the end of the latch 3200 is inserted when the door is being closed, is formed in the lower portion of the locking portion 3371. The latch insertion slot is formed in a way that the lower portion thereof is open.

An inserting protrusion 3373 is formed downwardly protruded in the right side of the lower surface of the locking portion 3371.

The inserting protrusion 3373 is positioned inside the rotating member insertion slot 3317'.

The rotating member inserting protrusion 3373 slides the main locking member 3300' along the left and right direction in accordance with the pivotal rotation of the rotating member 3370.

Preferably, the width along the left and right direction of the inserting protrusion 3373 is formed to be formed narrower than the width along the left and right direction of the rotating member insertion slot 3317'.

Further, as illustrated in FIG. 99, a shaft insert 3463 is formed between the both ends 3462 of the second return spring 3460 which returns the hooks connecting the main locking member 3300' and the sub-locking member 3400.

The second return spring 3460 is disposed between the front surface of the first housing 3110 and the backside surface of the hooks and the main locking member 3300'.

The shaft insert 3463 is formed by bending the center portion of the second return spring 3460 in the shape of a circle.

In addition, a second return spring shaft 3317, which is inserted into the shaft insert 3463, is formed backwardly protruded in the backside surface of the main locking member 3300'.

Thus, the shaft insert 3463 is pivotally and rotatably installed in the main locking member 3300'.

In the second return spring 3460, a bended portion 3461 is formed between the shaft insert 3463 and the both ends 3462.

In the backside surface of the main locking member 3300', a second return spring support surface 3318 is formed backwardly protruded in order to support the portion near the shaft insert 3463 of the bended portion 3461. The twisting of the second return spring 3460 can be prevented due to the second return spring support surface 3318.

The second return spring support surface 3318 is formed corresponding to the shape of the bended portion 3461.

The second return spring support surfaces 3318 are disposed in the right upper portion and the right lower portion of the second return spring shaft 3317 respectively.

In this way, since two hooks can be returned by using a single second return spring 3460, the structure of the device becomes simple and the number of components can further be reduced.

At the same time, since the second return spring 3460 is installed as described above, the shaking of the second return spring 3460 or the twisting in the second return spring 3460 can be prevented.

<Assembling Method of the Door Latch System>

An assembling method for a door latch system according to the above described eighth exemplary embodiment of the present invention is as follows.

The components such as locking plate, driving unit, and the like, which are to be installed in the backside surface of the first housing 3110, are installed. Next, the third housing 3150 is coupled and fastened to the backside surface of the first housing 3110 using bolts or rivets.

In addition, the main locking member 3300', the sub-locking member 3400, the child locking member 3700, and the like are installed in the front surface of the first housing 3110. As illustrated in FIG. 97, the latch 3200, the first return spring 3250, the rotating member 3370, and the rotating spring 3390 are installed in the backside surface of the second housing 3130' by the latch rotating shaft 3230, the first return spring stopping shaft 3251, rotating shaft 3380, and the rotating spring stopping shaft 3391. Then, the assembling can be completed by coupling and fastening the first housing 3110 and the second housing 3130' using bolts or rivets.

Through such an assembling process, the assembling process of the door latch system may further be facilitated.

Embodiment 9

In describing the door latch system according to the ninth exemplary embodiment of the present invention, same symbols will be used for the same or the similar elements as those of the door latch system according to the first, the second, the third, the fourth, the fifth, the sixth, the seventh, and the eighth exemplary embodiments of the present invention, and the detailed description and illustration will be omitted.

As illustrated in FIGS. 100 and 104, the door latch system according to the ninth exemplary embodiment of the present invention is characterized in that and includes: a housing 2100; a latch 4200 pivotally and rotatably installed in the housing 2100; a main locking member 2300 slidingly installed in the housing 2100 for locking the latch 4200; a sub-locking member 2400 slidingly installed in the housing 2100 and disposed in one side of the main locking member 2300; a connecting means which enables simultaneous sliding of the main locking member 2300 and the sub-locking member 2400, or sliding of only the sub-locking member 2400; and a driving unit which unlocks the connection between the main locking member 2300 and the sub-locking member 2400, or connects the main locking member 2300 and the sub-locking member 2400 using the connecting means, wherein the driving unit includes a main gear 2630, and in the main gear 2630, a geared portion 2632, wherein gear teeth are formed, is formed in a portion of the peripheral surface thereof, and a non-geared portion, wherein no gear teeth are formed, is formed in the remaining portion of the peripheral surface.

As illustrated in FIG. 100, the main locking member 2300 is slidingly installed in front of the first housing 2110 disposed in the middle of the housing 2100.

In the upper left portion of the main locking member 2300, a locking protrusion 2320 is protrudedly installed towards the left side, and a horizontal bar 2340 is protrudedly formed towards the left side.

The sub-locking member 2400 is slidingly installed in front of the first housing 2110. The sub-locking member 2400 is disposed in the right side of the main locking member 2300.

A door lever connecting unit 4800 is connected to the sub-locking member 2400.

A stopping member receiving slot 2401, wherein the stopping member of the door lever connecting unit 4800 is being received, is formed in front of the sub-locking member 2400. A plurality of notches are formed spaced apart from each other along the circumference of the stopping member receiving slot 2401. Due to the notches, the slipping of the stopping member of the door lever connecting unit 4800 inside the stopping member receiving slot 2401 is prevented.

A horizontal portion is formed in the lower right portion of the sub-locking member 2400 which is connected to the door in lever connecting unit of the door lever connecting unit 4800.

The connecting means includes a hook 4450 pivotally installed in any one of the main locking member 2300 and the sub-locking member 2400, and a stopping threshold, formed in the other one of the main locking member 2300 and the sub-locking member 2400, wherein the hook 4450 is being held. In this exemplary embodiment of the present invention, the hook 4450 is rotatably formed in the backside of the main locking member 2300, and the stopping threshold is formed in the backside of the sub-locking member 2400.

As illustrated in FIG. 101, the driving unit includes a motor 2610 and a main gear 2630 rotated by the motor 2610. The driving unit is connected to the ECU installed inside the car, and controlled by the control unit installed inside the car.

The motor 2610 is installed in the backside surface of the first housing 2110. The motor 2610 is disposed in the upper right portion of the first housing 2110. The rotating shaft of the motor 2610 is horizontally disposed along the left and right direction. Since the motor 2610 only performs a function of locking or unlocking the door, a small motor is provided therefor. Thus, the door latch system can be compactly maintained.

A worm gear 2613 is installed in the rotating shaft of the motor 2610.

The worm gear 2613 is engaged with the main gear 2630.

The main gear 2630 is pivotally installed in the backside surface of the first housing 2110. The main gear 2630 is disposed in the middle of the first housing 2110. The main gear 2630 is disposed in the lower portion of the motor 2610.

In the main gear 2630, a geared portion 2632, wherein gear teeth are formed, is formed in a portion of the peripheral surface thereof, and a non-geared portion is formed in the remaining portion of the peripheral surface.

The geared portion 2632 is formed in the upper portion and in a portion of the lower portion of the main gear 2630. The non-geared portion is formed in a portion of the lower portion of the main gear 2630.

An opening is formed in the lower portion of the main gear 2630. The opening is formed in a way that the front and backside thereof and the lower portion thereof are open. Due to such an opening, a first stopping portion 2633 and the second stopping portion 2635 are formed in the main gear 2630 for sliding the locking plate 2500 which will be described later. The first stopping portion 2633 is disposed in the right side of the opening, and the second stopping portion 2635 is disposed in the left side of the opening.

The circumference of the insertion hole, wherein the shaft is inserted, and the geared portion 2632, and the first and the second stopping portions 2633 and 2635 are formed to be thicker than the other portions of the main gear 2630. Thus, the light weight of the main gear 2630 is maintained, and, at the same time, the durability is maintained.

As illustrated in FIG. 103, a gear return spring 2650, which returns the main gear 2630 to the basic position, is provided.

A coil spring is provided as the gear return spring 2650. Preferably, the gear return spring 2650 is curvedly formed in the shape of an arc.

A gear return spring slot 2647, wherein the gear return spring 2650 is received, is formed in the front surface of the main gear 2630. The gear return spring slot 2647 is curvedly formed in the shape of an arc, and the front side thereof is open. That is, the portion facing the first housing 2110 in the gear return spring slot 2647 is open.

In addition, as illustrated in FIG. 102, a pushing rib 2140 is protrudedly formed towards the backside in the backside surface of the first housing 2110. The pushing rib 2140 is formed in the shape of an arc whose upper portion is open. The pushing rib 2140 is disposed between the insertion hole, wherein the shaft of the main gear 2630 is inserted, and the geared portion 2632, and the first and the second stopping portions 2633 and 2635.

In the main gear 2630, two rib insertion slots 2648, wherein the pushing rib 2140 is inserted, are respectively formed in each of the both side surfaces which form the gear return spring slot 2647, and communicates with the gear return spring slot 2647.

A locking plate 2500, which is slidingly installed in the backside surface of the first housing 2110, is further provided.

The locking plate 2500 is disposed in the lower portion of the main gear 2630 along the left and right direction.

The locking plate 2500 includes, an unlocking cable connecting portion 2501, a hook guiding portion 2507 disposed in the right side of the unlocking cable connecting portion 2501, and a manual locking member mount 2515.

A stopping protrusion 2506 is formed downwardly protruded in the lower portion of the locking plate 2500 so as to be disposed in the right side of the unlocking cable connecting portion 2501. The stopping protrusion 2506 is inserted into the key connect opening 4555 of the key connect 4550.

A door locking surface 2509, an inclined surface 2511, and a door unlocking surface 2513 are formed respectively.

In the upper portion of the locking plate 2500, a main gear stopping portion 2502 is formed upwardly protruded so as to be disposed between the stopping protrusion 2506 and the hook guiding portion 2507. The main gear stopping portion 2502 is inserted into the opening of the main gear 2630. Thus, when the main gear 2630 is rotated, the main gear stopping portion 2502 is caught on the main gear 2630, and the locking plate 2500 is being slid towards the left side or the right side. When the locking plate 2500 is moved to the right side, the hook 4450 is released from the stopping threshold of the sub-locking member 2400, and the main locking member 2300 and the sub-locking member 2400 are disconnected from each other thereby. When the locking plate 2500 is moved to the left side, the hook 4450 is caught on the stopping threshold of the sub-locking member 2400, and the main locking member 2300 and the sub-locking member 2400 are connected to each other thereby.

A manual locking member 2560 is slidingly installed in the manual locking member mount 2515.

A guide wall body 2125 is formed backwardly protruded in the backside surface of the first housing 2110 for guiding the manual locking member 2560 towards the backside direction.

An electrical connecting member 2572 is installed in the front surface of the locking plate 2500 which is a surface facing the first housing 2110 so as to be disposed in the lower portion of the door unlocking surface 2513. The electrical connecting member 2572 may be made of a metal plate which conducts electricity and disposed along the vertical direction.

Inside the first housing 2110, a first, a second, and a third electrical wires 921, 922, and 923 are installed in the backside surface facing the front surface of the locking plate 2500. The first, the second, and the third electrical wires 921, 922, and 923 are connected to the control unit which is installed inside the car.

The first, the second, and the third electrical wires 921, 922, and 923 are inserted into the first housing 2110 and installed thereby.

The ends of the first, the second, and the third electrical wires 921, 922, and 923 are externally exposed through the opening which is a cutoff area of a portion of the backside surface of the first housing 2110. The (upper) ends of the first, the second, and the third electrical wires 921, 922, and 923 are horizontally disposed.

The (lower) end of the second electrical wire 922 is disposed above the (lower) ends of the first electrical wire 921 and the third electrical wire 923.

The (lower) ends of the first electrical wire 921 and the third electrical wire 923 disposed spaced apart along the horizontal direction (left and right direction) which is the direction along which the locking plate 2500 is being slid.

When the locking plate 2500 is being slid, the electrical connecting member 2572 connects the first and the second electrical wires 921 and 922, or connects the second and the third electrical wires 922 and 923.

In the locking plate 2500, two stopper slots 2571 are formed spaced apart along the direction of sliding. The topper slots 2571 are disposed in the lower portion of the main gear stopping portion 2502.

A stopper insertion slot wherein the stopper 2570 is inserted, is formed in the backside surface of the first housing 2110. The stopper 2570 may be formed using an elastically deformable material. The stopper 2570 is formed in the shape of a strip, and the center portion thereof is bended upwardly protruded. The width of the stopper insertion slot is formed to be wider than that of the stopper 2570 so that the stopper 2570 can be elastically deformed in a certain degree.

The upwardly protruded portion in the center of the stopper 2570 is inserted into the stopper slot 2571. Thus, the stop state of the locking plate 2500 is stably maintained in the locking state and the unlocking state of the door.

Hereinafter, operation process of the door latch system having the above described configuration and according the ninth exemplary embodiment of the present invention will be described.

<Door Closing>

When the user closes the door which is opened, the striker 4101 installed in the car body presses the latch 4200, and the latch 4200 is rotated in a clockwise direction thereby.

The locking protrusion 2320 is inserted into the locking slot of the latch 4200, and the door is closed thereby.

<Door Locking>

The operation that an unlocked state of a door becomes a locked state by a key, a locking button, a knob, a door out lever sensor, start, and a preset critical value of a vehicle speed and the like will be described.

When a door locking (signal) is entered through the motor 2610, the motor 2610 is operated and rotates the main gear 2630 in a counter clockwise direction.

When the main gear 2630 is rotated in a counter clockwise direction, the second stopping portion 2635 pushes the main gear stopping portion 2502 of the locking plate 2500 and slides the locking plate 2500.

When the locking plate 2500 is moved to the right side, the hook 4450 is released from the stopping threshold of the sub-locking member 2400, and the main locking member 2300 and the sub-locking member 2400 are disconnected from each other thereby. Due to this action, the state of the door becomes a locked state, therefore, the force will not be transferred to the main locking member 2300 when the door lever (not shown) is being pulled.

The motor 2610 is operating until the electrical connecting member 2572 installed in the locking plate 2500 connects the second electrical wire 922 and the third electrical wire 923 to each other. Later, the motor 2610 stops operation thereof.

When the main gear 2630 is being rotated in the counter clockwise direction, the pushing rib 2140 presses the gear return spring 2650, and the gear return spring 2650 is compressed thereby. When the force rotating the main gear 2630 is removed (when the operation of the motor 2610 is stopped), the main gear 2630 is returned to the original position due to the restoring force of the compressed gear return spring 2650.

<Door Unlocking>

As illustrated in FIG. 104, the operation that a locked state of a door becomes an unlocked state by a key, a locking button, a knob, a door out lever sensor, start, and a preset critical value of a vehicle speed and the like will be described.

When a door unlocking (signal) is entered through the motor 2610, the motor 2610 is operated and rotates the main gear 2630 in a clockwise direction.

When the main gear 2630 is rotated in a clockwise direction, the first stopping portion 2633 pushes the main gear stopping portion 2502 of the locking plate 2500 and slides the locking plate 2500.

When the locking plate 2500 is moved to the left side, the hook 4450 is caught on the stopping threshold of the sub-locking member 2400, and the main locking member 2300 and the sub-locking member 2400 are connected to each other thereby. Due to this action, the state of the door becomes an unlocked state, therefore, the force will be transferred to the main locking member 2300 when the door lever is being pulled.

The motor 2610 is operating until the electrical connecting member 2572 installed in the locking plate 2500 connects the second electrical wire 922 and the first electrical wire 921 to each other. Later, the motor 2610 stops operation thereof.

When the main gear 2630 is being rotated in the clockwise direction, the pushing rib 2140 presses the gear return spring 2650, and the gear return spring 2650 is compressed thereby. When the force rotating the main gear 2630 is removed (when the operation of the motor 2610 is stopped), the main gear 2630 is returned to the original position due to the restoring force of the compressed gear return spring 2650.

<Door Opening>

When the door is in an unlocked state, if the door lever is being pulled by the user, the door lever connecting unit 4800 pulls the sub-locking member 2400 and the main locking member 2300 to the right side. Due to this action, the locking protrusion 2320 is released from the locking slot of the latch 4200. At this time, the latch 4200 is returned to the original position by the first return spring. Thus, the striker 4101 can be released from the door latch system.

Since the process of door locking from inside the car using child locking member 4700 and the process of door unlocking from inside the car using the door in lever are same as the above described third exemplary embodiment, description on this matter will be omitted.

Embodiment 10

In describing the door latch system according to the tenth exemplary embodiment of the present invention, same symbols will be used for the same or the similar elements as those of the door latch system according to the first, the second, the third, the fourth, the fifth, the sixth, the seventh, the eighth, and the ninth exemplary embodiments of the present invention, and the detailed description and illustration will be omitted.

As illustrated in FIG. 105, the door latch system according to the tenth exemplary embodiment of the present invention further includes a rotating member 2370 for sliding the main locking member 2300' which is being pivotally rotated by the latch 4200.

Since only the body 2310' of the main locking member 2300' is formed in a different form than that of the ninth exemplary embodiment of the present invention, only the body 2310' will be described and the description about the other identical configurations will be omitted.

The body 2310' comprises a first portion 2311', and a second portion 2313' formed to have a step in the first portion 2311' in a way that the front surface thereof is to be disposed in front of the front surface of the first portion 2311'.

The first portion 2311' constitutes the upper portion of the body 2310', and the second portion 2313' constitutes the lower portion of the body 2310'.

A rotating member insertion slot 2317' is formed in the upper portion of the second portion 2313' wherein a portion of the rotating member 2370, which will be described later, is inserted.

The front and the upper portion of the rotating member insertion slot 2317' are open.

The front of the rotating member insertion slot 2317' is closed by installing the second housing.

The left side surface and the right side surface forming the rotating member insertion slot 2317' have the slopes whose slopes are inclining as they travel from the left side towards the right side.

The length of the inclined slope of the left side surface constituting the rotating member insertion slot 2317' is shorter than that of the right side surface constituting the rotating member insertion slot 2317'.

The lower side surface forming the rotating member insertion slot 2317' has a slope whose slope is declining as it travels from the left side towards the right side.

The rotating member 2370 is disposed in front of the first portion 2311' of the main locking member 2300'.

The rotating member 2370 is installed in the front side of the first housing 2110, and installed in a way that it can be pivotally rotated by the rotating shaft 2380 disposed along the forward and backward direction.

In addition, a rotating spring 2390 which returns the rotating member 2370 may be provided.

One end of the rotating spring 2390 is supported and fixed by the first housing 2110, and the other end is connected to the rotating member 2370.

The rotating spring 2390 applies a force to the rotating member 2370 and pushes it towards the counter clockwise direction, and when the force is released, an elastic force, which pivotally rotates the rotating member 2370 towards the clockwise direction, is generated, and returns (the rotating member) to its original position.

The rotating member 2370 comprises a locking portion 2371 and an inserting protrusion 2373.

The lower portion of the left side of the locking portion 2371 is protruded towards the left side, and the right side thereof is formed to be flat.

The locking portion 2371 restricts the position of the latch 4200.

A latch insertion slot is formed in the lower portion of the locking portion 2371 wherein a portion of the end of the latch 4200 is being inserted when closing the door. The latch insertion slot is formed to have an open lower portion.

An inserting protrusion 2373, which is downwardly protruded, is formed in the right side of the lower surface of the locking portion 2371.

The inserting protrusion 2373 is positioned inside the rotating member insertion slot 2317'.

The inserting protrusion 2373 slides the main locking member 2300' along the left and right direction according to the pivotal rotation of the rotating member 2370.

Preferably, the width along the left and right direction of the inserting protrusion 2373 is formed to be formed narrower than the width along the left and right direction of the rotating member insertion slot 2317'.

Since the rotating member 2370 is pivotally rotated by the latch 4200 and the main locking member 2300' is being slid, a user can feel the door closing operation more softly, and the strength of the door latch system can be increased as well.

<Door Closing>

When the user closes the door which is opened, the striker 4101 installed in the car body presses the latch 4200, and the latch 4200 is rotated in a clockwise direction thereby.

The outer circumferential surface of the latch 4200 being rotated in the clockwise direction pushes the locking portion 2371 of the rotating member 2370, and the rotating member 2370 is being rotated in the counter clockwise direction, and the inserting protrusion 2373 of the rotating member 2370 pushes the right side surface forming the rotating member insertion slot 2317', thus, the main locking member 2300' is being pushed to the right side. As the latch 4200 is further being rotated, and the locking portion 2371 of the rotating member 2370 is disposed in the right side of the locking slot of the latch 4200, then, the locking portion 2371 of the rotating member 2370 is being rotated in the clockwise direction due to the elastic force of the rotating spring 2390 and positioned inside the locking slot, and the door is closed thereby. When the rotating member 2370 is being rotated in the clockwise direction, the inserting protrusion 2373 pushes the left side surface forming the rotating member insertion slot 2317', and the main locking member is being moved to the left side and returned to the original position.

As described above, although the present invention has been described with reference to the preferred exemplary embodiments, various changes and alterations of the present invention can be made by those skilled in the art without departing from the spirit and the scope of the present invention written in the claims described herein below.

DESCRIPTION OF SYMBOLS

100, 1100, 2100, 3100, 4100: housing
200, 3200, 4200: latch
300, 300', 1300, 1300', 2300, 2300', 3300', 4300, 4300': main locking member
400, 1400, 2400, 3400, 4400: sub-locking member
450, 1450, 4450: hook
500, 1500, 2500, 3500, 4500: locking plate
600, 4600: driving unit
710, 3700, 4700: child locking member
800, 1800, 4800: door lever connecting unit
900, 1900, 4900: PCB

The invention claimed is:

1. A door latch system comprising:
a housing;
a latch pivotally and rotatably installed in said housing;
a main locking member slidingly installed in said housing for locking said latch;
a sub-locking member slidingly installed in said housing and disposed in one side of said main locking member;
a hook pivotally and movably installed in any one of said main locking member and said sub-locking member;
a stopping threshold formed in the other one of said main locking member and said sub-locking member; and
a locking plate slidingly installed in said housing for pivotally moving said hook,
wherein said main locking member and said sub-locking member are sliding together when said hook is held by said stopping threshold by the sliding of said locking plate, and
only said sub-locking member is sliding when said hook is separated from said stopping threshold by the sliding of said locking plate.

2. The door latch system according to claim 1, wherein a hook guide portion is formed in said locking plate, and a guide bar is formed in said hook, so that the pivotal rotation of said hook is accomplished as said guide bar is guided by said hook guide portion.

3. The door latch system according to claim 1, wherein a driving unit for pivotally rotating said latch or sliding said locking plate is further included.

4. The door latch system according to claim 3, wherein the driving unit includes a main gear wherein an engagement arm for rotating said latch is formed in said main gear.

5. The door latch system according to claim 3, wherein said driving unit includes a main gear wherein a first engagement arm and a second engagement arm are formed in said main gear for sliding said locking plate.

6. The door latch system according to claim 1, wherein a key connect, which is installed in the lower portion of said locking plate so as to move in conjunction therewith, is further included, wherein said locking plate is being slided as said key connect is being rotated.

7. The door latch system according to claim 1, wherein a child locking cover installed in the upper side of said sub-locking member; and a child locking member pivotally and rotatably installed inside said child locking cover are further included, wherein said hook is held by or separated from said stopping threshold by the pivotal rotation of said child locking member.

8. The door latch system according to claim 1, wherein said sub-locking member comprises a horizontal portion outwardly extended therefrom, and said locking plate comprises a manual locking member mount, and a manual locking member is slidingly installed in said manual locking member mount, wherein said hook is held by said stopping threshold due to the sliding of said locking plate since said manual locking member is pushed by said horizontal portion when the door in lever is pulled once while said hook is separated from said stopping threshold.

9. The door latch system according to claim 1, wherein a rotating member for sliding said main locking member when being pivotally rotated by said latch, is further included.

10. A door latch system comprising:

a housing;

a latch pivotally and rotatably installed in said housing;

a main locking member slidingly installed in said housing for locking said latch;

a sub-locking member slidingly installed in said housing and disposed in one side of said main locking member; and a connecting means which enables simultaneous sliding of said main locking member and said sub-locking member, or sliding of only said sub-locking member.

11. The door latch system according to claim 10, wherein said connecting means comprises a hook pivotally and rotatably installed in any one of said main locking member and said sub-locking member; and a stopping threshold formed in the other one of said main locking member and said sub-locking member.

12. The door latch system according to claim 11, wherein a locking plate slidingly installed in said housing for pivotally rotating said hook is further included, wherein said main locking member and said sub-locking member are sliding together when said hook is held by said stopping threshold by the sliding of said locking plate, and only said sub-locking member is sliding when said hook is separated from said stopping threshold by the sliding of said locking plate.

13. The door latch system according to claim 10, wherein a driving unit is further included for pivotally rotating said latch, or releasing the connection of said main locking member and said sub-locking member, or connecting said main locking member and said sub-locking member using said connecting means, wherein said driving unit comprises a main gear, and a geared portion wherein gear teeth are formed in a portion of the peripheral surface of said main gear and a non-geared portion may be formed in the remaining portion of said peripheral surface thereof.

14. The door latch system according to claim 13, wherein said geared portion is formed to be thicker than said non-geared portion.

15. The door latch system according to claim 13, wherein said main gear includes a plastic portion and a metal portion which is to be inserted into said plastic portion.

16. The door latch system according to claim 15, wherein said metal portion includes a plate portion having the shape of a plate and a protruded portion forwardly protruded in the circumference of said plate portion.

17. The door latch system according to claim 16, wherein said protruded portion is disposed in said geared portion.

18. The door latch system according to claim 16, wherein an engagement arm is formed in said main gear for rotating said latch, and said protruded portion may be disposed in said engagement arm.

19. The door latch system according to claim 15, wherein a locking plate slidingly installed in the housing is further provided, and a first engagement arm and a second engagement arm are formed in the main gear for sliding the locking plate, so that the locking plate disconnects the main locking member and the sub-locking member or connects the main locking member and the sub-locking member, and the first engagement arm and the second engagement arm are formed in the plastic portion.

20. The door latch system according to claim 15, wherein a locking plate slidingly installed in said housing is further provided, and a first engagement arm and a second engagement arm for sliding said locking plate is in said main gear, so that said locking plate disconnects said main locking member and said sub-locking member or connects said main locking member and said sub-locking member, and said first engagement arm and said second engagement arm are formed in said metal portion.

21. The door latch system according to claim 13, wherein a child locking member movably installed in the housing is further provided, wherein the child locking member is being moved and disconnects the main locking member and the sub-locking member or connects the main locking member and the sub-locking member.

22. The door latch system according to claim 13, wherein a locking plate slidingly installed in said housing is further provided, and said locking plate is being slid by said main gear, and said locking plate disconnects said main locking member and said sub-locking member or connects said main locking member and said sub-locking member, and inside said housing, a first, a second, and a third electrical wires are installed in the surface facing said locking plate, wherein in said locking plate, an electrical connecting member is installed in the surface facing said housing for connecting the first and the second electrical wires or connecting the second and the third electrical wires, and the ends of the first and the third electrical wires are disposed spaced apart along the sliding direction of said locking plate.

23. The door latch system according to claim 13, wherein a gear return spring is provided for returning of said main gear.

24. The door latch system according to claim 23, wherein a coil spring is provided as said gear return spring, and a gear return spring slot is formed in said main gear for receiving said gear return spring, and a pushing rib is formed in said housing, and in said main gear, a rib insertion slot, wherein said pushing rib is inserted, is formed communicating with said gear return spring slot in each of the both side surfaces constituting said gear return spring slot.

25. The door latch system according to claim 13, wherein a locking plate slidingly installed in said housing is further provided, and said locking plate is slid by said main gear, and said locking plate disconnects said main locking member and said sub-locking member or connects said main locking member and said sub-locking member, and a first stopper protrusion is protrudedly formed in one of said locking plate and said housing, and a first stop spring elastically deformed by said first stopper protrusion is installed in said remaining one, and said first stop spring is elastically deformed by said first stopper protrusion when said locking plate is located between the connected position and the disconnected position.

26. The door latch system according to claim 13, wherein a child locking member movably installed in said housing is further provided, wherein said child locking member is being slid and disconnects said main locking member and said sub-locking member or connects said main locking member and said sub-locking member, and a second stopper protrusion is protrudedly formed in one of said locking plate and said housing, and a second stop spring elastically deformed by said second stopper protrusion is installed in the remaining one, and said second stop spring is elastically deformed by said second stopper protrusion when said child locking member is located between the connected position and the released position.

27. The door latch system according to claim 13, wherein a child locking member movably installed in said housing is further provided, wherein said child locking member is being moved and disconnects said main locking member and said sub-locking member or connects said main locking member and said sub-locking member, and a child locking sensor is further included for detecting whether said main locking member and said sub-locking member are connected or disconnected through said child locking member.

28. The door latch system according to claim 11, wherein said hook includes a first hook and a second hook, and said first hook and said second hook are pivotally and rotatably installed in said main locking member respectively, and said sub-locking member includes a first sub-locking member connected to said door in lever, and a second sub-locking member connected to said door out lever, and said stopping thresholds are formed in said first and said second sub-locking member respectively, and a second return spring is installed for returning said first and said second hooks, and said one end of said second return spring is connected to said first hook, and the other end is connected to said second hook, and a shaft insert is formed between the both ends thereof, and said shaft insert may be pivotally and rotatably installed in said main locking member.

* * * * *